US006152703A

United States Patent [19]

Yoshimura et al.

[11] Patent Number: 6,152,703

[45] Date of Patent: Nov. 28, 2000

[54] HERMETIC-TYPE COMPRESSOR

[75] Inventors: Takao Yoshimura, Fujisawa; Hironari Akashi, Chigasaki; Akio Yagi, Kouza-gun; Akira Hayashi, Fujisawa, all of Japan

[73] Assignee: Matsushita Refrigeration Company, Osaka, Japan

[21] Appl. No.: 09/011,672

[22] PCT Filed: Jun. 12, 1997

[86] PCT No.: PCT/JP97/02058

§ 371 Date: May 21, 1997

§ 102(e) Date: May 21, 1998

[87] PCT Pub. No.: WO97/47882

PCT Pub. Date: Dec. 18, 1997

[30] Foreign Application Priority Data

| | | | |
|---|---|---|---|
| Jun. 14, 1996 | [JP] | Japan | 8-153973 |
| Oct. 29, 1996 | [JP] | Japan | 8-286376 |
| Nov. 8, 1996 | [JP] | Japan | 8-296123 |
| Feb. 7, 1997 | [JP] | Japan | 9-024925 |
| Feb. 10, 1997 | [JP] | Japan | 9-026488 |
| Apr. 11, 1997 | [JP] | Japan | 9-093483 |
| May 19, 1997 | [JP] | Japan | 9-128231 |

[51] Int. Cl.[7] ..... F04B 39/00

[52] U.S. Cl. ..... 417/312; 181/229; 181/403

[58] Field of Search ..... 417/45, 312, 415; 181/229, 403

[56] References Cited

U.S. PATENT DOCUMENTS

| | | | |
|---|---|---|---|
| 4,238,172 | 12/1980 | Abe et al. | 417/312 |
| 4,239,461 | 12/1980 | Elson | 417/312 |
| 4,549,857 | 10/1985 | Kropiwnicki et al. | 417/312 |
| 4,856,286 | 8/1989 | Sulfstede et al. | 417/45 X |
| 5,288,212 | 2/1994 | Lee | 417/312 |
| 5,358,386 | 10/1994 | Koyama et al. | 417/312 |
| 5,496,156 | 3/1996 | Harper et al. | 417/312 |

FOREIGN PATENT DOCUMENTS

| | | |
|---|---|---|
| 57-122192A | 7/1982 | Japan . |
| 06050262A | 2/1994 | Japan . |
| 7-208334 | 8/1995 | Japan . |

*Primary Examiner*—Tony M. Argenbright
*Attorney, Agent, or Firm*—Sheridan Ross P.C.

[57] ABSTRACT

The present invention provides a hermetic-type compressor delivering high refrigeration capability at low noise. The hermetic-type compressor of the present invention is provided with a position adjustment mechanism, a communication/shutoff mechanism, a passage changeover mechanism or the like so as to dispose the opening end of a suction passage, which is provided in an enclosed container and used to communicate the cylinder of its compressor with the enclosed container, on a predetermined plane so that the opening end is aligned with the position of a node of a resonance mode generated in the enclosed container.

24 Claims, 67 Drawing Sheets

HERMETIC-TYPE COMPRESSOR

TECHNICAL FIELD

The present invention relates to a hermetic-type compressor for use in refrigeration apparatuses and the like.

BACKGROUND OF THE INVENTION

Hermetic-type compressors for use in refrigeration apparatuses and the like are strongly requested to have improved refrigeration capability and to reduce noise.

As conventional technologies for improving refrigeration capability, the hermetic-type compressors have been disclosed in Japanese Laid-open Patent Application No. Sho 57-122192 and No. Hei 6-50262, for example. In these conventional technologies, pressure in a cylinder at the time when the suction of refrigerant gas is completed is raised higher than the pressure on the low-pressure side of a refrigeration cycle, whereby the density of refrigerant gas to be sucked into the cylinder is raised so as to further improve refrigeration capability.

In addition, as a conventional technology for reducing noise, a hermetic-type compressor has been disclosed in Japanese Laid-open Patent Application No. Hei 6-74154, for example. In this hermetic-type compressor, its suction portion for sucking refrigerant gas into its cylinder has been improved in order to prevent the generation of resonance sound which generates in its enclosed container during suction in a compression stroke.

An example of conventional hermetic-type compressors intended to reduce noise is described below referring to the drawings.

FIG. 67 is a vertical sectional view showing a conventional hermetic-type compressor, and FIG. 68 is a plan sectional view showing the conventional hermetic-type compressor shown in FIG. 67.

In FIGS. 67 and 68, a hermetic-type compressor 1 has an enclosed container 2 comprising a lower shell 3 and an upper shell 4. An electric compression element 5 disposed vertically in the enclosed container 2 is elastically supported in the enclosed container 2 by coil springs 8 so that a mechanical portion 6 is disposed in the upper portion and so that a motor portion 7 is disposed in the lower portion.

The mechanical portion 6 comprises a cylinder 10 integrally provided with a block 9, a piston 11, a crankshaft 12, a connecting rod 13, a bearing 14, a cylinder head 80 and the like. The motor portion 7 comprises a rotor 15 secured by shrinkage fit to the crankshaft 12 and a stator 16. The stator 16 is secured to the block 9 using screws. Lubricant 17 is stored at the bottom of the enclosed container 2.

Mark a in FIG. 68 represents the minimum distance between the inner walls of the enclosed container 2 along the center of gravity of a plane having nearly the maximum cross-sectional area on a horizontal section of the enclosed container 2. In other words, the distance a is the maximum distance in a direction perpendicular to the reciprocating direction of the piston 11 and the axial direction of the crankshaft 12. Mark b represents the distance between the inner walls of the enclosed container 2 in a direction nearly perpendicular to the line segment of the above-mentioned distance a on the same horizontal plane. That is, the distance b is the maximum distance between the inner walls of the enclosed container 2 in the reciprocating direction of the piston 11. Mark c represents the maximum distance from the upper inner wall surface of the enclosed container 2 to the surface of the lubricant 17 in the axial direction of the crankshaft 12.

In a suction pipe 18 for sucking refrigerant gas in the enclosed container 2, its one end is secured to the block 9, and the other end passes through the center of the line indicated by the distance a and is disposed on a plane orthogonal to the line. This other end is disposed in the space inside the enclosed container 2 as an opening end 18*a*, and communicates with the space inside the cylinder 10.

The operation of the conventional hermetic-type compressor having the above-mentioned configuration is described below.

Refrigerant gas circulated from a system such as a refrigeration apparatus is relieved once in the space inside the enclosed container 2, sucked into the cylinder 10 via the suction pipe 18 secured to the block 9, and compressed by the piston 11. At this time, the refrigerant gas is sucked into the cylinder 10 by one half rotation of the crankshaft 12, and then compressed by the other half rotation.

Since the refrigerant gas is not sucked continuously into the cylinder 10 as described above, the pressure pulsation of the refrigerant gas occurs in the suction pipe 18. Therefore, the pressure pulsation vibrates the space inside the enclosed container 2, and resonance modes are generated in the reciprocating direction of the piston 11, in a direction perpendicular to the reciprocating direction on a horizontal plane including the reciprocating direction of the piston 11, and in the axial direction of the crankshaft 12.

However, the opening end 18*a* of the suction pipe 18 in the space inside the enclosed container 2 is disposed on a plane passing through the center of the line indicated by the distance a and being orthogonal to the line, that is, on a plane including the position of a node of the resonance mode generated in the direction perpendicular to the reciprocating direction on the horizontal plane including the reciprocating direction of the piston 11.

Therefore, in the conventional hermetic-type compressor shown in FIGS. 67 and 68, the pressure pulsation vibrates the node of the resonance mode. As a result, in the conventional hermetic-type compressor, no resonance mode is caused, the generation of resonance sound is prevented, and noise due to resonance sound is prevented.

In addition, when the resonance mode at a resonance frequency causing a problem occurs in the reciprocating direction of the piston 11 of the enclosed container 2, the opening end 18*a* of the suction pipe 18 in the space inside the enclosed container 2 is disposed at the following position. Referring to FIG. 68, on the same horizontal plane of a line segment A indicated by the distance a along the center of gravity on a horizontal section, in a line segment B indicated by the distance b between the inner walls of the enclosed container 2 and being nearly orthogonal to the line segment A, the opening end 18*a* is disposed on a plane passing through the center of the line segment B and being orthogonal to the line segment B. Therefore, the pressure pulsation vibrates on the node of the resonance mode. Consequently, no resonance mode is caused, whereby the generation of resonance sound can be prevented, and noise due to resonance sound can be prevented in the hermetic-type compressor.

Furthermore, when the resonance mode at the resonance frequency causing a problem is present in the axial direction of the crankshaft 12 of the enclosed container 2, the opening end 18*a* of the suction pipe 18 in the space inside the enclosed container 2 is disposed at the following position. In other words, with respect to a line segment C indicated by a distance c (FIG. 67) which is the maximum distance between the upper inner wall surface of the enclosed container 2 in the vertical direction and the surface of the lubricant 17, the opening end is disposed on a plane passing through the center of the line segment C and being orthogonal to the line segment C. Therefore, the pressure pulsation vibrates on the node of the resonance mode, the generation of resonance sound can be prevented, and noise due to resonance sound can be prevented in the hermetic-type compressor.

Next, an example of the conventional hermetic-type compressor intended for improved refrigeration capability is described below referring to the drawings.

FIG. 69 is a vertical sectional view showing a conventional hermetic-type compressor intended for improved refrigerant capability. FIG. 70 is a plan sectional view showing the conventional hermetic-type compressor of FIG. 69. FIG. 71 is a sectional view showing the main portion of the compressor taken on line A—A of FIG. 69. FIG. 72 is an explanatory view showing the behavior of refrigerant gas.

In FIGS. 69, 70, 71 and 72, a valve plate 19 has a suction hole 19*a* and is disposed at the end surface of the cylinder 10. The suction hole 19*a* (FIGS. 70 and 71) communicates with a suction pipe 21 and the interior of the cylinder 10. A suction valve 20 shown in FIG. 71 opens and closes the suction hole 19*a* of the valve plate 19. One end 21*a* of the suction pipe 21 is open into the space inside the enclosed container 2, and its other end 21*b* is directly connected to the valve plate 19.

On the other hand, in the conventional rotary compressor intended for improved refrigeration capability and disclosed in Japanese Laid-open Patent Application No. Sho 57-122192, when a suction stroke period is T (sec), and the velocity of sound in the suction condition of refrigerant gas to be sucked is a (m/sec), the length L (m) of the suction pipe 21 is represented by:

$$(T\times a/4-0.2)\pm 0.1=L$$

Next, the operation of the conventional hermetic-type compressor having the above-mentioned configuration is described below.

In FIG. 72, in the case of refrigerant gas, at the start of a suction stroke (at time of (a) in FIG. 72), the suction hole 19*a* of the valve plate 19 is clogged. Therefore, the flow of the refrigerant gas stops.

Next, the piston 11 moves to the right, and the volume inside the cylinder 10 increases abruptly. Therefore, a pressure difference generates between the space inside the cylinder 10 and the space inside the enclosed container 2, and the refrigerant gas begins to flow rightward (toward the cylinder 10) inside the suction pipe 21. At the same time, a pressure wave Wa is generated in the cylinder 10 because the volume inside the cylinder 10 increases abruptly. The pressure wave Wa inside the cylinder 10 passes through the suction hole 19*a* used as an opening, and propagates though the interior of the suction pipe 21 in the direction opposite to the flow of the refrigerant gas toward the space inside the enclosed container 2 (at time of (b) in FIG. 72).

The pressure wave Wa reached the space inside the enclosed container 2 becomes a reflected wave Wb having been inverted in the space inside the enclosed container 2 in which the refrigerant gas is in a stagnate condition. This reflected wave Wb propagates through the interior of the suction pipe 21 in the same direction as the flow of the refrigerant gas (at time of (c) in FIG. 72).

In other words, the pressure wave Wa generated in the cylinder 10 passes through the suction hole 19*a* of the valve plate 19, and propagates in the direction opposite to the flow of refrigerant gas. Then, the pressure wave Wa becomes the reflected wave Wb having an inverse phase in the space inside the enclosed container 2, and propagates in the same direction as the flow of the refrigerant gas, and returns to the suction hole 19*a* of the valve plate 19.

By aligning the time when the reflected wave Wb reaches the suction hole 19*a* with the time when the volume inside the cylinder 10 becomes maximum (suction completion time), the pressure energy of the reflected wave Wb can be added to the refrigerant gas at the suction completion time, and the suction pressure of the refrigerant gas is raised.

As a result, refrigerant gas having a higher density is charged into the cylinder 10, the discharge amount of refrigerant per a compression stroke increases, the circulation amount of refrigerant increases, and the refrigeration capability of the hermetic-type compressor is improved.

However, in the above-mentioned conventional hermetic-type compressor, when the velocity of sound propagating through refrigerant gas (hereinafter referred to as the velocity of sound in refrigerant gas) is changed by a change in the temperature of the refrigerant gas due to a change in outside-air temperature, the position of the node of the resonance mode at the resonance frequency is changed, and the generation of resonance sound may not be prevented.

In addition, shock sound is generated by a pressure wave generated by the suction pipe, and noise may be generated.

Furthermore, when the velocity of sound is changed by a change in the temperature of the refrigerant gas due to a change in outside-air temperature, the wavelengths of the pressure wave and the reflected wave are changed depending on the velocity of sound. Therefore, the timing of adding the pressure energy of the reflected wave at the suction completion time generates an error, and the rising ratio of the suction pressure lowers.

Therefore, it becomes difficult to charge refrigerant gas having a higher density into the cylinder, the discharge amount of refrigerant gas per a compression stroke decreases, and refrigeration capability may lower.

Moreover, a method of improving refrigeration capability by always increasing the circulation amount of refrigerant gas regardless of a change in outside-air temperature can be devised. In this case, however, a room is often closed in winter or during cold days when outside-air temperature is low, and noise due to shock sound may become more annoying than that in summer.

The present invention is intended to solve the above-mentioned problems, and aims to provide a hermetic-type compressor having high refrigeration capability, low suction loss of refrigerant gas and high refrigeration efficiency.

Accordingly, the hermetic-type compressor of the present invention is intended to attain the above-mentioned objects and also attain the following technological advantages by using various embodiments described later.

In embodiment 1 of the present invention described later, even when a node of a resonance mode at a resonance frequency is changed because the velocity of sound in refrigerant gas is changed by a change in the temperature of the refrigerant gas, the opening end of the suction pipe is adjusted so as to be always positioned at the node of the resonance mode. Therefore, a hermetic-type compressor, wherein the generation of resonance sound is prevented, and low noise is attained, is provided.

In embodiment 2 of the present invention described later, the opening end of the suction pipe is adapted to become a node of a resonance mode, whereby the generation of shock sound generated by a pressure wave at the suction pipe can be prevented significantly. Therefore, a hermetic-type compressor, wherein noise is reduced, refrigeration capability is high, the suction loss of refrigerant gas is low and efficiency is high, can be provided.

In embodiment 3 of the present invention described later, the length of a suction passage in the suction pipe is changed. Therefore, even when the velocity of sound in refrigerant gas is changed by a change in the temperature of the refrigerant gas due to a change in outside-air temperature, the time when a reflected wave reaches the suction hole can be aligned with the time when the volume inside the cylinder becomes maximum (suction completion time). Therefore, the pressure energy of the reflected wave is added to the refrigerant gas at the suction completion time, and the suction pressure of the refrigerant gas is raised.

Therefore, the suction pressure rises at all times, the discharge amount of refrigerant gas per a compression stroke increases, the circulation amount of refrigerant gas increases, refrigeration capability is improved, and the suction loss of refrigerant gas is reduced. Consequently, a hermetic-type compressor having high efficiency can be obtained.

In embodiment 4 of the present invention described later, the inner cross-sectional area of the suction pipe is changed. Therefore, even when the velocity of sound in refrigerant gas is changed by a change in the temperature of the refrigerant gas due to a change in outside-air temperature, the time when a reflected wave reaches the suction hole can be aligned with the time when the volume inside the cylinder becomes maximum (suction completion time). Therefore, the pressure energy of the reflected wave can be added at the suction completion time, and the suction pressure of the refrigerant gas is raised.

Therefore, the suction pressure rises at all times, the discharge amount of refrigerant per a compression stroke increases, the circulation amount of refrigerant increases, refrigeration capability is improved, and the suction loss of refrigerant gas is reduced. As a result, a hermetic-type compressor having high efficiency can be obtained.

In comparison with the time when outside-air temperature is high, at the time when outside-air temperature is low, and refrigeration capability is not required to be improved greatly, the inner cross-sectional area of the suction pipe is decreased; the inner cross-sectional area of the suction pips is reduced as outside-air temperature lowers. Consequently, a hermetic-type compressor capable of significantly reducing noise can be obtained.

In the conventional configuration, the rotation position of the crankshaft when a reflected wave returns to the suction hole was not always proper depending on the length of the suction pipe 21, operation frequency or the velocity of sound in refrigerant gas. Therefore, the improvement ratio of refrigeration capability may be low.

Thus, in embodiment 5 of the present invention described later, the length and the like of the suction pipe are adjusted so that the rotation position (crank angle) of the crank shaft, wherein a reflected wave returns to the suction hole, is optimal, whereby a hermetic-type compressor capable of obtaining the improvement effect of maximum refrigeration capability can be obtained.

The conventional configuration was intended to always improve refrigeration capability even when outside-air temperature was high and even when it was low. Therefore, at low outside-air temperature at which no high refrigeration capability is required, more than necessary refrigeration capability is supplied, and the overall efficiency of a refrigeration system including the hermetic-type compressor is lowered; as a result, a disadvantage arises, that is, overall electric power consumption is apt to increase.

In embodiment 6 of the present invention described later, electric power consumption is decreased by not allowing the improvement effect of refrigeration capability to be obtained at low outside-air temperature at which no high refrigeration capability is required; on the other hand, at high outside-air temperature at which high refrigeration capability is required, the embodiment is configured so that the improvement effect of refrigeration capability can be obtained in a conventional way. Consequently, a hermetic-type compressor having low overall electric power consumption can be obtained by controlling refrigeration capability as described above.

In the conventional configuration, resonance sound is generated when the resonance frequency of refrigerant gas in the enclosed container is close to an integral multiple of the rotation number of the crankshaft, and the refrigerant gas in the enclosed container resonates. Therefore, when the pressure wave is reflected at the opening end of the suction pipe, the refrigerant gas in the enclosed container resonates. Due to its influence, the pressure amplitude of the reflected wave decreases, the rising ratio of suction pressure lowers, and a disadvantage arises, that is, the improvement effect of refrigeration capability is apt to become low.

In embodiment 7 of the present invention described later, the resonance frequency of refrigerant gas in the enclosed container is not close to an integral multiple of the rotation number of the crankshaft. Therefore, resonance sound is prevented from generating, and pressure amplitude is also prevented from decreasing when a pressure wave is reflected at the opening of the suction pipe. Consequently, a hermetic-type compressor, wherein suction pressure can be raised at all times, and the improvement effect of refrigeration capability can be obtained, can be obtained.

In embodiment 8 of the present invention described later, the force for vibrating refrigerant gas in the enclosed container is reduced by decreasing the pulsation of refrigerant gas to be sucked, and resonance sound is always diminished regardless of the resonance frequency of the refrigerant gas in the enclosed container. In addition, the pressure amplitude obtained when a pressure wave is reflected at the opening portion of the suction pipe is prevented at all times regardless of the resonance frequency of the refrigerant gas in the enclosed container. Consequently, a hermetic-type compressor, wherein suction pressure is raised at all times regardless of any change in the shape of the enclosed container, operation conditions and the like, and the improvement effect of refrigeration capability is obtained, can be obtained.

In the above-mentioned conventional configuration shown in FIG. 69, the suction pipe 21 makes contact with the cylinder head 80 and the valve plate 19. Therefore, the temperatures of the cylinder head 80 and the like rise significantly with the passage of time after start, and by following the temperature rise, the temperature of the suction pipe 21 also rises. As a result, the temperature of the refrigerant gas in the suction pipe 21 rises, the velocity of sound in the refrigerant gas changes, and the timing when the reflected wave reaches the suction hole 19*a* deviates. Consequently, in the conventional hermetic-type compressor, a stable suction pressure rising effect may not be obtained.

Thus, in embodiment 9 of the present invention described later, even when the temperature of the cylinder head or the like changes significantly, the change in the temperature of the suction pipe is decreased. Therefore, the change in the velocity of sound in refrigerant gas can be decreased, and a stable suction pressure rising effect is produced. Therefore, a hermetic-type compressor having stable and high refrigeration capability without being affected by the passage of time after start can be obtained.

In the conventional configuration shown in FIG. 69, since the opening end 21*a* of the suction pipe 21 is disposed in the enclosed container 2, high-temperature refrigerant gas having a low density is sucked into the suction pipe 21. Therefore, the velocity of sound in refrigerant gas increases, an influence of compressibility reduces, and the generation of the pressure wave becomes weak. As a result, in the conventional hermetic-type compressor, suction pressure may decrease.

If the opening end 21*a* of the suction pipe 21 is communicated with the opening end of the second suction pipe in the enclosed container 2 so that low-temperature refrigerant gas can be sucked into the cylinder 10, no reflected wave is generated, and the suction pressure may not be raised.

In embodiment 10 of the present invention described later, a large pressure wave is generated, and the effect of raising suction pressure increases, and low-temperature refrigerant gas is sucked into the cylinder. Therefore, the improvement effect of the circulation amount of refrigerant due to the low-temperature refrigerant gas is added, the improvement effect of refrigeration capability is increased significantly, whereby a hermetic-type compressor having high refrigeration capability and attaining low noise can be obtained.

In the conventional configuration shown in FIG. 69, when the sound of velocity in refrigerant gas is changed depending on operation conditions and the like, if the length of the suction pipe 21 is constant, the time required when the reflected wave reaches the suction hole 19*a* of the valve plate 19 changes. Therefore, suction timing to the cylinder 10 deviates, whereby the suction pressure rising effect significantly decreases depending on operation conditions, and refrigeration capability may become insufficient.

Thus, in embodiment 11 of the present invention described later, suction pressure is raised at all times regardless of a change in operation conditions, and stable and high refrigeration capability is provided.

In the conventional configuration shown in FIG. 69, since the suction pipe 21 always communicates with the suction hole 19*a,* the suction pressure rising effect occurs at start. Therefore, start torque becomes high; in a high pressure condition such as in a condition wherein outside-air temperature is high, improper start may occur due to insufficient torque.

Thus, in embodiment 12 of the present invention described later, the suction pressure rising effect is lessened, and start torque is lowered so as to prevent improper start. Therefore, a hermetic-type compressor having improved reliability and high refrigeration capability due to the suction pressure rising effect during stable operation can be obtained.

In the conventional configuration shown in FIG. 69, when refrigerant gas is heated in the space inside the enclosed container 2, and the density of refrigerant gas to be charged into the cylinder 10 is lowered, the circulation amount of refrigerant gas decreases, and refrigeration capability may be lowered.

Thus, in embodiment 13 of the present invention described later, the opening end of the first suction pipe, which is used as a suction passage, in the enclosed container is disposed so that it becomes a node of a resonance mode. In addition, the opening end of the second suction pipe in the enclosed container is provided near the opening end of the suction passage. As a result, resonance is prevented from generating in the enclosed container. Therefore, a hermetic-type compressor attaining low noise and improving refrigeration capability is provided.

In the conventional configuration shown in FIG. 69, shock sound is generated by a pressure wave generated from the suction pipe 21, and noise is generated; in addition, refrigerant gas is heated in the space inside the enclosed container 2, and the density of refrigerant gas to be charged into the cylinder 10 is lowered. Therefore, in the conventional hermetic-type compressor, the circulation amount of refrigerant gas decreases, and refrigeration capability may be lowered.

Thus, in embodiment 14 of the present invention described later, the opening end of the first suction pipe, which is used as a suction passage, in the enclosed container is disposed so that it becomes a node of a resonance mode. In addition, the opening end of the second suction pipe in the enclosed container is provided near the opening end of the suction passage. Therefore, the generation of shock sound due to the pressure wave in the suction passage is reduced significantly, whereby a hermetic-type compressor featuring low noise, refrigerant gas having a high density and significantly improved refrigeration capability can be obtained.

In the conventional configuration, since a long suction passage is provided in the enclosed container having a limited space, the structure of the suction passage is complicated, and has a plurality of bent portions having different curvatures. Therefore, the amplitude of pressure decreases at the bent portions having different curvatures, when the pressure wave Wa and the reflected wave Wb propagate through the suction passage. In addition, when the reflected wave Wb returns to the suction hole of the valve plate, the pressure amplitude of the reflected wave Wb diminishes, whereby in the conventional hermetic-type compressor, the improvement effect of high refrigeration capability may not be obtained.

Thus, in embodiment 15 of the present invention described later, the attenuation of the pressure amplitudes of the pressure wave Wa and the reflected wave Wb are decreased, and suction pressure is raised. Therefore, a hermetic-type compressor having highly improved refrigeration capability can be obtained.

In the conventional configuration, the suction passage receives heat from high-temperature refrigerant gas in the enclosed container, the temperature of the suction passage rises, and the temperature of the suction gas in the suction passage rises. Therefore, the density of refrigerant gas to be sucked is lowered, and the circulation amount of refrigerant is apt to decrease.

Thus, in embodiment 16 of the present invention described later, the amount of heat received from high-temperature refrigerant gas in the enclosed container by the suction passage is lessened. Therefore, the temperature rise of the suction passage is reduced, whereby the temperature rise of the refrigerant gas in the suction passage is reduced. Consequently, a hermetic-type compressor capable of obtaining a large circulation amount of refrigerant can be obtained.

In addition, in embodiment 16, the temperature of refrigerant gas to be sucked is low, and refrigerant gas having a high density is sucked into the suction passage. Therefore, the velocity of sound in the refrigerant gas is lowered, whereby the compressibility of refrigerant gas increases. Consequently, a large pressure wave generates, and a hermetic-type compressor having improved high refrigeration capability can be obtained.

In the conventional configuration, since the opening end of the suction passage is open into the enclosed container, when the pressure wave is reflected at the opening end of the suction passage, the refrigerant gas in the enclosed container is vibrated, and resonance sound may generate.

Thus, in embodiment 17 of the present invention described later, the pulsation of suction gas is diminished, and the force for vibrating the refrigerant gas in the enclosed container is weakened. By this reason, the hermetic-type compressor can reduce resonance sound can be diminished regardless of the resonance frequency of the refrigerant gas in the enclosed container.

In embodiment 17, regardless of the resonance frequency of the refrigerant gas in the enclosed container, the attenuation of the pressure amplitude at the time when a pressure wave is reflected at the opening end of the suction passage can be prevented at all times. Therefore, regardless of any change in the shape of the enclosed container, operation conditions and the like, the suction pressure of the refrigerant gas rises at all times, whereby the hermetic-type compressor can obtain an improvement in stable and high refrigeration capability.

Furthermore, in embodiment 17, the temperature distribution of the suction passage is made uniform, and the change in the velocity of sound in the refrigerant gas is decreased. Therefore, in the hermetic-type compressor, the attenuation of the pressure wave can be decreased, and stable suction pressure rising can be obtained. Therefore, a hermetic-type compressor capable of obtaining an improvement in stable refrigeration capability can be obtained.

In the conventional configuration, even when high refrigeration capability is not required, for example during ordinary operation of the hermetic-type compressor, refrigeration capability increases, and motor input also increases accordingly, and then overall electric power consumption may increase.

Thus, embodiment 18 of the present invention described later is configured so that a supercharging effect can be obtained only at high outside-air temperature or at a high load wherein a high load is applied to the electric compression element. Therefore, a hermetic-type compressor requiring less electric power consumption can be obtained.

In the conventional configuration, the refrigerant gas in the suction passage is heated in the space inside the enclosed container, and the density of refrigerant gas to be charged into the cylinder is lowered. Therefore, in the conventional hermetic-type compressor, the circulation amount of refrigerant decreases, and refrigeration capability may lower.

Thus, embodiment 19 of the present invention described later is configured so that a supercharging effect can be obtained only at high outside-air temperature or at a high load wherein a high load is applied to the electric compression element. Therefore, electric power consumption is reduced on the whole. Further, the opening end of the first suction pipe in the enclosed container is provided near the opening end of the second suction pipe in the enclosed container, whereby the density of refrigerant gas to be sucked into the cylinder is raised, and a hermetic-type compressor having high efficiency can be obtained.

In the conventional configuration, the follow-up performance of the valve mechanism causes a problem, and refrigeration capability in proportion to an increase in rotation number may not be obtained particularly at a high rotation region.

Thus, in embodiment 20 of the present invention described later, in addition to rotation number control, supercharging is performed particularly in a high rotation range so as to obtain refrigeration capability higher than that proportional to rotation number. Therefore, the hermetic-type compressor of embodiment 20 can obtain refrigeration capability required depending on outside-air temperature or a load, and electric power consumption can be decreased.

In the conventional configuration shown in FIG. 69, the suction pipe 21 used as the suction passage is nearly directly connected to the valve plate 19. Therefore, in the conventional hermetic-type compressor, noise generated depending on the pulsation or the like of suction gas near the suction hole 19*a* propagates through the suction passage without being attenuated significantly, and noise propagating outside the enclosed container 2 may increase eventually.

Thus, in embodiment 21 of the present invention described later, without reducing refrigeration capability, noise generated due to the pulsation or the like of refrigerant gas to be sucked is diminished. Therefore, the hermetic-type compressor of embodiment 21 becomes a low noise compressor.

In the conventional configuration, as shown by Wb in FIG. 72, when the reflected wave returns into the cylinder 10, the suction lead 20 is disposed at an angle nearly perpendicular to the advance direction of the reflected wave. Therefore, the reflected wave is mostly reflected at the angle nearly perpendicular to the suction lead. Consequently, the pressure energy of the reflected wave does not effectively propagate into the cylinder 10, a supercharging effect to refrigerant gas by the reflected wave cannot be obtained sufficiently, and the improvement of refrigerant capability may not be obtained sufficiently.

Thus, embodiment 22 of the present invention described later is configured so that when the reflected wave returns into a cylinder, the reflected wave is hardly reflected by the suction lead, and so that the pressure energy of the reflected wave effectively enters the cylinder. Therefore, the hermetic-type compressor of embodiment 22 has high refrigeration capability.

In the above-mentioned conventional configuration, high refrigeration capability can be obtained at all times even when outside-air temperature is high and even when it is low. Therefore, in the conventional hermetic-type compressor, at low outside-air temperature at which no high refrigeration capability is required, more than necessary refrigeration capability is supplied, and the overall efficiency of the refrigeration system including the hermetic-type compressor is lowered. Thus, as a result, the overall electric power consumption may increase.

Thus, embodiments 23 and 24 of the present invention described later are configured so that high refrigeration capability cannot be obtained at low outside-air temperature at which high refrigeration capability is not required, whereby electric power consumption is reduced; on the other hand, they are configured so that refrigeration capability as high as a conventional value can be obtained at high outside-air temperature at which high refrigeration capability is required. Therefore, by controlling refrigeration capability, a hermetic-type compressor having low overall electric power consumption can be obtained.

DISCLOSURE OF THE INVENTION

In order to attain the above-mentioned objects, a hermetic-type compressor in accordance with claim 1 of the present invention comprises:

- a motor portion used as a power source;
- a mechanical portion including a crankshaft, a piston, a cylinder and the like driven by the above-mentioned motor portion;
- an enclosed container for housing the above-mentioned motor portion and the above-mentioned mechanical portion and for storing lubricant;

a suction passage installed on the above-mentioned mechanical portion so as to communicate the above-mentioned cylinder with the above-mentioned enclosed container; and a position adjustment mechanism for adjusting the opening end of the above-mentioned suction passage into the above-mentioned enclosed container;

wherein the above-mentioned position adjustment mechanism disposes the above-mentioned opening end on at least one of planes:

(1) a first plane which is substantially orthogonal to a first line segment at the center point of the above-mentioned first line segment passing through the center of gravity of a plane having a substantially maximum cross-sectional area on the horizontal cross-section of the above-mentioned enclosed container, the above-mentioned first line segment being at a position wherein the distance between the inner walls of the above-mentioned enclosed container is minimum, (2) a second plane which, on the horizontal plane including the above-mentioned first line segment, passes through the center point of a second line segment between the inner wall surfaces of the above-mentioned enclosed container, the second line segment being substantially orthogonal to the above-mentioned first line segment, and which is substantially orthogonal to the above-mentioned second line segment, or (3) a third plane which passes through the center point of a third line segment having the maximum distance between the upper inner wall surface of the above-mentioned enclosed container and the above-mentioned lubricant surface in the vertical direction, and which is substantially orthogonal to the above-mentioned third line segment.

Therefore, in the hermetic-type compressor of the present invention, even when a node of a resonance mode at a resonance frequency is changed because the velocity of sound in refrigerant gas is changed by a change in the temperature of the refrigerant gas, the opening end of the suction passage is adjusted to be always positioned at the node of the resonance mode, whereby the generation of resonance sound can be prevented, and the generation of noise can thus be prevented.

A hermetic-type compressor in accordance with claim 2 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage, one end of which is substantially directly connected to the above-mentioned suction hole of the above-mentioned valve plate, and the other end of which is disposed in the space inside the above-mentioned enclosed container as an opening end;

wherein the above-mentioned opening end is disposed on at least one of three planes:

(1) a first plane which is substantially orthogonal to a first line segment at the center point of the above-mentioned first line segment passing through the center of gravity of a plane having a substantially maximum cross-sectional area on the horizontal cross-section of the above-mentioned enclosed container, the above-mentioned first line segment being at a position wherein the distance between the inner walls of the above-mentioned enclosed container is minimum, (2) a second plane which, on the horizontal plane including the above-mentioned first line segment, passes through the center point of a second line segment between the inner wall surfaces of the above-mentioned enclosed container, the second line segment being substantially orthogonal to the above-mentioned first line segment, and which is substantially orthogonal to the above-mentioned second line segment, or (3) a third plane which passes through the center point of a third line segment having the maximum distance between the upper inner wall surface of the above-mentioned enclosed container and the above-mentioned lubricant surface in the vertical direction, and which is substantially orthogonal to the above-mentioned third line segment.

Therefore, in the hermetic-type compressor of the present invention, the opening end of the suction passage becomes a node of a resonance mode, whereby the generation of shock sound generated by a pressure wave at the suction passage can be prevented significantly to reduce noise, refrigeration capability can be improved, and refrigerant gas suction loss can be reduced, whereby a hermetic-type compressor having high efficiency can be obtained.

A hermetic-type compressor in accordance with claim 3 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage having a length adjustment mechanism, one end of which is substantially directly connected to the above-mentioned suction hole of the above-mentioned valve plate, and the other end of which is disposed in the space inside the above-mentioned enclosed container as an opening end.

Therefore, by changing the length of the passage in the suction passage, even when the velocity of sound in refrigerant gas is changed by a change in the temperature of the refrigerant gas due to a change in outside-air temperature, the time when a reflected wave reaches the suction hole can be aligned with the time when the volume inside the cylinder becomes maximum (suction completion time). Therefore, in the hermetic-type compressor of the present invention, the pressure energy of the reflected wave can be added to the refrigerant gas at the suction completion time, and the suction pressure of the refrigerant gas can be raised.

Therefore, in the hermetic-type compressor of the present invention, the suction pressure rises at all times, the discharge amount of refrigerant per a compression stroke increases, and the circulation amount of refrigerant increases. Further, the hermetic-type compressor of the present invention becomes a hermetic-type compressor having high efficiency by improving refrigeration capability, and by reducing the suction loss of the refrigerant gas.

A hermetic-type compressor in accordance with claim 4 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage having an inner cross-sectional area adjustment mechanism, one end of which is substantially directly connected to the above-mentioned suction hole of the above-mentioned valve plate, and the other end of which is disposed in the space inside the above-mentioned enclosed container as an opening end.

Therefore, in the hermetic-type compressor of the present invention, by changing the inner cross-sectional area in the suction passage, even when the velocity of sound in refrigerant gas is changed by a change in the temperature of the refrigerant gas due to a change in outside-air temperature, the time when a reflected wave reaches the suction hole can be aligned with the time when the volume inside the cylinder becomes maximum (suction completion time). Therefore, in the hermetic-type compressor of the present invention, the pressure energy of the reflected wave can be added to the refrigerant gas at the suction completion time, and the suction pressure of the refrigerant gas can be raised.

Therefore, in the hermetic-type compressor of the present invention, in comparison with the time when outside-air temperature is high, during the time when the outside-air temperature is low, and refrigeration capability is not required to be improved greatly, the inner cross-sectional area of the suction passage decreases; the inner cross-sectional area of the suction passage decreases as the outside-air temperature lowers, whereby in the hermetic-type compressor of the present invention, noise can be reduced significantly.

A hermetic-type compressor in accordance with claim 5 of the present invention comprises:

a motor portion used as a power source;

a mechanical portion including a crankshaft, a piston, a cylinder and the like driven by the above-mentioned motor portion;

an enclosed container filled with refrigerant gas and used for housing the above-mentioned motor portion and the above-mentioned mechanical portion and for storing lubricant;

a valve plate disposed at the end surface of the above-mentioned cylinder and having a suction hole;

a suction lead for opening/closing the above-mentioned suction hole; and a suction passage, one end of which is substantially directly connected to the above-mentioned suction hole of the above-mentioned valve plate, and the other end of which is disposed in the space inside the above-mentioned enclosed container as an opening end;

wherein, on the assumptions that the crank angle at the opening start of the above-mentioned suction lead is θs (rad), that the length of the above-mentioned suction passage is L (m), that the rotation number of the above-mentioned crankshaft is f (Hz), and that the velocity of sound in refrigerant gas in the above-mentioned suction passage is As (m/sec), the return crank angle θr (rad) of the pressure wave generated at the above-mentioned suction hole at the start of suction, represented by (equation 1) described below, is configured to be within the range of (equation 2) described below.

$$\theta r=\theta s+4\pi\times L\times f/As \quad \text{(Equation 1)}$$

$$1.4\ (\text{rad})\leqq\theta r\leqq 3.0\ (\text{rad}) \quad \text{(Equation 2)}$$

Therefore, in the hermetic-type compressor of the present invention, since the length and the like of the suction passage are adjusted so that the crank angle wherein the reflected wave returns to the suction hole is optimal, suction pressure is raised, and the improvement effect of maximum refrigeration capability can be obtained.

A hermetic-type compressor in accordance with claim 6 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a suction passage, one end of which is substantially directly connected to the above-mentioned suction hole of the above-mentioned valve plate, and the other end of which is disposed in the space inside the above-mentioned enclosed container as an opening end; and a deformable reflection prevention plate provided oppositely facing the above-mentioned opening end of the above-mentioned suction passage in the above-mentioned space inside the above-mentioned enclosed container.

Therefore, in the hermetic-type compressor of the present invention, its electric power consumption is decreased by not allowing the improvement effect of refrigeration capability to be obtained at low outside-air temperature at which no high refrigeration capability is required; at high outside-air temperature at which high refrigeration capability is required, the capability is controlled so as to obtain the improvement effect of refrigeration capability in a conventional way, whereby the overall electric power consumption can be decreased.

A hermetic-type compressor in accordance with claim 7 of the present invention comprises:

a motor portion used as a power source;

a mechanical portion including a crankshaft, a piston, a cylinder and the like driven by the above-mentioned motor portion;

an enclosed container filled with refrigerant gas and used for housing the above-mentioned motor portion and the above-mentioned mechanical portion and for storing lubricant;

a valve plate disposed at the end surface of the above-mentioned cylinder and having a suction hole; and a suction passage, one end of which is substantially directly connected to the above-mentioned suction hole of the above-mentioned valve plate, and the other end of which is disposed in the space inside the above-mentioned enclosed container as an opening end;

wherein the resonance frequency of refrigerant gas in the above-mentioned enclosed container is a frequency different from a value close to a frequency range corresponding to an integral multiple of the rotation number of the above-mentioned crankshaft.

Therefore, since the hermetic-type compressor of the present invention is configured so that the resonance frequency of the refrigerant gas in the enclosed container is not close to an integral multiple of the rotation number of the crankshaft, resonance sound is prevented from generating, and pressure amplitude is also prevented from attenuating when a pressure wave is reflected at the opening of the suction passage, whereby suction pressure can be raised at all times, and the improvement effect of refrigeration capability can be obtained.

A hermetic-type compressor in accordance with claim 8 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a suction muffler; and a suction passage, one end of which is substantially directly connected to the above-mentioned suction hole of the above-mentioned valve plate, and the other end of which is disposed in the above-mentioned muffler as an opening end.

Therefore, the hermetic-type compressor of the present invention reduces the force for vibrating refrigerant gas in the enclosed container by decreasing the pulsation of the refrigerant gas, and can always diminish resonance sound regardless of the resonance frequency of the refrigerant gas in the enclosed container. In addition, the hermetic-type compressor of the present invention always prevents the attenuation of the pressure amplitude obtained when a pressure wave is reflected at the opening portion of the suction passage regardless of the resonance frequency of the refrigerant gas in the enclosed container, whereby suction pressure is raised at all times regardless of any change in the shape of the enclosed container, operation conditions and the like, and the improvement effect of refrigeration capability can be obtained.

A hermetic-type compressor in accordance with claim 9 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage, one end of which is substantially directly connected to the above-mentioned suction hole of the above-mentioned valve plate, the other end of which is disposed in the space inside the above-mentioned enclosed container as an opening end, and a part of which is formed of a material having low heat conductivity.

Therefore, in the hermetic-type compressor of the present invention, even when the temperatures of a cylinder head and the like change significantly with the passage of time after start, heat is prevented from transferring to the suction passage, and a change in the temperature of the suction passage is decreased, whereby a change in the velocity of sound in refrigerant gas can be decreased, the stable rising of suction pressure can occur, and stable and high refrigeration capability can be obtained without being affected by the passage of time after start.

A hermetic-type compressor in accordance with claim 10 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a first suction passage, one end of which is substantially directly connected to the above-mentioned suction hole of the above-mentioned valve plate, and the other end of which is disposed in the space inside the above-mentioned enclosed container as an opening end; and a second suction passage having an opening end disposed near the above-mentioned opening end of the above-mentioned first suction passage.

Therefore, in the hermetic-type compressor of the present invention, since low-temperature refrigerant gas having a high density is sucked into the suction passage, the velocity of sound in the refrigerant gas is lowered, and the influence of compressibility becomes large, and a large pressure wave generates. Therefore, in the hermetic-type compressor of the present invention, by increasing the effect of raising suction pressure, and by sucking low-temperature refrigerant gas into the cylinder, the improvement effect of refrigeration capability can be increased significantly, and high refrigeration capability can be delivered; in addition, the transfer of pressure pulsation from the second suction passage to the refrigeration cycle can be reduced, whereby noise can be reduced.

A hermetic-type compressor in accordance with claim 11 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage, one end of which is substantially directly connected to the above-mentioned suction hole of the above-mentioned valve plate, the other ends of which are disposed in the space inside the above-mentioned enclosed container as a plurality of opening ends, wherein the lengths from the above-mentioned suction hole to the above-mentioned plural opening ends have at least two kinds of values.

Therefore, in the hermetic-type compressor of the present invention, a generated pressure wave is reflected by each opening end of the suction passage and reaches the suction hole, whereby the timing when the reflected wave reaches the suction hole can be widened.

Accordingly, in the hermetic-type compressor of the present invention, the velocity of sound in refrigerant gas is changed by a change in operation conditions and the like; even if the timing when one of the reflected waves reaches the suction hole is deviated, other reflected waves reach the suction hole one after another; therefore, refrigerant gas having high pressure can be supplied into the cylinder at all times. Therefore, in the hermetic-type compressor of the present invention, suction pressure can be raised at all times regardless of changes in operation conditions, and stable and high refrigeration capability can be obtained.

A hermetic-type compressor in accordance with claim 12 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage having a communication/shutoff mechanism, one end of which is substantially directly connected to the above-mentioned suction hole of the above-mentioned valve plate, and the other end of which is disposed in the space inside the above-mentioned enclosed container as an opening end.

Therefore, in the hermetic-type compressor of the present invention, when torque at start is present, the suction passage is separated away from the valve plate so as not to generate a pressure wave, whereby suction pressure is prevented from rising, and start torque can be reduced; therefore, in the hermetic-type compressor of the present invention, improper start can be prevented, and high reliability can be obtained.

Furthermore, in the hermetic-type compressor of the present invention, the suction passage is directly connected to the valve plate during stable operation so as to generate pressure and raise suction pressure, whereby high refrigeration capability can be delivered.

A hermetic-type compressor in accordance with claim 13 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a first suction passage, one end of which is connected to the above-mentioned suction hole of the above-mentioned valve plate via a chamber, and the other end of which is disposed in the space inside the above-mentioned enclosed container as an opening end; and a second suction passage, one end of which is disposed near the opening end of the above-mentioned first suction passage, and the other end of which is extended outside the above-mentioned enclosed container;

wherein the above-mentioned opening end of the above-mentioned first suction passage is disposed on at least one of three planes:

(1) a first plane which is substantially orthogonal to a first line segment at the center point of the above-mentioned first line segment passing through the center of gravity of a plane having a substantially maximum cross-sectional area on the horizontal cross-section of the above-mentioned enclosed container, the above-mentioned first line segment being at a position wherein the distance between the inner walls of the above-mentioned enclosed container is minimum, (2) a second plane which, on the horizontal plane including the above-mentioned first line segment, passes through the center point of a second line segment between the inner wall surfaces of the above-mentioned enclosed container, the second line segment being substantially orthogonal to the above-mentioned first line segment, and which is substantially orthogonal to the above-mentioned second line segment, or (3) a third plane which passes through the center point of a third line segment having the maximum distance between the upper inner wall surface of the above-mentioned enclosed container and the above-mentioned lubricant surface in the vertical direction, and which is substantially orthogonal to the above-mentioned third line segment.

Therefore, the hermetic-type compressor of the present invention prevents resonance from generating in the enclosed container, reduces noise, raises the density of refrigerant gas, and becomes an apparatus having improved refrigeration capability.

A hermetic-type compressor in accordance with claim 14 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a first suction passage, one end of which is substantially directly connected to the above-mentioned suction hole of the above-mentioned valve plate, and the other end of which is disposed in the space inside the above-mentioned enclosed container as an opening end; and a second suction passage, one end of which is disposed near the opening end of the above-mentioned first suction passage, and the other end of which is extended outside the above-mentioned enclosed container;

wherein the above-mentioned opening end of the above-mentioned first suction passage is disposed on at least one of three planes:

(1) a first plane which is substantially orthogonal to a first line segment at the center point of the above-mentioned first line segment passing through the center of gravity of a plane having a substantially maximum cross-sectional area on the horizontal cross-section of the above-mentioned enclosed container, the above-mentioned first line segment being at a position wherein the distance between the inner walls of the above-mentioned enclosed container is minimum, (2) a second plane which, on the horizontal plane including the above-mentioned first line segment, passes through the center point of a second line segment between the inner wall surfaces of the above-mentioned enclosed container, the second line segment being substantially orthogonal to the above-mentioned first line segment, and which is substantially orthogonal to the above-mentioned second line segment, or (3) a third plane which passes through the center point of a third line segment having the maximum distance between the upper inner wall surface of the above-mentioned enclosed container and the above-mentioned lubricant surface in the vertical direction, and which is substantially orthogonal to the above-mentioned third line segment.

Therefore, in the hermetic-type compressor of the present invention, the opening end of the suction passage in the enclosed container is disposed at a node of a resonance mode, the generation of shock sound due to a pressure wave in the suction passage is reduced significantly, noise is reduced, the density of refrigerant gas is raised, and refrigeration capability can be improved significantly.

A hermetic-type compressor in accordance with claim 15 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage, one end of which is substantially directly connected to the above-mentioned suction hole of the above-mentioned valve plate, and the other end of which is disposed in the space inside the above-mentioned enclosed container as an opening end;

wherein the bent portion of the above-mentioned suction passage has a substantially uniform curvature.

Therefore, in the hermetic-type compressor of the present invention, the attenuation of the pressure amplitudes of a pressure wave and a reflected wave can be decreased, whereby suction pressure can be raised, and highly improved refrigeration capability can be obtained.

A hermetic-type compressor in accordance with claim 16 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole; and a suction passage, one end of which is substantially directly connected to the above-mentioned suction hole of the above-mentioned valve plate, and the other end of which is disposed in the space inside the above-mentioned enclosed container as an opening end;

wherein the above-mentioned suction passage is bent a plurality of times and formed so that suction passage portions are close to each other.

Therefore, in the hermetic-type compressor of the present invention, the amount of heat received from the high-temperature refrigerant gas in the enclosed container by the suction passage is lessened, and the temperature rise of the suction passage is reduced, whereby the temperature rise of suction gas in the suction passage is prevented, and a large circulation amount of refrigerant can be obtained.

In addition, in the hermetic-type compressor of the present invention, since the temperature of suction gas is low, and refrigerant gas having a high density is sucked into the suction passage, the velocity of sound in the refrigerant gas is lowered, whereby the influence of the compressibility of refrigerant gas increases, a large pressure wave generates, and high refrigeration capability can be obtained.

A hermetic-type compressor in accordance with claim 17 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a suction passage, one end of which is substantially directly connected to the above-mentioned suction hole of the above-mentioned valve plate, and the other end of which is disposed in the space inside the above-mentioned enclosed container as an opening end; and a suction muffler for substantially covering the above-mentioned suction passage.

Therefore, in the hermetic-type compressor of the present invention, the pulsation of suction gas is diminished, and the force for vibrating refrigerant gas in the enclosed container is weakened, whereby resonance sound can be diminished regardless of the resonance frequency of the refrigerant gas in the enclosed container.

In addition, in the hermetic-type compressor of the present invention, regardless of the resonance frequency of the refrigerant gas in the enclosed container, the attenuation of the pressure amplitude at the time when a pressure wave is reflected at the opening of the suction passage can be prevented at all times, whereby suction pressure rises at all times regardless of any change in the shape of the enclosed container, operation conditions and the like, and stable and high refrigeration capability can be obtained.

Furthermore, in the hermetic-type compressor of the present invention, the temperature distribution of the suction passage is made uniform, and the change in the velocity of sound in refrigerant gas is decreased, whereby the attenuation of the pressure wave can be decreased, and suction pressure can be raised stably, and stable refrigeration capability can be obtained.

A hermetic-type compressor in accordance with claim 18 of the present invention comprises:

an enclosed container;

an electric compression element housed in the above-mentioned enclosed container and comprising a cylinder constituting a compression element, and an electric motor a valve plate having a suction hole and disposed at the end surface of the above-mentioned cylinder;

a suction passage, one end of which is open in the above-mentioned enclosed container, and the other end is substantially directly connected to the above-mentioned suction hole of the above-mentioned valve plate; and a passage changeover mechanism provided in the above-mentioned suction passage.

Therefore, the hermetic-type compressor of the present invention is configured so that a supercharging effect can be obtained only at high outside-air temperature or at a high load wherein a high load is applied to the electric compression element, whereby electric power consumption can be reduced on the whole.

A hermetic-type compressor in accordance with claim 19 of the present invention comprises:

an enclosed container;

an electric compression element housed in the above-mentioned enclosed container and comprising a cylinder constituting a compression element, and an electric motor;

a valve plate having a suction hole and disposed at the end surface of the above-mentioned cylinder;

a first suction passage, one end of which is disposed in the above-mentioned enclosed container as an opening end, and the other end is substantially directly connected to the above-mentioned suction hole of the above-mentioned valve plate;

a second suction passage, one end of which is extended outside the above-mentioned enclosed container, and the other end has an opening end disposed near the above-mentioned opening end of the above-mentioned first suction passage; and a passage changeover mechanism provided in the above-mentioned first suction passage.

Therefore, the hermetic-type compressor of the present invention is configured so that a supercharging effect can be obtained only at high outside-air temperature or at a high load wherein a high load is applied to the electric compression element, whereby electric power consumption can be reduced on the whole, and the density of refrigerant gas can be raised, and the refrigeration efficiency can be raised.

A hermetic-type compressor in accordance with claim 20 of the present invention comprises:

an enclosed container;

an electric compression element housed in the above-mentioned enclosed container and comprising a cylinder constituting a compression element, and an electric motor a valve plate having a suction hole and disposed at the end surface of the above-mentioned cylinder;

a suction passage, one end of which is open in the space inside the above-mentioned enclosed container, an accumulator or the like, and the other end is substantially directly connected to the above-mentioned suction hole; and an inverter for driving the above-mentioned motor.

Therefore, in the hermetic-type compressor of the present invention, by performing supercharging in addition to rotation number control, refrigeration capability required depending on outside-air temperature or a load can be obtained, and electric power consumption can be decreased.

A hermetic-type compressor in accordance with claim 21 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a suction lead for opening/closing the above-mentioned suction hole;

a suction passage, one end of which is substantially directly connected to the above-mentioned suction hole of the above-mentioned valve plate, and the other end of which is disposed in the space inside the above-mentioned enclosed container as an opening end; and a resonance-type muffler provided in the above-mentioned suction passage.

Therefore, in the hermetic-type compressor of the present invention, without reducing refrigeration capability, noise generated due to the pulsation or the like of refrigerant gas to be sucked is diminished by the resonance-type muffler provided in the suction passage, whereby noise propagating from the suction passage into the enclosed container can be diminished, and noise propagating outside the enclosed container can be diminished eventually.

A hermetic-type compressor in accordance with claim 22 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a suction lead for opening/closing the above-mentioned suction hole; and a suction passage, one end of which is substantially directly connected to the above-mentioned suction hole of the above-mentioned valve plate, and the other end of which is disposed in the space inside the above-mentioned enclosed container as an opening end;

wherein, at the direct connection portion between the above-mentioned suction hole and the above-mentioned suction passage, the axial direction of the above-mentioned suction passage has an angle smaller than 90 degrees with respect to the connection surface of the above-mentioned valve plate.

Therefore, the hermetic-type compressor of the present invention is configured so that when a reflected wave returns into the cylinder, the reflected wave is not reflected by the suction lead, but is apt to easily enter the cylinder; even when the reflected wave is reflected by the suction lead, the angle between the propagation direction of the reflected wave and the suction lead is small; therefore, the propagation direction of the reflected wave after reflection is not changed greatly, and the reflected wave is apt to enter the cylinder. In other words, the reflected wave is less obstructed by the suction lead, and the pressure energy of the reflected wave effectively enters the cylinder, whereby the hermetic-type compressor of the present invention has high refrigeration capability.

A hermetic-type compressor in accordance with claim 23 of the present invention comprises:

a motor portion used as a power source;

a mechanical portion including a crankshaft, a piston, a cylinder and the like driven by the above-mentioned motor portion;

an enclosed container for housing the above-mentioned motor portion and the above-mentioned mechanical portion and for storing lubricant;

a valve plate disposed at the end surface of the above-mentioned cylinder and having a suction hole;

a suction lead for opening/closing the above-mentioned suction hole;

a deflection control mechanism for controlling the initial deflection amount of the above-mentioned suction lead; and a suction passage, one end of which is substantially directly connected to the above-mentioned suction hole of the above-mentioned valve plate, and the other end of which is disposed in the space inside the above-mentioned enclosed container as an opening end.

Therefore, the hermetic-type compressor of the present invention is configured so that high refrigeration capability cannot be obtained at low outside-air temperature at which high refrigeration capability is not required, whereby electric power consumption is reduced; and is configured so that refrigeration capability as high as a conventional value can be obtained at high outside-air temperature at which high refrigeration capability is required; by controlling refrigeration capability, overall electric power consumption can be reduced.

BEST MODE FOR EMBODYING THE PRESENT INVENTION

Each embodiment of the present invention will be described below referring to the accompanying drawings.

EMBODIMENT 1

First, embodiment 1, an example of a hermetic-type compressor of the present invention, is described below.

Figure 1:
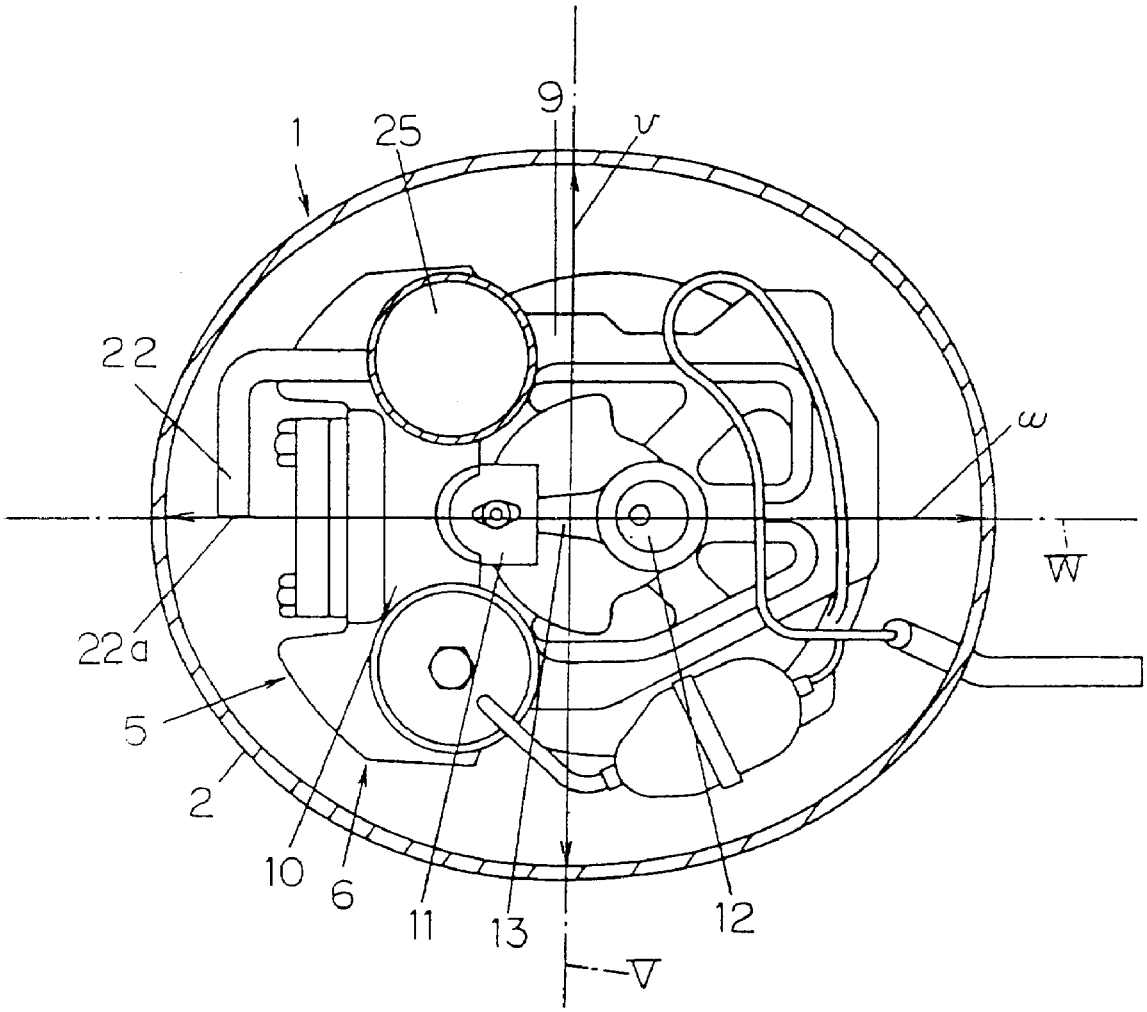
FIG. 1 is a plan sectional view showing a hermetic-type compressor in accordance with embodiment 1 of the present invention when the compressor has a node in the reciprocating direction of its piston.
Figure 2:
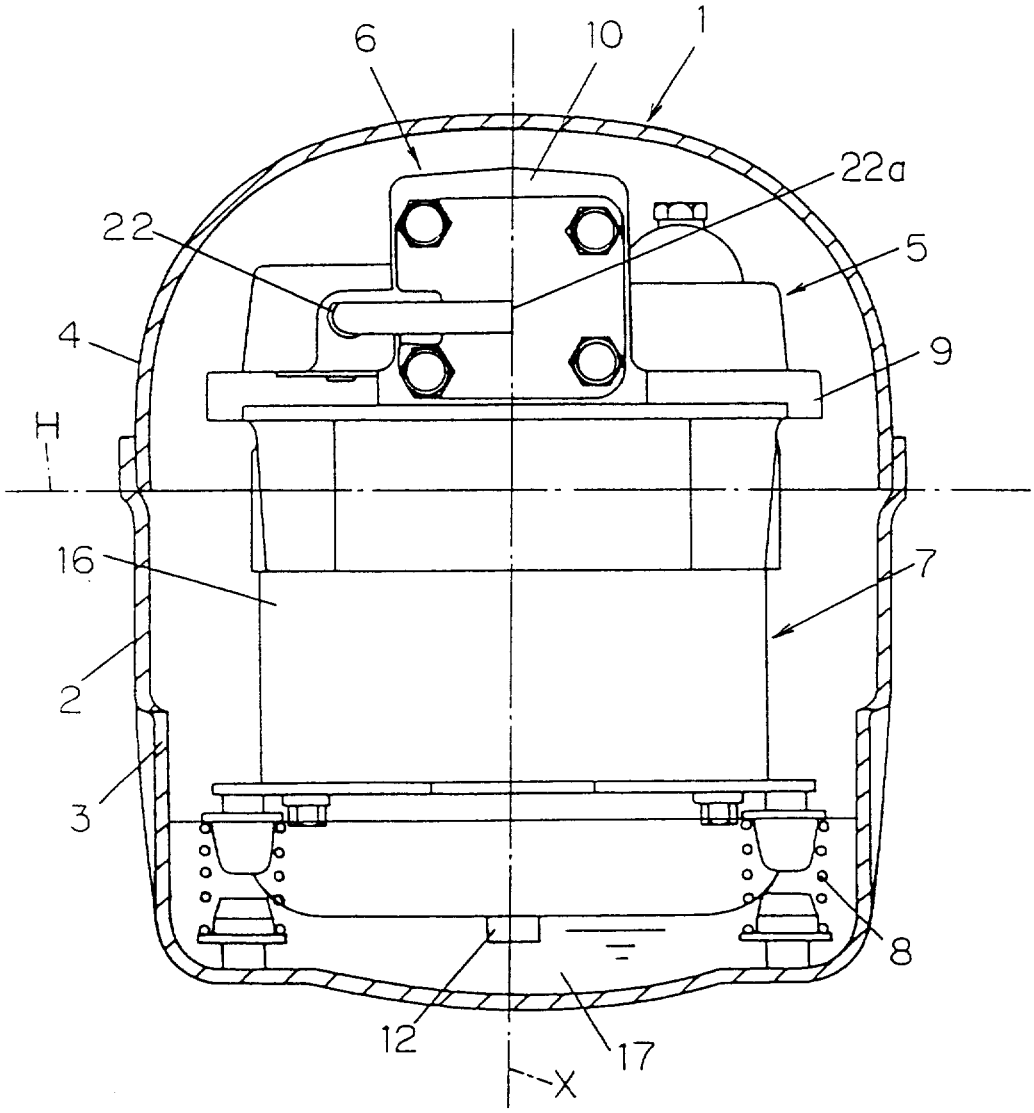
FIG. 2 is a front view showing the hermetic-type compressor in accordance with embodiment 1 of the present invention when the compressor has a node in the reciprocating direction of its piston.
Figure 3:
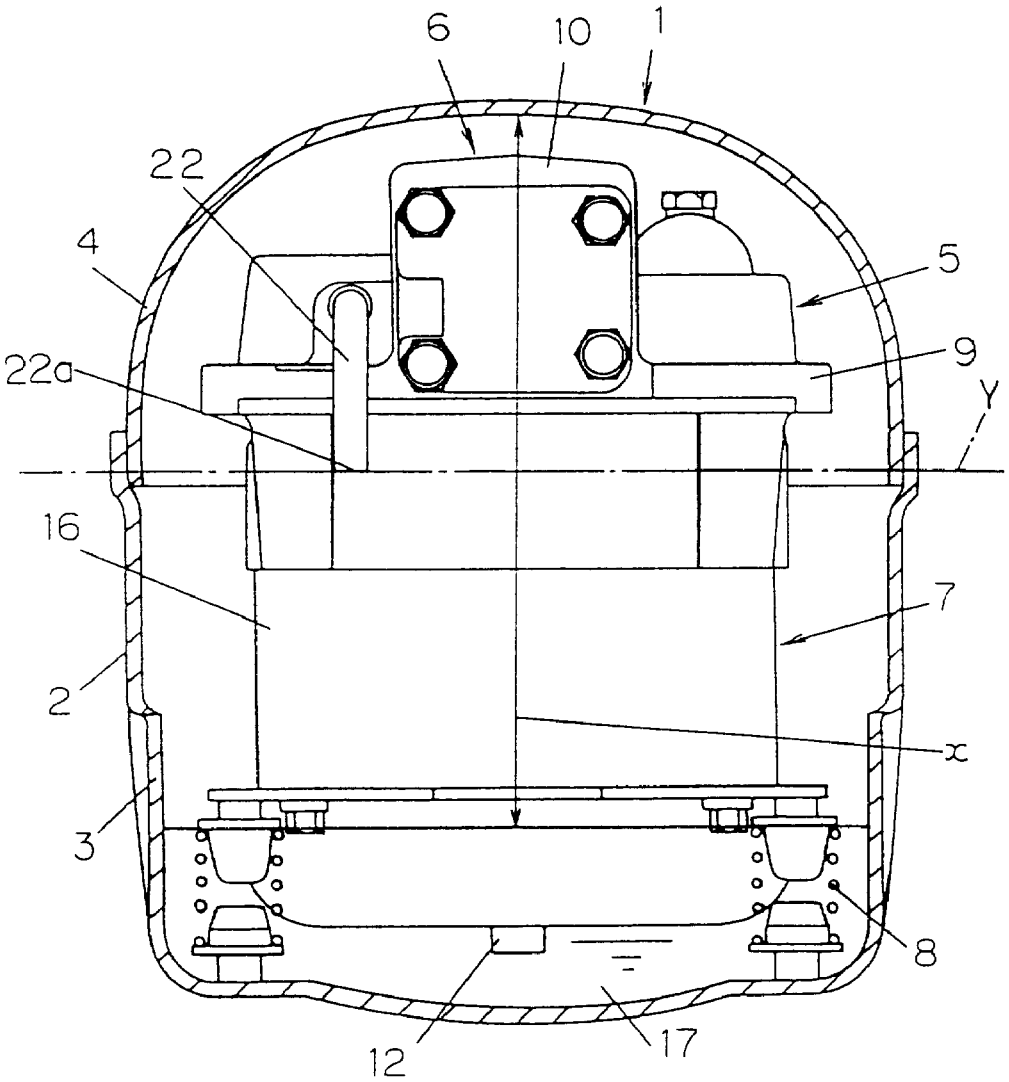
FIG. 3 is a front view showing the hermetic-type compressor in accordance with embodiment 1 of the present invention when the compressor has a node in the axial direction of its crankshaft.

FIG. 1 is a plan sectional view showing the hermetic-type compressor in accordance with embodiment 1 of the present invention, and shows the hermetic-type compressor having a node of a resonance mode in a direction perpendicular to the reciprocating direction on a horizontal plane including the reciprocating direction (arrows w—w in FIG. 1) of its piston. FIG. 2 is a front view showing a condition wherein a resonance mode is provided in the direction perpendicular to the reciprocating direction on the horizontal plane including the reciprocating direction of the piston of the hermetic-type compressor in accordance with embodiment 1 of the present invention. FIG. 3 is a front view showing a condition wherein a resonance mode is provided in the axial direction of the crankshaft of the hermetic-type compressor in accordance with embodiment 1 of the present invention.

In FIGS. 1 and 2, the hermetic-type compressor 1 has an enclosed container 2 comprising a lower shell 3 and an upper shell 4. An electric compression element 5 in the enclosed container 2 is elastically supported in the enclosed container 2 by coil springs 8 so that a mechanical portion 6 is disposed in the upper portion and so that a motor portion 7 is disposed in the lower portion. The mechanical portion 6 comprises a cylinder 10 integrally provided with a block 9, a piston 11 reciprocating in the left-right directions in FIG. 1 along arrows w in FIG. 1, a crankshaft 12, a connecting rod 13 and the like. The motor portion 7 comprises a rotor secured by shrinkage fit (fitted after heating and secured) to the crankshaft 12, a stator and the like. The stator is secured to the block 9 using screws. Lubricant 17 is stored at the bottom of the enclosed container 2.

One end of a suction pipe 22 for sucking refrigerant gas into the cylinder 10 is installed in the mechanical portion 6 via a suction chamber 25, and the other end is disposed in the enclosed container 2 as an opening end 22*a*. Therefore, the suction pipe 22 is used so that the interior of the cylinder 10 communicates with the interior of the enclosed container 2. This suction pipe 22 is formed of a shape-memory alloy,. and the opening end 22*a* of the suction pipe 22 is configured so as to be at a desired position depending on a change in temperature. The opening end 22*a* of the suction pipe 22 is movable and disposed on at least one of the following three planes in accordance with the condition described below.

(1) on a first plane (the plane indicated by straight line W in FIG. 1) (at the position showing the opening end 22*a* in FIG. 1) which is substantially orthogonal to a first line segment (the line segment indicated by arrow v in FIG. 1) at the center point of the above-mentioned first line segment (v) passing through the center of gravity (the position of the center of gravity at the horizontal cross-section) of a plane (the horizontal plane indicated by straight line H in FIG. 2) having a substantially maximum cross-sectional area on the horizontal cross-section (the cross-section in parallel with the paper surface of FIG. 1) of the above-mentioned enclosed container 2, the first line segment (v) being at a position wherein the distance between the inner walls of the above-mentioned enclosed container 2 is minimum (on the horizontal plane indicated by straight line H in FIG. 2), or (2) on a second plane (the vertical plane indicated by straight line V in FIG. 1 and the straight line X in FIG. 2) (at the position showing the opening end 22*a* in FIG. 2) which, on the horizontal plane (H) including the above-mentioned first line segment (v), passes through the center point of a second line segment (the line segment indicated by arrow w in FIG. 1) between the inner wall surfaces of the above-mentioned enclosed container 2, the second line segment being substantially orthogonal to the above-mentioned first line segment (v), and which is substantially orthogonal to the above-mentioned second line segment (w), or (3) on a third plane (the horizontal plane indicated by straight line Y in FIG. 3) (at the position showing the opening end 22*a* in FIG. 3) which passes through the center point of a third line segment (the line segment indicated by arrow x in FIG. 3) having the maximum distance between the upper inner wall surface of the above-mentioned enclosed container 2 and the above-mentioned lubricant surface in the vertical direction, and which is substantially orthogonal to the above-mentioned third line segment (x).

The opening end 22*a* of the suction pipe 22 is disposed on at least one of the three planes.

Next, the operation of the hermetic-type compressor of embodiment 1 having the above-mentioned configuration is described below.

Refrigerant gas circulated from a system such as a refrigeration apparatus is relieved once in the space inside the enclosed container 2 and sucked into the cylinder 10 via the suction pipe 22 secured to the block 9. The refrigerant gas in the cylinder 10 is compressed by the piston 11. At this time, the refrigerant gas is sucked into the cylinder 10 by one half rotation of the crankshaft 12, and compressed by the other half rotation.

Thus, since the refrigerant gas is not sucked continuously into the cylinder 10, the pressure pulsation of the refrigerant gas occurs in the suction pipe 22. Therefore, the pressure pulsation vibrates the space inside the enclosed container 2, and resonance modes are generated in the reciprocating direction of the piston 11, in a direction perpendicular to the reciprocating direction on a horizontal plane including the reciprocating-direction of the piston 11, and in the axial direction of the crankshaft 12.

At that time, the pressure pulsation energy in the resonance modes in the reciprocating direction of the piston 11, in the direction perpendicular to the reciprocating direction on the horizontal plane including the reciprocating direction of the piston 11, and in the axial direction of the crankshaft 12 changes depending on the velocity of sound in refrigerant gas (the velocity of sound passing through refrigerant gas).

For example, when the temperature of the refrigerant gas is raised because of high outside-air temperature and the velocity of the sound in the refrigerant gas increases, a node of the resonance mode is generated in the direction perpendicular to the reciprocating direction on the horizontal plane including the reciprocating direction of the piston 11.

At that time, by providing the opening end 22*a* of the suction pipe 22 in the space inside the enclosed container 2 so as to align the opening end 22*a* with the node of the resonance mode in the direction perpendicular to the reciprocating direction on the horizontal plane including the reciprocating direction of the piston 11, pressure pulsation is not caused, and the generation of resonance sound can be prevented. FIG. 2 is a front view showing a condition wherein the node of the resonance mode in the direction perpendicular to the reciprocating direction on the horizontal plane including the reciprocating direction of the piston 11 of the hermetic-type compressor in accordance with embodiment 1 is aligned with the opening end 22*a*.

Next, when the temperature of the refrigerant gas is lowered because of low outside-air temperature or the like, and the velocity of sound in the refrigerant gas decreases, the node of the resonance mode is generated in the axial direction of the crankshaft 12.

At this time, as the temperature of the refrigerant gas lowers, and the temperature of the suction pipe 22 lowers, the opening end 22*a* of the suction pipe 22 in the space inside the enclosed container 2, which is formed of a shape-memory alloy, is bent downward in the vertical direction.

Therefore, since the opening end 22*a* of the suction pipe 22 in the space inside the enclosed container 2 is disposed at the position aligned with the node of the resonance mode in the axial direction of the crankshaft 12, pressure pulsation is not caused, and the generation of resonance sound can be prevented. FIG. 3 is a front sectional view showing a condition wherein the node of the resonance mode in the axial direction of the crankshaft 12 of the hermetic-type compressor in accordance with embodiment 1 is aligned with the opening end 22*a*.

In the hermetic-type compressor of embodiment 1, even when the node of the resonance mode at a resonance frequency is changed because the velocity of sound in the refrigerant gas is changed by a change in outside-air temperature, the opening end 22*a* of the suction pipe 22 is always positioned at the node of the resonance mode. Therefore, the hermetic-type compressor of embodiment 1 can prevent the generation of resonance sound, and can attain low noise.

As described above, in the hermetic-type compressor of embodiment 1, the suction pipe 22 used to communicate the interior of the cylinder 10 with the interior of the enclosed container 2 is formed of a shape-memory alloy, and the opening end 22*a* of the suction pipe 22 is disposed at least one of the following planes:

(1) the first plane (W) which is substantially orthogonal to the first line segment (v) at the center point of the above-mentioned first line segment (v) passing through the center of gravity of the plane (H) having a substantially maximum cross-sectional area on the horizontal cross-section of the above-mentioned enclosed container 2, the first line segment (v) being at the position wherein the distance between the inner walls of the above-mentioned enclosed container 2 is minimum, (2) the second plane (V) which, on the horizontal plane (H) including the above-mentioned first line segment (v), passes through the center point of the second line segment (w) between the inner wall surfaces of the above-mentioned enclosed container 2, the second line segment being substantially orthogonal to the above-mentioned first line segment (v), and which is substantially orthogonal to the above-mentioned second line segment (w), or (3) on the third plane (Y) which passes through the center point of the third line segment (x) having the maximum distance between the upper inner wall surface of the above-mentioned enclosed container 2 and the above-mentioned lubricant surface in the vertical direction, and which is substantially orthogonal to the above-mentioned third line segment (x).

In the hermetic-type compressor of embodiment 1, even when the node of the resonance mode at the resonance frequency is changed because the velocity of sound in the refrigerant gas is changed by a change in the temperature of the refrigerant gas, the opening end 22*a* of the suction pipe 22 is always positioned at the node of the resonance mode. Therefore, the generation of resonance sound in the suction pipe 22 can be prevented, and the generation of noise can be prevented.

In the case of embodiment 1, the temperature of the refrigerant gas is changed by outside-air temperature, and the velocity of sound in the refrigerant gas is changed. However, under a condition wherein the velocity of sound in the refrigerant gas is changed, even when the change is caused by a change in pressure or the like, the same effect as that of the above-mentioned embodiment can be obtained.

In the above-mentioned embodiment 1, the following cases are described; the node of the resonance mode at high outside-air temperature is in the direction perpendicular to the reciprocating direction on the horizontal plane including the reciprocating direction of the piston 11, and the node of the resonance mode at low outside-air temperature is in the axial direction of the crankshaft 12. However, by having a configuration wherein the opening end 22*a* of the suction pipe 22 is moved as the node of the resonance mode is changed in the reciprocating direction of the piston 11, in the direction perpendicular to the reciprocating direction on the horizontal plane including the reciprocating direction of the piston 11, in the axial direction of the crankshaft 12, and in the vicinity of each direction, a hermetic-type compressor having attained low noise can be obtained.

Even an electric or mechanical configuration wherein the opening end 22*a* of the suction pipe 22 is moved depending on a change in the node of the resonance mode can obtain the same effect as that of the above-mentioned embodiment 1.

EMBODIMENT 2

Next, embodiment 2, an example of the hermetic-type compressor of the present invention, will be described below referring to the accompanying drawings.

Figure 4:
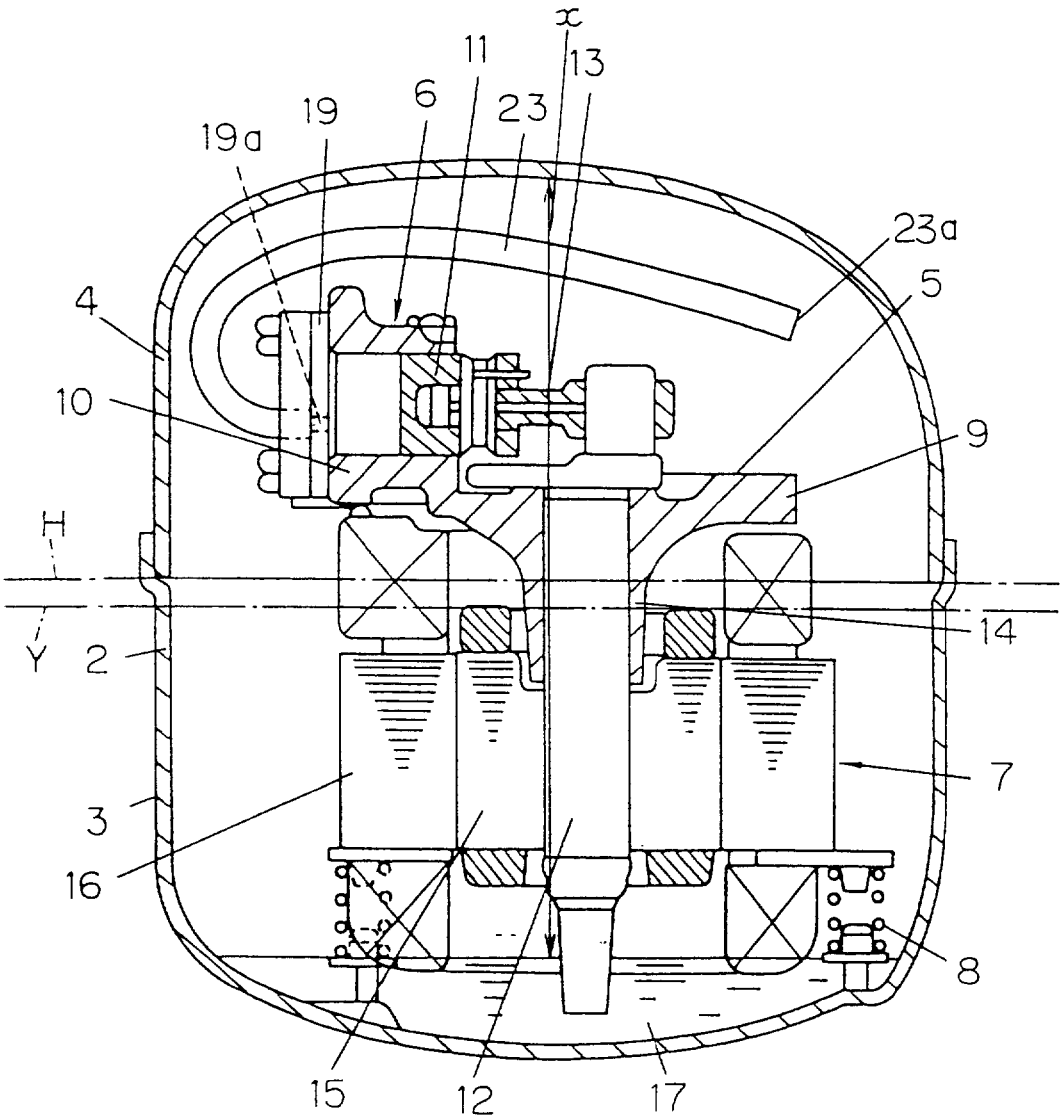
FIG. 4 is a vertical sectional view showing a hermetic-type compressor in accordance with embodiment 2 of the present invention.
Figure 5:
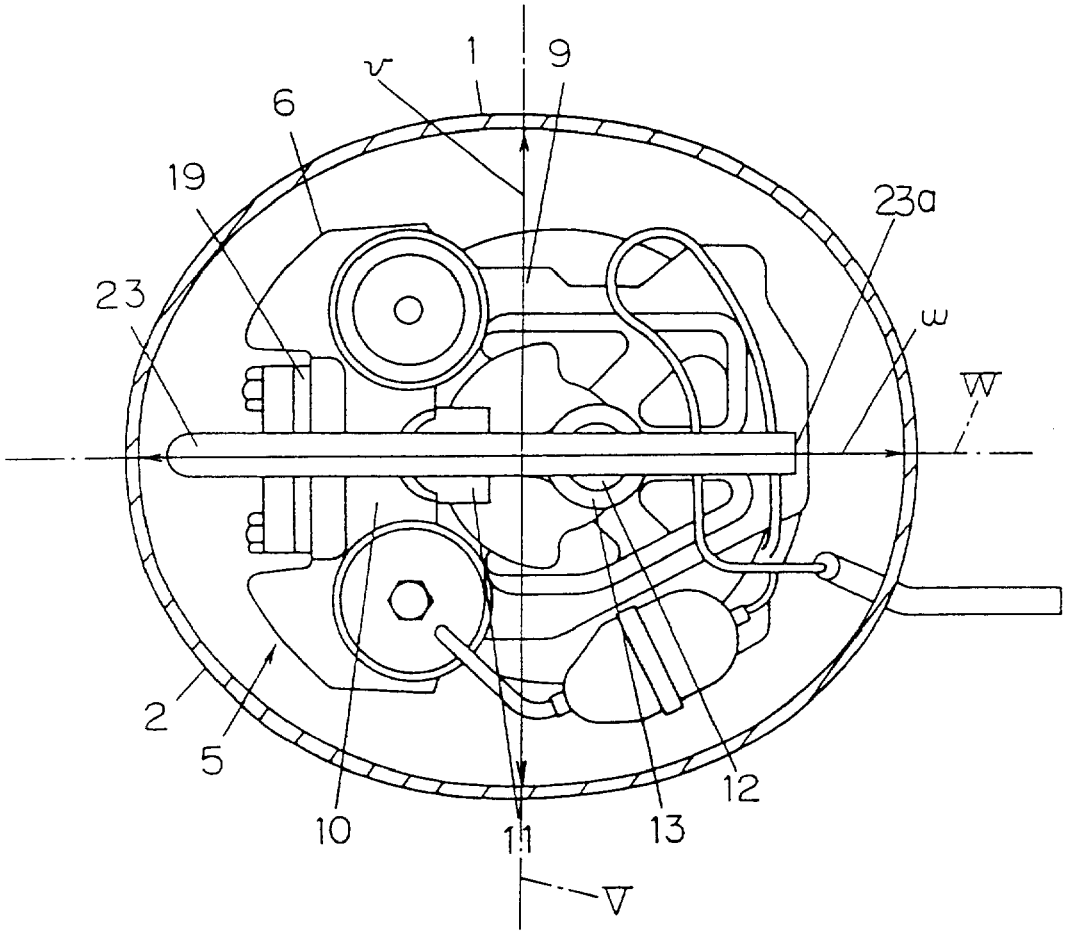
FIG. 5 is a plan sectional view showing the hermetic-type compressor in accordance with embodiment 2 of the present invention.

FIG. 4 is a vertical sectional view showing the hermetic-type compressor in accordance with embodiment 2 of the present invention. FIG. 5 is a plane sectional view showing the hermetic-type compressor in accordance with embodiment 2 of the present invention. In the hermetic-type compressor of embodiment 2, components having the same functions and configurations as those of the hermetic-type compressor of the above-mentioned embodiment 1 are designated by the same marks, and their descriptions are omitted.

In FIGS. 4 and 5, a suction hole 19*a* is formed in a valve plate 19 secured to the end surface of the cylinder 10 of a mechanical portion 6, and one end of a suction pipe 23 is directly connected to the suction hole 19*a*. The other end of the suction pipe 23 is disposed in the space inside an enclosed container 2.

An opening end 23*a* of the suction pipe 23 is disposed on at least one of the following three planes.

(1) on a first plane (the plane indicated by straight line W in FIG. 5) (at the position showing the opening end 22*a* in FIG. 5) which is substantially orthogonal to a first line segment (the line segment indicated by arrow v in FIG. 5) at the center point of the above-mentioned first line segment (v) passing through the center of gravity (the position of the center of gravity at the horizontal cross-section) of a plane (the horizontal plane indicated by straight line H in FIG. 4) having a substantially maximum cross-sectional area on the horizontal cross-section (the cross-section in parallel with the paper surface of FIG. 5) of the above-mentioned enclosed container 2, the first line segment (v) being at a position wherein the distance between the inner walls of the above-mentioned enclosed container 2 is minimum (on the horizontal plane indicated by straight line H in FIG. 4), or (2) on a second plane (the vertical plane indicated by straight line V in FIG. 5) which, on the horizontal plane (H) including the above-mentioned first line segment (v), passes through the center point of a second line segment (the line segment indicated by arrow w in FIG. 5) between the inner wall surfaces of the above-mentioned enclosed container 2, the second line segment being substantially orthogonal to the above-mentioned first line segment (v), and which is substantially orthogonal to the above-mentioned second line segment (w), or (3) on a third plane (the horizontal plane indicated by straight line Y in FIG. 4) which passes through the center point of a third line segment (the line segment indicated by arrow x in FIG. 4) having the maximum distance between the upper inner wall surface of the above-mentioned enclosed container 2 and the above-mentioned lubricant surface in the vertical direction, and which is substantially orthogonal to the above-mentioned third line segment (x).

The opening end 22*a* of the suction pipe 22 is disposed on at least one of the above three planes.

In the hermetic-type compressor shown in FIGS. 4 and 5, the opening end 23*a* of the suction pipe 23 is disposed on the first plane (W).

Next, the operation of the hermetic-type compressor of embodiment 2 having the above-mentioned configuration is described below.

A pressure wave generated in the cylinder 10 passes through the suction hole 19*a* of the valve plate 19, propagates in the direction opposite to the flow of refrigerant gas, and becomes a reflected wave having an inverse phase in the space inside the enclosed container 2. This reflected wave propagates in the same direction as the flow of the refrigerant gas, and returns to the suction hole 19*a*.

By aligning the time when this reflected wave reaches the suction hole 19*a* with the time when the volume inside the cylinder 10 becomes maximum (suction completion time), the pressure energy of the reflected wave is added to the refrigerant gas at the suction completion time, and the suction pressure of the refrigerant gas rises.

As a result, refrigerant gas having a higher density is charged into the cylinder 10, the discharge amount of refrigerant per a compression stroke increases, the circulation amount of refrigerant increases, and refrigeration capability can be improved significantly. In this way, in the hermetic-type compressor of embodiment 2, the suction loss of refrigerant gas decreases, and cooling efficiency can be improved.

At that time, the pressure wave generated in the cylinder 10 generates shock sound and vibrates the space inside the enclosed container 2, thereby generating resonance modes in the reciprocating direction of the piston 11, in a direction perpendicular to the reciprocating direction on a horizontal plane including the reciprocating direction of the piston 11, and in the axial direction of the crankshaft 12.

In the hermetic-type compressor shown in FIGS. 4 and 5, the opening end 23*a* of the suction pipe 23 in the space inside the enclosed container 2 is disposed at a node of the resonance mode in the direction perpendicular to the reciprocating direction on the horizontal plane including the reciprocating direction of the piston 11. Therefore, in the hermetic-type compressor of embodiment 2, the opening end 23*a* of the suction pipe 23 is positioned at the node of the resonance mode, whereby the generation of the shock sound generated by the pressure wave at the suction pipe 23 can be prevented significantly, and low noise can be attained.

As described above, in the hermetic-type compressor of embodiment 2, the one end of the suction pipe 23 is directly connected to the suction hole 19*a* of the valve plate 19, and the other end is disposed on the predetermined plane in the space inside the enclosed container 2. Therefore, the opening end 23*a* of the suction pipe 23 becomes the node of the resonance mode, whereby in the hermetic-type compressor, the generation of the shock sound generated by the pressure wave at the suction pipe 23 can be prevented significantly, and noise can be reduced. Consequently, the hermetic-type compressor of embodiment 2 becomes a highly efficient hermetic-type compressor capable of improving refrigeration capability and reducing suction loss.

In embodiment 2, a configuration wherein the opening end 23*a* of the suction pipe 23 in the space inside the enclosed container 2 is at the node of the resonance mode in the direction perpendicular to the reciprocating direction of the piston 11 is used in the above description. However, the same effect as that of the above-mentioned embodiment 2 can be obtained when the opening end of the suction pipe 23 in the space inside the enclosed container 2 is at the node of the resonance mode in each direction, that is, at the node of the resonance mode in the reciprocating direction of the piston 11, at the node of the resonance mode in the axial direction of the crankshaft 12, or the like.

EMBODIMENT 3

Next, embodiment 3, an example of the hermetic-type compressor of the present invention, will be described below referring to the accompanying drawings.

Figure 6:
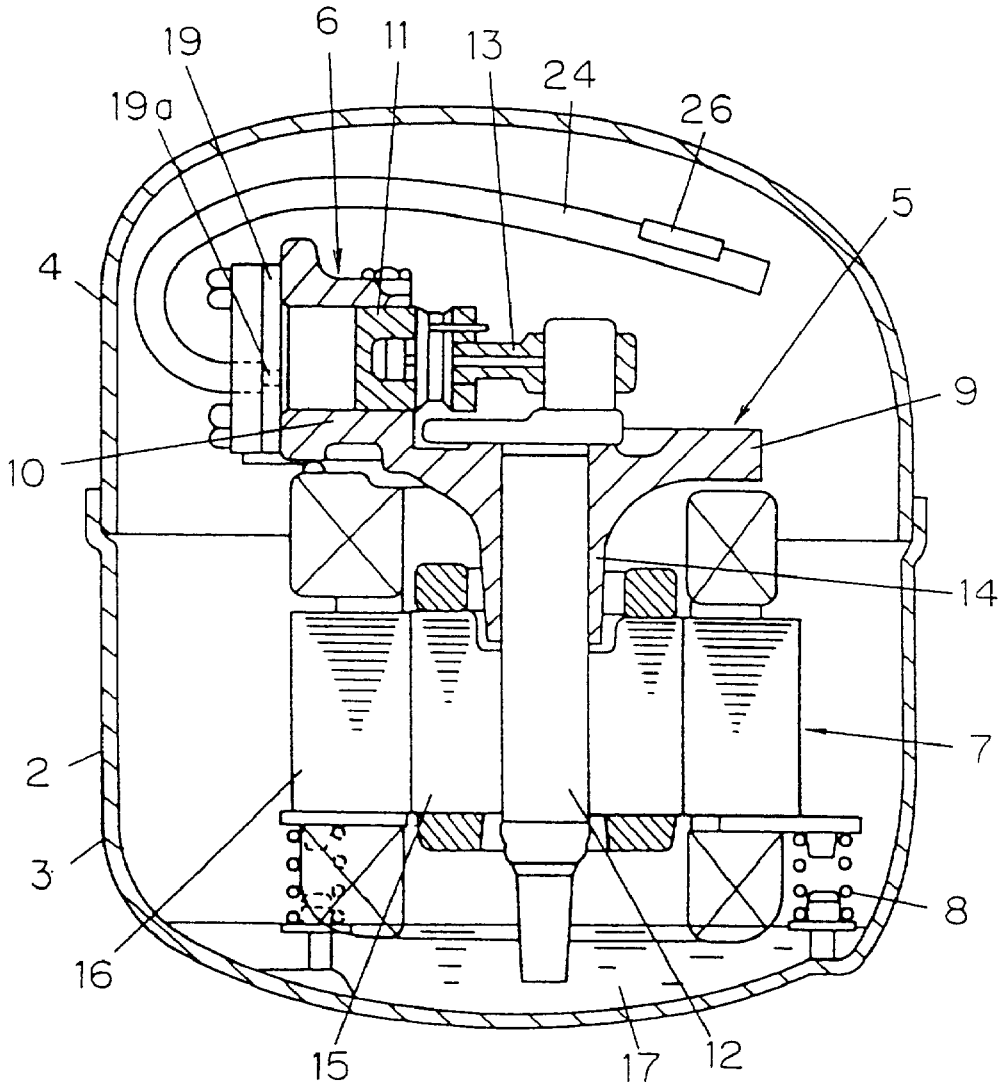
FIG. 6 is a vertical sectional view showing a hermetic-type compressor in accordance with embodiment 3 of the present invention.
Figure 7:
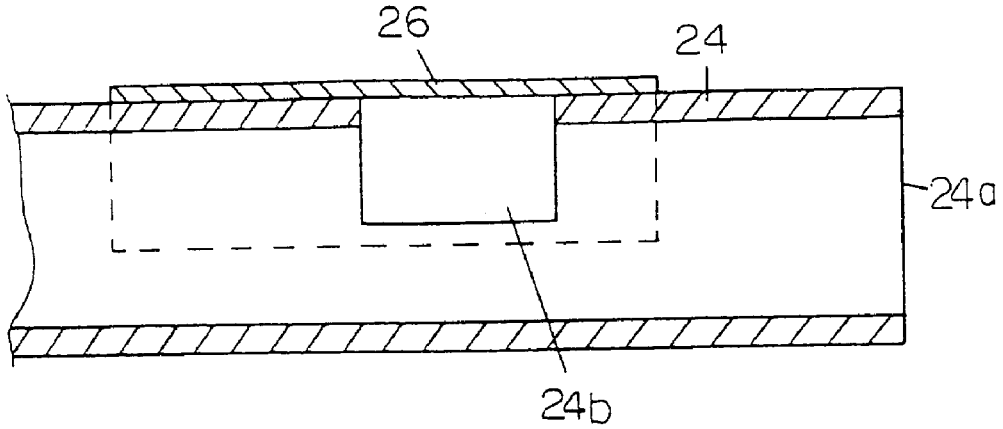
FIG. 7 is a vertical sectional view showing the main portion of the hermetic-type compressor in accordance with embodiment 3 of the present invention when the velocity of sound in refrigerant gas is high.
Figure 8:
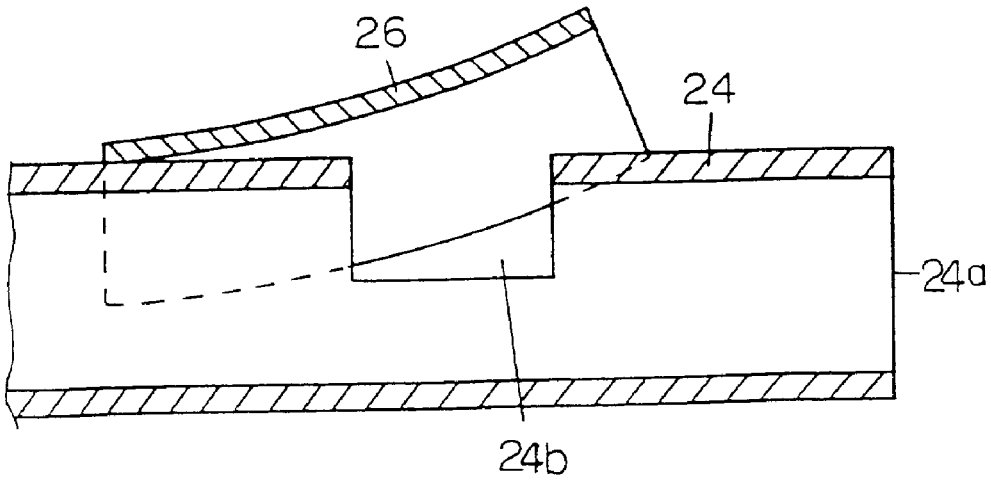
FIG. 8 is a vertical sectional view showing the main portion of the hermetic-type compressor in accordance with embodiment 3 of the present invention when the velocity of sound in refrigerant gas is low.

FIG. 6 is a vertical sectional view showing the hermetic-type compressor in accordance with embodiment 3 of the present invention. FIG. 7 is a vertical sectional view showing the main portion of the hermetic-type compressor in accordance with embodiment 3 of the present invention when the velocity of sound in refrigerant gas is high. FIG. 8 is a vertical sectional view showing the main portion of the hermetic-type compressor in accordance with embodiment 3 of the present invention when the velocity of sound in refrigerant gas is low. In the hermetic-type compressor of embodiment 3, components having the same functions and configurations as those of the hermetic-type compressor of the above-mentioned embodiment 1 or embodiment 2 are designated by the same marks, and their descriptions are omitted.

In FIGS. 6, 7 and 8, a suction hole 19*a* is formed in a valve plate 19 secured to the end surface of the cylinder 10 of a mechanical portion 6. One end of a suction pipe 24 is directly connected to the suction hole 19*a*. The other end of the suction pipe 24 is disposed as an opening end 24*a* in the space inside an enclosed container 2.

The suction pipe 24 has a length adjustment mechanism. In FIGS. 7 and 8, mark 24*b* represents an opening hole formed in the suction pipe 24. The opening hole 24*b*, which is at least one communication hole other than the opening end 24*a*, is provided for communicating the space inside the suction pipe 24 with the space inside the enclosed container 2. Mark 26 represents an opening hole lid formed of a bimetal, a shape-memory alloy or the like for opening/closing the opening hole 24*b*.

Next, the operation of the hermetic-type compressor of embodiment 3 having the above-mentioned configuration is described below.

A pressure wave generated in the cylinder 10 passes through the suction hole 19*a* of the valve plate 19, propagates in the direction opposite to the flow of refrigerant gas, and becomes a reflected wave having an inverse phase in the space inside the enclosed container 2. The phase-inverted reflected wave propagates in the same direction as the flow of the refrigerant gas, and returns to the suction hole 19*a*.

By aligning the time when this reflected wave reaches the suction hole 19*a* with the time when the volume inside the cylinder 10 becomes maximum (suction completion time), the pressure energy of the reflected wave is added at the suction completion time, and the suction pressure of the refrigerant gas rises.

As a result, refrigerant gas having a higher density is charged into the cylinder 10, the discharge amount of refrigerant per a compression stroke increases, the circulation amount of refrigerant increases, and refrigeration capability can be improved significantly.

However, since the wavelengths of the pressure wave and the reflected wave change depending on the velocity of sound, the timing of adding the pressure energy of the reflected wave at the suction completion time generates an error, and the rising ratio of the suction pressure of the refrigerant gas lowers.

Accordingly, as shown in FIG. 7, when the velocity of sound in the refrigerant gas is high because of high outside-air temperature or the like, the opening hole lid 26 formed of a bimetal, a shape-memory alloy or the like closes the opening hole 25, whereby the opening end of the suction pipe 24 becomes the opening end 24*a* disposed at the end of the suction pipe 24, and the length of the suction pipe 24 is increased.

As a result, the suction pipe 24 can be lengthened by the amount of change in wavelength depending on the increased velocity of sound in the refrigerant gas, and the time when the reflected wave reaches the suction hole 19*a* can be aligned with the time when the volume inside the cylinder 10 becomes maximum (suction completion time). Therefore, in the hermetic-type compressor of embodiment 3, the pressure energy of the reflected wave can be added to the refrigerant gas at the suction completion time, and the suction pressure of the refrigerant gas can be raised.

As shown in FIG. 8, when the velocity of sound in the refrigerant gas is low because of low outside-air temperature or the like, the opening hole lid 26 formed of a bimetal, a shape-memory alloy or the like opens the opening hole 25, whereby the opening end of the suction pipe 24 becomes ahead of the opening end 24*a* of the suction pipe 24, and this corresponds that the length of the suction pipe 24 is decreased.

As a result, when the velocity of sound in the refrigerant gas becomes low, the suction pipe 24 is shortened, whereby the time when the reflected wave reaches the suction hole 19*a* can be aligned with the time when the volume inside the cylinder 10 becomes maximum (suction completion time), the pressure energy of the reflected wave can be added to the refrigerant gas at the suction completion time, and the suction pressure of the refrigerant gas can be raised.

As described above, by changing the length of the suction pipe 24, even when the velocity of sound in the refrigerant gas is changed by a change in the temperature of the refrigerant gas due to a change in the outside-air temperature, the time when the reflected wave reaches the suction hole 19*a* can be aligned with the time when the volume inside the cylinder 10 becomes maximum (suction completion time). Therefore, in the hermetic-type compressor of embodiment 3, the pressure energy of the reflected wave can be added to the refrigerant gas at the suction completion time, and the suction pressure can be raised.

As a result, in the hermetic-type compressor of embodiment 3, the suction pressure rises at all times, the discharge amount of refrigerant per a compression stroke can increase, and the circulation amount of refrigerant increases. Therefore, the hermetic-type compressor of embodiment 3 can have high refrigeration efficiency by improving refrigeration capability and by lowering suction loss.

As described above, in the hermetic-type compressor of embodiment 3, the one end of the suction pipe 24 is disposed as the opening end 24*a* in the space inside the enclosed container 2, and the other end is directly connected to the suction hole 19*a* of the valve plate 19. In addition, the suction pipe 24 is provided with the length adjustment mechanism. The length adjustment mechanism comprises at least one opening hole 25, other than the opening end, which is provided in the suction pipe 24 so as to communicate the interior of the suction pipe 24 with the space inside the enclosed container 2, and the opening hole lid 26 formed of a bimetal, a shape-memory alloy or the like for opening/closing the opening hole 25. By changing the length of the suction pipe 24 by using the length adjustment mechanism, even when the velocity of sound in the refrigerant gas is changed by a change in the temperature of the refrigerant gas due to a change in the outside-air temperature, the time when the reflected wave reaches the suction hole 19*a* can be aligned with the time when the volume inside the cylinder 10 becomes maximum (suction completion time). Therefore, the pressure energy of the reflected wave can be added to the refrigerant gas at the suction completion time, and the suction pressure of the refrigerant gas can be raised.

As a result, in the hermetic-type compressor of embodiment 3, the suction pressure rises at all times, the discharge amount of refrigerant per a compression stroke can increase, and the circulation amount of refrigerant increases. Therefore, the hermetic-type compressor of embodiment 3 becomes an the hermetic-type compressor having high refrigeration efficiency by improving refrigeration capability and by reducing suction loss.

Furthermore, in embodiment 3, the temperature of the refrigerant gas is changed depending on outside-air temperature, and the velocity of sound in the refrigerant gas is changed. However, the hermetic-type compressor of embodiment 3 is useful even when the pressure or the like changes, provided that the velocity of sound in the refrigerant gas changes.

In embodiment 3, the length adjustment mechanism comprises the suction pipe 24, at least one opening hole 25, other than the opening end 24*a,* which is provided in the suction pipe 24 so as to communicate the interior of the suction pipe 24 with the space in the enclosed container 2, and the opening hole lid 26 formed of a bimetal, a shape-memory alloy or the like and openably disposed at the opening hole 25. However, if the length adjustment mechanism is an adjustment mechanism wherein the length of the pipe is changed depending on the change in the velocity of sound in the refrigerant gas, it is needless to say that the same effect as that of embodiment 3 can be obtained.

EMBODIMENT 4

Next, embodiment 4, an example of the hermetic-type compressor of the present invention, will be described below referring to the accompanying drawings.

Figure 9:
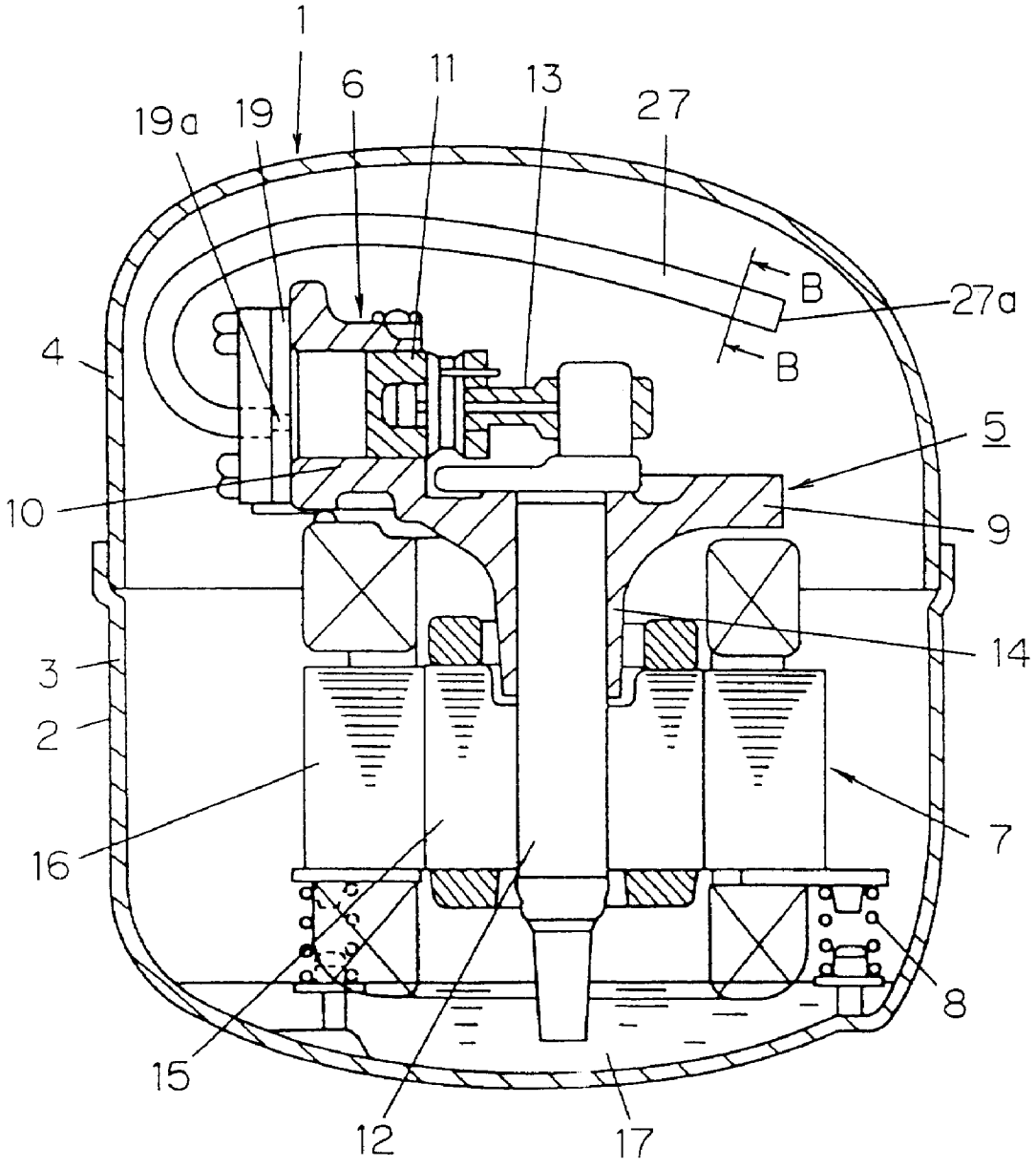
FIG. 9 is a vertical sectional view showing a hermetic-type compressor in accordance with embodiment 4 of the present invention.
Figure 10:
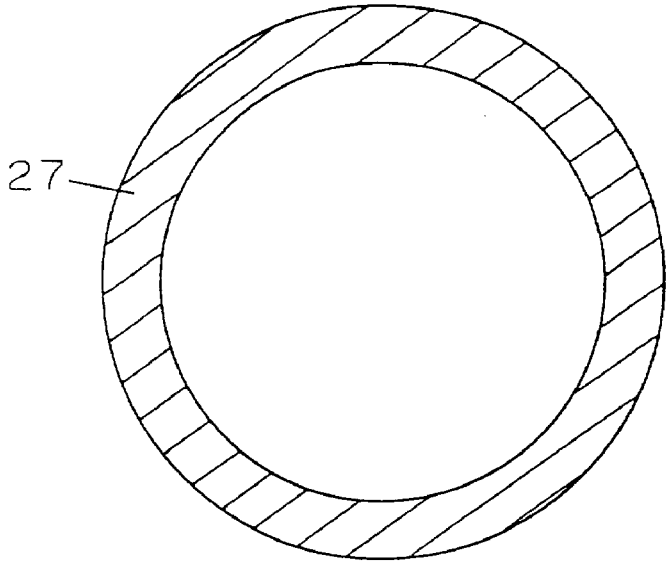
FIG. 10 is a sectional view taken on line B—B when the hermetic-type compressor in accordance with embodiment 4 of the present invention operates at high outside-air temperature.
Figure 11:
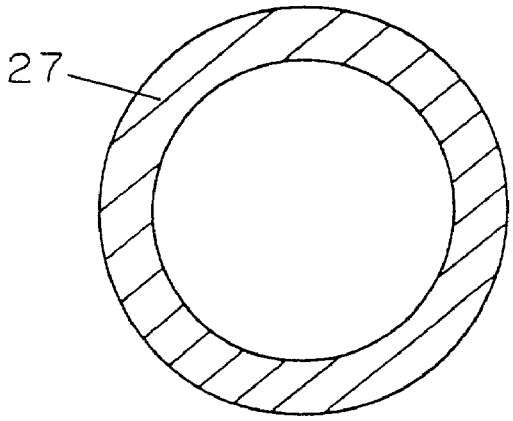
FIG. 11 is a sectional view taken on line B—B when the hermetic-type compressor in accordance with embodiment 4 of the present invention operates at low outside-air temperature.

FIG. 9 is a sectional view showing the hermetic-type compressor in accordance with embodiment 4 of the present invention. FIG. 10 is a sectional view taken on line B—B of FIG. 9 when the hermetic-type compressor in accordance with embodiment 4 of the present invention operates at high outside-air temperature. FIG. 11 is a sectional view taken on line B—B of FIG. 9 when the hermetic-type compressor in accordance with embodiment 4 of the present invention operates at low outside-air temperature. In the hermetic-type compressor of embodiment 4, components having the same functions and configurations as those of the hermetic-type compressor of the above-mentioned embodiment 1, embodiment 2 or embodiment 3 are designated by the same marks, and their descriptions are omitted.

In FIG. 9, a suction hole 19*a* is formed in a valve plate 19 secured to the end surface of the cylinder 10 of a mechanical portion 6, and one end of a suction pipe 27 is directly connected to the suction hole 19*a*. The other end of the suction pipe 27 is disposed in the space inside an enclosed container 2 as an opening end 27*a*. The suction pipe 27 is formed of a material having a high coefficient of linear expansion.

Next, the operation of the hermetic-type compressor of embodiment 4 having the above-mentioned configuration is described below.

A pressure wave generated in the cylinder 10 passes through the suction hole 19*a* of the valve plate 19, propagates in the direction opposite to the flow of refrigerant gas, and becomes a reflected wave having an inverse phase in the space inside the enclosed container 2. This reflected wave propagates in the same direction as that of the flow of the refrigerant gas, and returns to the suction hole 19*a*.

By aligning the time when this reflected wave reaches the suction hole 19*a* with the time when the volume inside the cylinder 10 becomes maximum (suction completion time), the pressure energy of the reflected wave is added to the refrigerant gas at the suction completion time, and the suction pressure of the refrigerant gas rises.

Therefore, refrigerant gas having a higher density is charged into the cylinder 10, the discharge amount of refrigerant per a compression stroke increases, the circulation amount of refrigerant increases, and refrigeration capability can be improved significantly.

At that time, the pressure wave generated in the cylinder 10 generates shock sound. However, since the wavelengths of the pressure wave and the reflected wave change depending on the velocity of sound, the timing of adding the pressure energy of the reflected wave at the suction completion time generates an error, and the rising ratio of the suction pressure of the refrigerant gas lowers.

Accordingly, as shown in FIG. 10, when the velocity of sound in the refrigerant gas is high, the suction pipe 27 formed of a material having a high coefficient of linear expansion expands due to high temperature, and the inner cross-sectional area of the suction pipe 27 increases.

In this way, as the velocity of sound in the refrigerant gas increases, and the wavelength of the reflected wave changes, the inner cross-sectional area of the suction pipe 27 increases. As a result, the flow velocity of the refrigerant gas is lowered, and the return timing of the reflected wave is delayed, whereby the time when the reflected wave reaches the suction hole 19*a* can be aligned with the time when the volume inside the cylinder 10 becomes maximum (suction completion time). Therefore, in the hermetic-type compressor of embodiment 4, the pressure energy of the reflected wave can be added to the refrigerant gas at the suction completion time, and the suction pressure of the refrigerant gas can be raised.

When the velocity of sound in the refrigerant gas is low due to low outside-air temperature as shown in FIG. 11, the suction pipe 27 formed of a material having a high coefficient of linear expansion shrinks due to a drop in temperature, and the inner cross-sectional area of the suction pipe 27 decreases.

In this way, when the velocity of sound in the refrigerant gas decreases, the inner cross-sectional area of the suction pipe 27 decreases, the flow velocity of the refrigerant gas is raised, and the return timing of the reflected wave is advanced, whereby the time when the reflected wave reaches the suction hole 19*a* can be aligned with the time when the volume inside the cylinder 10 becomes maximum (suction completion time). Therefore, the pressure energy of the reflected wave can be added to the refrigerant gas at the suction completion time, and the suction pressure of the refrigerant gas can be raised. However, since the inner cross-sectional area of the suction pipe 27 decreases, the pressure energy of the reflected wave decreases slightly, and the effect of raising the suction pressure is lowered slightly.

However, when outside-air temperature is low and it is not necessary to greatly improve refrigeration capability in comparison with the time when outside-air temperature is high, the inner cross-sectional area of the suction pipe 27 decreases. In this way, the effect of refrigeration capability decreases slightly; however, a room is often closed in winter during which outside-air temperature is low, and noise becomes more annoying than in summer; in the hermetic-type compressor of embodiment 4, the inner cross-sectional area of the suction pipe 27 is decreased, and shock sound is prevented significantly, whereby noise can be reduced greatly.

Therefore, by changing the inner cross-sectional area of the suction pipe 27, even when the velocity of sound in the refrigerant gas is changed due to a change in outside-air temperature, the time when the reflected wave reaches the suction hole 19*a* can always be aligned with the time when the volume inside the cylinder 10 becomes maximum (suction completion time). Therefore, in the hermetic-type compressor of embodiment 4, the pressure energy of the reflected wave can be added to the refrigerant gas at the suction completion time, and the suction pressure of the refrigerant gas can be raised, whereby the discharge amount of refrigerant per a compression stroke increases, and the circulation amount of refrigerant increases, and refrigeration capability is improved.

In comparison with the time when outside-air temperature is high, during the time when outside-air temperature is low, and refrigeration capability is not required to be improved greatly, the inner cross-sectional area of the suction pipe 27 decreases, the improvement of the refrigerating capability decreases slightly. However, the inner cross-sectional area of the suction pipe 27 decreases as outside-air temperature lowers. Therefore, in the hermetic-type compressor of embodiment 4, noise generation can be prevented significantly.

As described above, in the hermetic-type compressor of embodiment 4, the one end of the suction pipe 27 is open in the space inside the enclosed container 2, and the other end is directly connected to the suction hole 19*a* of the valve plate 19, and the suction pipe 27 is formed of a material having a high coefficient of linear expansion. Therefore, even when outside-air temperature changes, and the velocity of sound in the refrigerant gas changes, by changing the inner cross-sectional area of the suction pipe 27 depending on a change in outside-air temperature, the time when the reflected wave reaches the suction hole 19*a* can always be aligned with the time when the volume inside the cylinder 10 becomes maximum (suction completion time). Therefore, in the hermetic-type compressor of embodiment 4, the pressure energy of the reflected wave can be added to the refrigerant gas at the suction completion time, and the suction pressure of the refrigerant gas can be raised. Therefore, in the hermetic-type compressor of embodiment 4, the discharge amount of refrigerant per a compression stroke increases, and the circulation amount of refrigerant increases, and refrigeration capability is improved.

When outside-air temperature is low and it is not necessary to greatly improve refrigeration capability in comparison with the time when outside-air temperature is high, the inner cross-sectional area of the suction pipe 27 decreases. Therefore, in the hermetic-type compressor of embodiment 4, the inner cross-sectional area of the suction pipe 27 can be decreased as outside-air temperature is lowered, although the improvement of refrigeration capability is decreased slightly. Therefore, in the hermetic-type compressor of embodiment 4, noise can be reduced significantly.

In embodiment 4, it is assumed that the temperature of the refrigerant gas is changed by outside-air temperature, and the velocity of sound in the refrigerant gas is changed. However, the hermetic-type compressor of embodiment 4 is useful even when the pressure or the like changes, provided that the velocity of sound in the refrigerant gas changes.

In embodiment 4, in the mechanism for changing the inner cross-sectional area of the suction pipe 27, the suction pipe 27 is formed of a material having a high coefficient of linear expansion. However, i f an adjustment mechanism for changing the inner cross-sectional area of the suction pipe 27 depending on a change in the velocity of sound in the refrigerant gas is used, it is needless to say that the same effect as that of embodiment 4 can be obtained.

EMBODIMENT 5

Next, embodiment 5, an example of the hermetic-type compressor of the present invention, will be described below referring to the accompanying drawings.

Figure 12:
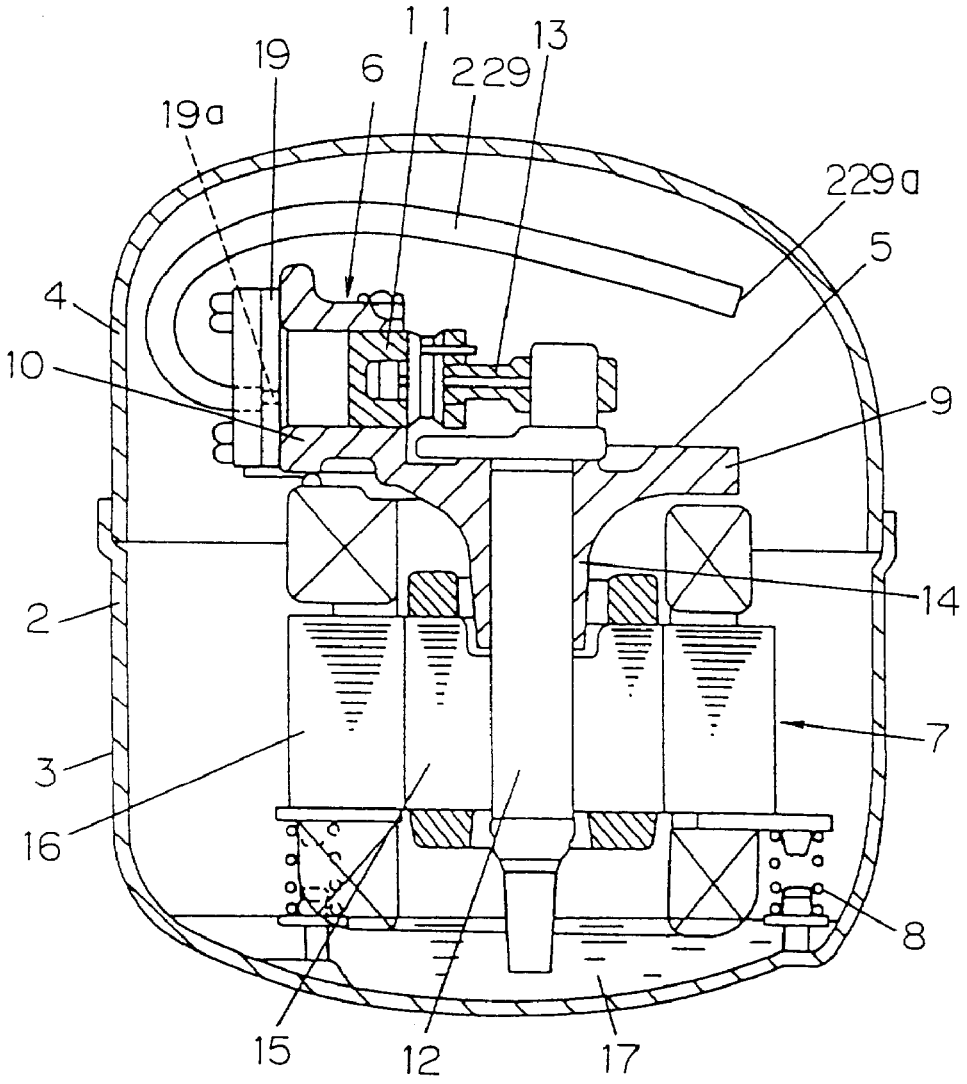
FIG. 12 is a vertical sectional view showing a hermetic-type compressor in accordance with embodiment 5 of the present invention.
Figure 13:
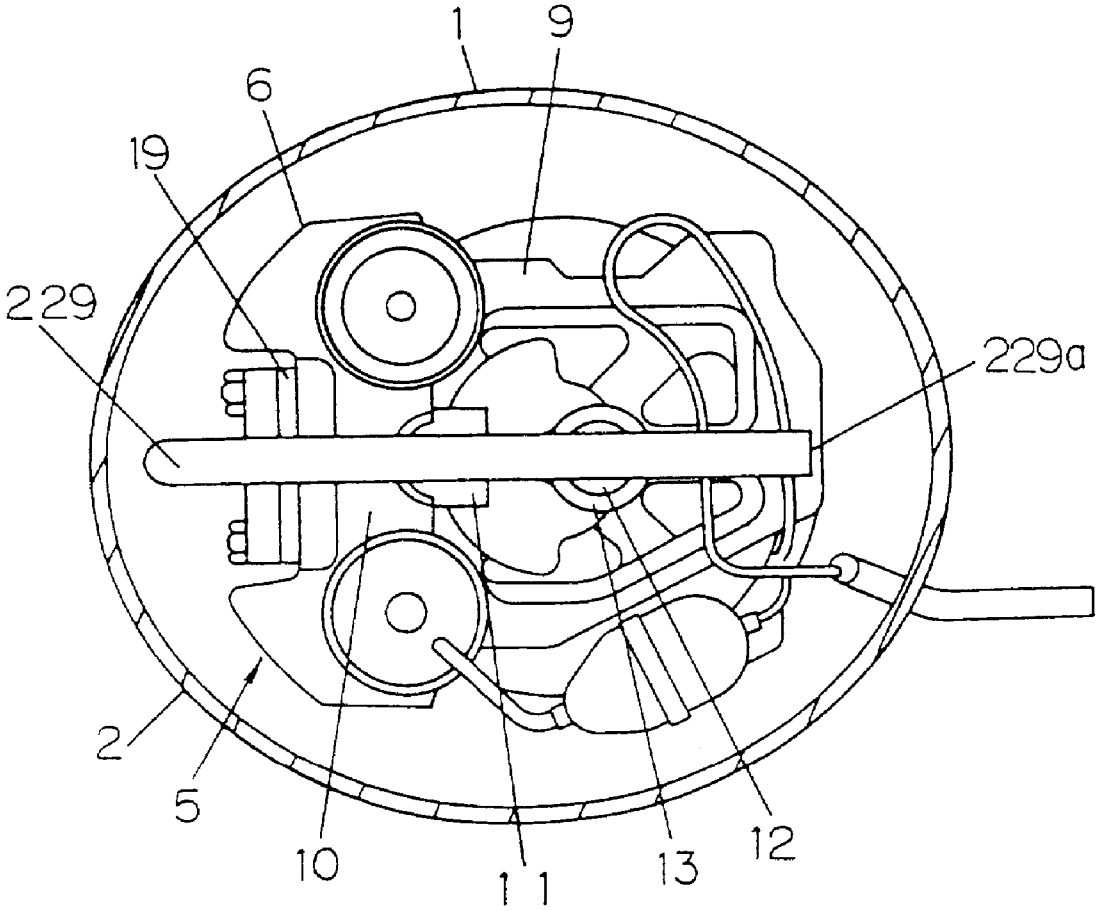
FIG. 13 is a plan sectional view showing the hermetic-type compressor in accordance with embodiment 5 of the present invention.
Figure 14:
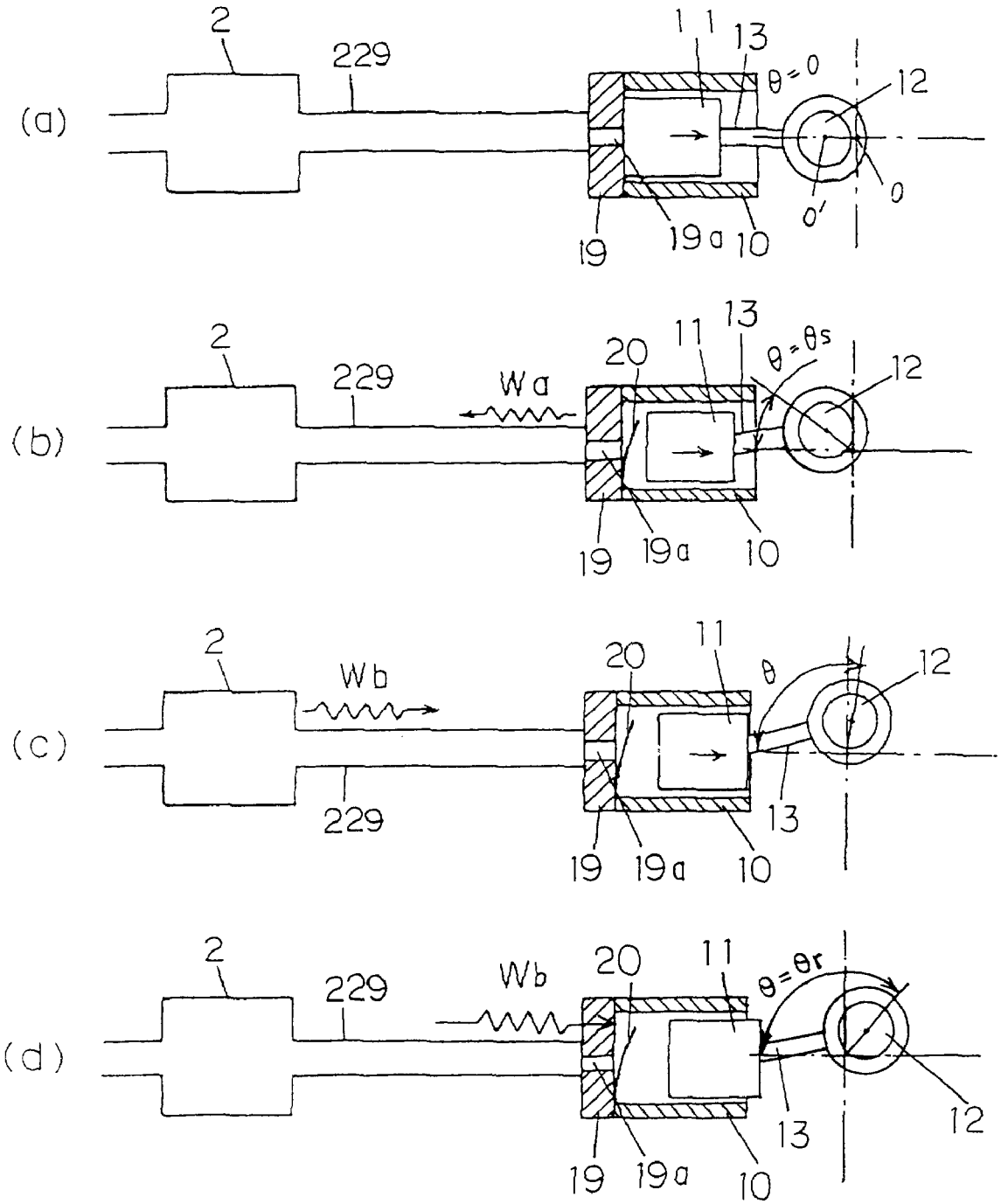
FIG. 14 is an explanatory view showing movements of refrigerant gas in the hermetic-type compressor in accordance with embodiment 5 of the present invention.

FIG. 12 is an explanatory view showing the behavior of refrigerant gas in the hermetic-type compressor of embodiment 5 of the present invention. FIG. 13 is a vertical sectional view showing the hermetic-type compressor of embodiment 5. FIG. 14 is an explanatory view showing the relationship between the behavior of refrigerant gas and a crankshaft in the hermetic-type compressor of embodiment 5. In the hermetic-type compressor of embodiment 5, components having the same functions and configurations as those of the hermetic-type compressor of each of the above-mentioned embodiments are designated by the same marks, and their descriptions are omitted.

In FIGS. 12 and 13, a suction hole 19*a* is formed in a valve plate 19 secured to the end surface of the cylinder 10 of a mechanical portion 6, and one end of a suction pipe 229 is directly connected to this suction hole 19*a*. The other end of the suction pipe 229 is disposed in the space inside an enclosed container 2 as an opening end 229*a*.

In FIG. 14, at the start of a suction stroke (at the time shown in (a) of FIG. 14), a crankshaft 12 is at a reference position, and the suction hole 19*a* of the valve plate 19 is clogged. Therefore, the flow of refrigerant gas is stopped.

Next, the crankshaft 12 rotates, a piston 11 moves to the right, and the volume inside the cylinder 10 increases abruptly. As a result, a pressure difference generates between the space inside the cylinder 10 and the space inside the enclosed container 2, and a suction lead 20 begins to open (at the time of (b) in FIG. 14). The rotation position (hereinafter referred to as a crank angle) of the crankshaft 12 at this time is represented by θs (rad).

The suction lead 20 opens, and refrigerant gas begins to flow rightward (toward the cylinder 10) in the suction pipe 229. At the same time, since the volume inside the cylinder 10 increases abruptly, a pressure wave Wa generates in the cylinder 10. The pressure wave Wa inside the cylinder 10 propagates via the suction hole 19*a*, an opening, into the suction pipe 229 toward the space inside the enclosed container 2 in the direction opposite to the flow of the refrigerant gas.

The pressure wave Wa having reached the space inside the enclosed container 2 becomes an inverted reflected wave Wb in the space inside the enclosed container 2 wherein the refrigerant gas is in a stagnant condition. The reflected wave Wb propagates into the suction pipe 229 in the same direction as the that of the flow of the refrigerant gas (at the time of (c) in FIG. 14).

Then, the reflected wave Wb propagates in the same direction as the flow of the refrigerant gas, and returns to the suction hole 19*a* of the valve plate 19 (at the time of (d) in FIG. 14).

When it is assumed that the crank angle at the top dead center shown in (a) of FIG. 14 is 0 (rad), that the crank angle at the opening start ((b) in FIG. 14) of the suction lead 20 is θs (rad), that the length of the suction pipe 229 is L (m), that the rotation number of the crankshaft 12 is f (Hz), that the velocity of sound in the refrigerant gas to be sucked into the suction pipe 229 is As (m/sec), and that the crank angle wherein the pressure wave generated at the suction hole 19*a* at the start of suction returns to the suction hole 19*a* as a reflected wave is θr (rad), the relationship among these is represented by the following equation (equation 1).

$$\theta r = \theta s + 4\pi \times L \times f / As \quad \text{(Equation 1)}$$

$$1.4\ (\text{rad}) \leqq \theta r \leqq 3.0\ (\text{rad}) \quad \text{(Equation 2)}$$

At this time, the length L and the like of the suction pipe 229 are adjusted so that the crank angle θr at the return of the pressure wave is within range of equation 2.

Next, the operation of the hermetic-type compressor of embodiment 5 having the above-mentioned configuration is described below.

The pressure wave Wa having generated just when the suction lead 20 opens at a suction stroke propagates in the direction opposite to the flow of the refrigerant gas. Further, the wave becomes a reflected wave Wb having an inverse phase in the space inside the enclosed container 2, the wave propagates in the same direction as the flow of the refrigerant gas, and returns to the suction hole 19*a*. In addition, since the reflected wave Wb has a width, the leading end of the reflected wave returns to the suction hole 19*a* at the crank angle θr represented by (equation 1). Furthermore, when the crank angle advances further after that, the trailing end of the reflected wave Wb returns to the suction hole 19*a*, and the return of the reflected wave Wb having the width is completed.

Next, the relationship between the crank angle at the return of the reflected wave Wb to the suction hole 19*a* and the improvement effect of refrigeration capability is described below by taking the length of the suction pipe 229 as an example.

When the length L of the suction pipe 229 is short, the crank angle θr at the return of the reflected wave Wb becomes small as understood from (equation 1); that is, the reflected wave Wb returns at advanced timing of a suction stroke. Therefore, the entire reflected wave Wb having the width can completely return to the suction hole 19*a* before the suction stroke is completed. In this case, after the return of the reflected wave Wb is completed, the pressure at the suction hole 19*a* lowers, whereby the suction lead 20 may be closed or the refrigerant gas may flow backward from the cylinder 10 to the suction pipe 229 even in the middle of the suction stroke. Therefore, the density of the refrigerant gas to be sucked into the cylinder 10 cannot be raised sufficiently, and the improvement effect of refrigerating capability is lowered.

On the other hand, when the length L of the suction pipe 229 is long, the reflected wave Wb returns at delayed timing of the suction stroke, or the wave returns after the suction stroke is completed. Therefore, the suction stroke is completed before the entire reflected wave Wb having the width returns completely to the suction hole 19*a,* whereby the density of the refrigerant gas to be sucked into the cylinder 10 cannot be raised sufficiently, and the improvement effect of refrigerating capability is lowered.

As described above, when the suction pipe 229 is too short or too long, the improvement effect of refrigeration capability is lowered. There is an optimal value in the length of the suction pipe 229, which offers the maximum improvement effect of refrigeration capability, that is, an optimal crank angle Or for the return of the reflected wave Wb. However, since the reflected wave Wb has a width, the crank angle for the return of the reflected wave, which offers a nearly maximum improvement effect of refrigeration capability, also has a width. In the case of a reciprocating hermetic-type compressor, when the crank angle θr for the return of the reflected wave is within the range of (equation 2), a nearly maximum improvement effect of refrigeration capability can be obtained.

When the refrigerant is HFC-134a, when the pressure of the refrigerant gas to be sucked is 0.085 (MPa), and when the temperature of the refrigerant gas is 80° C., for example, the velocity of sound As is 176.3 (m/s). And when it is assumed that the rotation number f of the crankshaft 12 is 58.5 (Hz), and that the crank angle θs is 0.96 (rad) at the opening start of the suction lead 20, the length L of the suction pipe 229 should be set at 0.10 to 0.48 (m) in order to satisfy (equation 2).

In this way, in the hermetic-type compressor of embodiment 5 of the present invention, since the length and the like of the suction pipe 229 are adjusted so that the crank angle for the return of the reflected wave is optimal, the improvement effect of refrigeration capability can be obtained up to the maximum.

As described above, the hermetic-type compressor of embodiment 5 of the present invention is configured so that the crank angle θr (rad) for the return of the pressure wave generated at the suction hole 19*a* at the start of suction, which is represented by (equation 1), is within the range of (equation 2), provided that the crank angle at the opening start of the suction lead 20 is θs (rad), that the length L of the suction pipe 229 is L (m), that the rotation number of the crankshaft 12 is f, and that the velocity of sound in the refrigerant gas to be sucked into the suction pipe 229 is As (m/sec).

Therefore, in the hermetic-type compressor of embodiment 5, the crank angle for the return of the reflected wave Wb to the suction hole 19*a* becomes optimal, and the suction pressure is raised, whereby the maximum improvement effect of the refrigerating capability can be obtained.

In case the velocity of sound differs because of differences in the type of refrigerant, and the pressure and temperature of refrigerant gas to be sucked, the same effect as that of the above-mentioned embodiment 5 can be obtained by adjusting the length of the suction pipe 229 so that the crank angle for the return of the reflected wave Wb satisfies (equation 2). In addition, even when the rotation frequency of the crankshaft 12 differs, or the crank angle at the opening start of the suction lead 20 differs, the same effect as that of the above-mentioned embodiment 5 can be obtained by adjusting the length of the suction pipe 229 so that the crank angle for the return of the reflected wave Wb satisfies (equation 2).

EMBODIMENT 6

Next, embodiment 6, an example of the hermetic-type compressor of the present invention, will be described below referring to the accompanying drawings.

Figure 15:
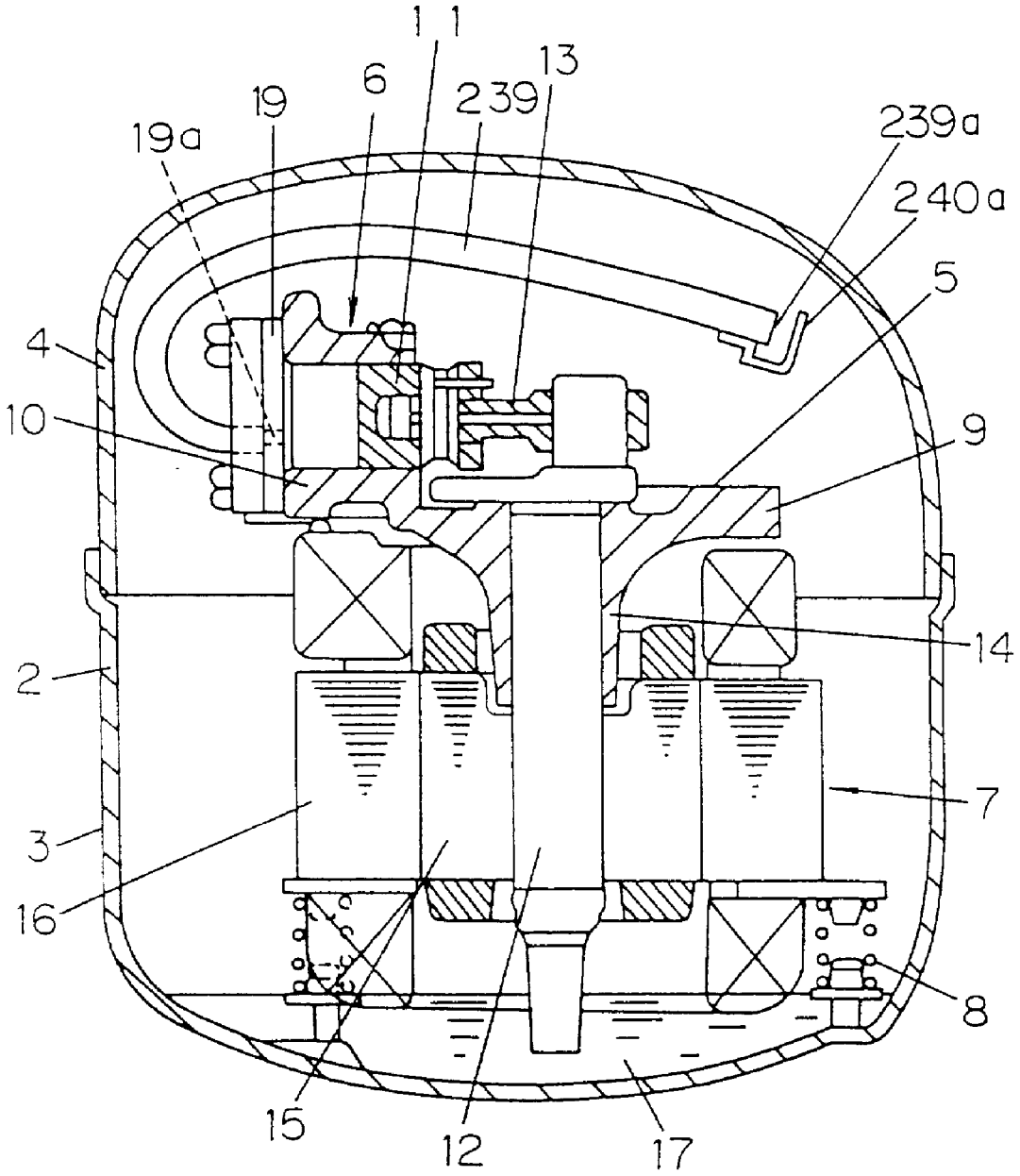
FIG. 15 is a vertical sectional view showing a hermetic-type compressor in accordance with embodiment 6 of the present invention.
Figure 16A:
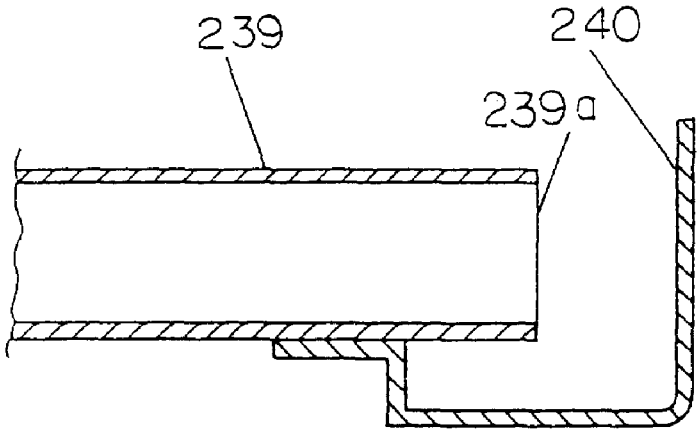
FIG. 16A is a sectional view showing an area near the opening of a suction pipe at low outside-air temperature in embodiment 6 of the present invention.
Figure 16B:
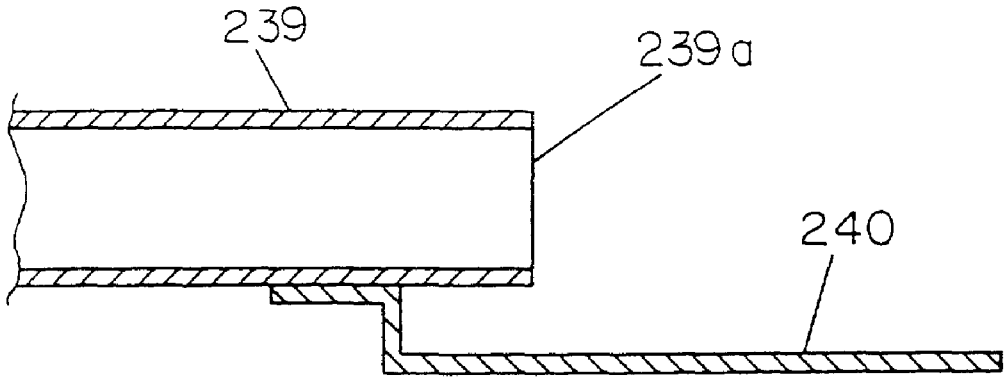
FIG. 16B is a sectional view showing the area near the opening of the suction pipe at high outside-air temperature in embodiment 6 of the present invention.

FIG. 15 is a vertical sectional view showing the hermetic-type compressor in accordance with embodiment 6 of the present invention. FIG. 16A is a sectional view showing an area near the opening of a suction pipe at low outside-air temperature in embodiment 6 of the present invention. FIG. 16B is a sectional view showing the area near the opening of the suction pipe at high outside-air temperature in embodiment 6 of the present invention. In the hermetic-type compressor of embodiment 6, components having the same functions and configurations as those of the hermetic-type compressor of each of the above-mentioned embodiments are designated by the same marks, and their descriptions are omitted.

In FIGS. 15, 16A and 16B, a suction hole 19*a* is formed in a valve plate 19 secured to the end surface of the cylinder 10 of a mechanical portion 6, and one end of a suction pipe 239 is directly connected to the suction hole 19*a*. The other end of the suction pipe 239 is disposed in the space inside an enclosed container 2 as an opening end 239*a*.

As shown in FIGS. 16A and 16B, a reflection prevention plate 240 is provided near the opening end 239*a* of the suction pipe 239 in the space inside the enclosed container 2. This reflection prevention plate 240 is a bendable plate formed of a bimetal, a shape-memory alloy or the like.

Next, the operation of the hermetic-type compressor of embodiment 6 having the above-mentioned configuration is described below.

Generally, at low outside-air temperature, no refrigeration apparatus is required to have high refrigeration capability. However, if a more than necessary circulation amount of refrigerant is supplied by a hermetic-type compressor, suction pressure lowers, and discharge pressure rises, whereby the efficiency of an entire refrigeration system including the hermetic-type compressor is lowered, and as a result the overall electric power consumption increases. Therefore, if the circulation amount of refrigerant can be decreased at low outside-air temperature, the overall electric power consumption can be decreased.

In the hermetic-type compressor of embodiment 6, when outside-air temperature is low, the temperature at each portion is lowered as a whole, and the temperature of the reflection prevention plate 240 is also lowered. In that case, the reflection prevention plate 240 has a shape so as to face the opening end 239*a* of the suction pipe 239 in the space inside the enclosed container 2 as shown in FIG. 16A. In the condition shown in FIG. 16A, the pressure wave generated just when the suction lead 20 opens propagates in the direction opposite to the flow of refrigerant gas, and reaches the opening end 239*a* of the suction pipe 239. At this time, because of the presence of the reflection prevention plate 240, the reflection of the pressure wave at a complete free end cannot be performed. In addition, since a gap is present between the opening end 239*a* of the suction pipe 239 and the reflection prevention plate 240, reflection at a stationary end cannot be performed either.

Therefore, at low outside-air temperature, because of the reflection prevention plate 240, the pressure wave is not reflected by the opening end 239*a* of the suction pipe 239, whereby the improvement effect on the circulation amount of refrigerant cannot be obtained, and the electric power consumption of the hermetic-type compressor of embodiment 6 can be decreased.

Furthermore, since the temperature of the reflection prevention plate 24 becomes high at high outside-air temperature, the reflection prevention plate 24 formed of a bimetal, a shape-memory alloy or the like is deformed as shown in FIG. 5, and does not face the opening portion of the suction pipe. Therefore, at high outside-air temperature at which high refrigeration capability is required, the pressure wave is reflected at the opening of the suction pipe 239 in a conventional way without being obstructed by the reflection prevention plate 24, and the improvement effect of refrigeration capability can be obtained.

As described above, in the hermetic-type compressor of embodiment 6, the one end of the suction pipe 239 is open in the space inside the enclosed container 2, and the other end is directly connected to the suction hole 19*a,* the reflection prevention plate 24 formed of a bimetal, a shape-memory alloy or the like is provided so as to face the opening end 239*a* of the suction pipe 239.

Therefore, in the hermetic-type compressor of embodiment 6, its electric power consumption is decreased by not allowing the improvement effect of refrigeration capability to be obtained at low outside-air temperature at which no high refrigeration capability is required. On the other hand, at high outside-air temperature at which high refrigeration capability is required, the hermetic-type compressor of embodiment 6 is configured so as to obtain the improvement effect of refrigeration capability in a conventional way.

As described above, the overall electric power consumption can be decreased by controlling refrigeration capability.

EMBODIMENT 7

Next, embodiment 7, an example of the hermetic-type compressor of the present invention, will be described below referring to the accompanying drawings.

Figure 17:
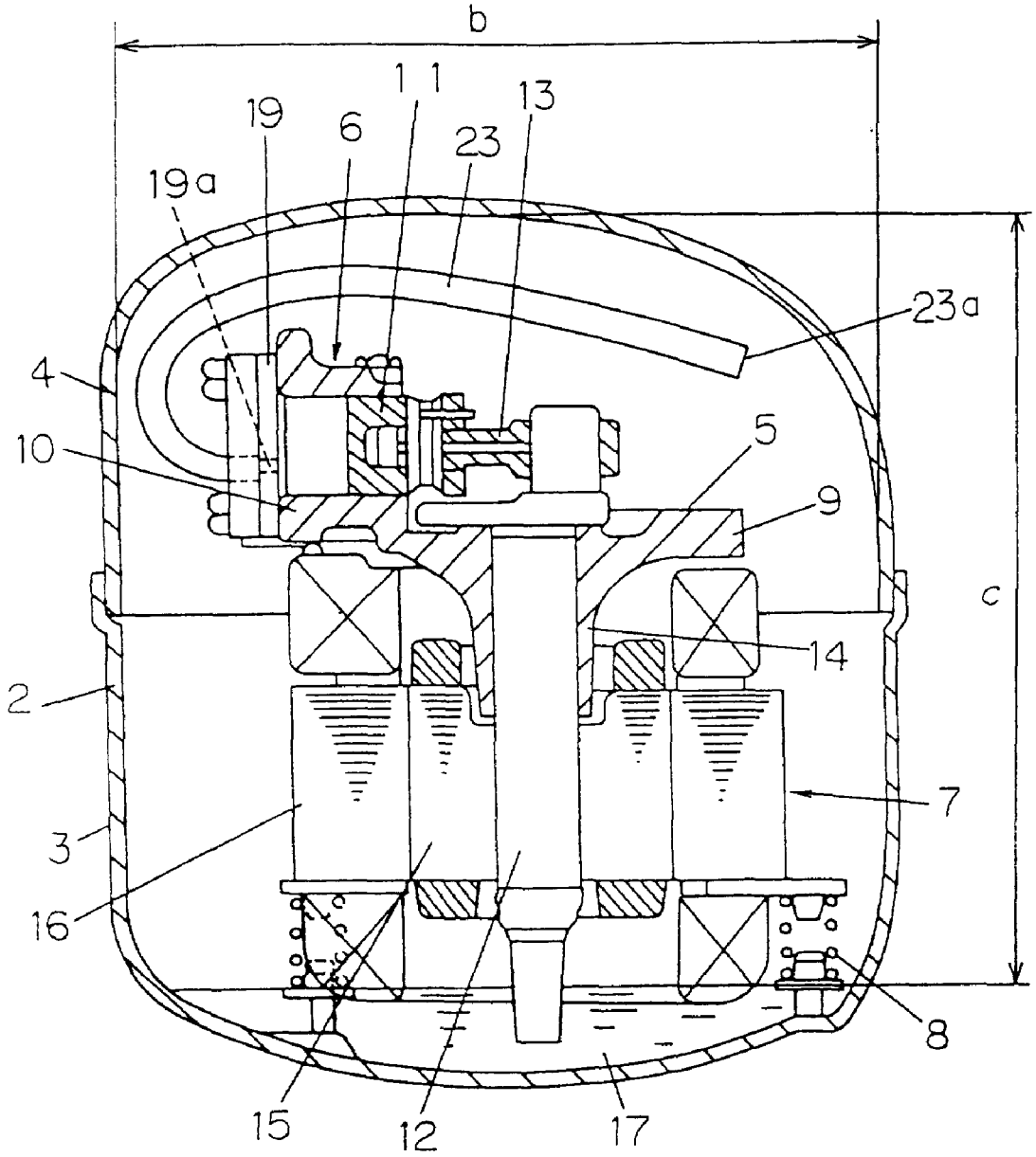
FIG. 17 is a vertical sectional view showing a hermetic-type compressor in accordance with embodiment 7 of the present invention.
Figure 18:
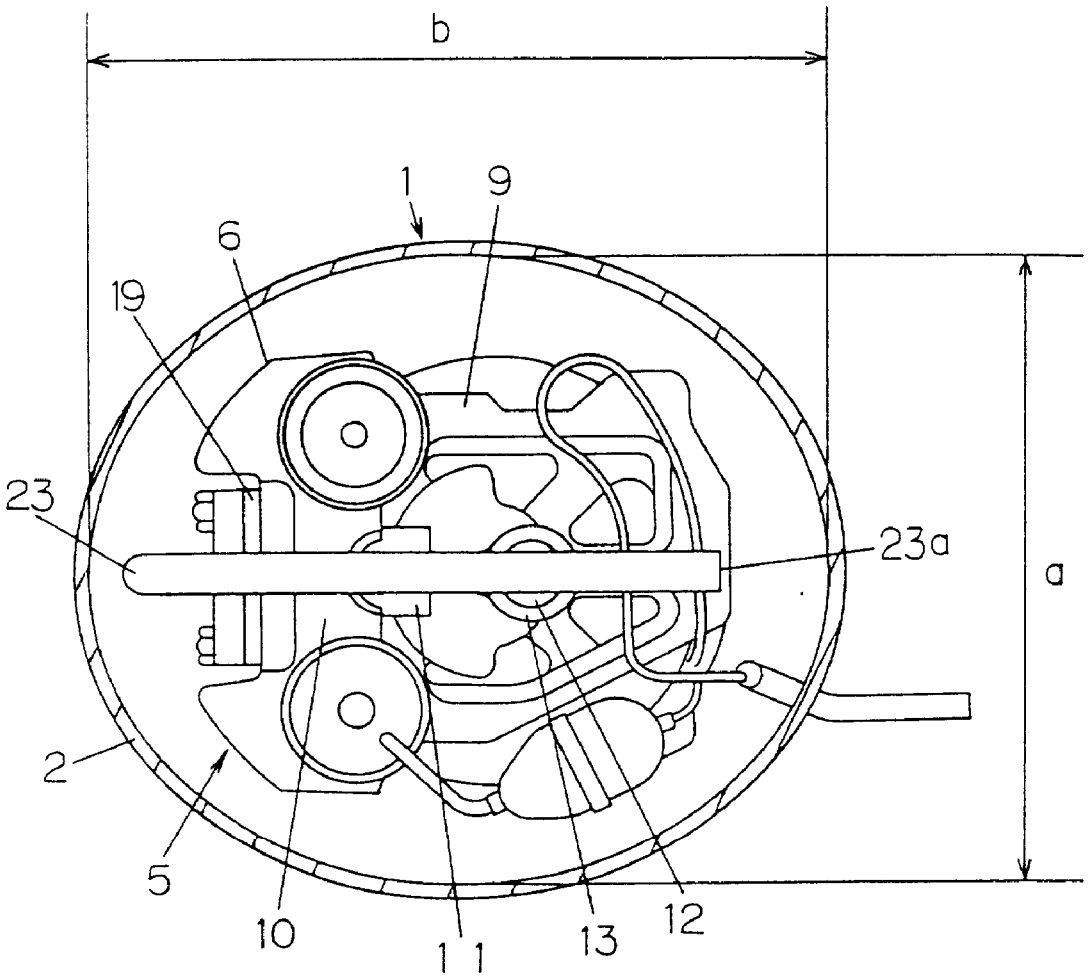
FIG. 18 is a plan sectional view showing the hermetic-type compressor in accordance with embodiment 7 of the present invention.

FIG. 17 is a vertical sectional view showing the hermetic-type compressor in accordance with embodiment 7 of the present invention. FIG. 18 is a plan sectional view showing the hermetic-type compressor of embodiment 7 of the present invention. In the hermetic-type compressor of embodiment 7, components having the same functions and configurations as those of the hermetic-type compressor of each of the above-mentioned embodiments are designated by the same marks, and their descriptions are omitted.

In FIGS. 17 and 18, a suction hole 19*a* is formed in the valve plate 19 secured to the end surface of the cylinder 10 of a mechanical portion 6, and one end of a suction pipe 23 is directly connected to this suction hole 19*a*. The other end of the suction pipe 23 is disposed in the space inside an enclosed container 2.

In FIGS. 17 and 18, the enclosed container 2 comprises a lower shell 3 and an upper shell 4. Mark a in FIG. 18 represents the maximum distance in a direction perpendicular to the reciprocating direction of a piston 11 inside the enclosed container 2, and mark b represents the maximum distance in the reciprocating direction of the piston 11 inside the enclosed container 2. Mark c in FIG. 17 represents the maximum distance in the axial direction of a crankshaft 12 from the inner surface of the enclosed container 2 to the surface of lubricant 17. Corresponding to the lengths of these a, b and c, the refrigerant gas in the enclosed container 2 has natural resonance frequencies in the corresponding directions. In the hermetic-type compressor of embodiment 7, the distances a, b and c have been adjusted so that those resonance frequencies are not close to integral multiples of the rotation number of the crankshaft 12.

Next, the operation of the hermetic-type compressor of embodiment 7 having the above-mentioned configuration is described below.

The pressure wave generated just when a suction lead 20 opens during a suction stroke propagates in the direction opposite to the flow of refrigerant gas, becomes a reflected plate having an inverse phase in the space inside the enclosed container 2, and propagates in the same direction as the flow of the refrigerant gas, and then returns to the suction hole 19*a*.

If the refrigerant gas in the enclosed container 2 causes resonance, noise increases; in addition, when the above-mentioned pressure wave is reflected at the opening end 23*a* of the suction pipe 23, loss occurs due to the resonance of the refrigerant gas in the enclosed container 2, that is, due to the influence of a standing wave. Therefore, the pressure amplitude of the reflected wave becomes small, and the rising ratio of suction pressure decreases, and the improvement effect of refrigeration capability decreases.

The refrigerant gas in the enclosed container 2 causes resonance when the resonance frequency in the enclosed container 2 is nearly equal to an integral multiple of the operation frequency of the hermetic-type compressor, that is, a vibration frequency.

Generally, in the resonance generated between walls facing opposite to each other, the following relationship (equation 3) is established among the distance Lw between the two walls, resonance frequency fr and the velocity of sound Ac in a medium.

$$Lw=Ac/(2fr) \quad \text{(Equation 3)}$$

When this relationship (equation 3) is applied to the hermetic-type compressor, Lw corresponds to the distance between the inner surfaces of the enclosed container 2, fr corresponds to a resonance frequency capable of being generated between the opposed inner surfaces of the enclosed container 2, and Ac corresponds to the velocity of sound in the enclosed container 2. In other words, no resonance occurs when the lengths a, b and c in the above-mentioned directions inside the enclosed container 2 are determined so that the resonance frequency of the enclosed container 2 is not close to an integral multiple of the operation frequency. In actual practice, however, since a slight dislocation from Lw calculated in (equation 3) occurs due to the influence of the mechanical portion 6 (equation 3), a motor portion 7 and the like in the enclosed container 2, it is necessary to multiply a correction factor obtained in comparison with the result of acoustic experiments or numeric analysis; the correction value has been known as 0.977 on the basis of the acoustic experiments and numerical analysis conducted by the inventors. Therefore, no resonance occurs if the lengths a, b and c in the corresponding directions are determined in consideration of this correction value. In this way, since the refrigerant gas in the enclosed container 2 does not cause resonance in the hermetic-type compressor of embodiment 7, generation of resonance sound is prevented, and the pressure amplitude is prevented from decreasing when the pressure wave is reflected at the opening end 23*a* of the suction pipe 23, whereby the suction pressure is raised at all times, and the improvement effect of refrigeration capability can be obtained.

As described above, since the hermetic-type compressor of embodiment 7 is configured so that the resonance frequency of the refrigerant gas in the enclosed container 2 is not close to an integral multiple of the rotation number of the crankshaft 12, the refrigerant gas in the enclosed container 2 does not cause resonance. Therefore, the hermetic-type compressor of embodiment 7 prevents resonance sound from generating, and also prevents pressure amplitude from decreasing when the pressure wave is reflected at the opening end 23*a* of the suction pipe 23, whereby suction pressure can be raised at all times, and the improvement effect of refrigeration capability can be obtained.

EMBODIMENT 8

Next, embodiment 8, an example of the hermetic-type compressor of the present invention, will be described below referring to the accompanying drawings.

Figure 19:
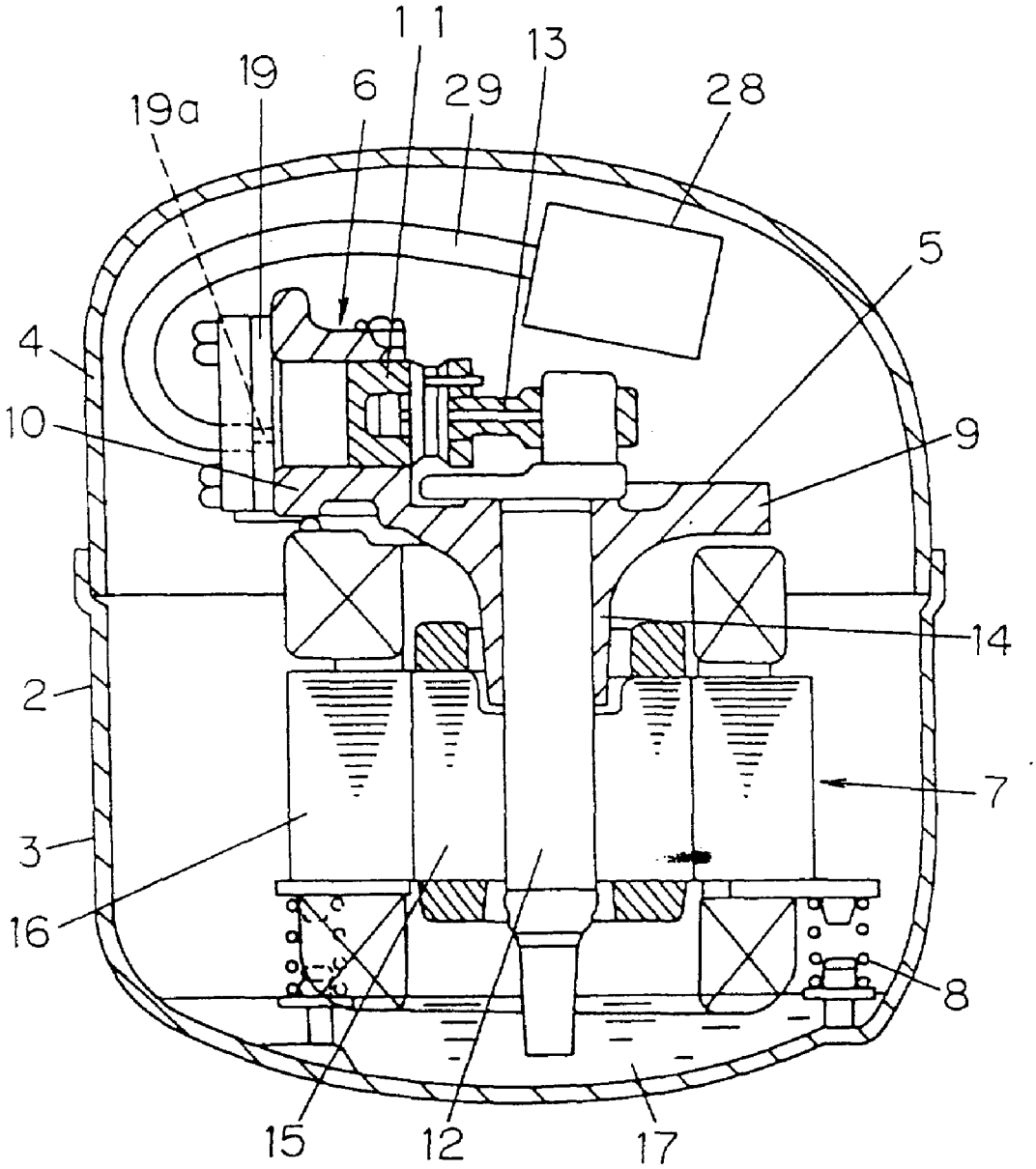
FIG. 19 is a vertical sectional view showing a hermetic-type compressor in accordance with embodiment 8 of the present invention.
Figure 20:
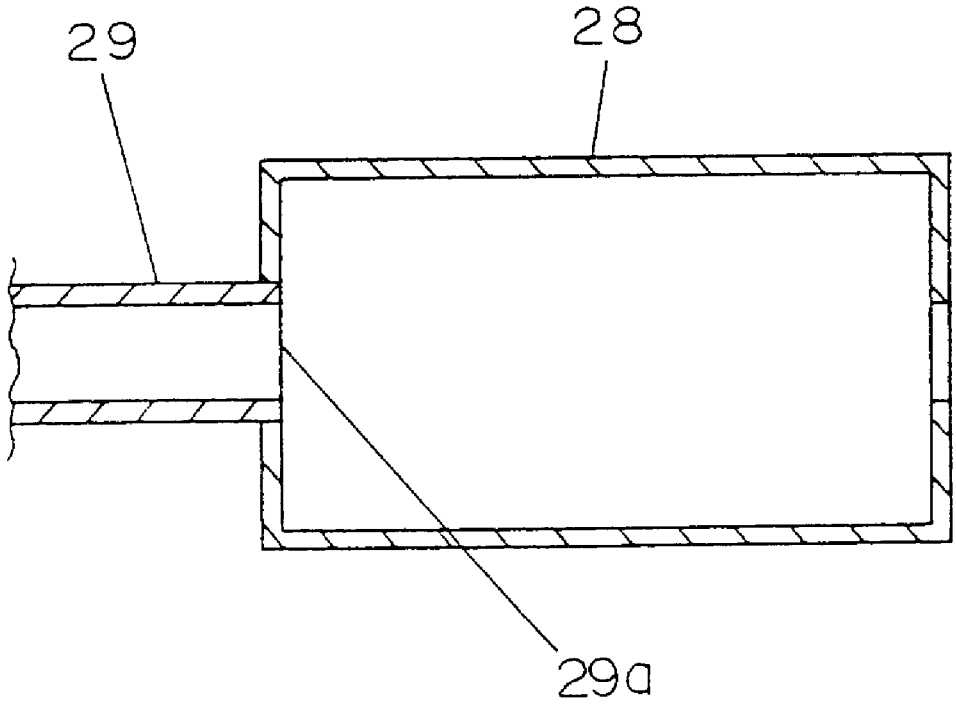
FIG. 20 is a sectional view showing an area near the opening end of the suction pipe and the suction muffler of the hermetic-type compressor in accordance with embodiment 8 of the present invention.

FIG. 19 is a vertical sectional view showing the hermetic-type compressor in accordance with embodiment 8 of the present invention. FIG. 20 is a sectional view showing an area near the opening end of the suction pipe and the suction muffler of the hermetic-type compressor in accordance with embodiment 8 of the present invention. In the hermetic-type compressor of embodiment 8, components having the same functions and configurations as those of the hermetic-type compressor of each of the above-mentioned embodiments are designated by the same marks, and their descriptions are omitted.

In FIGS. 19 and 20, a suction hole 19*a* is formed in a valve plate 19 secured to the end surface of the cylinder 10 of a mechanical portion 6, and one end of the suction pipe 29 is directly connected to the suction hole 19*a*. A suction muffler 28 is provided at the other end of the suction pipe 29.

Next, the operation of the hermetic-type compressor of embodiment 8 having the above-mentioned configuration is described below.

The pressure wave generated just when a suction lead 20 opens at a suction stroke passes through the suction hole 19*a* of the valve plate 19, propagates in the direction opposite to the flow of refrigerant gas, and becomes a reflected wave having an inverse phase in the space inside the suction muffler 28. This reflected wave propagates in the same direction as the flow of the refrigerant gas, and then returns to the suction hole 19*a*.

At this time, even when the refrigerant gas in the enclosed container 2 causes resonance, since the opening end 29*a* of the suction pipe 29 is inside the suction muffler 28, the pressure wave is not affected by the resonance of the refrigerant gas in the enclosed container 2 when the pressure wave is reflected at the opening end 29*a* of suction pipe 29. Therefore, the hermetic-type compressor of embodiment 8 prevents pressure amplitude from attenuating when the pressure wave is reflected. No matter what the resonance frequency in the enclosed container 2 is changed by a change in the shape of the enclosed container 2, operation conditions or the like, suction pressure can be raised and the improvement effect of refrigeration capability can be obtained in the hermetic-type compressor of embodiment 8.

In addition, since the hermetic-type compressor of embodiment 8 has the suction muffler 28, the pulsation of refrigerant gas to be sucked is decreased, the force for vibrating the refrigerant gas in the enclosed container 2 is reduced, whereby in the hermetic-type compressor of embodiment 8 resonance sound can be diminished at all times regardless of the resonance frequency of the refrigerant gas in the enclosed container 2.

As described above, the hermetic-type compressor of embodiment 8 comprises the suction muffler 28 and the suction pipe 29, one end of which is open inside the suction muffler 28 and the other end of which is directly connected to the suction hole 19*a*. Therefore, the hermetic-type compressor of embodiment 8 can reduce the force for vibrating the refrigerant gas in the enclosed container 2 by decreasing the pulsation of the refrigerant gas to be sucked, and thus can diminish the resonance sound at all times regardless of the resonance frequency of the refrigerant gas in the enclosed container 2.

In addition, the hermetic-type compressor of embodiment 8 always prevents the attenuation of the pressure amplitude when the pressure wave is reflected at the opening of the suction pipe 29 regardless of the resonance frequency of the refrigerant gas in the enclosed container 2. Therefore, the hermetic-type compressor of embodiment 8 can raise the suction pressure at all times and can obtain the improvement effect of refrigeration capability regardless of any change in the shape of the enclosed container 2, operation conditions and the like.

EMBODIMENT 9

Next, embodiment 9, an example of the hermetic-type compressor of the present invention, will be described below referring to the accompanying drawings.

Figure 21:
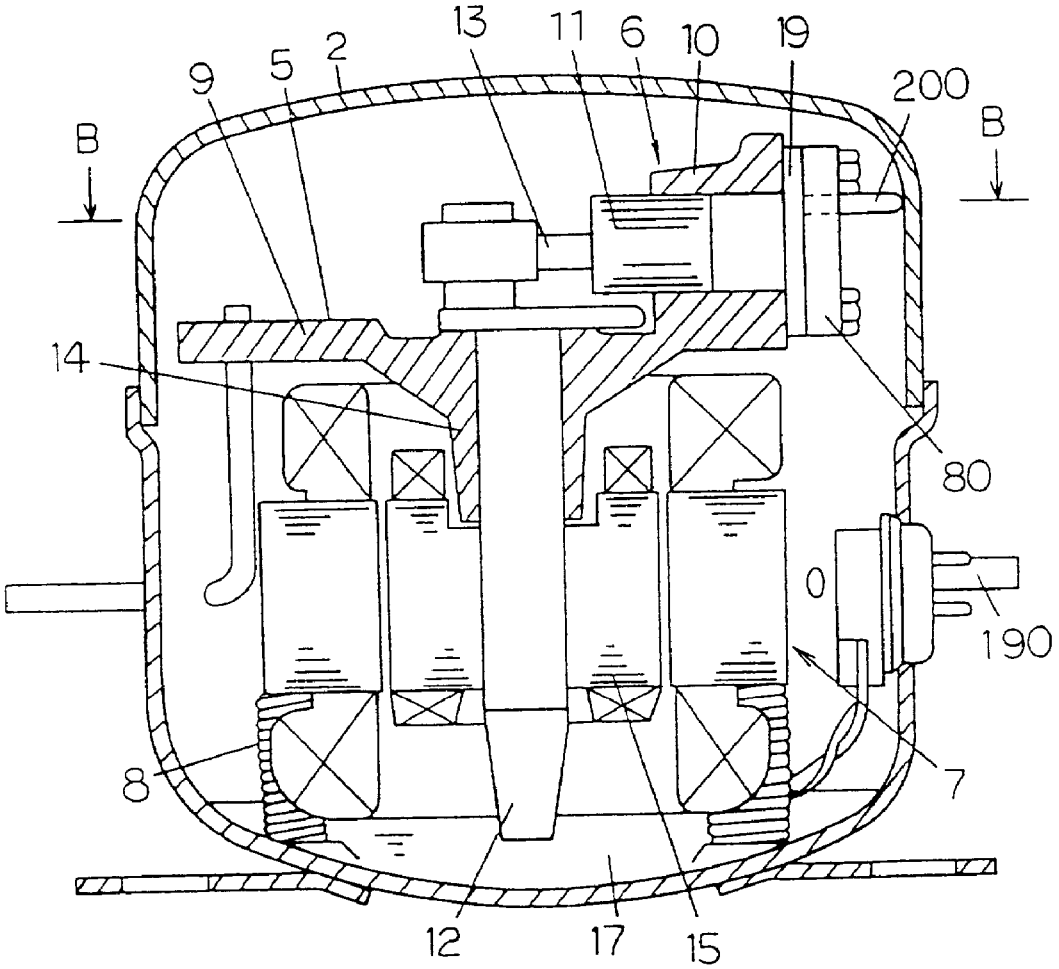
FIG. 21 is a vertical sectional view showing a hermetic-type compressor in accordance with embodiment 9 of the present invention.
Figure 22:
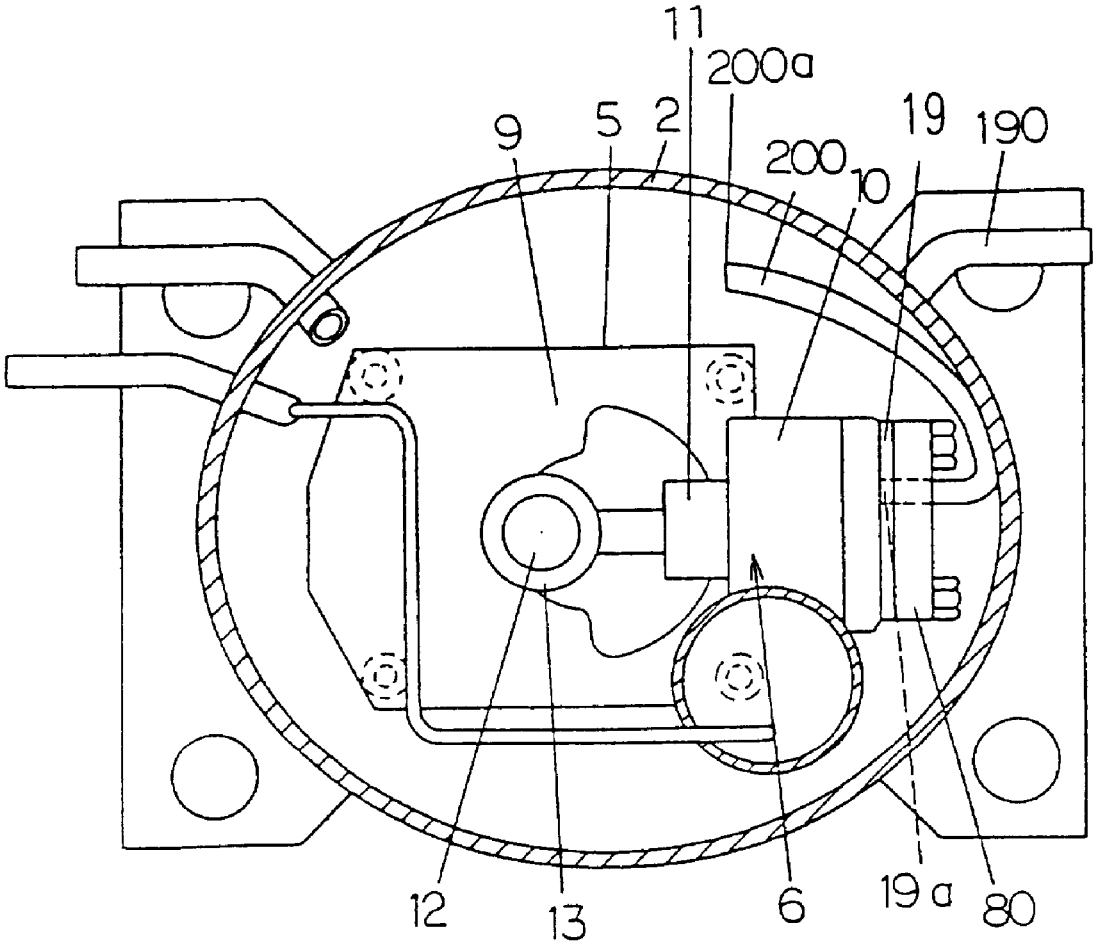
FIG. 22 is a sectional view showing the hermetic-type compressor in accordance with embodiment 9 taken on line B—B of FIG. 21.

FIG. 21 is a vertical sectional view showing the hermetic-type compressor in accordance with embodiment 9 of the present invention. FIG. 22 is a plan sectional view showing the hermetic-type compressor taken on line B—B of FIG. 22. In the hermetic-type compressor of embodiment 9 of the present invention, components having the same functions and configurations as those of the hermetic-type compressor of each of the above-mentioned embodiments are designated by the same marks, and their descriptions are omitted.

In FIGS. 21 and 22, a suction hole 19*a* is formed in a valve plate 19 secured to the end surface of the cylinder 10 of a mechanical portion 6, and one end of a suction pipe 200 is directly connected to this suction hole 19*a*. The other end of the suction pipe 200 is disposed in the space inside an enclosed container 2 as an opening end 200*a*.

At least a part of the suction pipe 200 is formed of a material having low heat conductivity, such as teflon, PBT or the like.

Next, the operation of the hermetic-type compressor of embodiment 9 having the above-mentioned configuration is described below.

The pressure wave generated in the cylinder 10 passes through the suction hole 19*a* of the valve plate 19, propagates in the direction opposite to the flow of refrigerant gas, and becomes a reflected wave having an inverse phase in the space inside the enclosed container 2. This reflected wave propagates in the same direction as the flow of the refrigerant gas, and then returns to the suction hole 19*a*.

By allowing this reflected wave to reach the suction hole 19*a* during a suction stroke, the pressure energy of the reflected wave is added at suction completion time, and the suction pressure of refrigerant gas rises.

Therefore, refrigerant gas having a higher density is charged into the cylinder 10, the discharge amount of refrigerant per a compression stroke increases. As a result, the circulation amount of refrigerant increases, and refrigeration capability can be improved significantly in the hermetic-type compressor of embodiment 9.

Since, in the hermetic-type compressor of embodiment 9, at least a part of the suction pipe 200 is formed of a material having low heat conductivity, such as teflon, PBT or the like, heat is prevented from being conducted to the suction pipe 200 even when the temperature of a cylinder head 80 or the like rises significantly as the passage of time after the start of the hermetic-type compressor, whereby a change in temperature of the suction pipe 200 can be decreased. Therefore, in the hermetic-type compressor of embodiment 9, a change in the velocity of sound in the refrigerant gas in the suction pipe 200 can be decreased. As a result, the hermetic-type compressor of embodiment 9 can obtain an effect of highly raising the suction pressure by generating a stable pressure wave, and can also obtain stable high refrigeration capability without being affected by the passage of time after start.

The hermetic-type compressor of embodiment 9 can supply low-temperature refrigerant gas into the cylinder 10, and can increase the circulation amount of refrigerant.

As described above, in the hermetic-type compressor of embodiment 9, the one end of the suction pipe 200 is open in the space inside the enclosed container 2, and the other end is directly connected to the suction hole 19*a* of the valve plate 19, and at least a part is formed of a material having low heat conductivity, such as teflon, PBT or the like.

Therefore, even when the temperature of the cylinder head 80 or the like rises significantly as the passage of time after the start of the hermetic-type compressor, heat is prevented from being conducted to the suction pipe 200, and a change in the temperature of the suction pipe 200 is decreased. Consequently, the change in the velocity of sound in the refrigerant gas in the suction pipe 200 can be decreased.

As a result, in the hermetic-type compressor of embodiment 9, the suction pressure can be raised by generating a stable pressure wave, whereby stable and high refrigeration capability can be obtained without being affected by the passage of time after start.

In the hermetic-type compressor of embodiment 9, low-temperature refrigerant gas can be supplied to the cylinder 10, and the circulation amount of the refrigerant gas can be increased.

In embodiment 9, the hermetic-type compressor is provided with the suction pipe formed of a material having low heat conductivity. However, the same effect of that of the above-mentioned embodiment 9 can be obtained by partially using a material having low heat conductivity at only an area near the cylinder or the like.

EMBODIMENT 10

Next, embodiment 10, an example of the hermetic-type compressor of the present invention, will be described below referring to the accompanying drawings.

Figure 23:
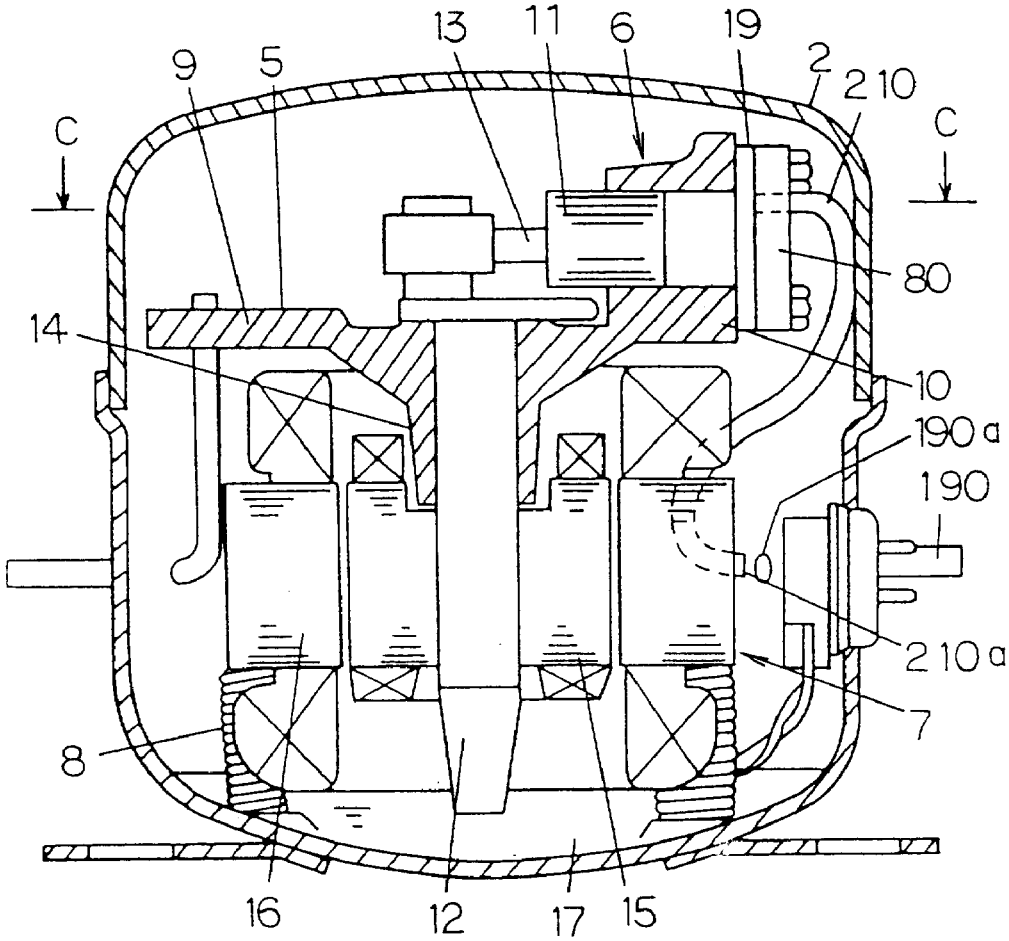
FIG. 23 is a vertical sectional view showing a hermetic-type compressor in accordance with embodiment 10 of the present invention.
Figure 24:
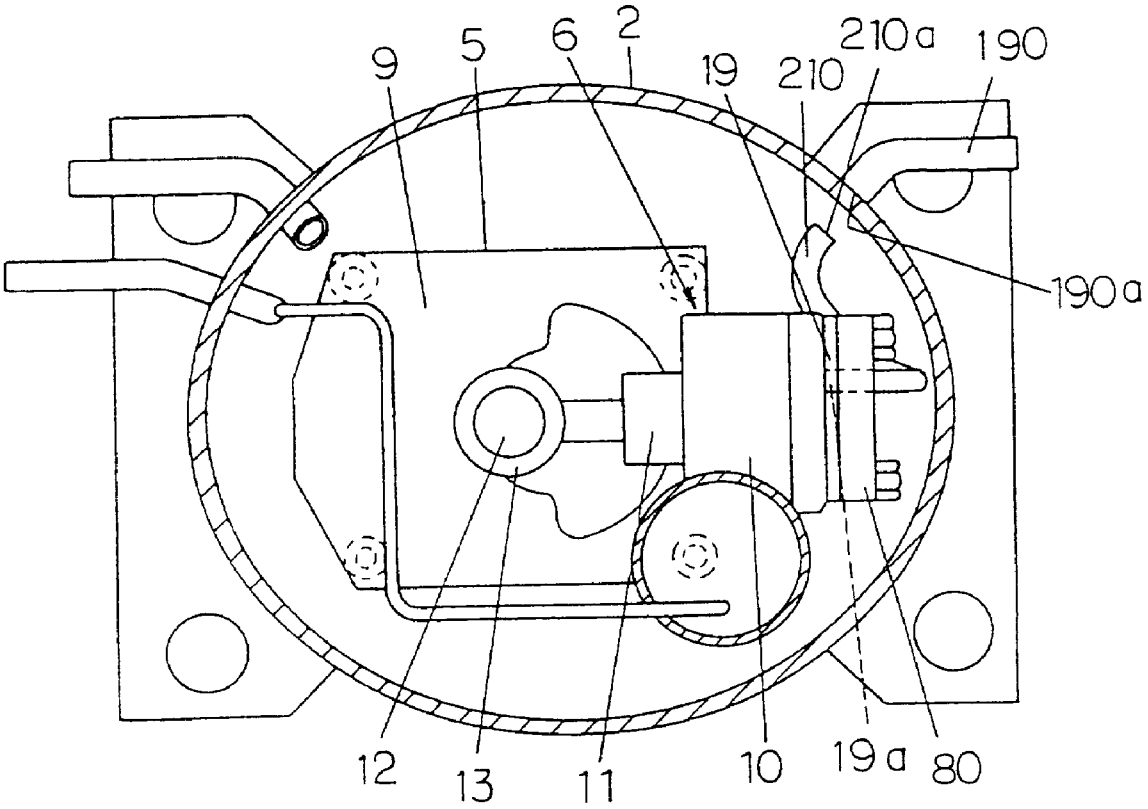
FIG. 24 is a sectional view showing the hermetic-type compressor in accordance with embodiment 10 taken on line C—C of FIG. 23.
Figure 25:
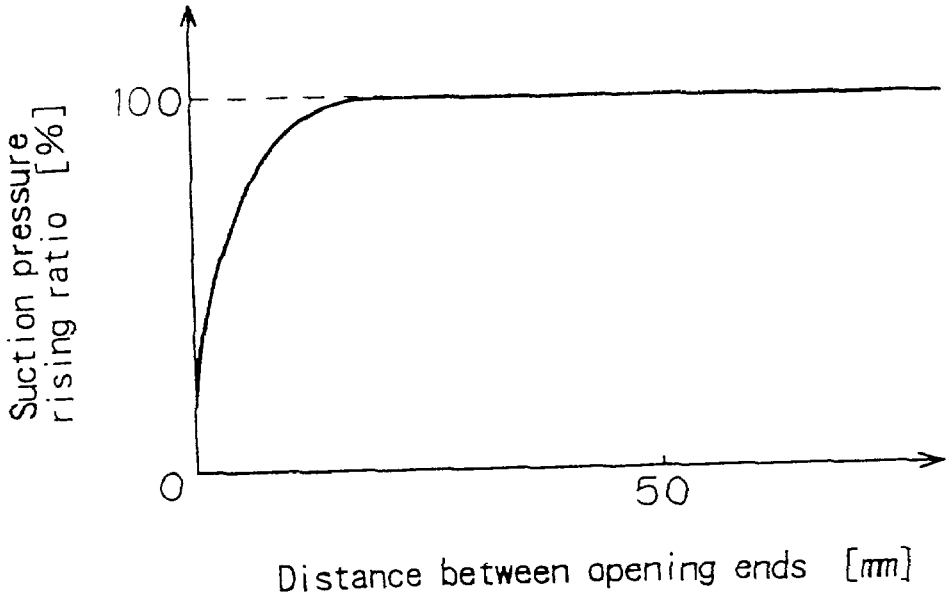
FIG. 25 is a characteristic graph showing a change in the rising ratio of suction pressure in embodiment 10 of the present invention.
Figure 26:
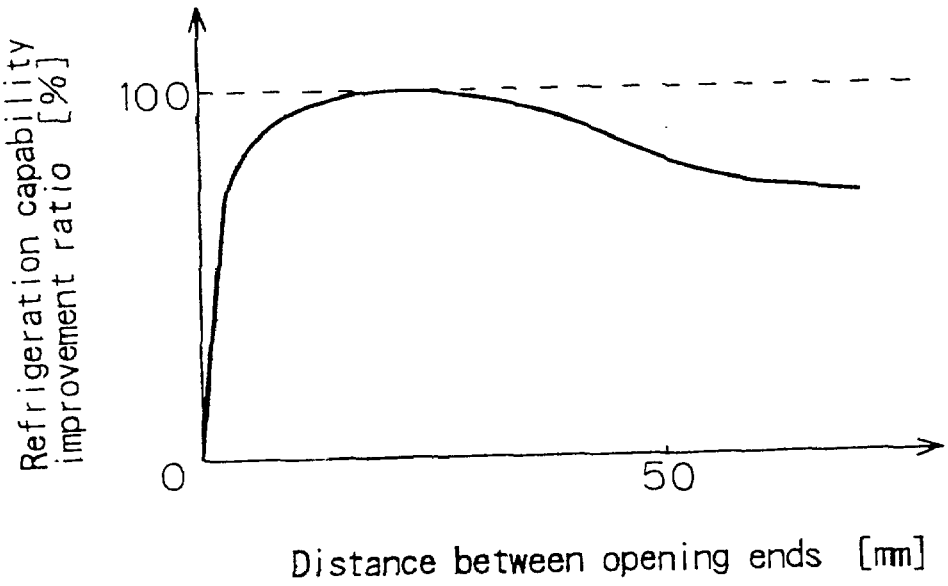
FIG. 26 is a characteristic graph showing a change in the improvement ratio of refrigeration capability in embodiment 10 of the present invention.
Figure 27:
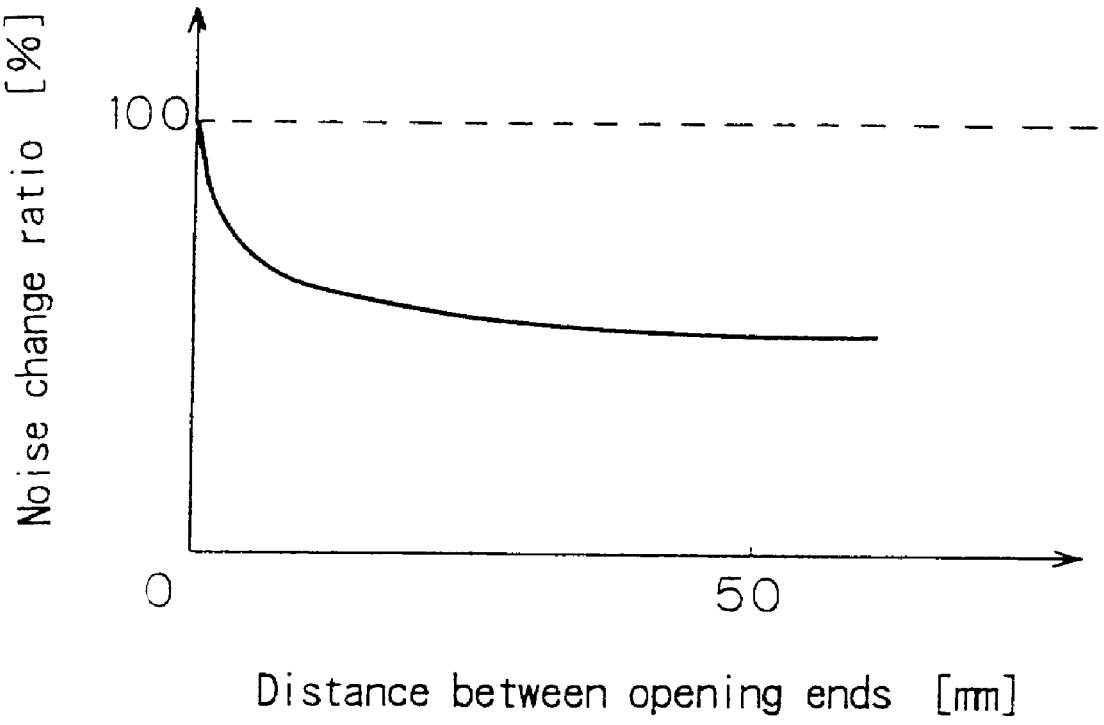
FIG. 27 is a characteristic graph showing a change in noise in embodiment 10 of the present invention.

FIG. 23 is a vertical sectional view showing the hermetic-type compressor of embodiment 10 in accordance with the present invention. FIG. 24 is a plan sectional view showing the hermetic-type compressor taken on line C—C of FIG. 23. FIG. 25 is a characteristic graph showing a change in the rising ratio of suction pressure. FIG. 26 is a characteristic graph showing a change in the improvement ratio of refrigeration capability. FIG. 27 is a characteristic graph showing a change in the change ratio of noise. In the hermetic-type compressor of embodiment 10 of the present invention, components having the same functions and configurations as those of the hermetic-type compressor of each of the above-mentioned embodiments are designated by the same marks, and their descriptions are omitted.

In FIGS. 23 and 24, a suction hole 19*a* is formed in a valve plate 19 secured to the end surface of the cylinder 10 of a mechanical portion 6, and one end of a first suction pipe 210 is directly connected to this suction hole 19*a*. The other end of the first suction pipe 210 is disposed in the space inside an enclosed container 2 as an opening end 210*a*, and also disposed as a suction passage near the opening end 190*a* of a second suction pipe 190.

Next, the operation of the hermetic-type compressor of embodiment 10 having the above-mentioned configuration is described below.

The pressure wave generated in the cylinder 10 passes through the suction hole 19*a* of the valve plate 19, propagates in the direction opposite to the flow of refrigerant gas, and becomes a reflected wave having an inverse phase in the space inside the enclosed container 2. This reflected wave propagates in the same direction as the flow of the refrigerant gas, and then returns to the suction hole 19*a*.

This reflected wave reaches the suction hole 19*a* during a suction stroke, whereby the pressure energy of the reflected wave is added to the refrigerant gas at suction completion time, and the suction pressure of the refrigerant gas is raised.

Therefore, refrigerant gas having a higher density is charged into the cylinder 10, the discharge amount of refrigerant per a compression stroke increases, and the circulation amount of refrigerant increases. As a result, the hermetic-type compressor of embodiment 10 can have significantly improved refrigeration capability.

In the hermetic-type compressor of embodiment 10, the opening end 210*a* of the first suction pipe 210 is disposed near the opening end 190*a* of the second suction pipe 190 in the enclosed container 2. Therefore, in the hermetic-type compressor of embodiment 10, low-temperature refrigerant gas having a high density can be sucked into the first suction pipe 210, and the velocity of sound in the refrigerant gas is delayed. Therefore, the hermetic-type compressor of embodiment 10 is greatly affected by compressibility, and can generate a large compression wave.

As a result, the hermetic-type compressor of embodiment 10 can increase the effect of raising the suction pressure. And, in the hermetic-type compressor of embodiment 10, by allowing low-temperature refrigerant gas to be sucked into the cylinder 10, the improvement effect of refrigeration capability can be increased significantly, and efficient and high refrigeration capability can be obtained.

In the hermetic-type compressor of embodiment 10, because of the gap between the opening end 190*a* of the second suction pipe 190 and the opening end 210*a* of the first suction pipe 210, the transfer of pressure pulsation from the second suction pipe 190 to the refrigeration cycle is decreased. Therefore, in the hermetic-type compressor of embodiment 10, noise can be reduced significantly.

It is found that the distance between the opening end 210*a* of the first suction pipe 210 and the opening end 190*a* of the second suction pipe 190 (the distance between the opening ends) is preferably in the range of 3 mm to 50 mm in accordance with the experiments by the inventors so as to increase the effect of raising the suction pressure, to increase the effect of improving refrigeration capability, and to increase the effect of reducing noise.

These results are shown in FIGS. 25, 26 and 27. FIG. 25 is a graph showing a suction pressure rising ratio (%) on the ordinate and showing the distance (mm) between the opening ends, that is, the gap between the opening end 190*a* of the second suction pipe 190 and the opening end 210*a* of the first suction pipe 210 on the abscissa. The suction pressure rising ratio in FIG. 25 represents the ratio of the pressure of the reflected wave, which is obtained when the pressure wave is reflected in the space inside the enclosed container 2, to the pressure of the pressure wave generated in the cylinder 10.

FIG. 26 is a graph showing a refrigeration capability improvement ratio (%) on the ordinate and the distance (mm) between the opening ends on the abscissa. The refrigeration capability improvement ratio in FIG. 26 is the ratio of measured refrigeration capability to the maximum refrigeration capability.

FIG. 27 shows a noise change ratio (%) on the ordinate and the distance (mm) between the opening ends on the abscissa. The noise change ratio in FIG. 27 shows the ratio of change in noise pressure provided that the ratio is 100% when the distance between the openings is 0 mm.

As described above, in the hermetic-type compressor of embodiment 10, the one end of the first suction pipe 210 is directly connected to the suction hole 19*a* of the valve plate 19, and the other end is disposed near the opening end 190*a* of the second suction pipe 190 in the enclosed container 2. Therefore, in the hermetic-type compressor of embodiment 10, since low-temperature refrigerant gas having a high density can be sucked into the first suction pipe 210, the velocity of sound in the refrigerant gas can be lowered. Therefore, the hermetic-type compressor of embodiment 10 is greatly affected by compressibility, and can generate a large pressure wave. Therefore, in the hermetic-type compressor of embodiment 10, by increasing the effect of raising suction pressure, and by sucking low-temperature refrigerant gas into the cylinder 10, the improvement effect of refrigeration capability can be increased significantly, and high refrigeration capability can be obtained.

In the hermetic-type compressor of embodiment 10, by forming the gap between the opening end 190*a* of the second suction pipe 190 and the opening end 210*a* of the first suction pipe 210, the transfer of pressure pulsation from the second suction pipe 190 to the refrigeration cycle can be reduced. Therefore, in the hermetic-type compressor of embodiment 10, noise can be decreased significantly.

It is needless to say that refrigerant gas can flow easier and that refrigeration capability can be improved by widening the opening end 210*a* of the suction pipe 210 used as a first suction passage, and by disposing the opening end opposite to the opening end 190*a* of the second suction pipe 190 used as a second suction passage.

EMBODIMENT 11

Next, embodiment 11, an example of the hermetic-type compressor of the present invention, will be described below referring to the accompanying drawings.

Figure 28:
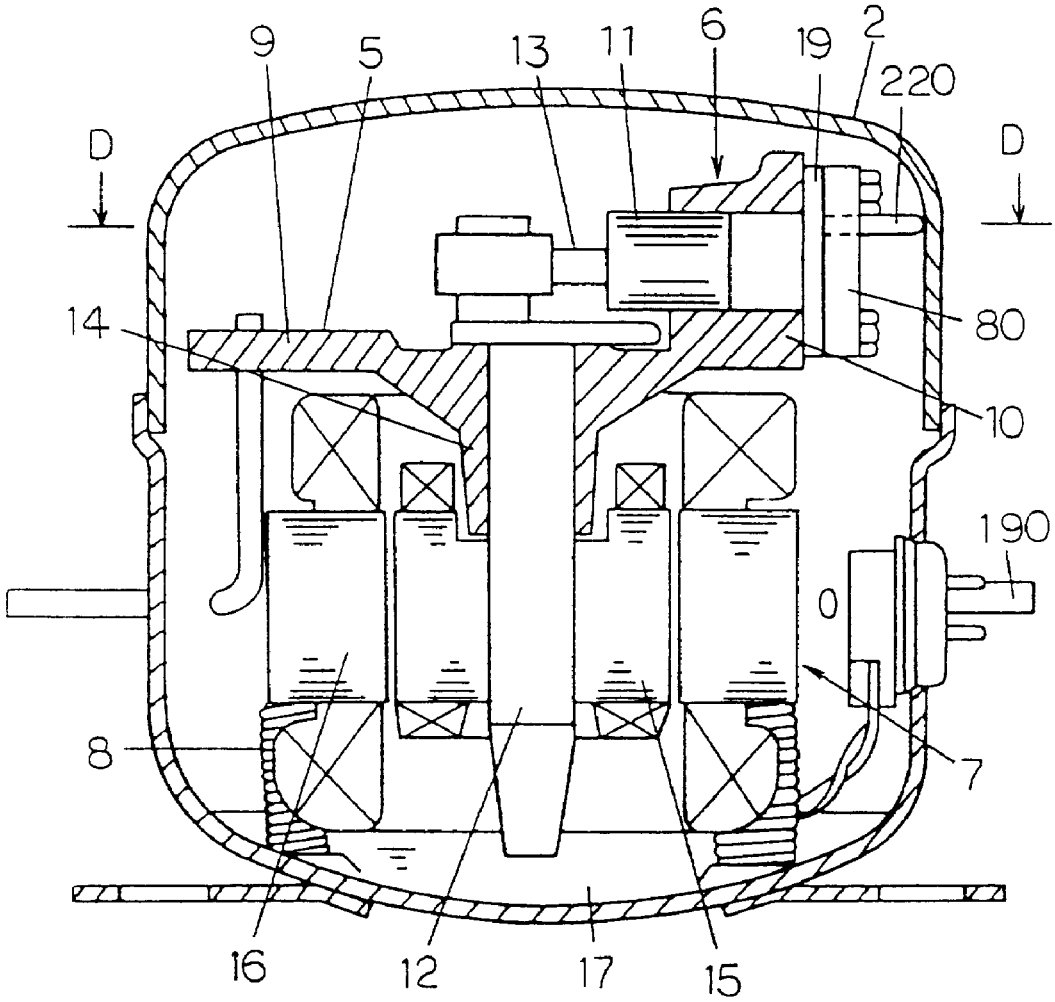
FIG. 28 is a vertical sectional view showing a hermetic-type compressor in accordance with embodiment 11 of the present invention.
Figure 29:
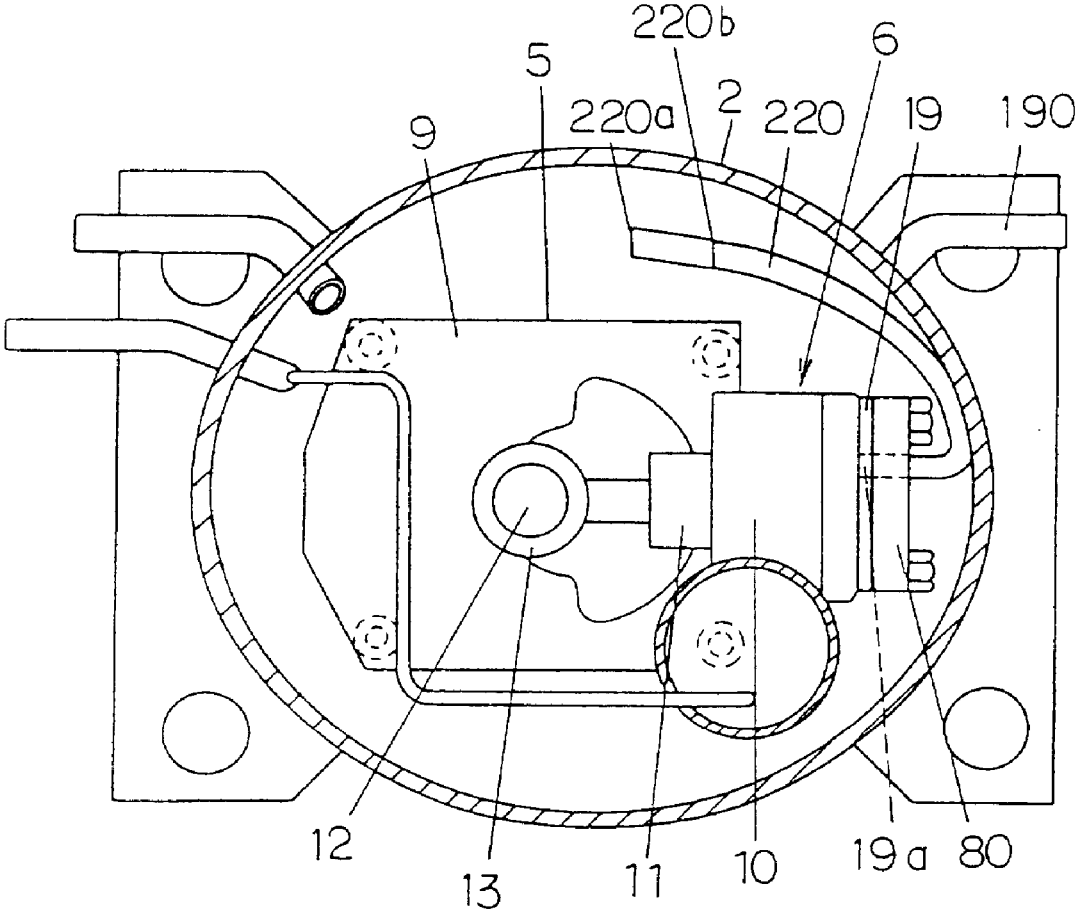
FIG. 29 is a sectional view showing the hermetic-type compressor in accordance with embodiment 11 of the present invention taken on line D—D of FIG. 28.
Figure 30:
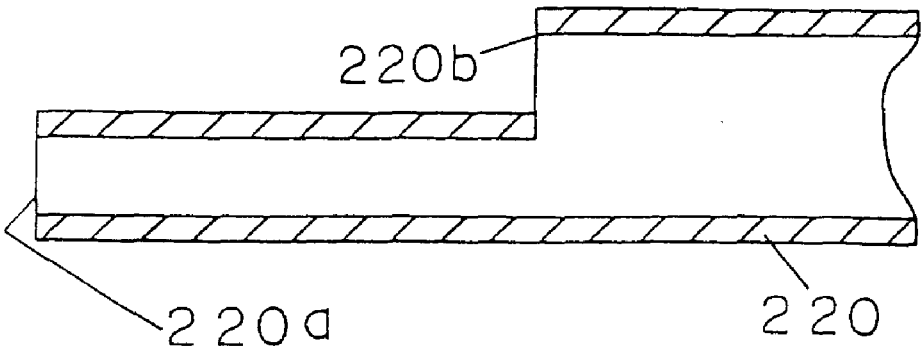
FIG. 30 is a vertical sectional view showing the opening end of a suction pipe in accordance with embodiment 11 of the present invention.
Figure 31:
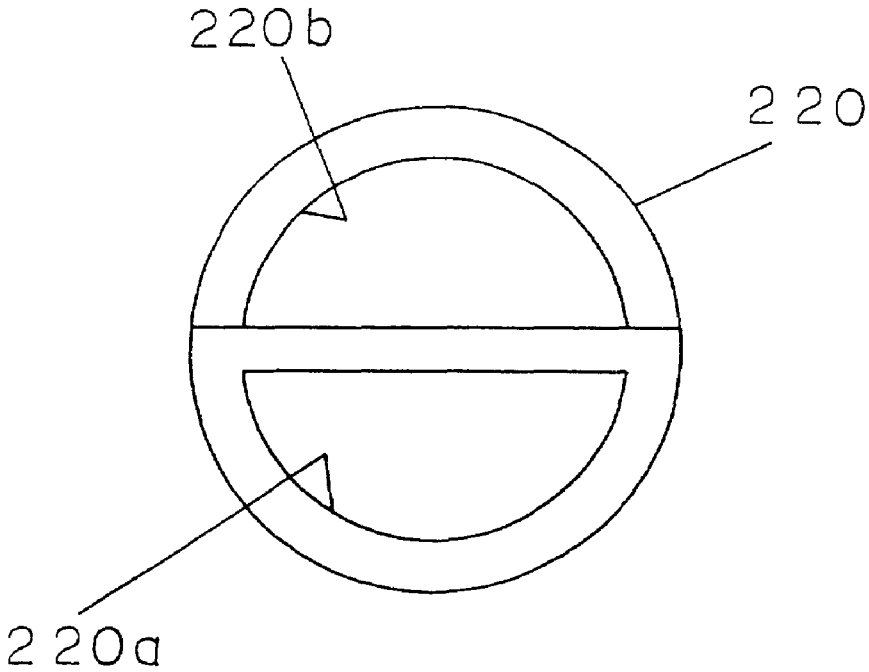
FIG. 31 is a view showing the opening surface of the opening end of the suction pipe in accordance with embodiment 11 of the present invention.

FIG. 28 is a vertical sectional view showing the hermetic-type compressor in accordance with embodiment 11 of the present invention. FIG. 29 is a plan sectional view showing the hermetic-type compressor taken on line D—D of FIG. 28. FIG. 30 is a vertical sectional view showing the opening end of a first suction pipe of embodiment 11. FIG. 31 is a view showing the opening surface of the opening end of the first suction pipe of embodiment 11.

In the hermetic-type compressor of embodiment 11, components having the same functions and configurations as those of the hermetic-type compressor of each of the above-mentioned embodiments are designated by the same marks, and their descriptions are omitted.

In FIGS. 28 and 29, a suction hole 19*a* is formed in a valve plate 19 secured to the end surface of the cylinder 10 of a mechanical portion 6, and one end of a first suction pipe 220 is directly connected to this suction hole 19*a*. The other end of the first suction pipe 220 is disposed in the space inside an enclosed container 2 as an opening end 220*a*. The opening end 190*a* of the second suction pipe 190 is disposed in the space inside the enclosed container 2.

As shown in FIGS. 29 and 30, one end of the first suction pipe 220 is directly connected to the suction hole 19*a* of the valve plate 19, and the other end has a plurality of opening ends 220*a*, 220*b* being open in the space inside the enclosed container 2; the lengths from the suction hole 19*a* to the plural opening ends 220*a*, 220*b* are different.

Next, the operation of the hermetic-type compressor of embodiment 11 having the above-mentioned configuration is described below.

The pressure wave generated in the cylinder 10 passes through the suction hole 19*a* of the valve plate 19, propagates in the direction opposite to the flow of refrigerant gas, and becomes a reflected wave having an inverse phase in the space inside the enclosed container 2. This reflected wave propagates in the same direction as the flow of the refrigerant gas, and reaches the suction hole 19*a*.

This reflected wave reaches the suction hole 19*a* during a suction stroke, whereby the pressure energy of the reflected wave is added to the refrigerant gas at suction completion time, and the suction pressure is raised.

Therefore, refrigerant gas having a higher density is charged into the cylinder 10, the discharge amount of refrigerant per a compression stroke increases, and the circulation amount of refrigerant increases. As a result, the hermetic-type compressor of embodiment 11 can have significantly improved refrigeration capability.

At this time, the pressure wave generated in the suction hole 19*a* is reflected by the plural opening ends 220*a*, 220*b* having different lengths from the suction hole 19*a* in succession, reaches the suction hole 19*a*, and is supplied into the cylinder 10.

As a result, in the hermetic-type compressor of embodiment 11, the timing when the reflected wave reaches the suction hole 19*a* can be widened.

Accordingly, in the hermetic-type compressor of embodiment 11, the velocity of sound in refrigerant gas is changed by a change in operation conditions or the like; even if the reaching timing of one of the reflected waves is deviated, other reflected waves reach the suction hole 19*a* in succession. Therefore, in the hermetic-type compressor of embodiment 11, refrigerant gas having high pressure can be supplied into the cylinder 10 at all times.

Therefore, in the hermetic-type compressor of embodiment 11, suction pressure can be raised at all times regardless of the change in operation conditions, and stable and high refrigeration capability can be obtained.

As described above, in the hermetic-type compressor of embodiment 11, the one end of the first suction pipe 220 is directly connected to the suction hole 19*a* of the valve plate 19, and the other end has the plural opening ends 220*a*, 220*b* being open in the space inside the enclosed container 2, and having different lengths from the suction hole 19*a* to the opening ends. Therefore, the pressure wave generated in the suction hole 19*a* is reflected by the plural opening ends 220*a*, 220*b* having different lengths from the suction hole 19*a* to the opening ends in succession.

As a result, in the hermetic-type compressor of embodiment 11, the timing when the reflected wave returns to the suction hole 19*a* can be widened. Accordingly, in the hermetic-type compressor of embodiment 11, even if the timing when one of the reflected waves reaches the suction hole 19*a* is deviated because the velocity of sound in refrigerant gas is changed by a change in operation conditions or the like, other reflected waves reach the suction hole 19*a* one after another. Therefore, refrigerant gas having high pressure is supplied into the cylinder 10 at all times. Therefore, in the hermetic-type compressor of embodiment 11, the suction pressure can be raised at all times regardless of the change in operation conditions, and stable and high refrigeration capability can be obtained.

In embodiment 11, although the suction pipe 220 having the opening ends 220*a*, 220*b* with different lengths is used as suction passages, the same effect as that of embodiment 11 can be obtained by using a plurality of suction pipes with different lengths.

EMBODIMENT 12

Next, embodiment 12, an example of the hermetic-type compressor of the present invention, will be described below referring to the accompanying drawings.

Figure 32:
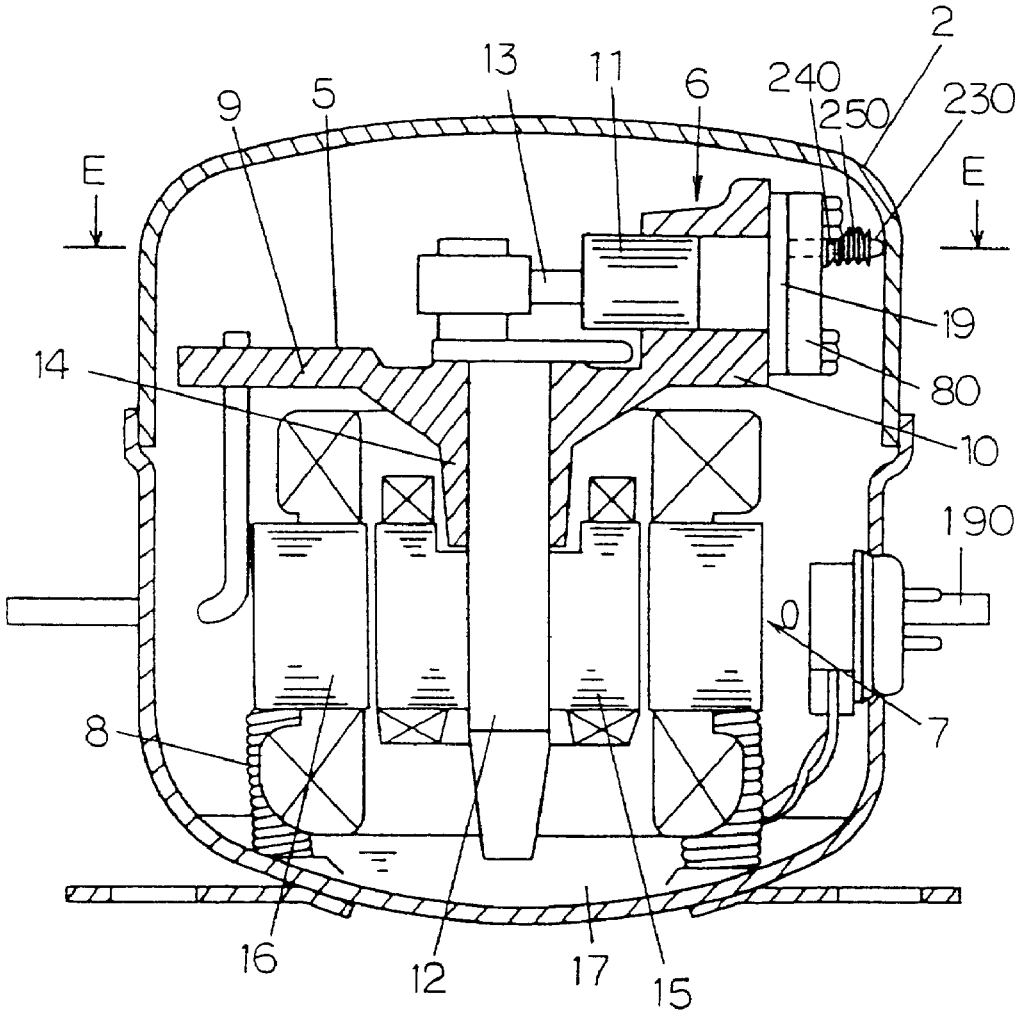
FIG. 32 is a vertical sectional view showing a hermetic-type compressor in accordance with embodiment 12 of the present invention.
Figure 33:
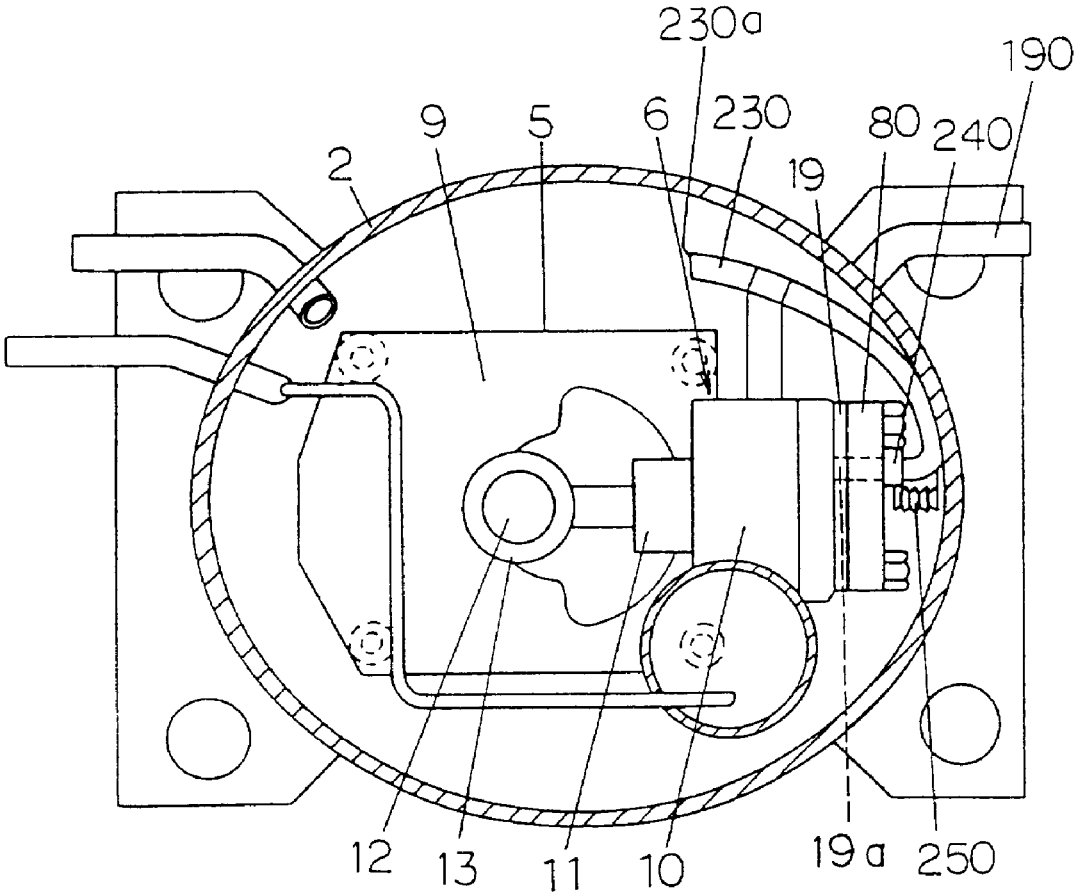
FIG. 33 is a sectional view showing the hermetic-type compressor in accordance with embodiment 12 of the present invention taken on line E—E of FIG. 32.
Figure 34:
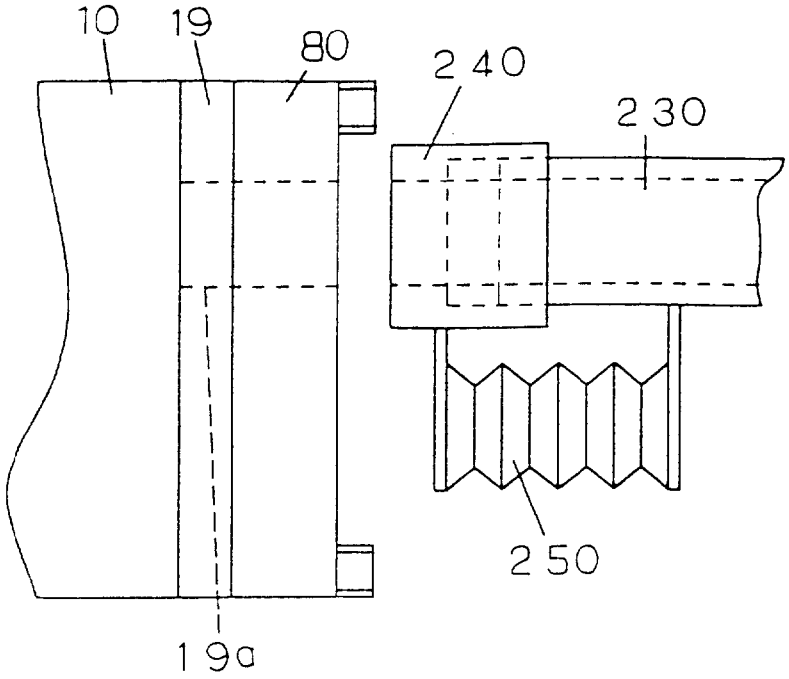
FIG. 34 is a plan sectional view showing the main portion of a cylinder head portion at the time of start in embodiment 12 of the present invention.
Figure 35:
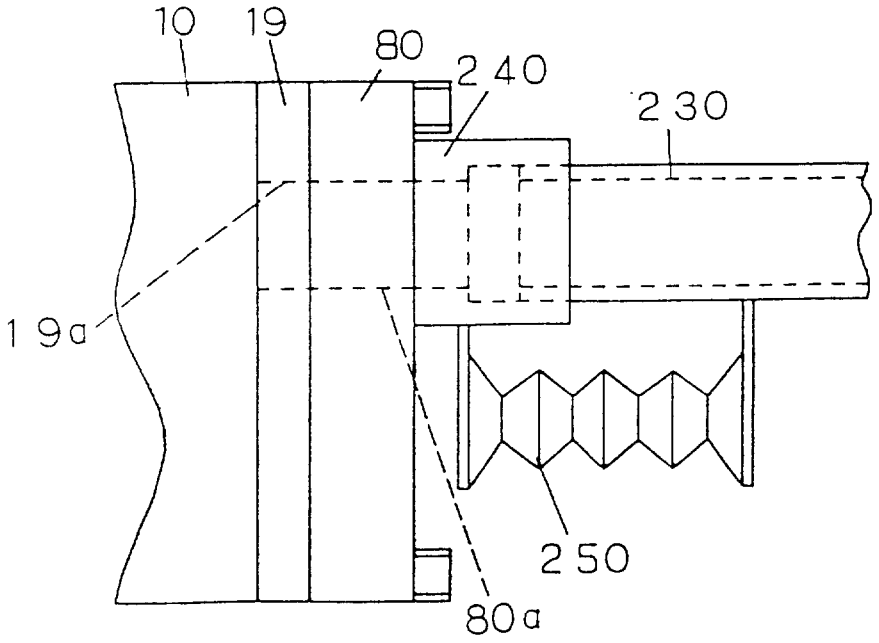
FIG. 35 is a plan sectional view showing the main portion of the cylinder head portion during stable operation in embodiment 12 of the present invention.

FIG. 32 is a vertical sectional view showing the hermetic-type compressor in accordance with embodiment 12 of the present invention. FIG. 33 is a plan sectional view showing the hermetic-type compressor taken on line E—E of FIG. 32. FIG. 34 is a plan sectional view showing the main portion of a cylinder head portion at the time of start in embodiment 12. FIG. 35 is a plan vertical view showing the main portion of the cylinder head portion during stable operation in embodiment 12.

In the hermetic-type compressor of embodiment 12, components having the same functions and configurations as those of the hermetic-type compressor of each of the above-mentioned embodiments are designated by the same marks, and their descriptions are omitted.

In FIGS. 32 and 33, a suction hole 19*a* is formed in a valve plate 19 secured to the end surface of the cylinder 10 of a mechanical portion 6, and one end of a first suction pipe 230 is connected to this suction hole 19*a* via a communication pipe 240. The other end of the first suction pipe 230 is disposed in the space inside the enclosed container 2 as an opening end 230*a*. The opening end of a second suction pipe 190 is disposed in the inner space inside the enclosed container 2.

As shown in FIGS. 33 and 34, the one end of the first suction pipe 230 is open in the space inside the enclosed container 2, and the other end is not directly connected to the suction hole 19*a* of the valve plate 19, but the pipe is cut ahead of a cylinder head 80. The first suction pipe 230 having been cut is disposed so that it can communicate with the opening hole 80*a* of the cylinder head via the communication pipe 240.

As shown in FIGS. 34 and 35, a bellows 250 is provided between the suction pipe 230 and the communication pipe 240. In other words, one end of the bellows 250 is secured to the first suction pipe 230, and the other end is secured to the communication pipe 240. In embodiment 12, a communication/shutoff mechanism comprises the communication pipe 240 and the bellows 250.

Next, the operation of the hermetic-type compressor of embodiment 12 having the above-mentioned configuration is described below.

The pressure wave generated in the cylinder 10 passes through the suction hole 19*a* of the valve plate 19, propagates in the direction opposite to the flow of refrigerant gas, and becomes a reflected wave having an inverse phase in the space inside the enclosed container 2. This reflected wave propagates in the same direction as the flow of the refrigerant gas, and returns to the suction hole 19*a*.

This reflected wave reaches the suction hole 19*a* during a suction stroke, whereby the pressure energy of the reflected wave is added to the refrigerant gas at suction completion time, and the suction pressure is raised.

Therefore, refrigerant gas having a higher density is charged into the cylinder 10, the discharge amount of refrigerant per a compression stroke increases, and the circulation amount of refrigerant increases. As a result, the hermetic-type compressor of embodiment 12 can have significantly improved refrigeration capability.

However, since a pressure wave is also generated at start, start torque becomes large; it is thus necessary to improve the capability of the motor portion 7.

Therefore, as shown in FIG. 34, when the pressure in the enclosed container 2 is high at start or the like, the bellows 250 is pressed and shrunk, and the communication pipe 240 is separated away from the cylinder head 80.

As a result, the first suction pipe 230 does not communicate with the suction hole 19*a,* and no pressure wave is not generated. Consequently, although the improvement effect of refrigeration capability is lost, torque can be reduced significantly, and improper start can be prevented, whereby reliability can be improved.

On the other hand, as shown in FIG. 35, when the pressure in the enclosed container 2 lowers after start, the bellows 250 is extended, and the communication pipe 240 is pressed against the cylinder head 80.

As a result, the first suction pipe 230 communicates with the suction hole 19*a,* a pressure wave is generated, and an effect of raising suction pressure can be obtained. Therefore, the refrigeration capability of the hermetic-type compressor of embodiment 12 is raised.

As described above, in the hermetic-type compressor of embodiment 12, the one end of the first suction pipe 230 is open in the space inside the enclosed container 2, the other end is directly connected to the suction hole 19*a* of the valve plate 19, and the first suction pipe 230 is cut ahead of the cylinder head 80. And the communication pipe 240 is provided so that the first suction pipe 230 having been cut can communicate with the opening hole 80*a* of the cylinder head 80; the one end of the bellows 250 of the communication/shutoff mechanism is secured to the first suction pipe 230, and the other end is secured to the communication pipe 240.

As a result, when the pressure in the enclosed container 2 is high at start or the like, the bellows 250 is pressed and shrunk, and the communication pipe 240 is separated away from the cylinder head 80. Therefore, the first suction pipe 230 does not communicate with the suction hole 19*a,* and no pressure wave is generated. Consequently, in the hermetic-type compressor of embodiment 12, when the pressure in the enclosed container 2 is high at start or the like, refrigeration capability is not improved, and torque is reduced significantly, whereby improper start can be prevented and reliability can be improved.

On the other hand, in the hermetic-type compressor of embodiment 12, when the pressure in the enclosed container 2 lowers after start, the bellows 250 is extended, and the communication pipe 240 is pressed against the cylinder head 80. As a result, the first suction pipe 230 communicates with the suction hole 19*a,* a pressure wave generates, and an effect of raising suction pressure can be obtained, and the improvement of refrigeration capability can be obtained.

Although the communication/shutoff mechanism is formed of the bellows 250 in embodiment 12, it is needless to say that the same effect as that of embodiment 12 can be obtained provided that a mechanism for not allowing the first suction pipe 230 to communication at start is used.

In addition, although the communication/shutoff mechanism is used in embodiment 12, it is needless to say that the same effect as that of embodiment 12 can be obtained provided that a mechanism for not allowing the generation of a pressure wave at start is used.

EMBODIMENT 13

Next, embodiment 13, an example of the hermetic-type compressor of the present invention, will be described below referring to the accompanying drawings.

Figure 36:
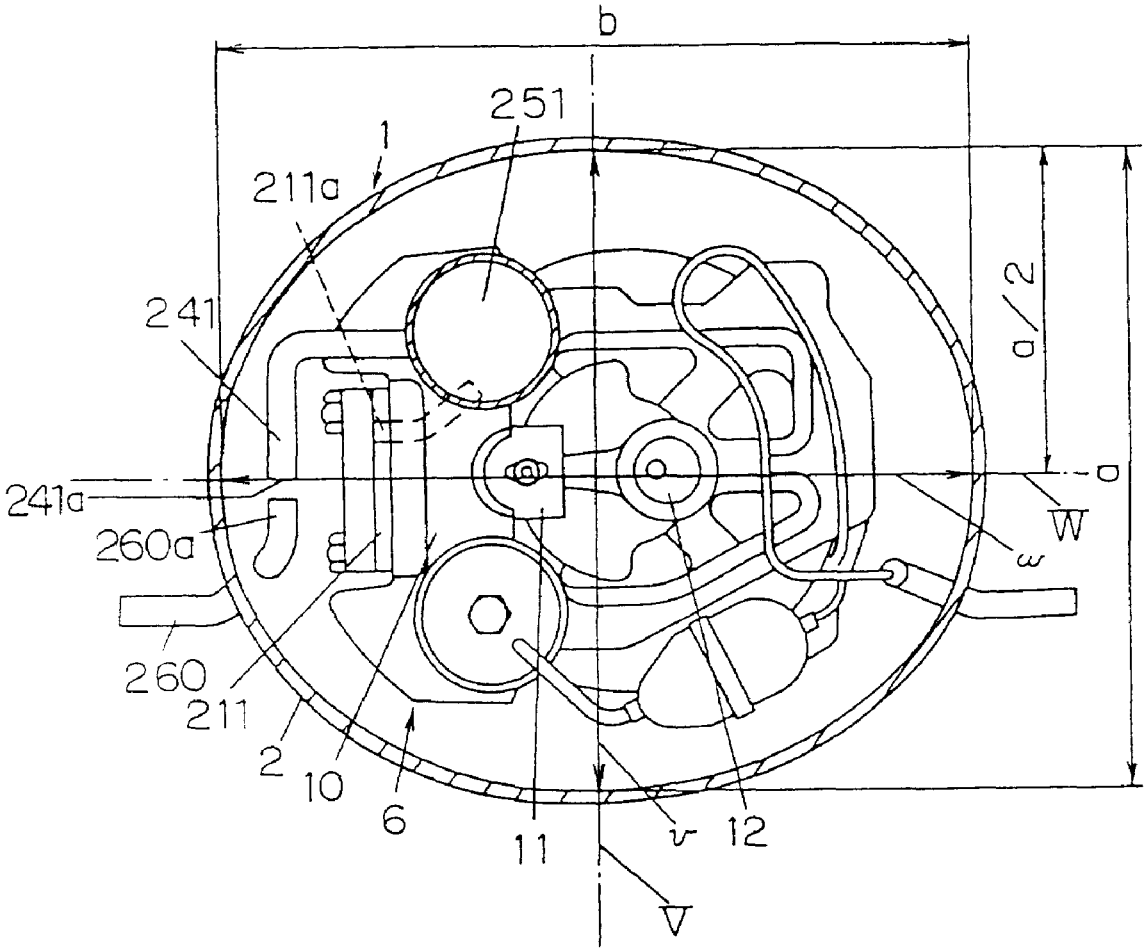
FIG. 36 is a plan sectional view showing a hermetic-type compressor in accordance with embodiment 13 of the present invention when the compressor has a node of a resonance mode in a direction perpendicular to the reciprocating direction of its piston.
Figure 37:
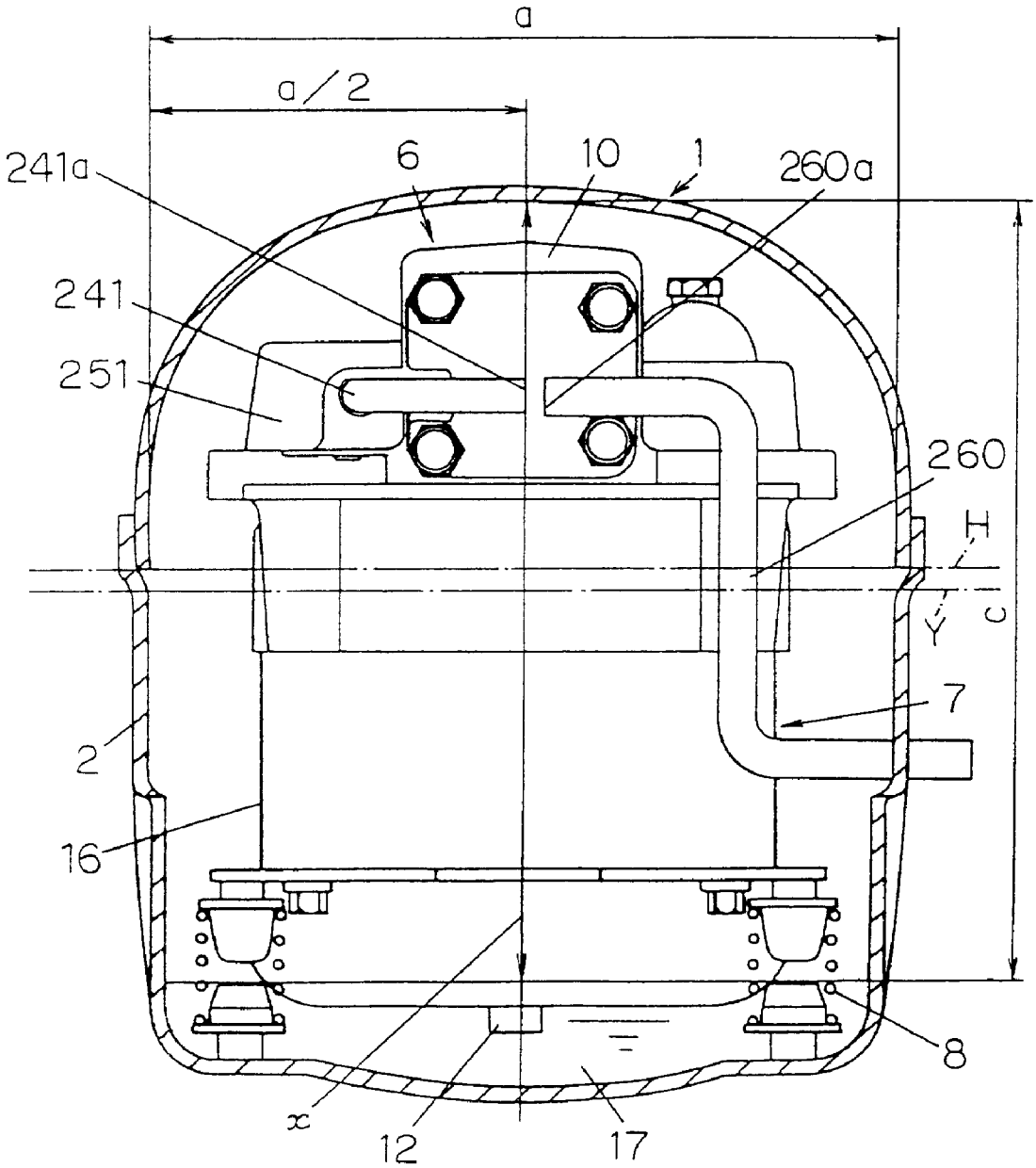
FIG. 37 is a plan view showing the hermetic-type compressor in accordance with embodiment 13 of the present invention when the compressor has a node of a resonance mode in the direction perpendicular to the reciprocating direction of its piston.

FIG. 36 is a plan sectional view showing the hermetic-type compressor of embodiment 13 of the present invention when the compressor has a node of a resonance mode in a direction perpendicular to the reciprocating direction on a horizontal plane including the reciprocating direction of its piston. FIG. 37 is a plan view showing the hermetic-type compressor of embodiment 13 when the compressor has a node of a resonance mode in the direction perpendicular to the reciprocating direction on the horizontal plane including the reciprocating direction of its piston.

In the hermetic-type compressor of embodiment 13, components having the same functions and configurations as those of the hermetic-type compressor of each of the above-mentioned embodiments are designated by the same marks, and their descriptions are omitted.

In FIGS. 36 and 37, a suction hole 211*a* is formed in a valve plate 211 secured to the end surface of the cylinder 10 of a mechanical portion 6, and this suction hole 211*a* is connected to one end of a first suction pipe 241 (suction passage) via a suction chamber 251. The other end of the first suction pipe 241 is disposed in the space inside an enclosed container 2 as an opening end 241*a*.

As described above, the one end of the first suction pipe 241 used as a suction passage is open inside the enclosed container 2, and the other end is connected to the suction hole 211*a* of the valve plate 211 via the suction chamber 251 used as a space. The opening end 241*a* of the first suction pipe 241 inside the enclosed container 2 is disposed on at least one of the following three planes.

(1) on a first plane (the plane indicated by straight line W in FIG. 36) (at the position showing the opening end 241*a* in FIG. 36) which is substantially orthogonal to a first line segment (the line segment indicated by arrow v in FIG. 36) at the center point of the above-mentioned first line segment (v) passing through the center of gravity (the position of the center of gravity at the horizontal cross-section) of a plane (the horizontal plane indicated by straight line H in FIG. 37) having a substantially maximum cross-sectional area on the horizontal cross-section (the cross-section in parallel with the paper surface of FIG. 36) of the above-mentioned enclosed container 2, the first line segment (v) being at a position wherein the distance between the inner walls of the above-mentioned enclosed container 2 is minimum (on the horizontal plane indicated by straight line H in FIG. 37), or (2) on a second plane (the vertical plane indicated by straight line V in FIG. 36) which, on the horizontal plane (H) including the above-mentioned first line segment (v), passes through the center point of a second line segment (the line segment indicated by arrow w in FIG. 36) between the inner wall surfaces of the above-mentioned enclosed container 2, the second line segment being substantially orthogonal to the above-mentioned first line segment (v), and which is substantially orthogonal to the above-mentioned second line segment (w), or (3) on a third plane (the horizontal plane indicated by straight line Y in FIG. 37) which passes through the center point of a third line segment (the line segment indicated by arrow x in FIG. 37) having the maximum distance between the upper inner wall surface of the above-mentioned enclosed container 2 and the surface of the above-mentioned lubricant 17 in the vertical direction, and which is substantially orthogonal to the above-mentioned third line segment (x).

The opening end 241*a* of the first suction pipe 241 is disposed on at least one of the above three planes.

In the hermetic-type compressor shown in FIGS. 36 and 37, the opening end 241*a* of the first suction pipe 241 is disposed on the first plane (W).

As shown in FIGS. 36 and 37, the opening end 260*a* of a second suction pipe 260 is disposed near the opening end 241*a* of the first suction pipe 241. This second suction pipe 260 is configured to suck refrigerant gas from a refrigeration system, which is disposed in an outside of the enclosed container 2.

Next, the operation of the hermetic-type compressor of embodiment 13 having the above-mentioned configuration is described below.

Refrigerant gas circulated from a refrigeration system such as a refrigeration apparatus passes through the second suction pipe 260, and is relieved once in the space inside the enclosed container 2. The refrigerant gas relieved once is sucked into the cylinder 10 via the first suction pipe 241 and the suction chamber 251, and compressed by a piston 11. At this time, the refrigerant gas is sucked into the cylinder 10 by one half rotation of a crankshaft 12, and compressed by the other half rotation. Thus, since the refrigerant gas is not sucked continuously into the cylinder 10, the pressure pulsation of the refrigerant gas occurs in the first suction pipe 241. Therefore, the pressure pulsation vibrates the space inside the enclosed container 2, and resonance modes are generated in the reciprocating direction of the piston 11, in the direction perpendicular to the reciprocating direction on the horizontal plane including the reciprocating direction of the piston 11, and in the axial direction of the crankshaft 12.

However, in the hermetic-type compressor of embodiment 13, the opening end 241*a* of the first suction pipe 241 in the space inside the enclosed container 2 is disposed on a plane passing through the center point of the line segment (v) indicated by distance a in FIG. 36 and perpendicular to the line segment (v). In other words, in the hermetic-type compressor of embodiment 13, the plane has a node of the resonance mode generated in the direction perpendicular to the reciprocating direction on the horizontal plane including the reciprocating direction of the piston 11. Therefore, the pressure pulsation component for causing the resonance mode is positioned at the node of the resonance mode. Consequently, vibration occurs at the node of the resonance mode, whereby no resonance mode is caused, and the generation of resonance sound can be prevented.

Furthermore, in the hermetic-type compressor of embodiment 13, by providing the opening end 260*a* of the second suction pipe 260 inside the enclosed container 2 near the opening end 241*a* of the first suction pipe 241 inside the enclosed container 2, the refrigerant gas to be sucked into the first suction pipe 241 can be prevented from being heated by the refrigerant gas inside the enclosed container 2. Therefore, refrigerant gas having a higher density is charged into the cylinder 10, the discharge amount of refrigerant per a compression stroke increases, and the circulation amount of refrigerant increases, whereby refrigeration capability can be improved.

As described above, the hermetic-type compressor of embodiment 13 has the mechanical portion 6 including the crankshaft 12, the piston 11, the cylinder 10 and the like, the motor portion 7, the enclosed container 2 for storing lubricant 17 at its bottom, the valve plate 211 having the suction hole 211*a* and disposed at the end surface of the cylinder 10, the first suction pipe 241, and the second suction pipe 260. The one end of the first suction pipe 241 is connected to the suction hole 211*a* of the valve plate 211 via the space inside the suction chamber 251, and the other end, that is, the opening end 241*a* is disposed at a desired position in the enclosed container 2. In other words, the opening end 241*a* is disposed:

(1) on the plane (W) which passes through the center point of the first line segment (v: distance a) and is nearly perpendicular to the first line segment which passes through the center of gravity of the plane having a nearly maximum cross-sectional area on the horizontal cross-section of the enclosed container 2 and is at the position wherein the distance between the inner walls of the enclosed container 2 is minimum, or (2) on the plane (V) which passes through the center point of a second line segment (w: distance b) between the inner wall surfaces of the enclosed container 2, and is nearly perpendicular to the second line segment (w), the second line segment being nearly perpendicular to the horizontal plane including the first line segment v which passes through the center of gravity of the horizontal cross-section and is at the position wherein the distance is minimum, or (3) on the plane (Y) which passes through the center point of the third line segment (x: distance c) having the maximum distance between the upper inner wall surface of the enclosed container 2 and the surface of the lubricant 17 in the vertical direction, and which is nearly perpendicular to the third line segment (x).

The opening end 241*a* is disposed on at least one of the three planes as a suction port of the suction passage in the enclosed container.

In addition, the one end of the second inflow pipe 260 is extended outside the enclosed container 2, and the other end is disposed in the enclosed container 2 as the opening end 260*a*; and this opening end 260*a* is provided near the opening end 241*a* of the first suction pipe 241 used as a suction passage.

Therefore, the hermetic-type compressor of embodiment 13 can prevent resonance from generating in the enclosed container 2, and can also prevent noise increase due to the generation of resonance sound. Consequently, the hermetic-type compressor of embodiment 13 can raise the density of refrigerant gas, and can improve refrigeration capability.

In embodiment 13, the opening end 241*a* of the first suction pipe 241 used as a suction passage in the space inside the enclosed container 2 is described as the node of the resonance mode in the direction perpendicular to the reciprocating direction on the horizontal plane including the reciprocating direction of the piston 11. However, the same effect as that of embodiment 13 can be obtained provided that the opening end 241*a* of the suction pipe 241 in the space inside the enclosed container 2 is disposed at the node of the resonance mode wherein the opening end of the suction passage 2 in the space inside the enclosed container 2 relates to the problem of the node of the resonance mode, such as the node of the resonance mode in the reciprocating direction of the piston 11, or the node of the resonance mode in the axial direction of the crankshaft 12.

In embodiment 13, the suction passages were described as the suction pipe 241 and the suction chamber 251 used as a space. However, the same effect as that of embodiment 13 can be obtained in case a muffler or the like is provided as a suction passage having a space.

The hermetic-type compressor of embodiment 13 has been described on the assumption that the number of the cylinder 10 is one. However, the present invention can be applied to a hermetic-type compressor having a plurality of cylinders.

Even when the number of suction passages is two or more in the hermetic-type compressor of the present invention, the same effect as that of embodiment 13 can be obtained by disposing the opening end of each suction passage inside the enclosed container 2 at the position of the node of the resonance mode described in the above-mentioned embodiment 13.

EMBODIMENT 14

Next, embodiment 14, an example of the hermetic-type compressor of the present invention, will be described below referring to the accompanying drawings.

Figure 38:
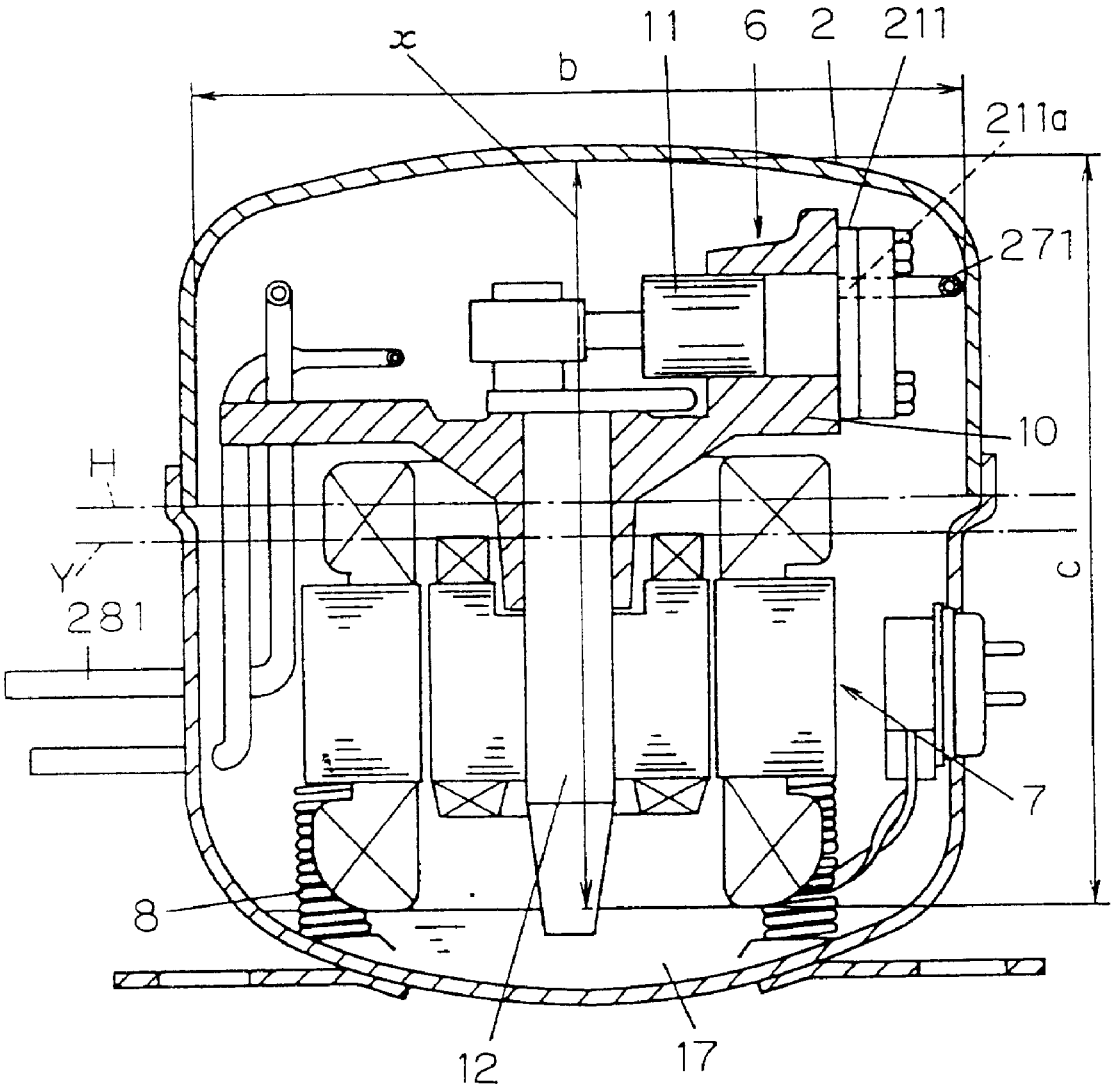
FIG. 38 is a vertical sectional view showing a hermetic-type compressor in accordance with embodiment 14 of the present invention when the compressor has a node of a resonance mode in a direction perpendicular to the reciprocating direction of its piston.
Figure 39:
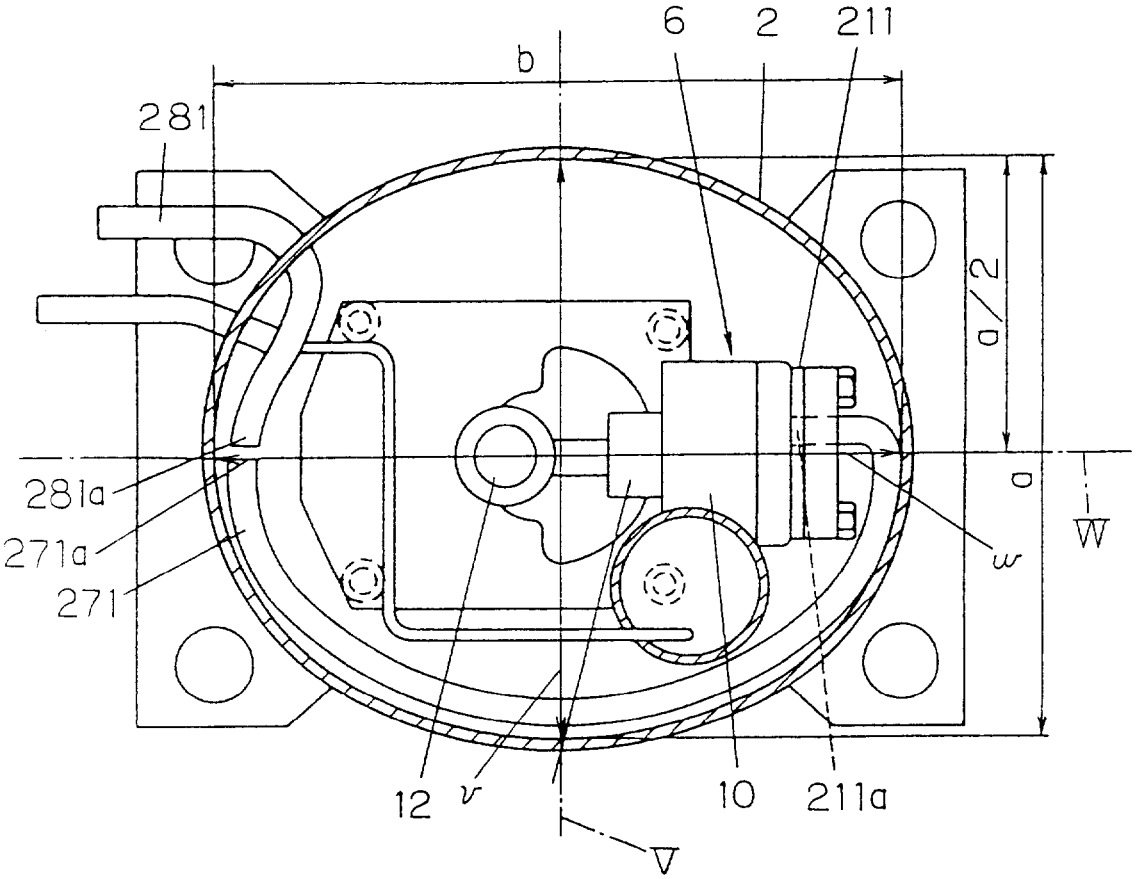
FIG. 39 is a plan sectional view showing the hermetic-type compressor in accordance with embodiment 14 when the compressor has a node of a resonance mode in the direction perpendicular to the reciprocating direction of its piston.

FIG. 38 is a vertical sectional view showing the hermetic-type compressor in accordance with embodiment 14 of the present invention when the compressor has a node of a resonance mode in a direction perpendicular to the reciprocating direction on a horizontal plane including the reciprocating direction of the piston 11. FIG. 39 is a plan sectional view showing the hermetic-type compressor of embodiment 14 when the compressor has a node of a resonance mode in the direction perpendicular to the reciprocating direction on the horizontal plane including the reciprocating direction of its piston.

In the hermetic-type compressor of embodiment 14, components having the same functions and configurations as those of the hermetic-type compressor of each of the above-mentioned embodiments are designated by the same marks, and their descriptions are omitted.

In FIGS. 38 and 39, a suction hole 211*a* is formed in a valve plate 211 secured to the end surface of the cylinder 10 of a mechanical portion 6, and this suction hole 211*a* is directly connected to one end of a first suction pipe 271 (suction passage). The other end of the first suction pipe 271 is disposed as an opening end 271*a* at a predetermined position in the space inside an enclosed container 2.

The opening end 271*a* of the first suction pipe 271 used as a suction passage inside the enclosed container 2 is configured so as to be disposed on at least one of the following three planes.

(1) on a first plane (the plane indicated by straight line W in FIG. 39) (at the position showing the opening end 271*a* in FIG. 39) which is substantially orthogonal to a first line segment (the line segment indicated by arrow v in FIG. 39) at the center point of the above-mentioned first line segment (v) passing through the center of gravity (the position of the center of gravity at the horizontal cross-section) of a plane (the horizontal plane indicated by straight line H in FIG. 38) having a substantially maximum cross-sectional area on the horizontal cross-section (the cross-section in parallel with the paper surface of FIG. 37) of the above-mentioned enclosed container 2, the first line segment (v) being at a position wherein the distance between the inner walls of the above-mentioned enclosed container 2 is minimum (on the horizontal plane indicated by straight line H in FIG. 38), or (2) on a second plane (the vertical plane indicated by straight line V in FIG. 39) which, on the horizontal plane (H) including the above-mentioned first line segment (v), passes through the center point of a second line segment (the line segment indicated by arrow w in FIG. 39) between the inner wall surfaces of the above-mentioned enclosed container 2, the second line segment being substantially orthogonal to the above-mentioned first line segment (v), and which is substantially orthogonal to the above-mentioned second line segment (w), or (3) on a third plane (the horizontal plane indicated by straight line Y in FIG. 38) which passes through the center point of a third line segment (the line segment indicated by arrow x in FIG. 38) having the maximum distance between the upper inner wall surface of the above-mentioned enclosed container 2 and the surface of the above-mentioned lubricant 17 in the vertical direction, and which is substantially orthogonal to the above-mentioned third line segment (x).

The opening end 271*a* of the first suction pipe 271 is disposed on at least one of the above three planes.

In the hermetic-type compressor of embodiment 14 shown in FIGS. 38 and 39, the opening end 271*a* of the first suction pipe 271 is disposed on the first plane (W).

As shown in FIGS. 38 and 39, the opening end 281*a* of a second suction pipe 281 is disposed near the opening end 271*a* of the first suction pipe 271. This second suction pipe 281 is extended outside the enclosed container 2.

Next, the operation of the hermetic-type compressor of embodiment 14 having the above-mentioned configuration is described below.

The pressure wave generated near the valve plate 211 propagates in the direction opposite to the flow of refrigerant gas, and becomes a reflected wave having an inverse phase in the space inside the enclosed container 2. This reflected wave propagates in the same direction as the flow of the refrigerant gas, and returns to the suction hole 211*a*.

By aligning the time when this reflected wave reaches the suction hole 211*a* with the time when the volume inside the cylinder 10 becomes maximum (suction completion time), the pressure energy of the reflected wave is added to the refrigerant gas at the suction completion time, and the suction pressure of the refrigerant gas rises.

Therefore, refrigerant gas having a higher density is charged into the cylinder 10, the discharge amount of refrigerant per a compression stroke increases, and the circulation amount of refrigerant increases. Consequently, the hermetic-type compressor of embodiment 14 has significantly improved refrigeration capability.

Refrigerant gas in the second suction pipe 281, circulated from a system such as a refrigeration apparatus, is relieved once in the space inside the enclosed container 2 and sucked into the cylinder 10 via the suction pipe 271 secured to the valve plate 211, and is compressed by the piston 11. At this time, the refrigerant gas is sucked into the cylinder 10 by one half rotation of a crankshaft 12, and compressed by the other half rotation.

In this way, since the refrigerant gas is not sucked continuously into the cylinder 10, the pressure pulsation of the refrigerant gas occurs in the first suction pipe 271. Therefore, the pressure pulsation vibrates the space inside the enclosed container 2, and resonance modes are generated in the reciprocating direction of the piston 11, in the direction perpendicular to the reciprocating direction on the horizontal plane including the reciprocating direction of the piston 11, and in the axial direction of the crankshaft 12.

However, as described above, the opening end 271*a* of the first suction pipe 271 in the space inside the enclosed container 2 is disposed on a plane (W) passing through the center point of a line indicated by distance a (FIG. 39) and orthogonal to the line; in other words, on the plane including the position of a node of the resonance mode in the direction perpendicular to the reciprocating direction on the horizontal plane including the reciprocating direction of the piston 11. Therefore, the pressure pulsation component for causing the resonance mode is concentrated on the node of the resonance mode.

Consequently, in the hermetic-type compressor of embodiment 14, the pressure pulsation vibrates the node of the resonance mode. Therefore, in this hermetic-type compressor, no resonance mode is caused, the generation of resonance sound can be prevented, and noise generation in the hermetic-type compressor due to resonance sound is prevented.

Furthermore, in the hermetic-type compressor of embodiment 14, the opening end 281*a* of the second suction pipe 281 inside the enclosed container 2 is provided near the opening end 271*a* of the first suction pipe 271 inside the enclosed container 2. Therefore, the refrigerant gas to be sucked into the first suction pipe 271 can be prevented from being heated by the refrigerant gas inside the enclosed container 2. Thus, in the hermetic-type compressor of embodiment 14, since the velocity of sound in refrigerant gas reduces, compression capability becomes high, a large pressure wave is generated, and the suction pressure of the refrigerant gas rises significantly.

Since the hermetic-type compressor of embodiment 14 is configured as described above, refrigerant gas having a higher density is charged into the cylinder 10, and the discharge amount of refrigerant per a compression stroke increases. Therefore, in the hermetic-type compressor of embodiment 14, the circulation amount of refrigerant increases, and refrigeration capability can be improved significantly.

In embodiment 14, the opening end 271*a* of the first suction pipe 271 used as a suction passage is disposed at the node of the resonance mode in the direction perpendicular to the reciprocating direction on the horizontal plane including the reciprocating direction of the piston 11. However, the opening end 271*a* of the first suction pipe 271 may be disposed at the position of the node of the resonance mode wherein the opening end of the suction passage in the space inside the enclosed container 2 relates to the problem of the node of the resonance mode, such as the node of the resonance mode in the reciprocating direction of the piston 11, or the node of the resonance mode in the axial direction of the crankshaft 12.

Embodiment 14 of the present invention is applicable regardless of the number of the cylinders 10. Furthermore, even when the number of suction passages is two or more, the same effect as that of embodiment 14 can be obtained by disposing the opening end of each suction passage inside the enclosed container 2 at the above-mentioned position of the node of the resonance mode.

Even when the first suction pipe 271 used as a suction passage is configured to be connected to the suction hole 211*a* of the valve plate 211 via a small space (a space having substantially the same sectional shape), nearly the same effect as that of the above-mentioned embodiment 14 can be obtained.

As described above, embodiment 14 can prevent resonance from generating in the enclosed container, and can also prevent noise due to resonance sound from increasing in the hermetic-type compressor. And the hermetic-type compressor of embodiment 14 can obtain advantageous effects of raising the density of refrigerant gas and improving refrigeration capability.

According to embodiment 14, the opening end of the suction passage to the enclosed container becomes the node of the resonance mode, the generation of shock sound due to a pressure wave in the suction passage is reduced significantly, and noise increase in the hermetic-type compressor can be prevented. Therefore, the hermetic-type compressor of embodiment 14 can obtain advantageous effects of raising the density of refrigerant gas and greatly improving refrigeration capability.

EMBODIMENT 15

Next, embodiment 15, an example of the hermetic-type compressor of the present invention, will be described below referring to the accompanying drawings.

Figure 40:
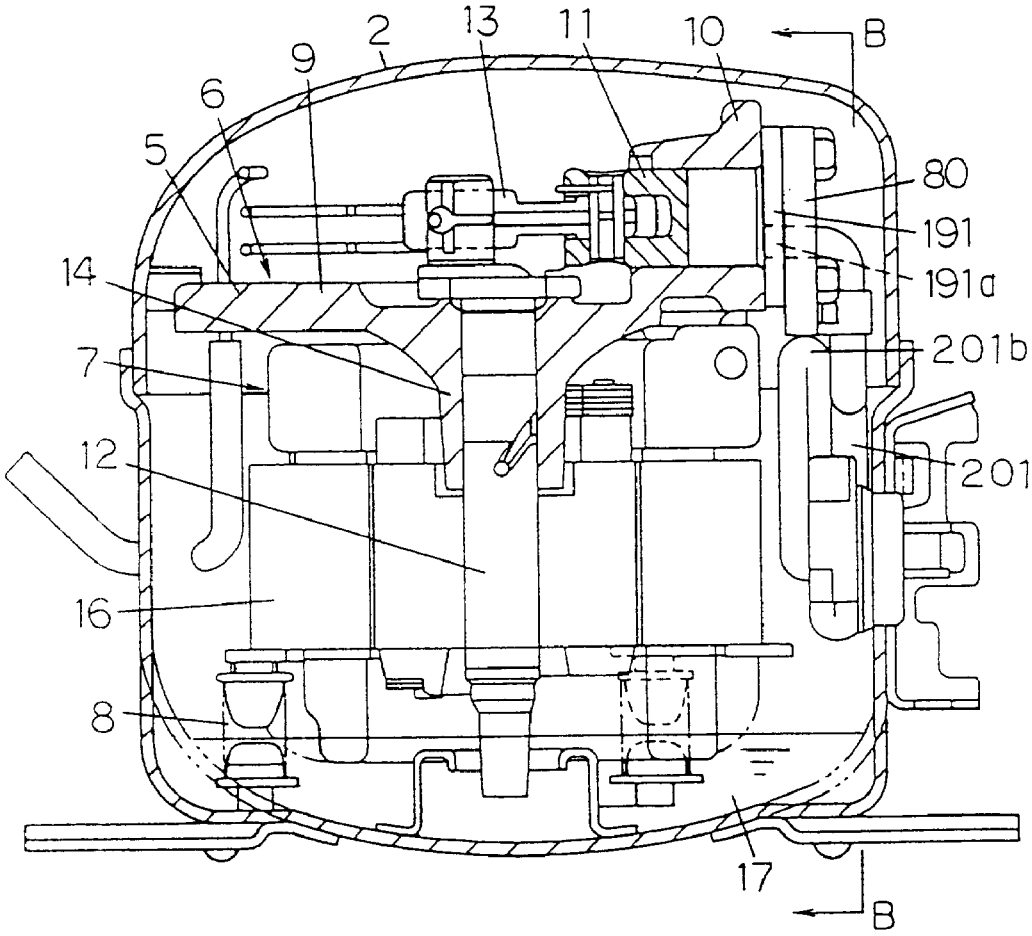
FIG. 40 is a vertical sectional view showing a hermetic-type compressor in accordance with embodiment 15 of the present invention.
Figure 41:
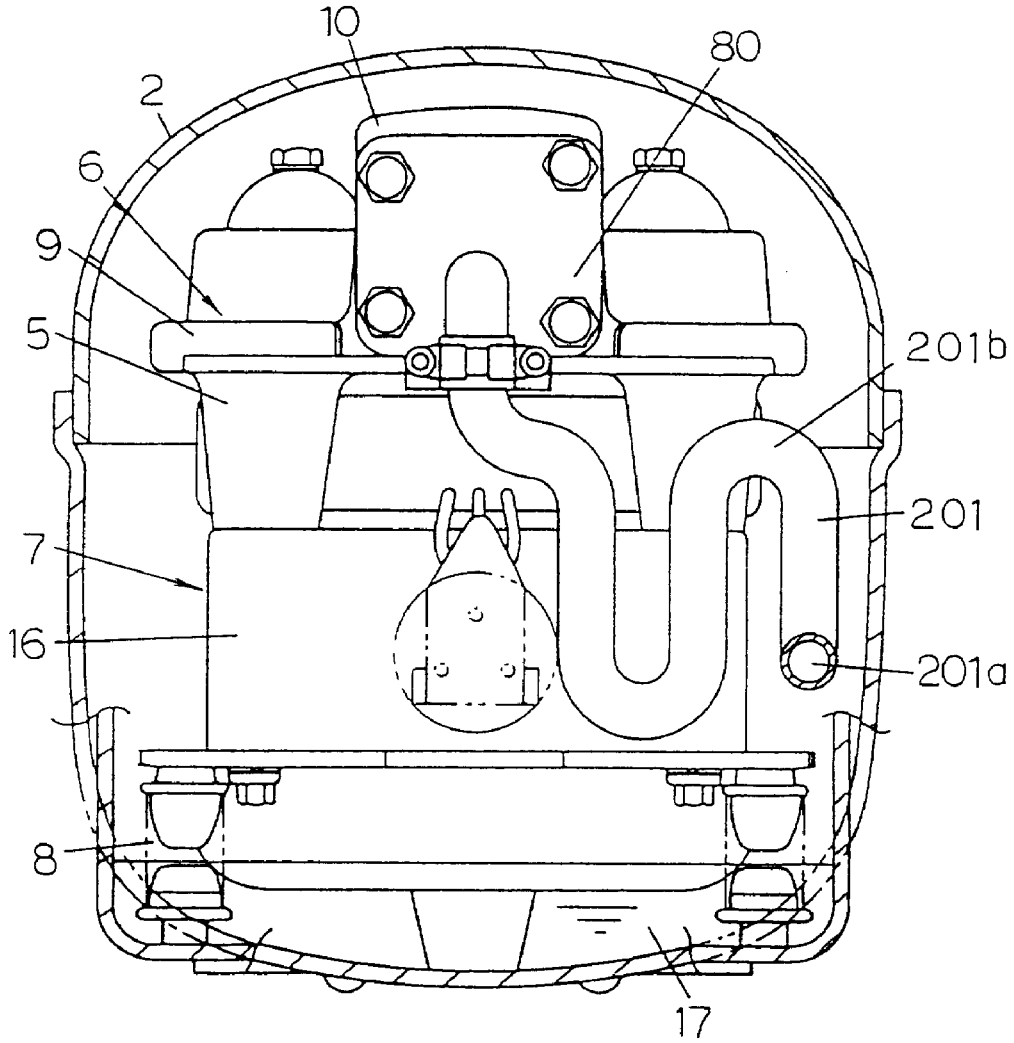
FIG. 41 is a front sectional view showing the hermetic-type compressor in accordance with embodiment 15 of the present invention taken on line B—B of FIG. 40.
Figure 42:
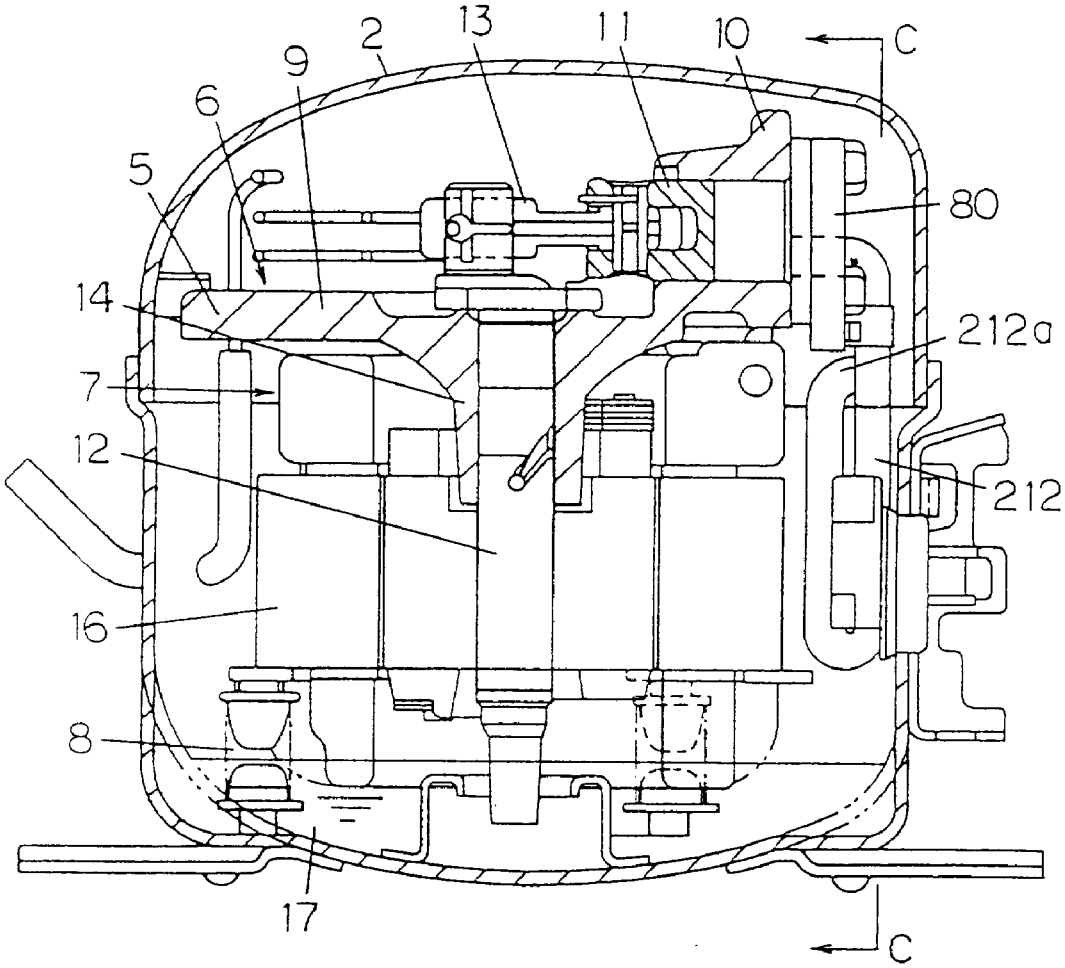
FIG. 42 is a vertical sectional view showing the hermetic-type compressor in accordance with embodiment 15 of the present invention having another shape of suction passage.
Figure 43:
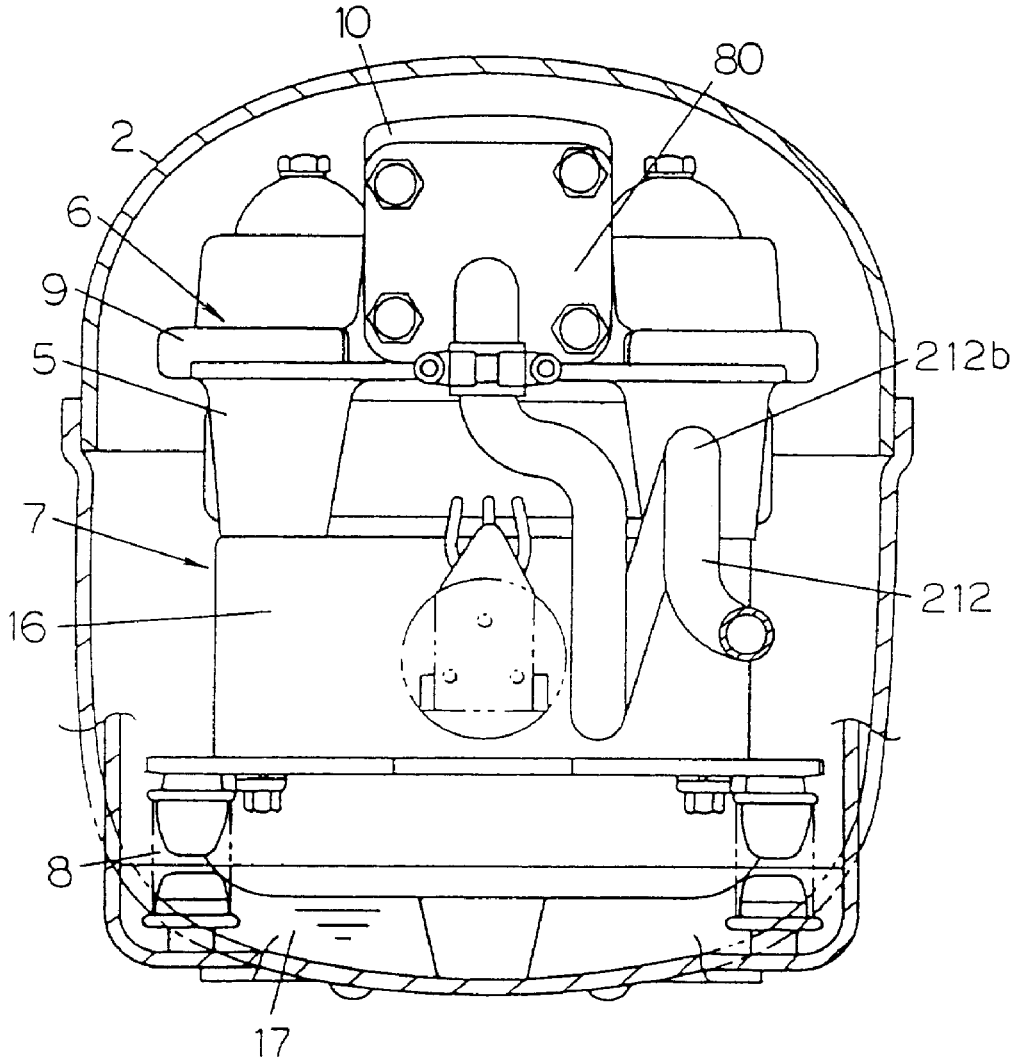
FIG. 43 is a front sectional view showing the hermetic-type compressor in accordance with embodiment 15 of the present invention taken on line C—C of FIG. 42.

FIG. 40 is a vertical sectional view showing the hermetic-type compressor in accordance with embodiment 15 of the present invention. FIG. 41 is a front sectional view showing the hermetic-type compressor taken on line B—B of FIG. 40. FIG. 42 is a vertical sectional view showing the hermetic-type compressor in accordance with embodiment 15 having a suction passage of another shape. FIG. 43 is a front sectional view showing the hermetic-type compressor taken on line C—C of FIG. 42.

In the hermetic-type compressor of embodiment 15, components having the same functions and configurations as those of the hermetic-type compressor of each of the above-mentioned embodiments are designated by the same marks, and their descriptions are omitted.

In FIGS. 40 and 41, a suction hole 191*a* is formed in a valve plate 191 secured to the end surface of the cylinder 10 of a mechanical portion 6, and this suction hole 191*a* is directly connected to one end of a first suction pipe 201 (suction passage). The other end of the first suction pipe 201 is disposed as an opening end 201*a* at a predetermined position in the space inside an enclosed container 2. The first suction pipe 201 (suction passage) has bent portions 201*b* having a nearly uniform curvature.

Next, the operation of the hermetic-type compressor of embodiment 15 having the above-mentioned configuration is described below.

The pressure wave generated during a suction stroke near the suction hole 191*a* of the valve plate 191 propagates in the direction opposite to the flow of refrigerant gas, becomes a reflected wave having an inverse phase in the space inside the enclosed container 2, propagates in the same direction as that of the flow of the refrigerant gas, and returns to the suction hole 191*a*.

This reflected wave reaches the suction hole 191*a* during the suction stroke, whereby the pressure energy of the reflected wave is added to refrigerant gas at suction completion time, and the suction pressure of the refrigerant gas is raised.

Therefore, in the hermetic-type compressor of embodiment 15, refrigerant gas having a higher density is charged into the cylinder 10, the discharge amount of refrigerant per a compression stroke increases, and the circulation amount of refrigerant increases, whereby refrigeration capability can be improved.

In addition, in the hermetic-type compressor of embodiment 15, by making the curvature of each bent portion 201*b* of the first suction pipe 201 nearly uniform, the amplitude of the pressure wave at the bent portions can be prevented from decreasing, the reflected wave having high pressure can be returned into the cylinder 10, whereby higher refrigeration capability can be obtained.

In addition, in the hermetic-type compressor of embodiment 15, the first suction pipe can be made compact, whereby the enclosed container 2 can be made smaller.

As described above, the hermetic-type compressor of embodiment 15 comprises the valve plate 191 having the suction hole 191*a* and disposed at the end surface of the cylinder 10, and the first suction pipe 201, one end of which is open in the space inside the enclosed container 2 and the other end of which is nearly directly connected to the suction hole 191*a* of the valve plate 191, having the bent portions 201*b* with a nearly uniform curvature. Therefore, in the hermetic-type compressor of embodiment 15, the attenuation of the pressure amplitudes of the pressure wave and the reflected wave can be reduced. Therefore, in the hermetic-type compressor of embodiment 15, suction pressure can be raised, and high refrigeration capability can be obtained.

In the hermetic-type compressor of embodiment 15, by forming the first suction pipe used as a suction passage in the shape of a spiral suction pipe 212 as shown in FIGS. 42 and 43, the curvature of the bent portions 212*b* can be made larger. Therefore, in the hermetic-type compressor of embodiment 15, the attenuation of the pressure in the first suction pipe 212 can be reduced further.

In embodiment 15, the first suction pipe 201, 212 is nearly directly connected to the suction pipe 191*a* of the valve plate 191. However, even when the first suction pipe 201, 212 is connected to the suction hole 191*a* of the valve plate 191 via a passage space having substantially the same cross-sectional area, the same effect of that of the above-mentioned embodiment 15 can be obtained.

In the hermetic-type compressor of embodiment 15, the suction passage is formed of the pipe-shaped first suction pipe 201, 212. However, even when the suction passage is formed of a block-shaped component having a suction passage for example instead of the suction pipe, the same effect as that of the above-mentioned embodiment 15 can be obtained.

EMBODIMENT 16

Next, embodiment 16, an example of the hermetic-type compressor of the present invention, will be described below referring to the accompanying drawings.

Figure 44:
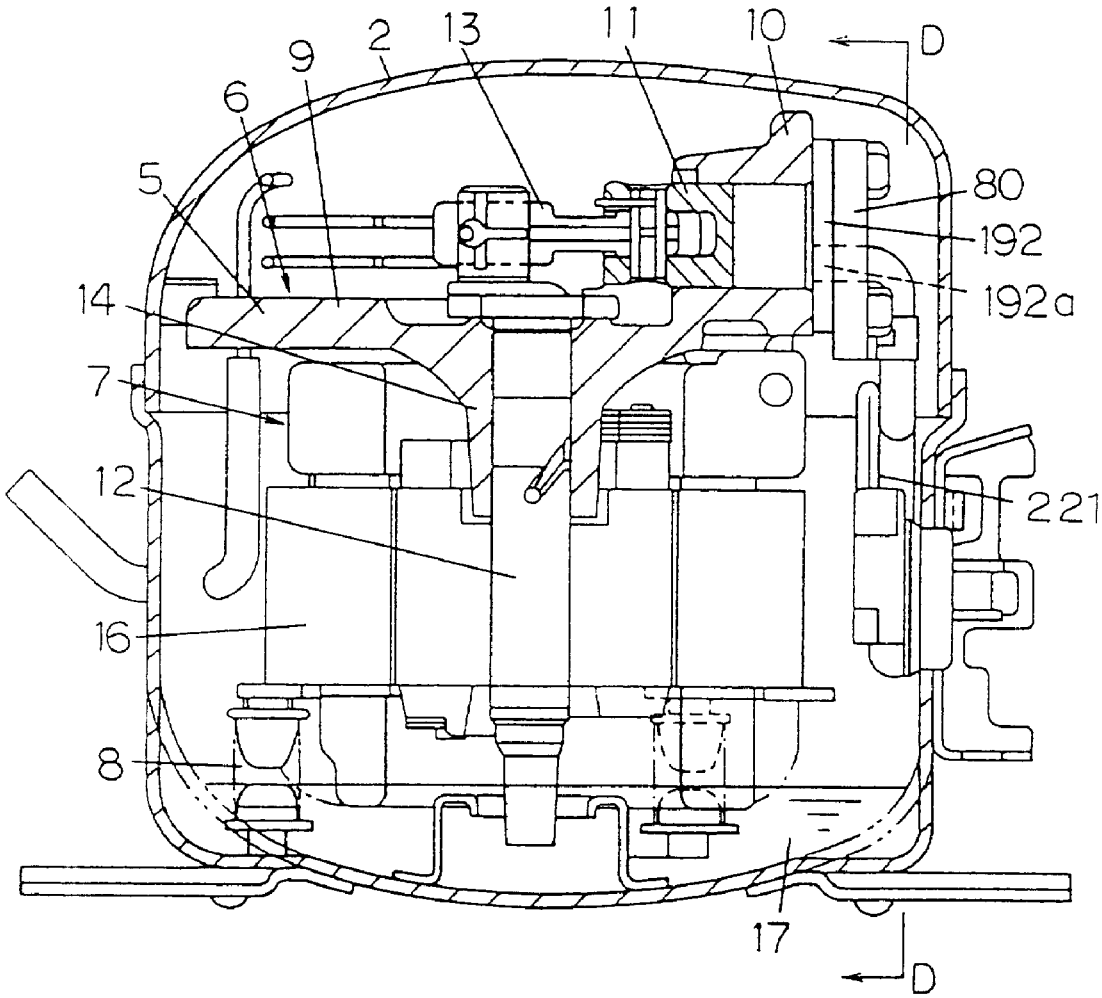
FIG. 44 is a vertical sectional view showing a hermetic-type compressor in accordance with embodiment 16 of the present invention.
Figure 45:
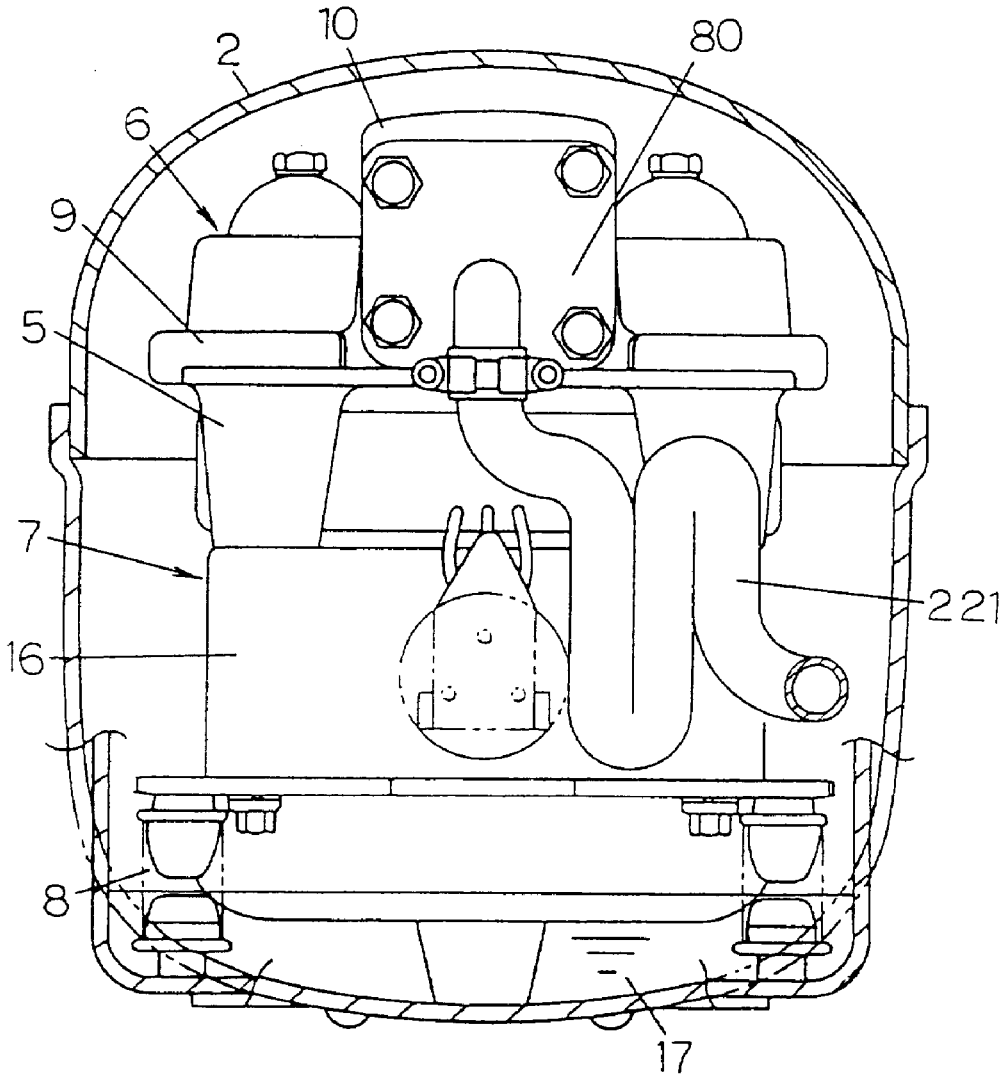
FIG. 45 is a front sectional view showing the hermetic-type compressor in accordance with embodiment 16 of the present invention taken on line D—D of FIG. 44.

FIG. 44 is a vertical sectional view showing the hermetic-type compressor in accordance with embodiment 16 of the present invention. FIG. 45 is a front sectional view showing the hermetic-type compressor taken on line D—D of FIG. 44.

In the hermetic-type compressor of embodiment 16, components having the same functions and configurations as those of the hermetic-type compressor of each of the above-mentioned embodiments are designated by the same marks, and their descriptions are omitted.

In FIGS. 44 and 45, a suction hole 192*a* is formed in a valve plate 192 secured to the end surface of the cylinder 10 of a mechanical portion 6, and this suction hole 192*a* is directly connected to one end of a first suction pipe 221 (suction passage). The other end of the first suction pipe 221 is disposed as an opening end 221*a* at a predetermined position in the space inside an enclosed container 2. As shown in FIG. 45, the first suction pipe 221 (suction passage) is bent a plurality of times so that the portions of the suction passage come close to each other.

Next, the operation of the hermetic-type compressor of embodiment 16 having the above-mentioned configuration is described below.

The pressure wave generated during a suction stroke near the suction hole 192*a* of the valve plate 192 propagates in the direction opposite to the flow of refrigerant gas, becomes a reflected wave having an inverse phase in the space inside the enclosed container 2, propagates in the same direction as the flow of the refrigerant gas, and returns to the suction hole 192*a*.

This reflected wave reaches the suction hole 192*a* during the suction stroke, whereby the pressure energy of the reflected wave is added to refrigerant gas at suction completion time, and the suction pressure of the refrigerant gas is raised.

Therefore, in the hermetic-type compressor of embodiment 16, refrigerant gas having a higher density is charged into the cylinder 10, the discharge amount of refrigerant per a compression stroke increases, and the circulation amount of refrigerant increases, whereby refrigeration capability can be improved.

In the hermetic-type compressor of embodiment 16, the first suction pipe 221 is bent a plurality of times so that the portions of the suction pipe 221, through which low-temperature suction gas flows, are disposed closely. Therefore, the hermetic-type compressor of embodiment 16 is less affected by the refrigerant gas in the enclosed container 2, which is heated to high temperature by the effect of compression heat, motor heat, sliding heat and the like in the enclosed container 2.

As a result, in the hermetic-type compressor of embodiment 16, the high-temperature refrigerant gas in the enclosed container 2 is prevented from transferring to the first suction pipe 221, and the temperature rise of the suction gas in the first suction pipe 221 can be decreased. Consequently, in the hermetic-type compressor of embodiment 16, the density of the suction gas can be raised, and the circulation amount of refrigerant can be increased.

In the hermetic-type compressor of embodiment 16, the temperature (suction gas temperature) of refrigerant gas to be sucked is low, and refrigerant gas having a high density is sucked into the suction pipe 221. Therefore, since the velocity of sound in the suction gas is lowered, the effect of the compressibility of the refrigerant gas is enhanced, a large pressure wave generates, and high refrigeration capability can be obtained.

In addition, in the hermetic-type compressor of embodiment 16, the first suction pipe 221 can be made compact, and the enclosed container can be made smaller.

As described above, the hermetic-type compressor of embodiment 16 comprises the valve plate 191 having the suction hole 191*a* and disposed at the end surface of the cylinder 10, and the first suction pipe 221, one end of which is open in the space inside the enclosed container 2 and the other end of which is nearly directly connected to the suction hole 191*a* of the valve plate 191, bent a plurality of times so that the portions of the suction passage come close to each other. Therefore, in the hermetic-type compressor of embodiment 16, the amount of heat received from the high-temperature refrigerant gas in the enclosed container 1 by the first suction pipe 221 is lessened, the temperature rise of the first suction pipe 221 is reduced, and the temperature rise of the suction gas in the first suction pipe 221 is reduced. As a result, the hermetic-type compressor of embodiment 16 can obtain a large circulation amount of refrigerant.

In addition, in the hermetic-type compressor of embodiment 16, since the temperature of the suction gas is low, and refrigerant gas having a high density is sucked into the suction pipe 221, the velocity of sound in the refrigerant gas to be sucked is lowered. Therefore, the influence of the compressibility of the refrigerant gas is enhanced, a large pressure wave generates, and the improvement effect of high refrigeration capability can be obtained.

In embodiment 16, the first suction pipe 221 is bent a plurality of times so that the portions of the suction passage can come close to each other, and so that the first suction pipe 221 can receive less amount of heat from the high-temperature refrigerant gas in the enclosed container; however, the same effect as that of the hermetic-type compressor of the above-mentioned embodiment 16 can be obtained by using a block-shaped component having portions of a suction passage disposed close to each other for example.

In embodiment 16, the portions of the first suction pipe 221 are disposed close to each other. However, by contacting the portions of the first suction pipe 221 tightly close to each other, the area for heat exchange between the first suction pipe 221 and the high-temperature refrigerant gas in the enclosed container may be reduced. With this configuration, in the hermetic-type compressor of the present invention, the heat receiving amount at the first suction pipe 221 can be decreased, and the improvement effect of higher refrigeration capability can be obtained.

In embodiment 16, the first suction pipe 221 is nearly directly connected to the suction hole 191*a* of the valve plate 191. However, even when the first suction pipe 221 is connected to the suction hole 191*a* of the valve plate 191 via a passage space having substantially the same cross-sectional area, nearly the same effect can be obtained.

EMBODIMENT 17

Next, embodiment 17, an example of the hermetic-type compressor of the present invention, will be described below referring to the accompanying drawings.

Figure 46:
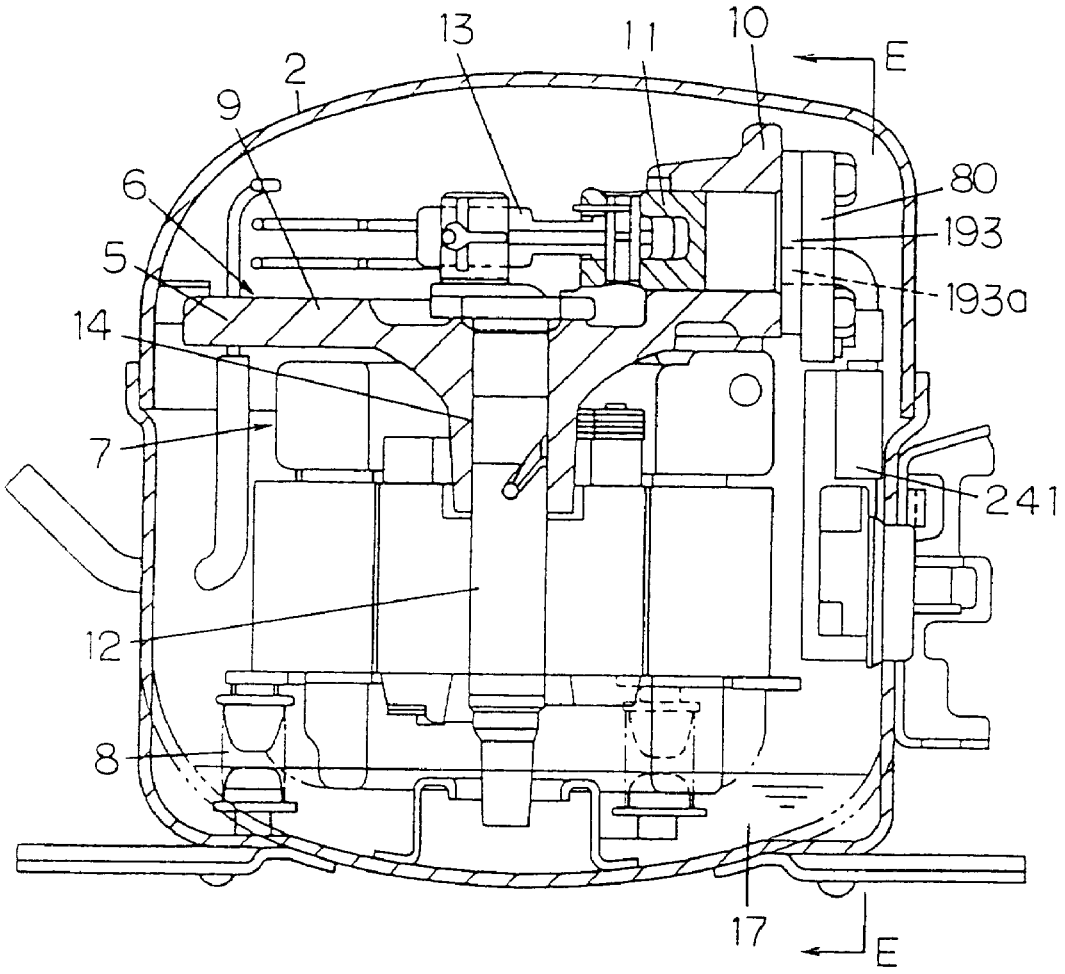
FIG. 46 is a vertical sectional view showing a hermetic-type compressor in accordance with embodiment 17 of the present invention.
Figure 47:
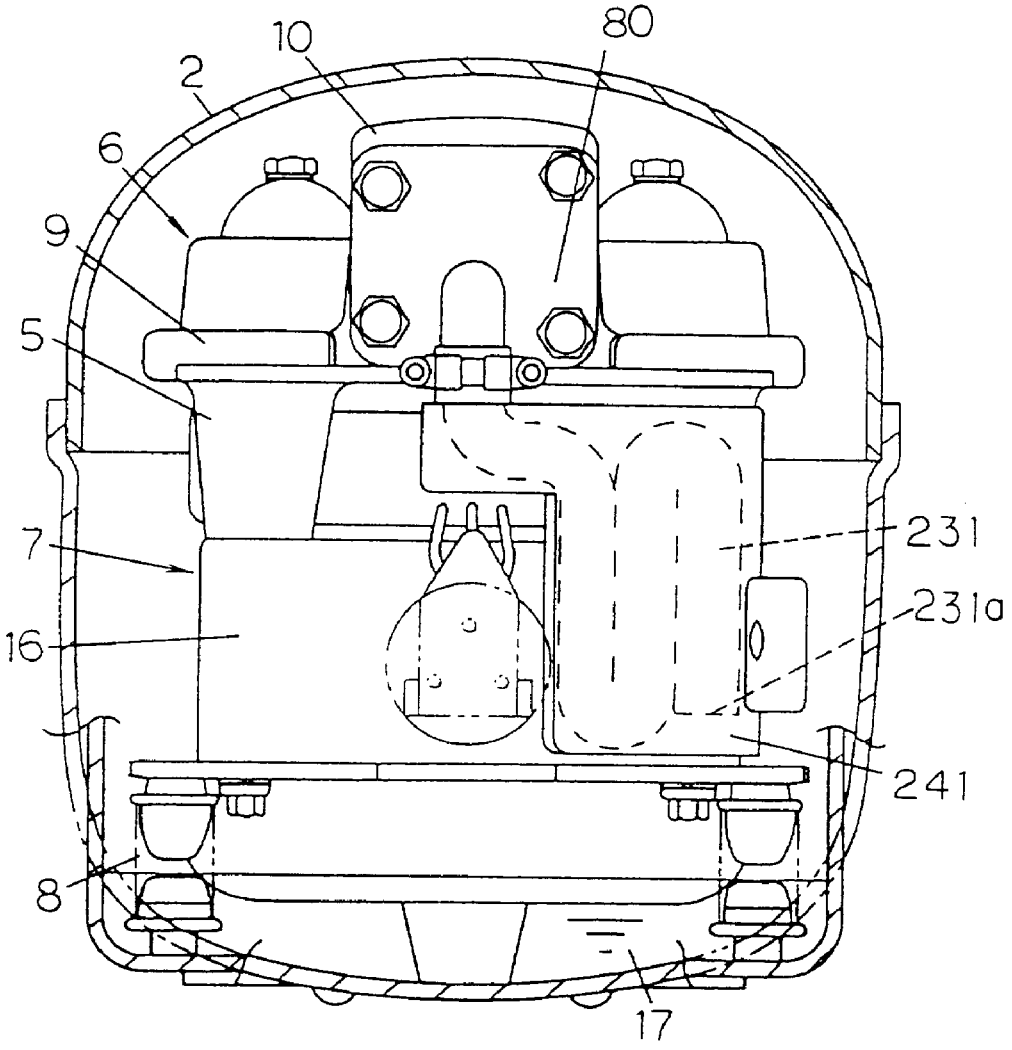
FIG. 47 is a front sectional view showing the hermetic-type compressor in accordance with embodiment 17 of the present invention taken on line E—E of FIG. 46.

FIG. 46 is a vertical sectional view showing the hermetic-type compressor in accordance with embodiment 17 of the present invention. FIG. 47 is a front sectional view showing the hermetic-type compressor taken on line E—E of FIG. 46.

In the hermetic-type compressor of embodiment 17, components having the same functions and configurations as those of the hermetic-type compressor of each of the above-mentioned embodiments are designated by the same marks, and their descriptions are omitted.

In FIGS. 46 and 47, a suction hole 193*a* is formed in a valve plate 193 secured to an end surface of a cylinder 10 of a mechanical portion 6, and this suction hole 193*a* is directly connected to one end of a first suction pipe 231 (suction passage). The other end of the first suction pipe 231 is disposed as an opening end 231*a* at a predetermined position in the space inside an enclosed container 2. As shown in FIG. 47, the first suction pipe 231 (suction passage) is bent a plurality of times so that the portions of the suction passage come close to each other.

As shown in FIG. 47, a suction muffler 241 is provided in the hermetic-type compressor of embodiment 17. This suction muffler 241 is configured so as to nearly cover the first suction pipe 231. The suction muffler 241 has a volume required to reflect a pressure wave.

Next, the operation of the hermetic-type compressor of embodiment 17 having the above-mentioned configuration is described below.

The pressure wave generated during a suction stroke near the suction hole 193*a* of the valve plate 193 propagates in the direction opposite to the flow of refrigerant gas, becomes a reflected wave having an inverse phase in the space inside the enclosed container 2, propagates in the same direction as the flow of the refrigerant gas, and returns to the suction hole 193*a*.

This reflected wave reaches the suction hole 193*a* during the suction stroke, whereby the pressure energy of the reflected wave is added to refrigerant gas at suction completion time, and the suction pressure of the refrigerant gas is raised.

Therefore, in the hermetic-type compressor of embodiment 17, refrigerant gas having a higher density is charged into the cylinder 10. Therefore, in the hermetic-type compressor of embodiment 17, the discharge amount of refrigerant per a compression stroke increases, and the circulation amount of refrigerant increases, whereby refrigeration capability can be improved.

At this time, in the hermetic-type compressor of embodiment 17, the opening end 231*a* of the first suction pipe 231 is disposed in the suction muffler 241. Therefore, in the hermetic-type compressor of embodiment 17, the pulsation of suction gas is attenuated by the suction muffler 241, the force for vibrating the refrigerant gas in the enclosed container 2 is weakened, and resonance sound can be diminished at all times regardless of the resonance frequency of the refrigerant gas in the enclosed container 2.

In the hermetic-type compressor of embodiment 17, even when the refrigerant gas in the enclosed container 2 resonates, since the opening end 231*a* of the first suction pipe 231 is positioned in the suction muffler 241, when the pressure wave is reflected at the opening end 231*a* of the first suction pipe 231, the pressure wave is not affected by the resonance of the refrigerant gas in the enclosed container 2.

Therefore, in the hermetic-type compressor of embodiment 17, when the pressure wave is reflected at the opening end 241*a* of the first suction pipe 231 in the suction muffler 241, the attenuation of pressure amplitude by the effect of resonance in the space inside the enclosed container 2 is prevented. Therefore, in the hermetic-type compressor of embodiment 17, the suction pressure of the refrigerant gas can be raised at all times, and stable and high refrigeration capability can be obtained, regardless of any change in the shape of the enclosed container 2, operation conditions and the like.

In the hermetic-type compressor of embodiment 17, by covering the first suction pipe 231 with the suction muffler 241, the temperature distribution of the first suction pipe 231 can be made uniform, and a change in the velocity of sound in the refrigerant gas can be decreased. Therefore, in the hermetic-type compressor of embodiment 17, the attenuation of the pressure wave can be decreased, and the suction pressure of the refrigerant gas can be raised stably, and the improvement effect of stable refrigeration capability can be obtained.

In the hermetic-type compressor of embodiment 17, the first suction pipe 231 can be made compact, and the enclosed container 2 can be made smaller.

As described above, the hermetic-type compressor of embodiment 17 comprises the valve plate 191 having the suction hole 191*a* and disposed at the end surface of the cylinder 10, and the first suction pipe 231, one end of which is open in the space inside the enclosed container 2 and the other end of which is nearly directly connected to the suction hole 191*a* of the valve plate 191, and the suction muffler 241 for nearly covering the first suction pipe 231. Therefore, in the hermetic-type compressor of embodiment 17, the pulsation of suction gas is diminished, and the force for vibrating the refrigerant gas in the enclosed container 2 is weakened, whereby resonance sound can be diminished regardless of the resonance frequency of the refrigerant gas in the enclosed container 2.

In the hermetic-type compressor of embodiment 17, regardless of the resonance frequency of the refrigerant gas in the enclosed container 2, the attenuation of the pressure amplitude at the time when the pressure wave is reflected at the opening end 231*a* of the first suction pipe 231 can be always prevented. In the hermetic-type compressor of embodiment 17, the suction pressure of the refrigerant gas rises at all times, and stable and high refrigeration capability can be obtained, regardless of any change in the shape of the enclosed container 2, operation conditions and the like.

In the hermetic-type compressor of embodiment 17, the temperature distribution of the first suction pipe 231 can be made uniform, and the change in the velocity of sound in the refrigerant gas can be decreased. Therefore, in the hermetic-type compressor of embodiment 17, the attenuation of the pressure wave can be decreased, the suction pressure can be raised stably, and stable refrigeration capability can be obtained.

In embodiment 17, the first suction pipe 231 is nearly directly connected to the suction hole 191*a* of the valve plate 191. However, by connecting the first suction pipe 231 to the suction hole 191*a* of the valve plate 192 via a slight space (a passage space having substantially the same sectional shape), the same effect as that of the above-mentioned embodiment 17 can also be obtained.

In embodiment 17, the suction passage is described as the first suction pipe 231. However, the same effect as that of the above-mentioned embodiment 17 can also be obtained by another suction passage, for example, a block-shaped having a suction passage.

EMBODIMENT 18

Next, embodiment 18, an example of the hermetic-type compressor of the present invention, will be described below referring to the accompanying drawings.

Figure 48:
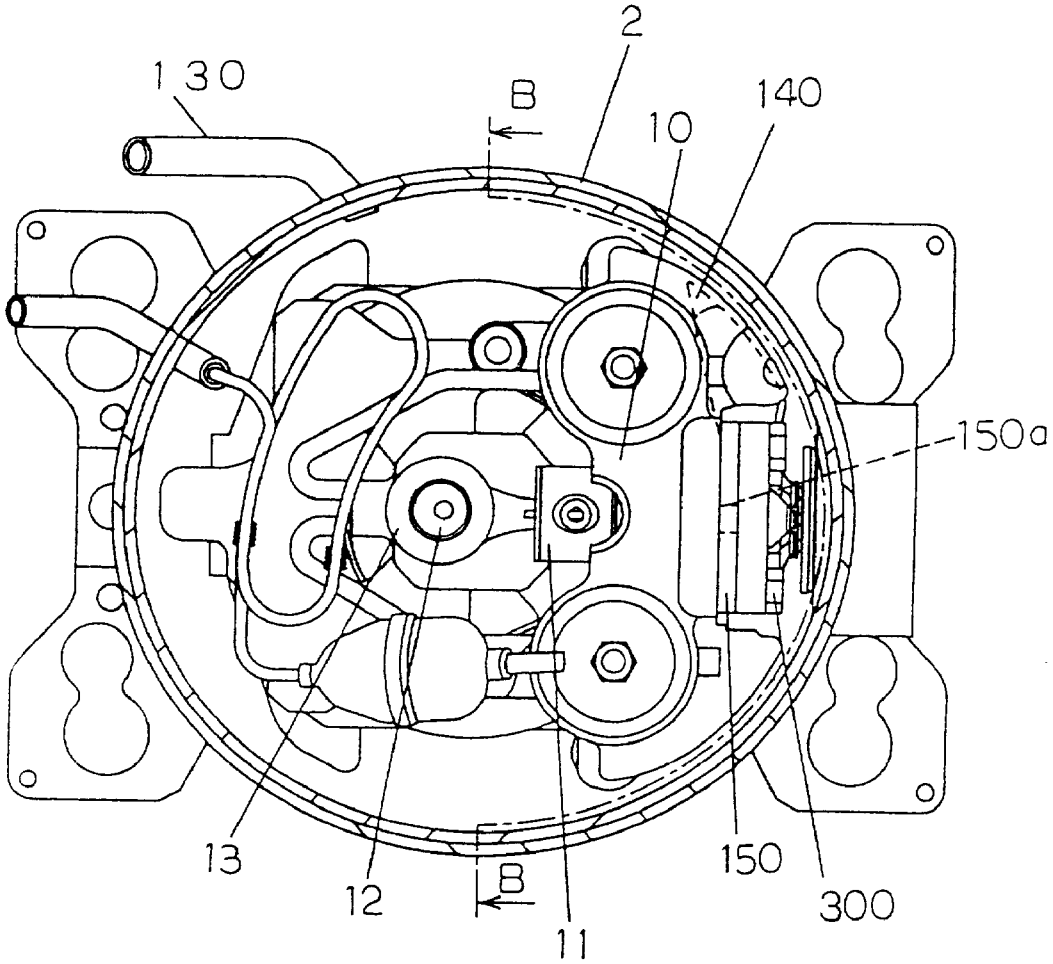
FIG. 48 is a plan sectional view showing a hermetic-type compressor in accordance with embodiment 18 of the present invention.
Figure 49:
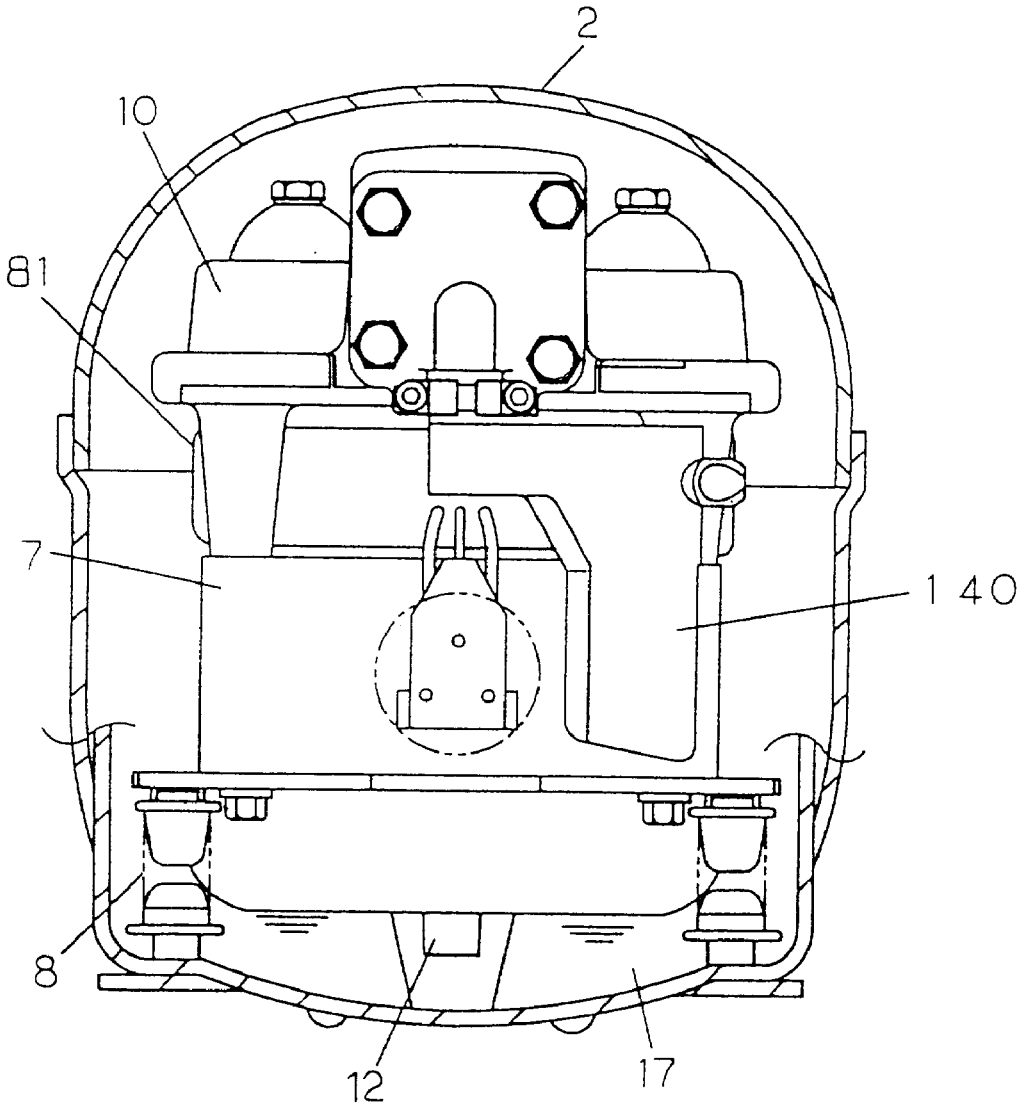
FIG. 49 is a front sectional view taken on line B—B of FIG. 48.
Figure 50:
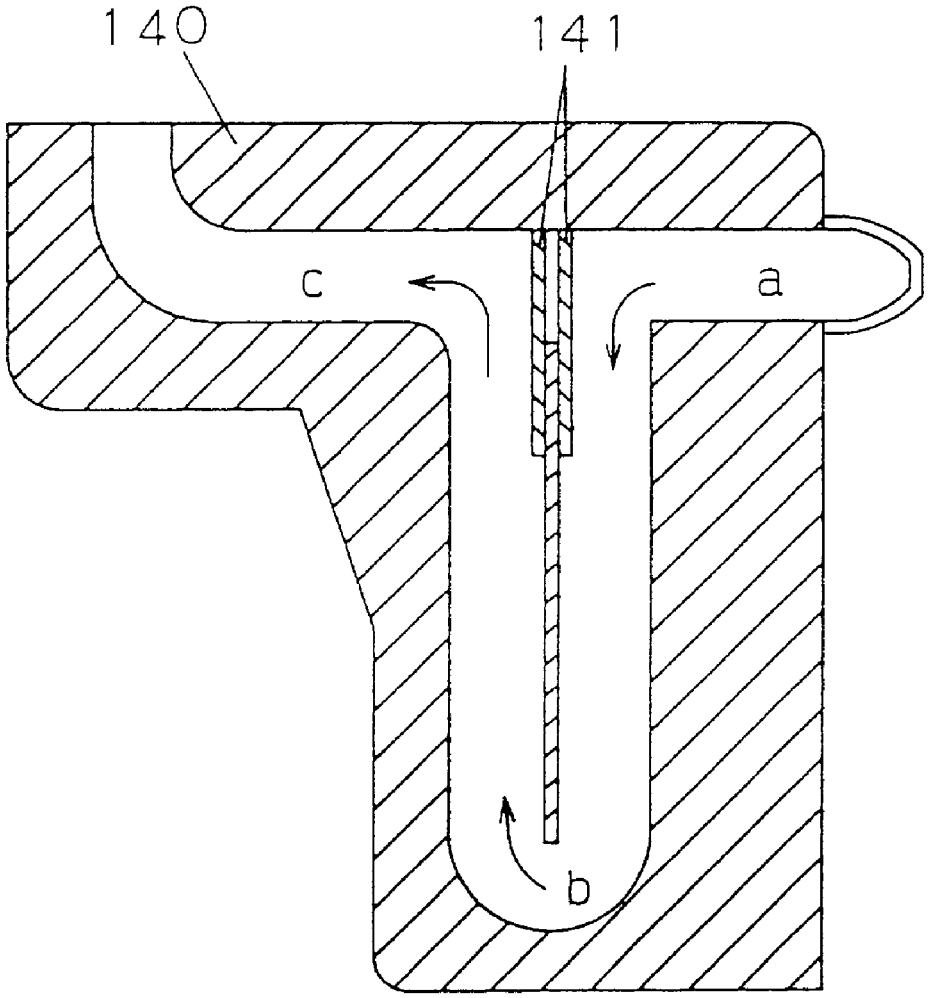
FIG. 50 is a sectional view showing the main portion of the suction passage of the hermetic-type compressor in accordance with embodiment 18 of the present invention during high-load operation.
Figure 51:
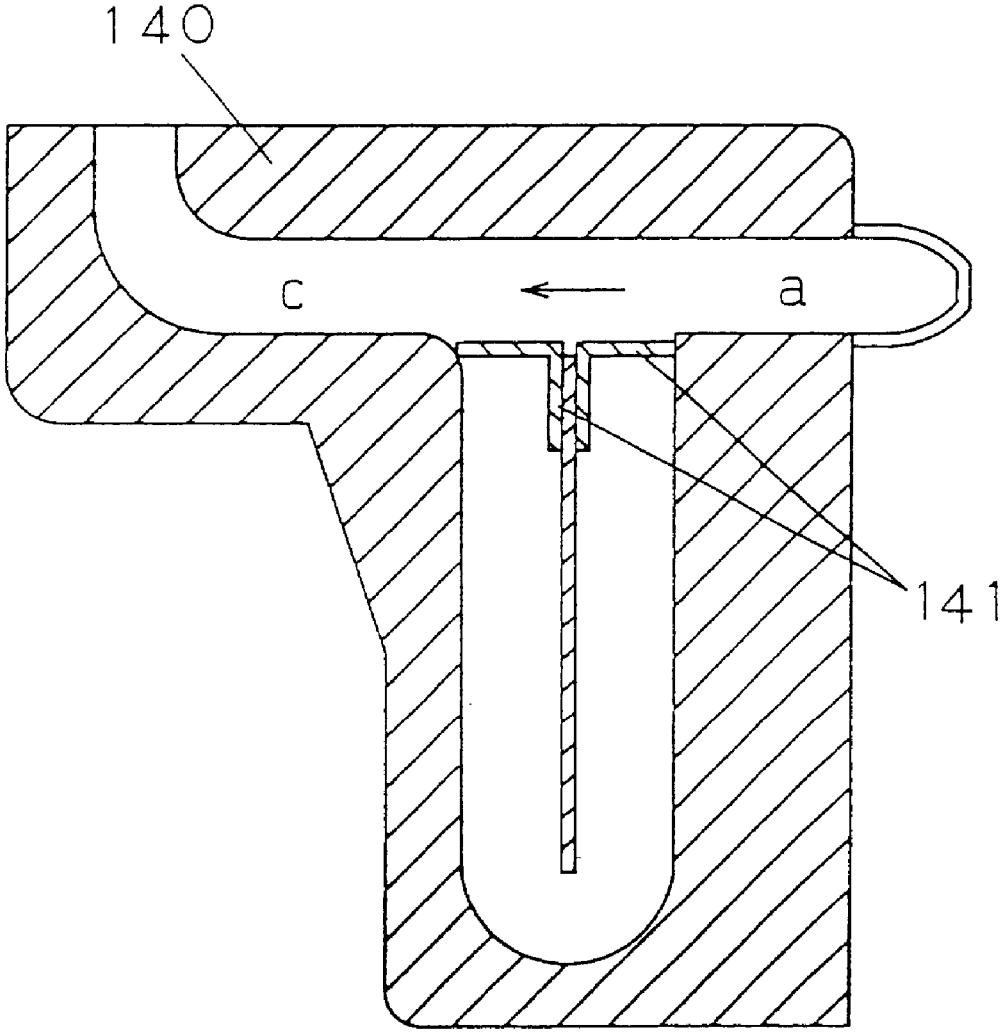
FIG. 51 is a sectional view showing the main portion of the suction passage of the hermetic-type compressor in accordance with embodiment 18 of the present invention during ordinary operation.

FIG. 48 is a plan sectional view showing the hermetic-type compressor in accordance with embodiment 18 of the present invention. FIG. 49 is a front sectional view showing the hermetic-type compressor taken on line B—B of FIG. 48. FIG. 50 is a sectional view showing the main portion of the suction passage of the hermetic-type compressor of embodiment 18 during high-load operation. FIG. 51 is a sectional view showing the main portion of the suction passage of the hermetic-type compressor of embodiment 18 during ordinary operation.

In the hermetic-type compressor of embodiment 18, components having the same functions and configurations as those of the hermetic-type compressor of each of the above-mentioned embodiments are designated by the same marks, and their descriptions are omitted.

In FIGS. 48 and 49, in a suction passage block 140 having a suction passage, one end of the suction passage is disposed as an opening end in the space inside the enclosed container 2, and the other end is nearly directly connected to the suction hole 150*a* of the valve plate 150.

FIGS. 50 and 51 are sectional views showing the main portion of the suction passage block 140. A passage changeover mechanism 141 is disposed in the suction passage block 140. The passage changeover mechanism 141 has a function to select a suction passage depending on a preset temperature, and is formed of a bimetal, a shape-memory alloy, a valve for detecting a high-load condition and selecting a passage, or the like.

Next, the operation of the hermetic-type compressor of embodiment 18 having the above-mentioned configuration is described below.

Generally, no refrigeration apparatus is required to have high refrigeration capability at low outside-air temperature.

However, in such a situation, if a more than necessary circulation amount of refrigerant is supplied by a hermetic-type compressor, suction pressure lowers, and discharge pressure rises. Therefore, the efficiency of the entire refrigeration system including the hermetic-type compressor is lowered, and as a result, the problem of increased overall electric power consumption occurs.

To solve this problem, the circulation amount of refrigerant is decreased at low outside-air temperature, whereby the overall electric power consumption can be decreased.

In the hermetic-type compressor of embodiment 18, the temperatures of various portions rise on the whole at high outside-air temperature or at a high load, and the temperature of the passage changeover mechanism 141 disposed in the suction passage block 140 having the suction passage also rises. In this case, the passage changeover mechanism 141 formed of a bimetal, a shape-memory alloy, a valve for detecting a high-load condition and selecting a passage, or the like is disposed so as to have the shape shown in FIG. 50. The flow of refrigerant gas to be sucked at this time is in the direction of a→b→c in FIG. 50, and the pressure wave generating near the suction hole 150*a* during a suction stroke propagates in the direction opposite to the flow of the refrigerant gas. And the pressure wave becomes a reflected wave having an inverse phase in the space inside the enclosed container 2, and propagates in the same direction as the flow of the refrigerant gas, and returns to the suction hole 150*a*.

This reflected wave is allowed to reach the suction hole 150*a* during the suction stroke, whereby the pressure energy of the reflected wave is added to refrigerant gas at suction completion time, and the suction pressure of the refrigerant gas is raised.

Therefore, in the hermetic-type compressor of embodiment 18, refrigerant gas having a higher density is charged into the cylinder 10. As a result, the discharge amount of refrigerant per a compression stroke increases, and the circulation amount of refrigerant increases. Therefore, in the hermetic-type compressor of embodiment 18, refrigeration capability can be improved significantly at high outside-air temperature or at a high load wherein high refrigeration capability is required, just as in the case of conventional hermetic-type compressors.

On the other hand, the temperatures of the various portions drop on the whole during ordinary operation or at low outside-air temperature, and the temperature of the passage changeover mechanism 141 also drops. In this case, since the passage changeover mechanism 141 is deformed as shown in FIG. 51, the refrigerant gas to be sucked flows in the direction of a a→c as shown in FIG. 51. Therefore, the flow of the refrigerant gas shown in FIG. 51 becomes shorter than the flow in the direction of a→b→c shown in FIG. 50; at the length of the suction passage shown in FIG. 51, the return timing of the pressure wave to the suction hole 150*a* advances excessively, and the pressure energy of the reflected wave is not added to the refrigerant gas at the suction completion time, whereby no supercharging effect can be obtained.

In the opposite case, that is, in case the length of the suction passage of the suction passage block 140 is longer, the return timing of the reflected wave to the suction hole 150*a* is delayed excessively, and the pressure energy of the reflect wave is not added to the refrigerant gas at the suction completion time, whereby no supercharging effect can be obtained.

In this way, in the hermetic-type compressor of embodiment 18 of the present invention, the length of the suction passage and the like are adjusted so that a supercharging effect can be obtained only at high outside-air temperature or at a high load. Therefore, in the hermetic-type compressor of embodiment 18 of the present invention, more than necessary refrigeration capability cannot be generated except at high outside-air temperature or at a high load, whereby electric power consumption can be reduced on the whole.

As described above, the hermetic-type compressor of embodiment 18 comprises the enclosed container 2, an electric compression element 81 housed in the enclosed container 2 and including a compression element 300 and a motor, a cylinder 10 constituting the compression element 300, the valve plate 150 having the suction hole 150*a* and disposed at the end surface of the cylinder 10, and the suction passage block 140 having the suction passage, one end of which is open in the space inside the enclosed container 2, and the other end of which is nearly directly connected to the suction hole 150*a* of the valve plate 150, and the passage changeover mechanism 141 provided in the suction passage. Therefore, the hermetic-type compressor of embodiment 18 is configured so that the supercharging effect can be obtained only at high outside-air temperature or at a high load wherein a high load is applied to the electric compression element, whereby electric power consumption can be reduced on the whole.

In embodiment 18, it is shown that the suction passage is configured so as to be nearly directly connected to the suction hole 150*a* of the valve plate 150; however, even when the suction passage is connected to the suction hole 150*a* of the valve plate 150 via a slight space, the same effect as that of the above-mentioned embodiment 18 can be obtained.

In embodiment 18, its configuration is described by using the suction passage formed in the suction passage block 140 as shown in FIGS. 48 to 51. However, even when the suction passage is formed of a pipe, for example, the same effect as that of the above-mentioned embodiment 18 can be obtained.

EMBODIMENT 19

Next, embodiment 19, an example of the hermetic-type compressor of the present invention, will be described below referring to the accompanying drawings.

Figure 52:
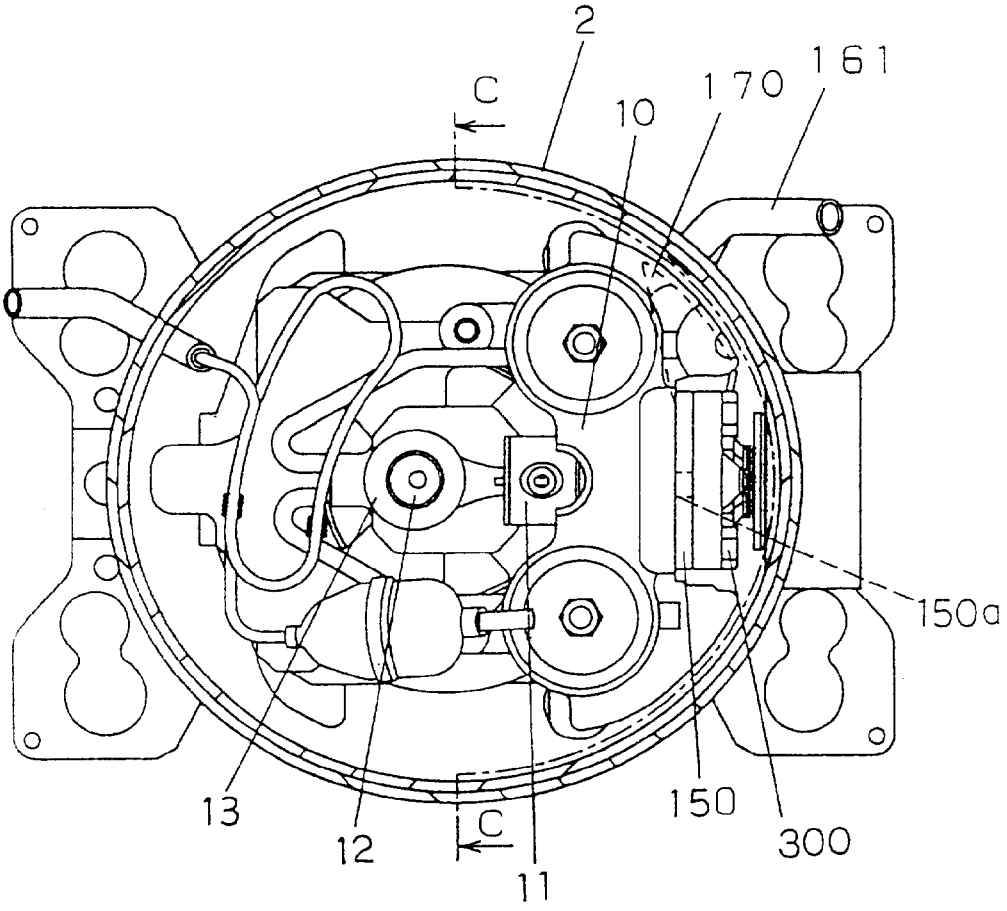
FIG. 52 is a plan sectional view showing a hermetic-type compressor in accordance with embodiment 19 of the present invention.
Figure 53:
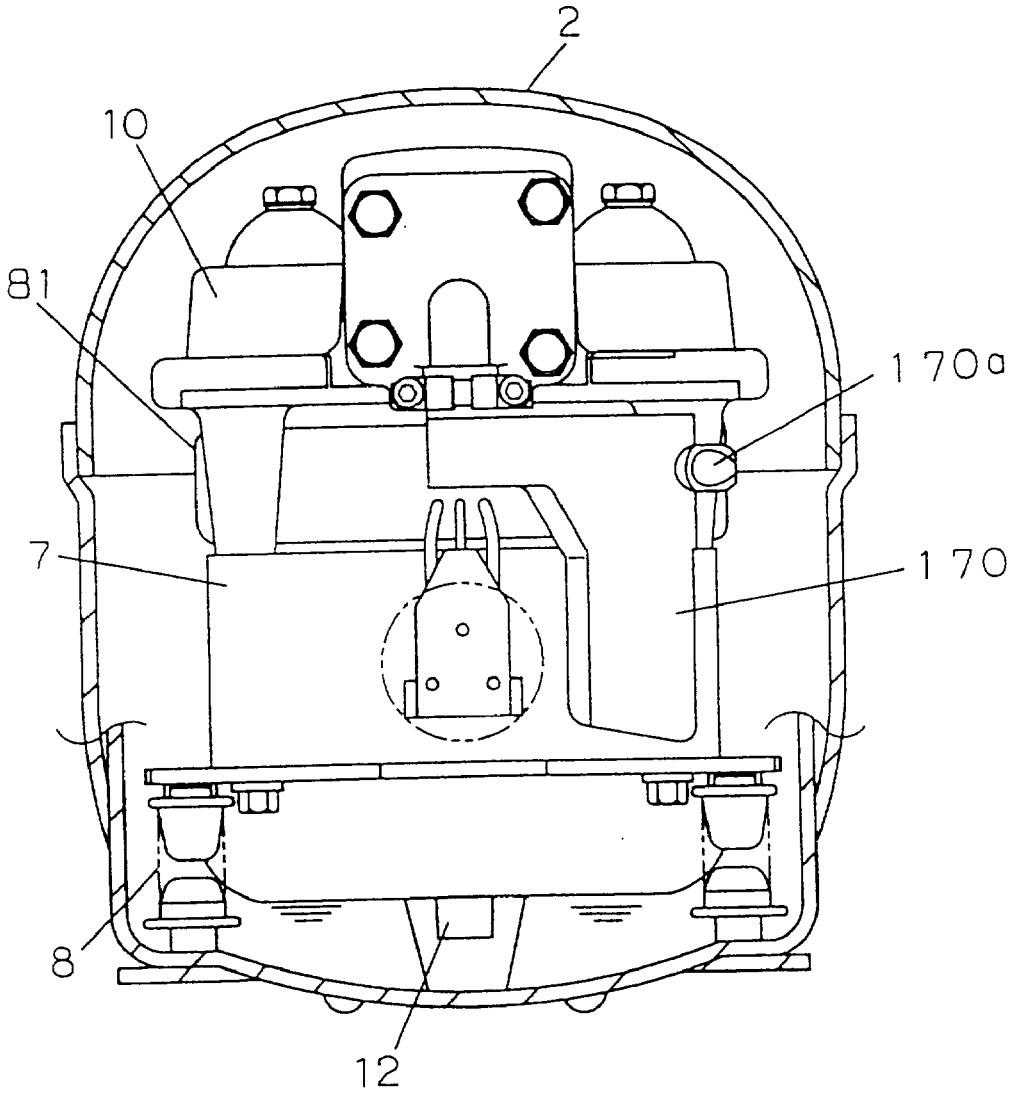
FIG. 53 is a front sectional view taken on line C—C of FIG. 52.
Figure 54:
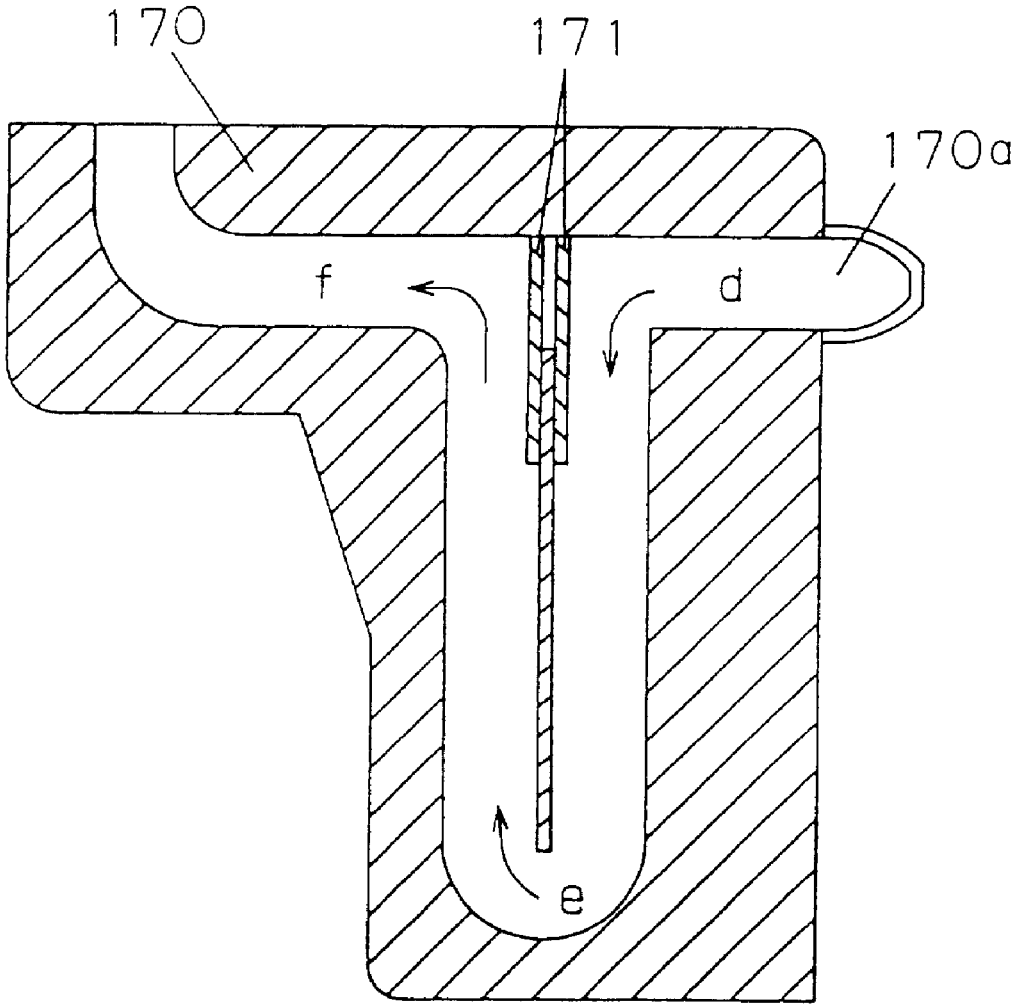
FIG. 54 is a sectional view showing the main portion of the suction passage of the hermetic-type compressor in accordance with embodiment 19 during high-load operation.
Figure 55:
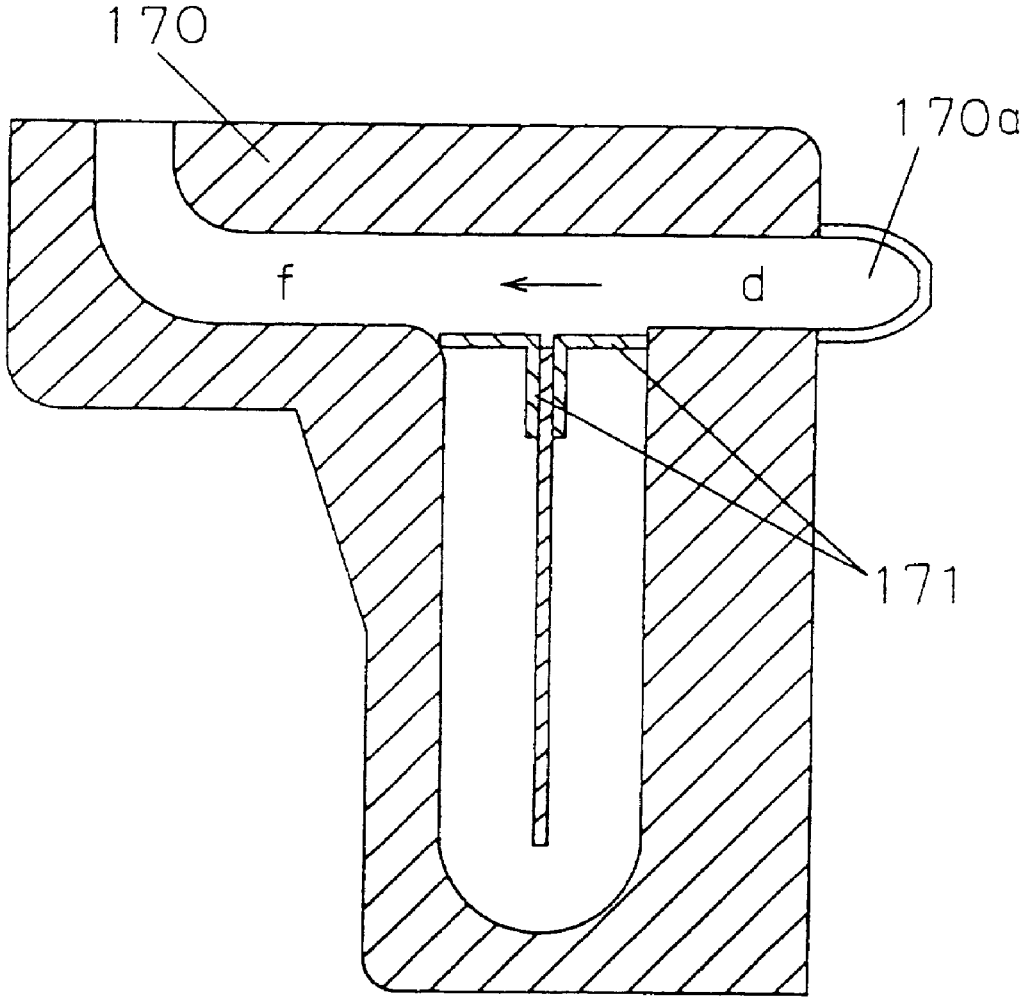
FIG. 55 is a sectional view showing the main portion of the suction passage of the hermetic-type compressor in accordance with embodiment 19 during ordinary operation.

FIG. 52 is a plan sectional view showing the hermetic-type compressor in accordance with embodiment 19 of the present invention. FIG. 53 is a front sectional view taken on line C—C of FIG. 52. FIG. 54 is a sectional view showing the main portion of the suction passage of the hermetic-type compressor of embodiment 19 during high-load operation. FIG. 55 is a sectional view showing the main portion of the suction passage of the hermetic-type compressor of embodiment 19 during ordinary operation.

In the hermetic-type compressor of embodiment 19, components having the same functions and configurations as those of the hermetic-type compressor of each of the above-mentioned embodiments are designated by the same marks, and their descriptions are omitted.

In FIGS. 52 and 53, in a suction passage block 170 having a suction passage, one end of the suction passage is disposed as an opening end 170*a* in the space inside the enclosed container 2, and the other end is nearly directly connected to the suction hole 150*a* of the valve plate 150. A suction pipe 161 is used to introduce refrigerant gas into the enclosed container 2, and the opening end of the suction pipe 161 in the enclosed container is disposed near the opening end 170*a* of the suction passage block 170.

FIGS. 54 and 55 are sectional views showing the main portion of the suction passage block 170, and a passage changeover mechanism 171 is disposed in the suction passage. The passage changeover mechanism 171 has a function to select a suction passage depending on a preset temperature, and is formed of a bimetal, a shape-memory alloy, a valve for detecting a high-load condition and selecting a passage, or the like.

Next, the operation of the hermetic-type compressor of embodiment 19 having the above-mentioned configuration is described below.

Generally, no refrigeration apparatus is required to have high refrigeration capability at low outside-air temperature. However, in such a situation, if a more than necessary circulation amount of refrigerant is supplied by a hermetic-type compressor, suction pressure lowers, and discharge pressure rises. As a result, the efficiency of the entire refrigeration system including the hermetic-type compressor is lowered, and consequently, the problem of increased overall electric power consumption occurs.

To solve this problem, the circulation amount of refrigerant is decreased at low outside-air temperature, whereby electric power consumption can be decreased.

In the hermetic-type compressor of embodiment 19, the temperatures of various portions rise on the whole at high outside-air temperature or at a high load, and the temperature of the passage changeover mechanism 171 disposed in the suction passage of the suction passage block 170 also rises. In this case, the passage changeover mechanism 171 formed of a bimetal, a shape-memory alloy, a valve for detecting a high-load condition and selecting a passage, or the like is disposed so as to have the shape shown in FIG. 54. The flow of refrigerant gas to be sucked at this time takes the direction of d→e→f in FIG. 54, and the pressure wave generating near the suction hole 150*a* during a suction stroke propagates in the direction opposite to the flow of the refrigerant gas. The pressure wave becomes a reflected wave having an inverse phase in the space inside the enclosed container 2, and propagates in the same direction as the flow of the refrigerant gas, and returns to the suction hole 150*a*.

This reflected wave is allowed to reach the suction hole 150*a* during the suction stroke, whereby the pressure energy having the reflected wave is added to refrigerant gas at suction completion time, and the suction pressure of the refrigerant gas is raised.

Therefore, in the hermetic-type compressor of embodiment 19, refrigerant gas having a higher density is charged into the cylinder 10, the discharge amount of refrigerant per a compression stroke increases, and the circulation amount of refrigerant increases. Therefore, in the hermetic-type compressor of embodiment 19, refrigeration capability can be improved significantly at high outside-air temperature or at a high load wherein high refrigeration capability is required, just as in the case of conventional hermetic-type compressors.

On the other hand, the temperatures of the various portions drop on the whole during ordinary operation or at low outside-air temperature, and the temperature of the passage changeover mechanism 171 also drops. In this case, the passage changeover mechanism 171 is deformed as shown in FIG. 55, and the refrigerant gas to be sucked flows in the direction of d→f as shown in FIG. 55. Therefore, the flow of the refrigerant gas shown in FIG. 55 becomes shorter than the flow in the direction of d→e→f shown in FIG. 54. Therefore, at the length of the suction passage shown in FIG. 55, the return timing of the pressure wave to the suction hole 150*a* advances excessively, and the pressure energy of the reflected wave is not added to the refrigerant gas at the suction completion time, whereby no supercharging effect can be obtained.

In the opposite case, that is, in case the length of the suction passage of the suction passage block 170 is longer, the return timing of the reflected wave to the suction hole 150*a* is delayed excessively, and the pressure energy of the reflect wave is not added to the refrigerant gas at the suction completion time, whereby no supercharging effect can be obtained.

In this way, in the hermetic-type compressor of embodiment 19 of the present invention, the length of the suction passage and the like are adjusted so that the supercharging effect can be obtained only at high outside-air temperature or at a high load. Therefore, in the hermetic-type compressor of embodiment 19 of the present invention, more than necessary refrigeration capability cannot be generated except at high outside-air temperature or at a high load, whereby electric power consumption can be reduced on the whole.

In the hermetic-type compressor of embodiment 19, the opening end 171*a* of the suction passage of the suction passage block 170 in the enclosed container 2 is provided near the opening end of the suction pipe 161 in the enclosed container 2. Therefore, in the hermetic-type compressor of embodiment 19, the refrigerant gas to be sucked into the suction passage of the suction passage block 170 is less affected by heat from an electric compression element 81 heated at high temperature due to the influence of compression heat, motor heat, sliding heat and the like in the enclosed container 2, and temperature rising can be decreased.

Therefore, in the hermetic-type compressor of embodiment 19, the density of the refrigerant gas in the suction passage can be raised, the circulation amount of refrigerant can be increased, and efficiency can be raised.

As described above, the hermetic-type compressor of embodiment 19 comprises the enclosed container 2, the electric compression element 81 housed in the enclosed container 2 and including a compression element 300 and a motor portion 7 such as a motor, a cylinder 10 constituting the compression element 300, the valve plate 150 having the suction hole 150*a* and disposed at the end surface of the cylinder 10, the suction pipe 161, one end of which communicates with the exterior of the enclosed container 2, and the other end of which is open in the enclosed container 2, the suction passage, one end of which is open near the opening end of the suction pipe 161 in the enclosed container 2, and the other end of which is nearly directly connected to the suction hole 150*a* of the valve plate 150, and the passage changeover mechanism 171 provided in the suction passage.

Therefore, the hermetic-type compressor of embodiment 19 is configured so that the supercharging effect can be obtained only at high outside-air temperature or at a high load wherein a high load is applied to the electric compression element 81. In the hermetic-type compressor of embodiment 19, electric power consumption can be reduced on the whole.

In the hermetic-type compressor of embodiment 19, by decreasing the temperature rise of refrigerant gas to be sucked, the density of the refrigerant gas is raised, and the circulation amount of refrigerant is increased, whereby efficiency can be raised.

In embodiment 19, the suction passage is configured so as to be nearly directly connected to the suction hole 150*a* of the valve plate 150. However, even when the suction passage is connected to the suction hole 150*a* of the valve plate 150 via a slight space (a passage space having substantially the same sectional shape), the same effect as that of the above-mentioned embodiment 19 can be obtained.

In embodiment 19, its configuration is described by using the suction passage formed in the suction passage block as shown in FIGS. 52 to 55; however, even when the suction passage is formed of a pipe, for example, the same effect as that of the above-mentioned embodiment 19 can be obtained.

EMBODIMENT 20

Next, embodiment 20, an example of the hermetic-type compressor of the present invention, will be described below referring to the accompanying drawings.

Figure 56:
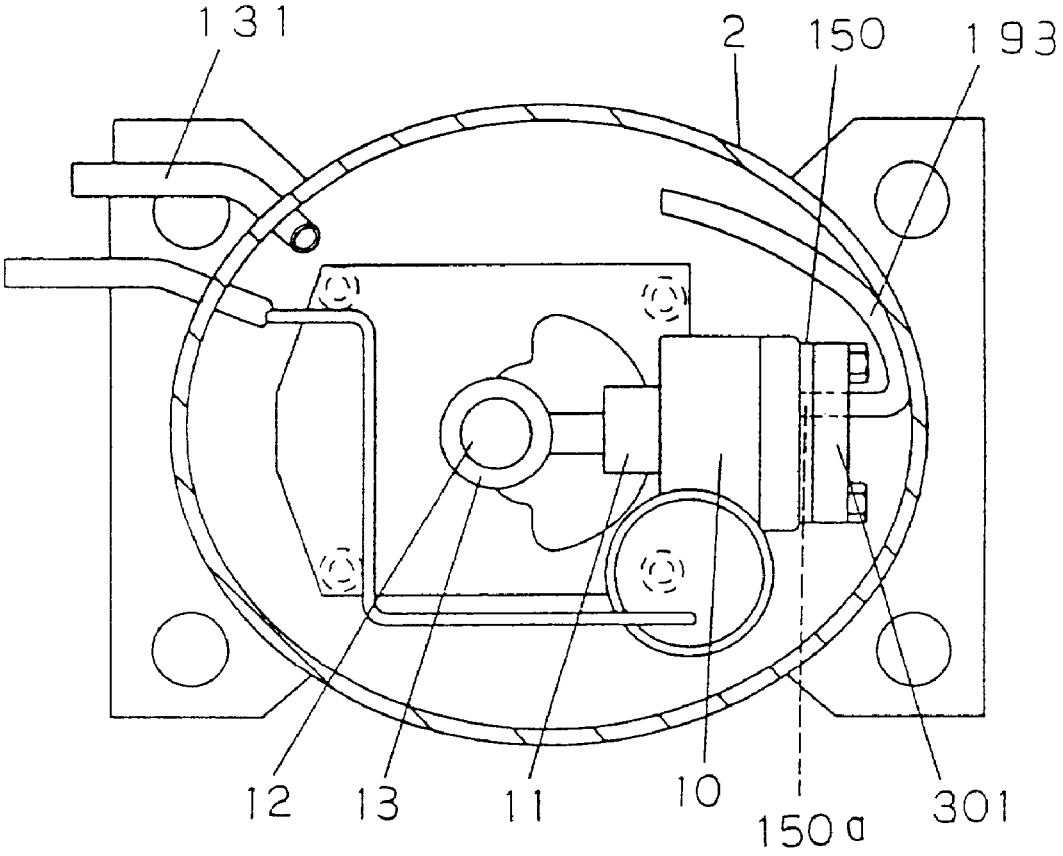
FIG. 56 is a plan sectional view showing a hermetic-type compressor in accordance with embodiment 20 of the present invention.
Figure 57:
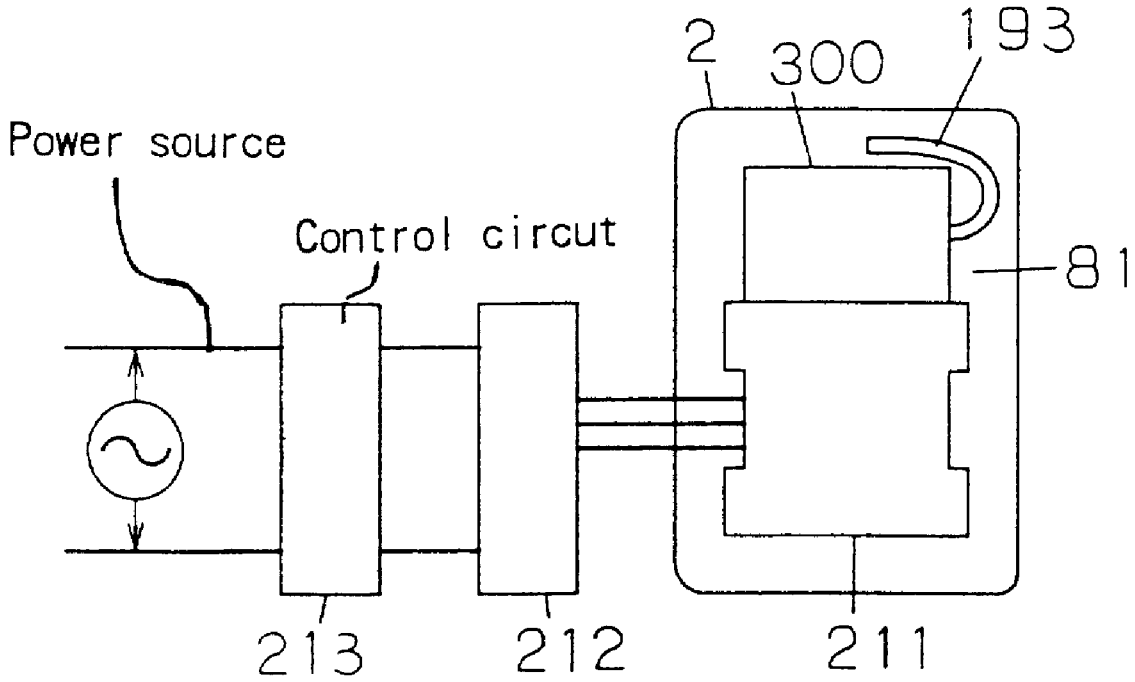
FIG. 57 is a control block diagram of a refrigeration apparatus including the hermetic-type compressor in accordance with embodiment 20 of the present invention.
Figure 58:
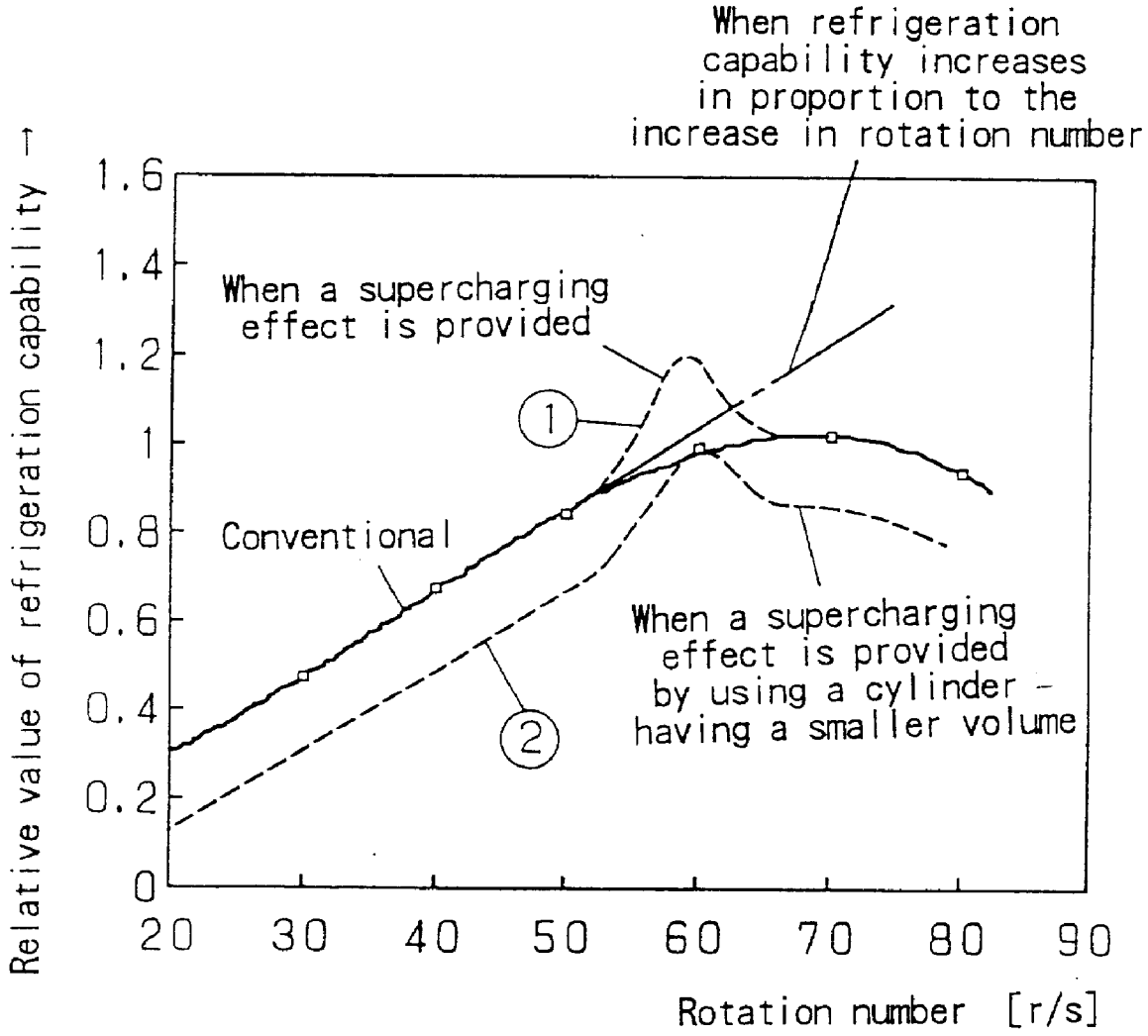
FIG. 58 is a characteristic diagram showing a change in refrigeration capability at the time of rotation number control in the hermetic-type compressor in accordance with embodiment 20.

FIG. 56 is a plan sectional view showing the hermetic-type compressor in accordance with embodiment 20 of the present invention. FIG. 57 is a view showing a schematic structure of the hermetic-type compressor of embodiment 20 and a control block diagram of a refrigeration apparatus. FIG. 58 is a characteristic diagram showing a change in refrigeration capability at the time of rotation number control in the hermetic-type compressor of embodiment 20 using an inverter.

In the hermetic-type compressor of embodiment 20, components having the same functions and configurations as those of the hermetic-type compressor of each of the above-mentioned embodiments are designated by the same marks, and their descriptions are omitted.

In FIGS. 56 and 57, a first suction pipe 193 is used as a suction passage, one end of which is open in the space inside the enclosed container 2, and the other end of which is nearly directly connected to the suction hole 150*a* of the valve plate 150. In an inverter 212 shown in FIG. 57, a motor 211 is operated at least at two specific frequencies.

Next, the operation of the hermetic-type compressor of embodiment 20 having the above-mentioned configuration is described below.

Generally, no refrigeration apparatus is required to have high refrigeration capability at low outside-air temperature. However, in such a situation, if a more than necessary circulation amount of refrigerant is supplied by a conventional hermetic-type compressor, suction pressure lowers, and discharge pressure rises. As a result, the efficiency of the entire refrigeration system including the conventional hermetic-type compressor is lowered, and consequently, the problem of increased overall electric power consumption occurs.

To solve this problem, the circulation amount of refrigerant is decreased at low outside-air temperature, whereby electric power consumption can be decreased.

In the hermetic-type compressor of embodiment 20, the pressure wave generated during a suction stroke near the suction hole 150*a* propagates in the direction opposite to the flow of refrigerant gas. And the pressure wave becomes a reflected wave having an inverse phase in the space inside the enclosed container 2, propagates in the same direction as that of the flow of the refrigerant gas, and returns to the suction hole 150*a*.

This reflected wave is allowed to reach the suction hole 150*a* during the suction stroke, whereby the pressure energy of the reflected wave is added to refrigerant gas at the suction completion time, and the suction pressure of the refrigerant gas is raised.

Therefore, in the hermetic-type compressor of embodiment 20, refrigerant gas having a higher density is charged into the cylinder 10. Therefore, in the hermetic-type compressor of embodiment 20, the discharge amount of refrigerant per a compression stroke increases, and the circulation amount of refrigerant increases. By this supercharging effect, the hermetic-type compressor of embodiment 20 can improve refrigeration capability significantly.

Next, a concrete example of a supercharging effect is described below referring to FIG. 58. FIG. 58 is a characteristic diagram showing a change in refrigeration capability at the time of rotation number control of the hermetic-type compressor using the inverter. In FIG. 58, the rotation number (r/s) is shown on the abscissa, and the relative value of refrigeration capability is shown on the ordinate. The relative value of refrigeration capability is based on that obtained when the rotation number of the conventional hermetic-type compressor is 60 Hz. In FIG. 58, the solid line indicates a case when the conventional hermetic-type compressor was subjected to rotation number control. The broken lines (1) and (2) indicate cases when the hermetic-type compressors of embodiment 20 having different cylinder volumes were subjected to rotation number control. In FIG. 58, the single-dot chain line indicates a case when refrigeration capability increases in proportion to an increase in rotation number.

When the conventional reciprocating hermetic-type compressor being subjected to rotation number control is configured so that a supercharging effect can be obtained during operation at a frequency of 60 Hz, refrigeration capability changes as indicated by the broken line (1) of FIG. 11.

As shown by the slid line in FIG. 11, in the conventional hermetic-type compressor, at a high speed rotation number exceeding 50 Hz, refrigeration capability in proportion to an increase in rotation number was unable to be obtained because of the follow-up performance or the like of its valve mechanism, whereby the compressor had a characteristic of saturation in refrigeration capability, resulting in further reduction.

However, in the hermetic-type compressor of embodiment 20, refrigeration capability was improved significantly near a high-speed side rotation number of 60 Hz by supercharging in comparison with the conventional apparatus, and about 20% of increase in capability was attained during operation at the same rotation number of 60 Hz. As shown by the broken line (1) of FIG. 58, the hermetic-type compressor of embodiment 20 was able to have the same refrigeration capability as that obtained during operation at 70 Hz when it was assumed that refrigeration capability was able to be obtained in proportion to an increase in rotation number.

In addition, as shown in FIG. 58, the same refrigeration capability as that of the conventional apparatus during operation at 60 Hz was obtained by using the hermetic-type compressor of embodiment 20 having a cylinder volume smaller by about 20% as shown by the broken line (2).

As described above, in the hermetic-type compressor of embodiment 20, the range of refrigeration capability can be widened, and its configuration can be made so that refrigeration capability required depending on outside-air temperature or a load can be obtained. Furthermore, as shown by the broken line (2) of FIG. 58, by using a hermetic-type compressor having a cylinder volume less than that of the conventional compressor, its configuration can be made so that substantially the same refrigeration capability as that of the conventional compressor can be obtained, whereby the hermetic-type compressor can be made smaller.

Consequently, in the hermetic-type compressor of embodiment 20, by performing supercharging in addition to rotation number control, refrigeration capability required depending on outside-air temperature or a load can be obtained, and electric power consumption can be decreased.

As described above, the hermetic-type compressor of embodiment 20 comprises the enclosed container 2, an electric compression element 81 housed in the enclosed container 2 and including a compression element 300 and a motor 211, a cylinder 10 constituting the compression element 300, a valve plate 150 having a suction hole 150*a,* a first suction pipe 193, one end of which is open in the space inside the enclosed container 1 or an accumulator etc., and the other end of which is substantially directly connected to the suction hole 150*a,* and an inverter 212 for operating the motor 211. Therefore, in the hermetic-type compressor of embodiment 20, refrigeration capability required depending on outside-air temperature or a load can be obtained, and electric power consumption can be reduced.

In the hermetic-type compressor of embodiment 20, it is needless to say that the same effect as that of the above-mentioned embodiment 20 can also be obtained by using a rotary-type or a scroll-type compressor.

Although the suction passage is formed of a suction pipe in embodiment 20, the same effect as that of the above-mentioned embodiment 20 can be obtained even when the suction passage is formed of a block.

EMBODIMENT 21

Next, embodiment 21, an example of the hermetic-type compressor of the present invention, will be described below referring to the accompanying drawings.

Figure 59:
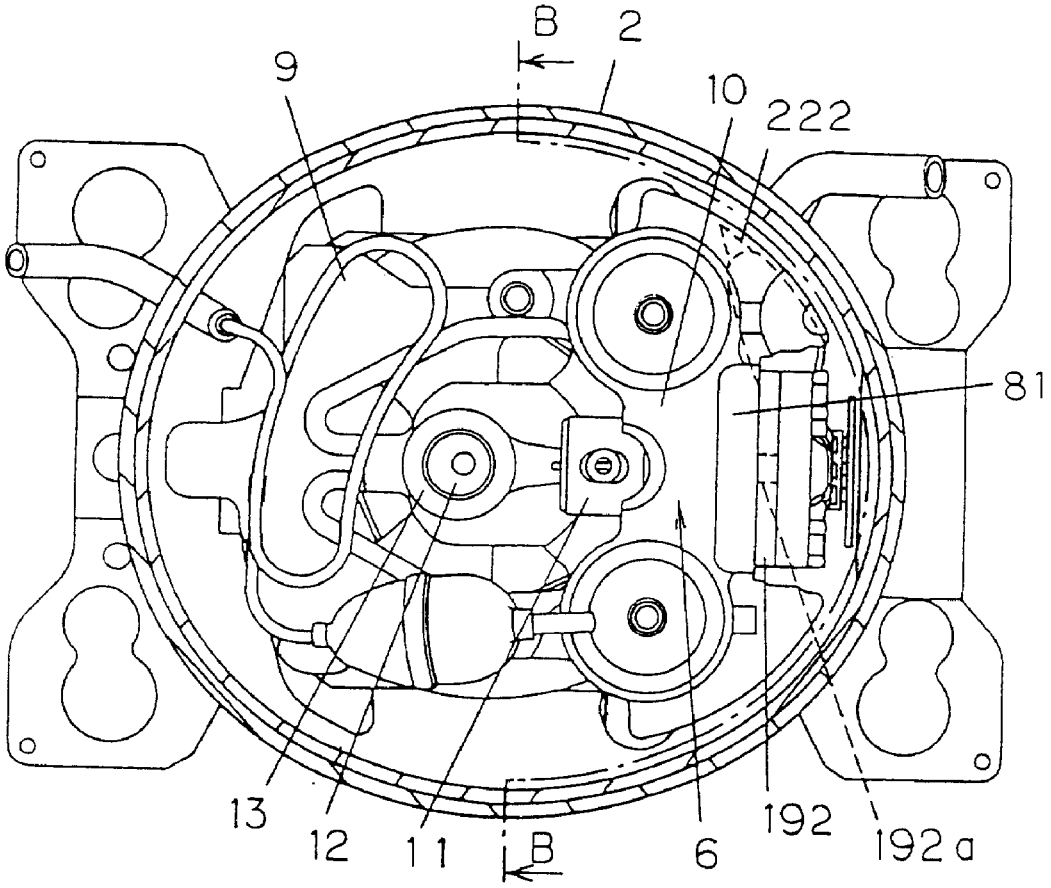
FIG. 59 is a plan sectional view showing a hermetic-type compressor in accordance with embodiment 21 of the present invention.
Figure 60:
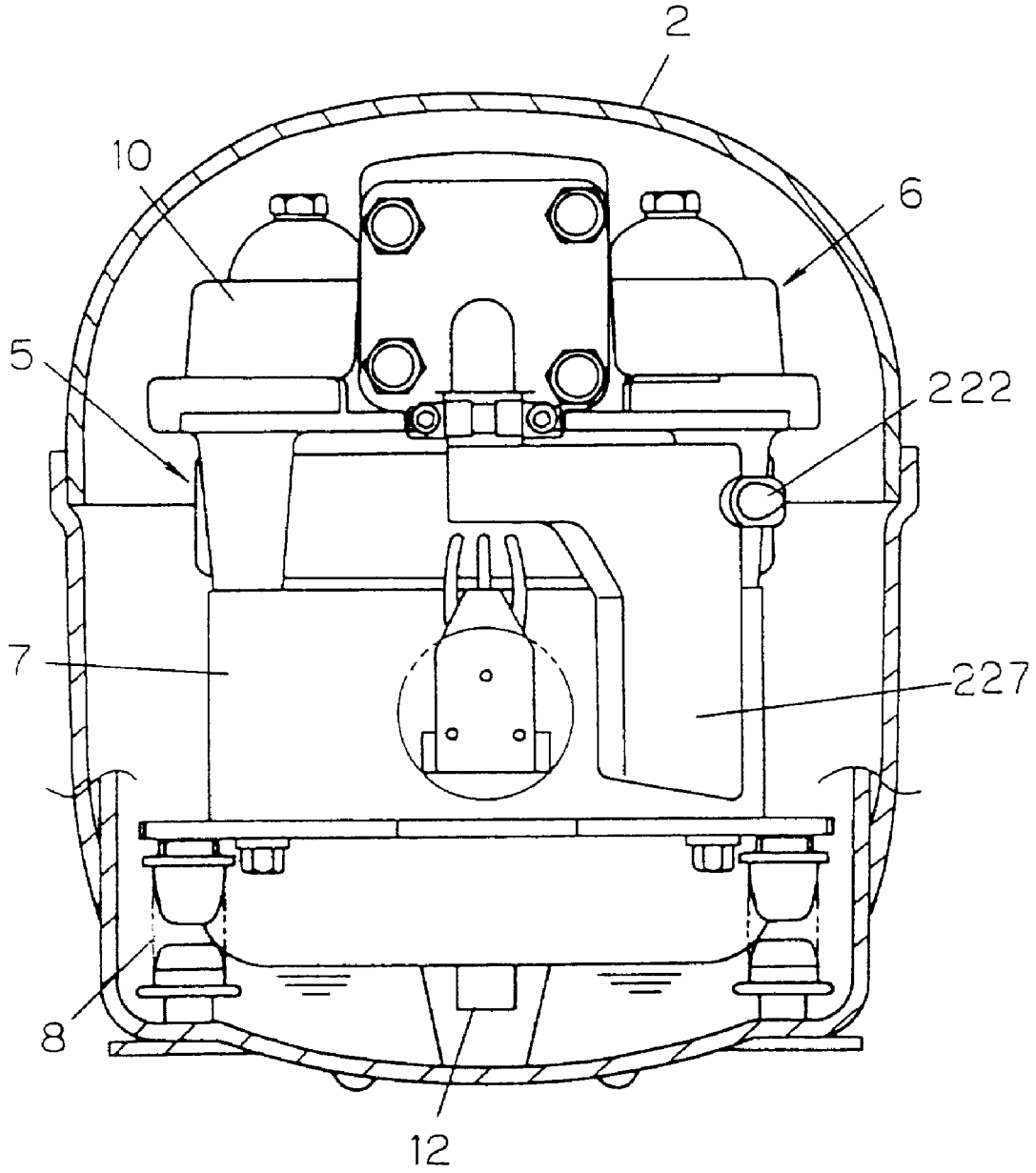
FIG. 60 is a front sectional view showing the hermetic-type compressor in accordance with embodiment 21 taken on line B—B of FIG. 59.
Figure 61:
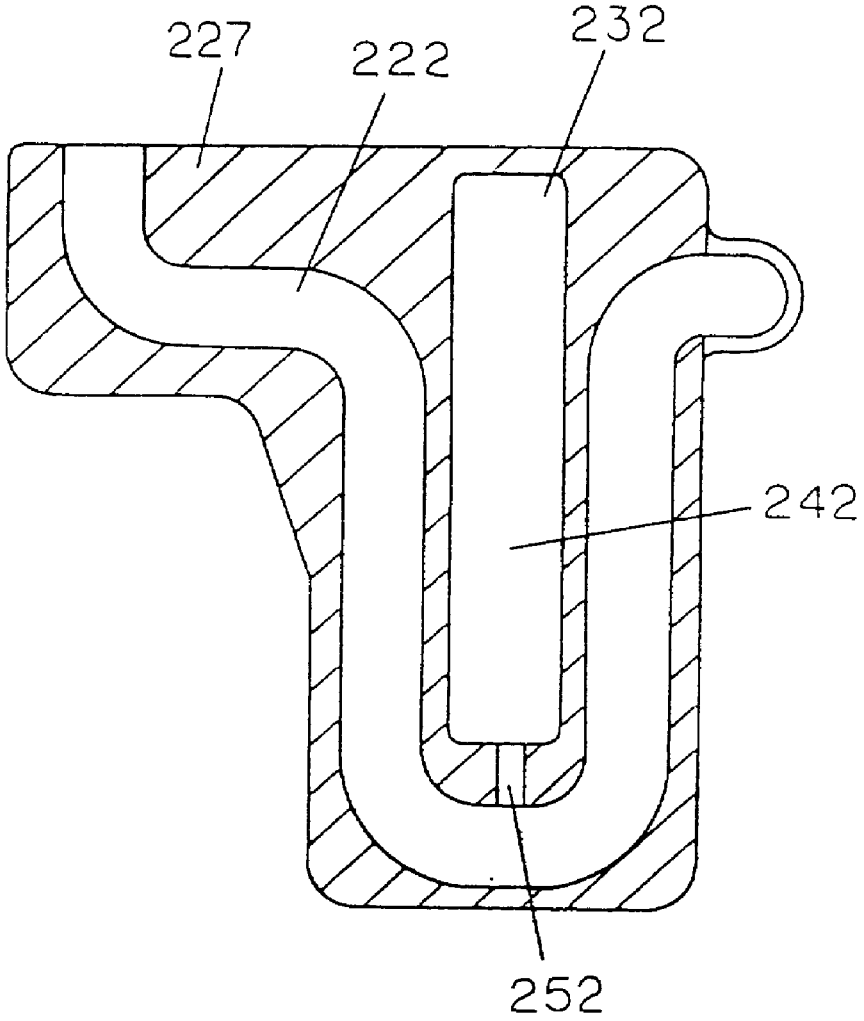
FIG. 61 is a sectional view showing an area near the suction passage of the hermetic-type compressor in accordance with embodiment 21.

FIG. 59 is a plan sectional view showing the hermetic-type compressor in accordance with embodiment 21 of the present invention. FIG. 60 is a front sectional view taken on line B—B of FIG. 59. FIG. 61 is a sectional view showing an area near the suction passage of the hermetic-type compressor of embodiment 21.

In the hermetic-type compressor of embodiment 21, components having the same functions and configurations as those of the hermetic-type compressor of each of the above-mentioned embodiments are designated by the same marks, and their descriptions are omitted.

In FIGS. 59, 60 and 61, in a suction block 227, a suction passage 222 is formed, one end of which is disposed as an opening end in the space inside an enclosed container 2, and the other end of which is substantially directly connected to the suction hole 192*a* of a valve plate 192. As shown in FIG. 61, a resonance-type muffler 232 formed in the suction block 227 together with the suction passage 222 has a hollow portion 242 and a connection portion 252. One end of the connection portion 252 of the resonance-type muffler 232 is open into the hollow portion 242, and the other end is open into the suction passage 222. The volume of the hollow portion 242, the length of the connection portion 252, the cross-sectional area of the connection portion 252 and the like are adjusted so that the resonance frequency of the resonance-type muffler 232 aligns with the frequency of the noise causing the most serious problem, among noises generated near the suction hole 192*a* due to the pulsation and the like of refrigerant gas to be sucked.

Next, the operation of the hermetic-type compressor of embodiment 21 having the above-mentioned configuration is described below.

When refrigerant gas is sucked into a cylinder 10, noise generates near the suction hole 192*a* due to the pulsation of refrigerant gas or the operation of a suction lead. When the generated noise propagates through the suction passage 222, it is attenuated by the resonance muffler 232 provided in the suction passage 222. Therefore, the noise propagating from the suction passage 222 to the space in the enclosed container 2 diminishes, whereby noise generated from the hermetic-type compressor can be diminished.

Next, an influence upon the effect of improving refrigeration capability by the resonance-type muffler 232 in embodiment 21, that is, an influence upon the effect of supercharging is described below.

In the conventional hermetic-type compressor described in the aforementioned background art, the frequency of the noise generated from the suction passage and causing the most serious problem is usually in the range of 400 Hz to 600 Hz. In comparison with the frequency, the frequency of the pressure wave generated during a suction stroke and providing a supercharging effect is fairly low. In addition, the resonance-type muffler is characteristic in that it generally has a great silencing effect only in a narrow frequency range near the resonance frequency.

Therefore, in the above-mentioned embodiment 21, in a process wherein the pressure wave (expansion wave) generated during the suction stroke becomes a reflected wave (compression wave) and returns to the suction hole 192*a,* the resonance-type muffler 232 attenuates only the noise causing problems, and does not virtually affect the pressure wave for providing the supercharging effect, whereby refrigeration capability as high as that obtained without the resonance-type muffler 232 can be obtained.

As described above, in the hermetic-type compressor having specifications for providing a supercharging effect, the configuration for providing the resonance-type muffler in the suction passage 222 is very effective, whereby both the supercharging effect and noise reduction can be attained.

As described above, the hermetic-type compressor of embodiment 21 comprises the suction passage 222, one end of which is open in the space inside the enclosed container 2, and the other end of which is nearly directly connected to the suction hole 192*a,* and the resonance-type muffler 232 provided in the suction passage 222. Therefore, refrigeration capability as high as that obtained conventionally can be obtained; furthermore, noise generated due to the pulsation of refrigerant gas having been sucked is diminished by the resonance-type muffler 232 provided in the suction passage 222, whereby noise propagating from the suction passage 222 into the enclosed container 2 is diminished.

Therefore, in the hermetic-type compressor of embodiment 21, noise propagating outside the enclosed container can be diminished eventually.

In embodiment 21, the resonance-type muffler 232 is configured so as to have the hollow portion 242 and the connection portion 252; however, the same effect as that of the above-mentioned embodiment 21 can be obtained even when the muffler has a shape wherein the hollow portion is directly connected to the suction passage 222, a so-called side-branch type or the like, as long as the muffler has the shape of a resonance-type muffler.

EMBODIMENT 22

Next, embodiment 22, an example of the hermetic-type compressor of the present invention, will be described below referring to the accompanying drawings.

Figure 62:
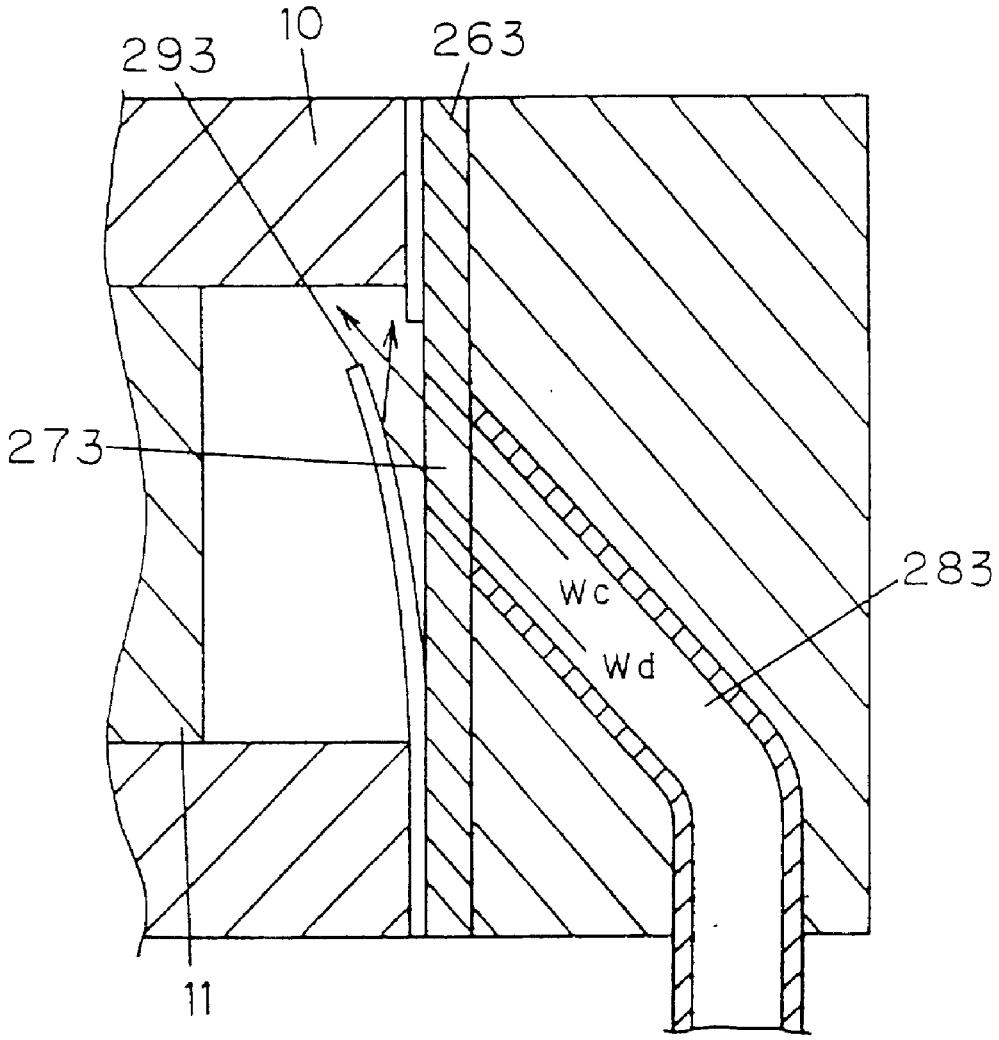
FIG. 62 is a sectional view showing an area near the cylinder of a hermetic-type compressor in accordance with embodiment 22 of the present invention.

FIG. 62 is a sectional view showing an area near the cylinder of the hermetic-type compressor in accordance with embodiment 22 of the present invention.

In the hermetic-type compressor of embodiment 22, components having the same functions and configurations as those of the hermetic-type compressor of each of the above-mentioned embodiments are designated by the same marks, and their descriptions are omitted.

In FIG. 62, a valve plate 263 having a suction hole 273 is secured to the end surface of a cylinder 10. One end of a suction passage 283 is disposed as an opening end in the space inside an enclosed container 2, and the other end is substantially directly connected to the above-mentioned suction hole 273.

A suction lead 293 is mounted on the valve plate 263 to open and close the suction hole 273.

As shown in FIG. 62, the axial direction of the passage at the connection portion of the suction passage 283 with respect to the suction hole 273 is inclined so as not to be perpendicular to the end surface of the valve plate 263.

Next, the operation of the hermetic-type compressor of embodiment 22 having the above-mentioned configuration is described below.

Figure 71:
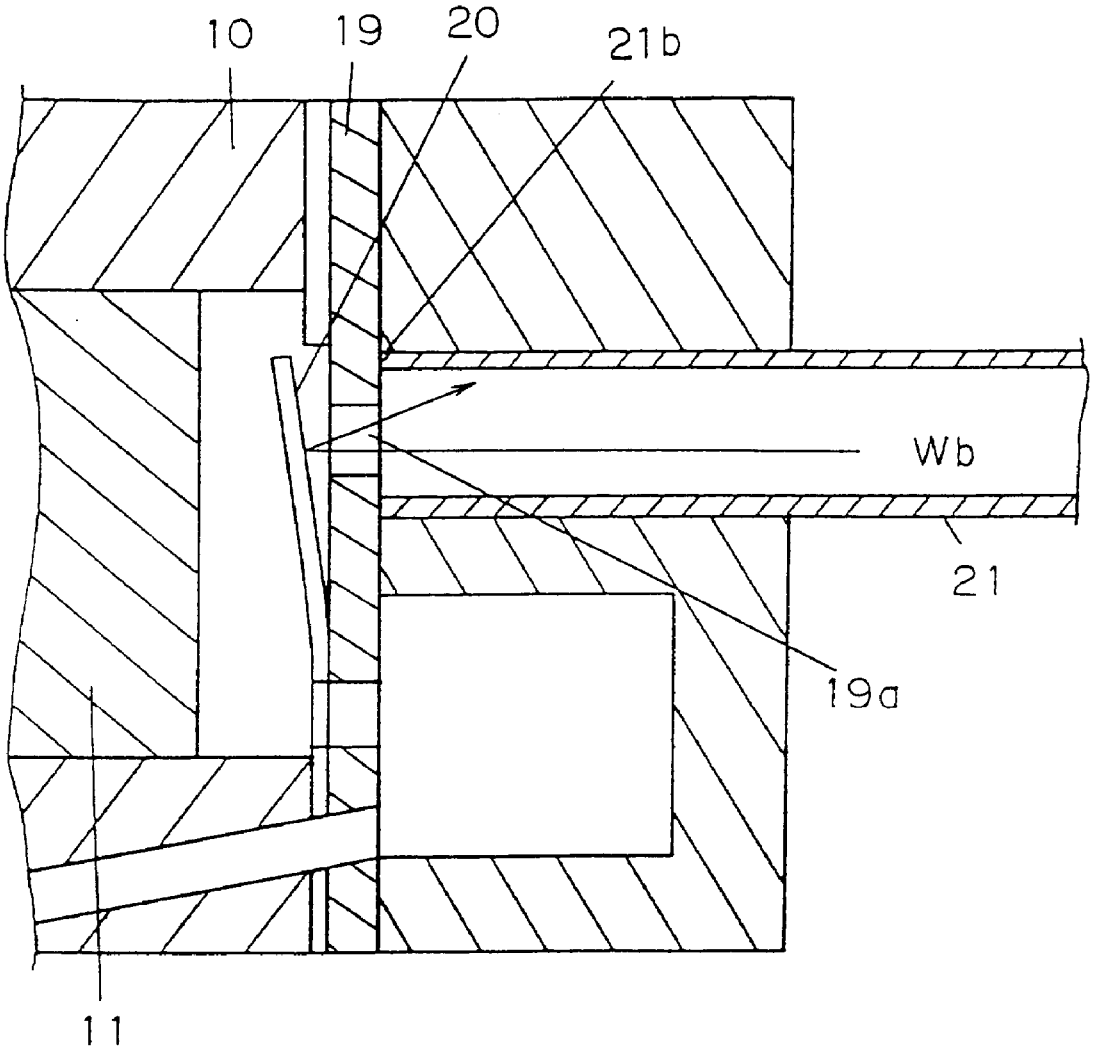
F I G. 71 PRIOR ART
FIG. 71 is the sectional view showing the main portion of the hermetic-type compressor shown in FIG. 69.
Figure 72:
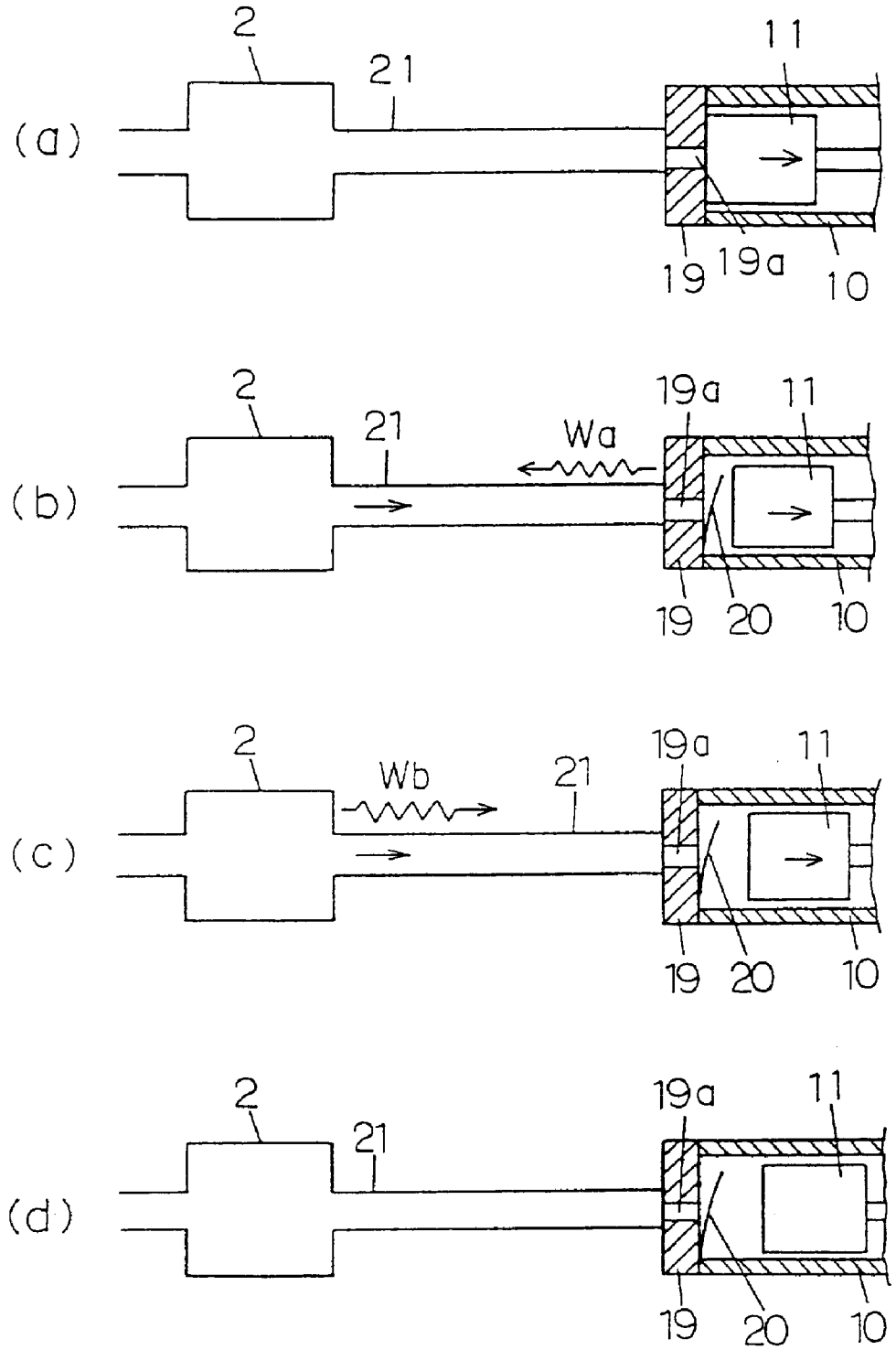
FIG. 72 is the explanatory view showing the behavior of refrigerant gas.

First, the conventional hermetic-type compressor shown in FIG. 71 and described in the background art is described below. In FIG. 71, the pressure wave (expansion wave) generated during a suction stroke becomes a reflected wave Wb (compression wave) having an inverse phase in the space inside the enclosed container 2, and returns to the suction hole 19*a*. However, as shown in FIG. 71, since the opening/closing surface of the suction lead 20 has an angle nearly perpendicular to the propagation direction of the reflected wave Wb, the reflected wave Wb is mostly reflected in the nearly opposite direction by the suction lead 20. Therefore, in the conventional hermetic-type compressor, the pressure energy of the reflected wave Wb does not work effectively in the cylinder 10, whereby a problem occurs, that is, the effect of supercharging cannot be obtained sufficiently.

On the other hand, in the hermetic-type compressor of embodiment 22 of the present invention shown in FIG. 62, the suction passage 273 is connected to the end surface of the valve plate 263 not in perpendicular thereto but being inclined. Therefore, as shown in FIG. 62, a reflected wave Wc directly enters the cylinder 10 without being reflected by the suction lead 293. Furthermore, even when the reflected wave Wb is reflected by the suction lead 293, the angle between the propagation direction of a reflected wave Wd and the opening/closing surface of the suction lead 293 is small; therefore, as shown in FIG. 62, the propagation direction of the reflected wave Wd after the reflection is not changed greatly, and the wave is apt to enter the cylinder 10 easily.

As described above, in the hermetic-type compressor of embodiment 22, since the reflected wave is hard to be obstructed by the suction valve 293, the pressure energy of the reflected wave effectively enters the cylinder 10, and the hermetic-type compressor of embodiment 22 has high refrigeration capability.

Since the angle between the propagation direction of the refrigerant gas to be sucked and the opening/closing surface of the suction valve 293 is small, the resistance to the flow of the refrigerant gas due to the suction valve 293 becomes small, and pressure loss decreases. Therefore, the hermetic-type compressor of embodiment 22 has excellent refrigeration efficiency, and has high refrigeration capability.

As described above, in the hermetic-type compressor of embodiment 22, the axial direction of the passage of the connection portion of the suction passage 283 to the suction hole 273 is not perpendicular to the end surface of the valve plate 263 but inclined. Therefore, the hermetic-type compressor of embodiment 22 is configured so that when the reflected wave returns to the cylinder 10, the reflected wave is not reflected by the suction valve 293, but is apt to enter the cylinder 10 easily. In addition, even when the reflected wave is reflected by the suction valve 293, the angle between the propagation direction of the reflected wave and the opening/closing surface of the suction valve 293 is small. Therefore, the propagation direction of the reflected wave after the reflection is not changed greatly, and the reflected wave is apt to enter the cylinder 10 easily. In other words, the reflected wave is hard to be obstructed by the suction lead 293, and the pressure energy of the reflected wave effectively enters the cylinder 10. Therefore, the hermetic-type compressor of embodiment 22 has excellent refrigeration efficiency, and has high refrigeration capability.

The resistance to the flow of the sucked refrigerant gas due to the suction valve 293 is small, and pressure loss is low. Therefore, the hermetic-type compressor of embodiment 22 has higher refrigeration capability.

EMBODIMENT 23

Next, embodiment 23, an example of the hermetic-type compressor of the present invention, will be described below referring to the accompanying drawings.

Figure 63:
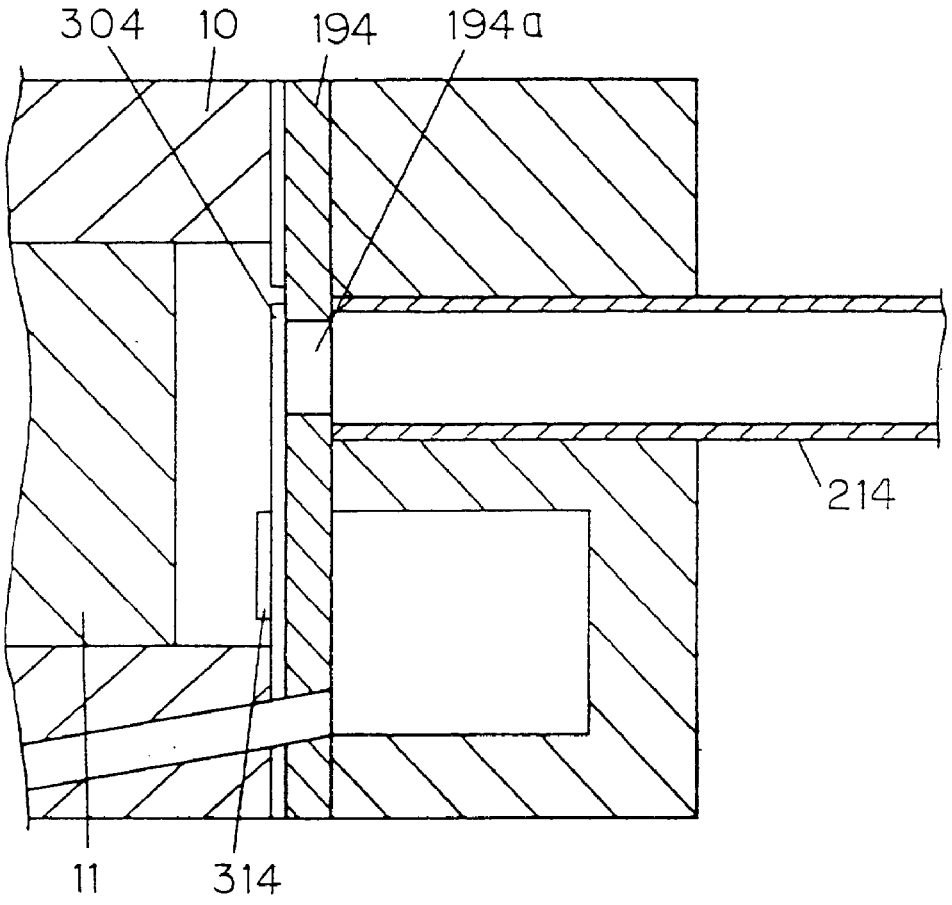
FIG. 63 is a sectional view showing an area near the cylinder of a hermetic-type compressor in accordance with embodiment 23 of the present invention during stoppage at low outside-air temperature.
Figure 64:
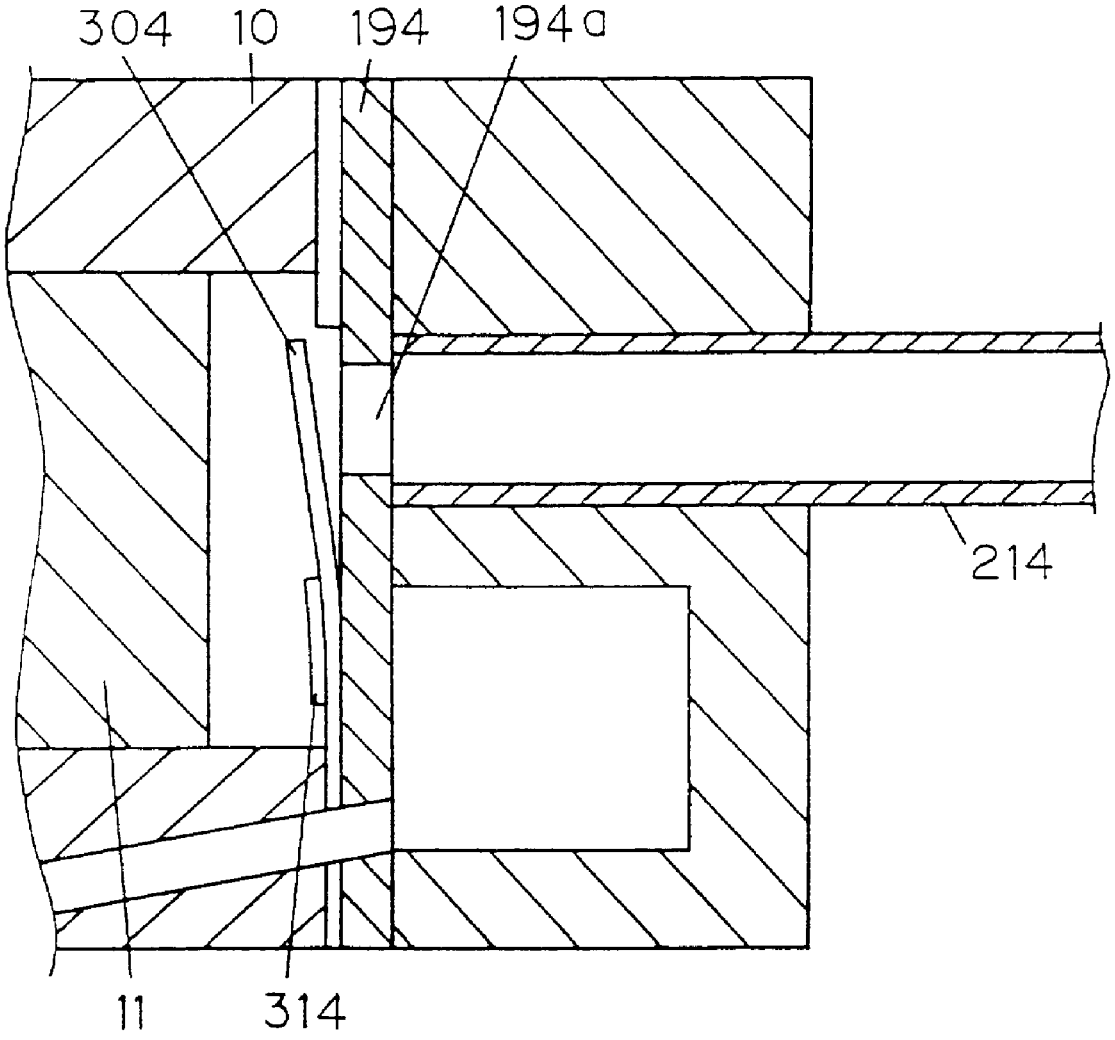
FIG. 64 is a sectional view showing the area near the cylinder of the hermetic-type compressor in accordance with embodiment 23 of the present invention during stoppage at high outside-air temperature.

FIG. 63 is a sectional view showing an area near the cylinder of the hermetic-type compressor in accordance with embodiment 23 of the present invention during stoppage at low outside-air temperature. FIG. 64 is a sectional view showing the area near the cylinder of the hermetic-type compressor in accordance with embodiment 23 of the present invention during stoppage at high outside-air temperature.

In the hermetic-type compressor of embodiment 23, components having the same functions and configurations as those of the hermetic-type compressor of each of the above-mentioned embodiments are designated by the same marks, and their descriptions are omitted.

In FIGS. 63 and 64, a suction valve 304 is provided between the end surface of a cylinder 10 and a valve plate 194. This suction valve 304 is configured so as to open/close the suction hole 194*a* of the valve plate 194. A deflection control mechanism 314 for controlling the initial deflection amount of the suction valve 304 is installed on the suction valve 304. In embodiment 23, the deflection control mechanism 314 is formed of a material having a coefficient of linear expansion smaller than that of the suction valve 304, and secured to the piston side of the suction valve 304.

Next, the operation of the hermetic-type compressor of embodiment 23 having the above-mentioned configuration is described below.

Generally, no refrigeration apparatus is required to have high refrigeration capability at low outside-air temperature. However, in such a situation, if a more than necessary circulation amount of refrigerant is supplied by a conventional hermetic-type compressor, suction pressure lowers, and discharge pressure rises. As a result, the efficiency of the entire refrigeration system including the conventional hermetic-type compressor is lowered, and consequently, the problem of increased overall electric power consumption occurs.

To solve this problem, the circulation amount of refrigerant is decreased at low outside-air temperature, whereby electric power consumption can be decreased.

In the hermetic-type compressor of embodiment 23, the temperatures of its various portions become lower at low outside-air temperature on the whole, and the temperatures of the suction valve 304 and the deflection control mechanism 314 also become lower. In that case, the suction valve 304 during stoppage is in a condition for closing the suction hole 194*a* as shown in FIG. 63, in other words, the initial deflection of the suction valve 304 is zero. In this condition, the time from the opening to the closing of the suction hole 194 becomes shorter than that required when an initial deflection is present, and the displacement amount of the suction valve 304 also becomes smaller. Therefore, when the pressure wave generated during a suction stroke returns to the suction hole 194 as a reflected wave, the amount of refrigerant gas to be sucked into the cylinder 10 becomes slightly smaller, and the improvement effect of the circulation amount of refrigerant due to supercharging is lowered. Therefore, in the hermetic-type compressor of embodiment 23, electric power consumption can be reduced at low outside-air temperature.

At high outside-air temperature, since the temperatures of the suction valve 304 and the deflection control mechanism 314 become high, and the coefficient of linear expansion of the deflection control mechanism 314 is smaller than that of the suction valve 304, they work as a bimetal because of the difference in the expansion coefficients of the materials due to temperature rise. As a result, during stoppage, the suction valve 304 is in a condition for opening the suction hole 194*a* as shown in FIG. 64, in other words, in a condition wherein the suction valve 304 has an initial deflection. In this condition, the time from the opening to the closing of the suction hole 194*a* becomes longer than that required when the initial deflection is zero, and the displacement amount of the suction valve 304 also becomes larger. Therefore, when the pressure wave generated during the suction stroke returns to the suction hole 194 as a reflected wave, the amount of the refrigerant gas to be sucked into the cylinder 10 becomes larger, and the improvement effect of the circulation amount of refrigerant due to supercharging can be obtained sufficiently. Therefore, in the hermetic-type compressor of embodiment 23, the improvement effect of refrigeration capability due to supercharging can be obtained sufficiently at high outside-air temperature at which high refrigeration capability is required.

As described above, in the hermetic-type compressor of embodiment 23, the deflection control mechanism 314 for controlling the initial deflection amount of the suction valve 304 is formed of a material having a coefficient of linear expansion smaller than that of the suction valve 304, and secured to the piston side of the suction valve 304. Therefore, in the hermetic-type compressor of embodiment 23, the improvement effect of refrigeration capability becomes small at low outside-air temperature at which high refrigeration capability is not required, whereby electric power consumption is reduced; on the other hand, the improvement effect of refrigeration capability is obtained sufficiently at high outside-air temperature at which high refrigeration capability is required. Therefore, in the hermetic-type compressor of embodiment 23, electric power consumption can be reduced by controlling refrigeration capability.

In embodiment 23, the deflection control mechanism 314 is formed of a material having a coefficient of linear expansion lower than that of the suction valve 304, and secured to the piston side of the suction valve 304. However, the same effect as that of the above-mentioned embodiment 23 can be obtained, even when the deflection control mechanism 314 is formed of a material having a coefficient of linear expansion higher than that of the suction valve 304, and secured to the opposite piston side of the suction valve 304.

EMBODIMENT 24

Next, embodiment 24, an example of the hermetic-type compressor of the present invention, will be described below referring to the accompanying drawings.

Figure 65:
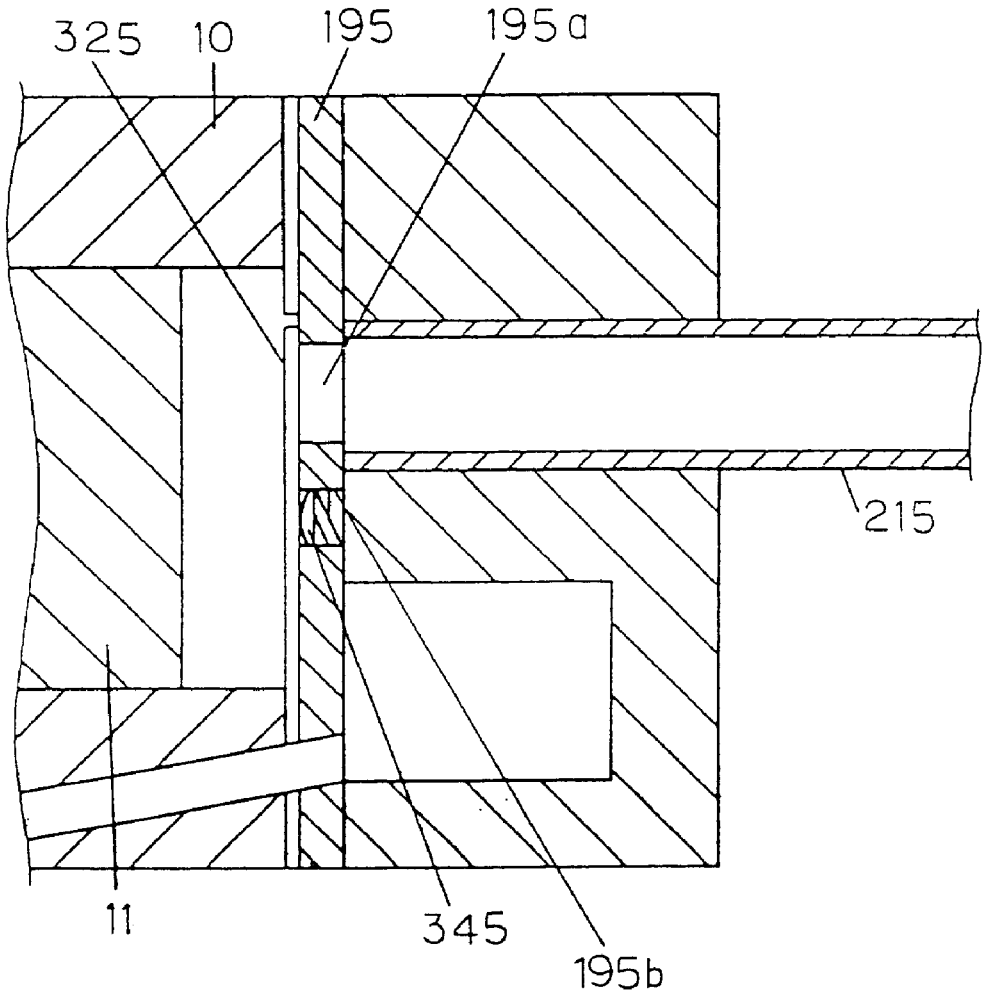
FIG. 65 is a sectional view showing an area near the cylinder of a hermetic-type compressor in accordance with embodiment 24 of the present invention during stoppage at low outside-air temperature.
Figure 66:
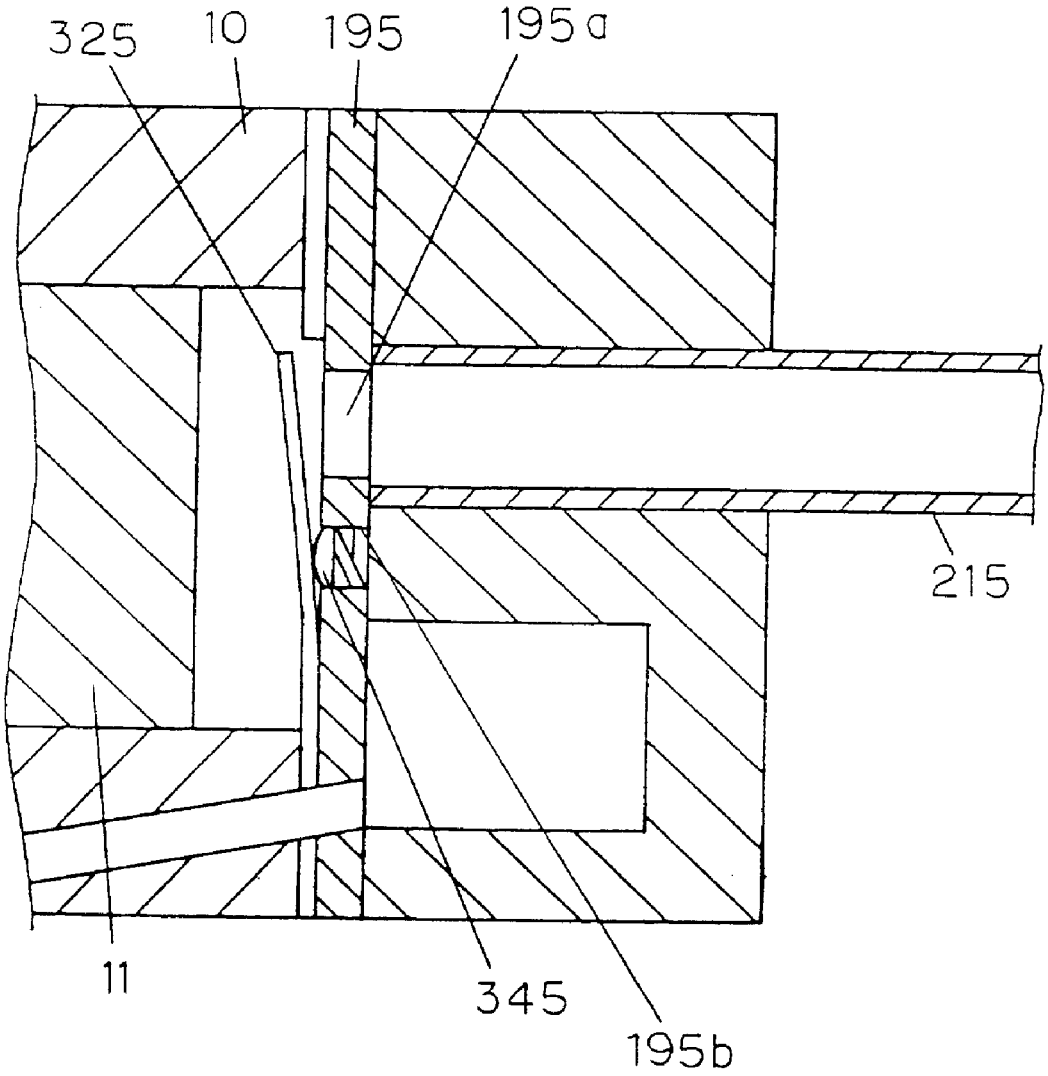
FIG. 66 is a sectional view showing the area near the cylinder of the hermetic-type compressor in accordance with embodiment 24 of the present invention during stoppage at high outside-air temperature.
Figure 67:
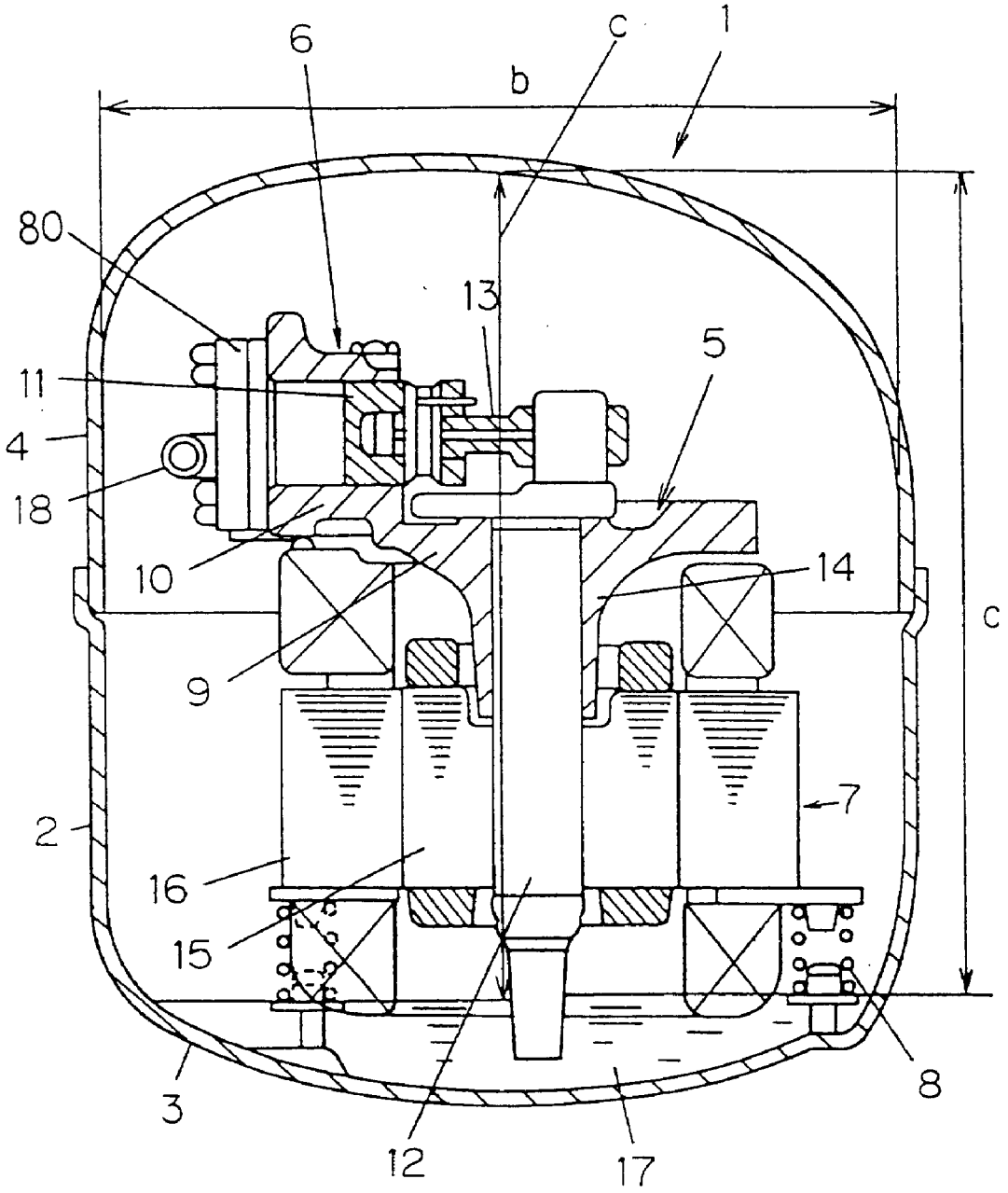
F I G. 67 PRIOR ART
FIG. 67 is the vertical sectional view showing the conventional hermetic-type compressor intended for low noise.
Figure 68:
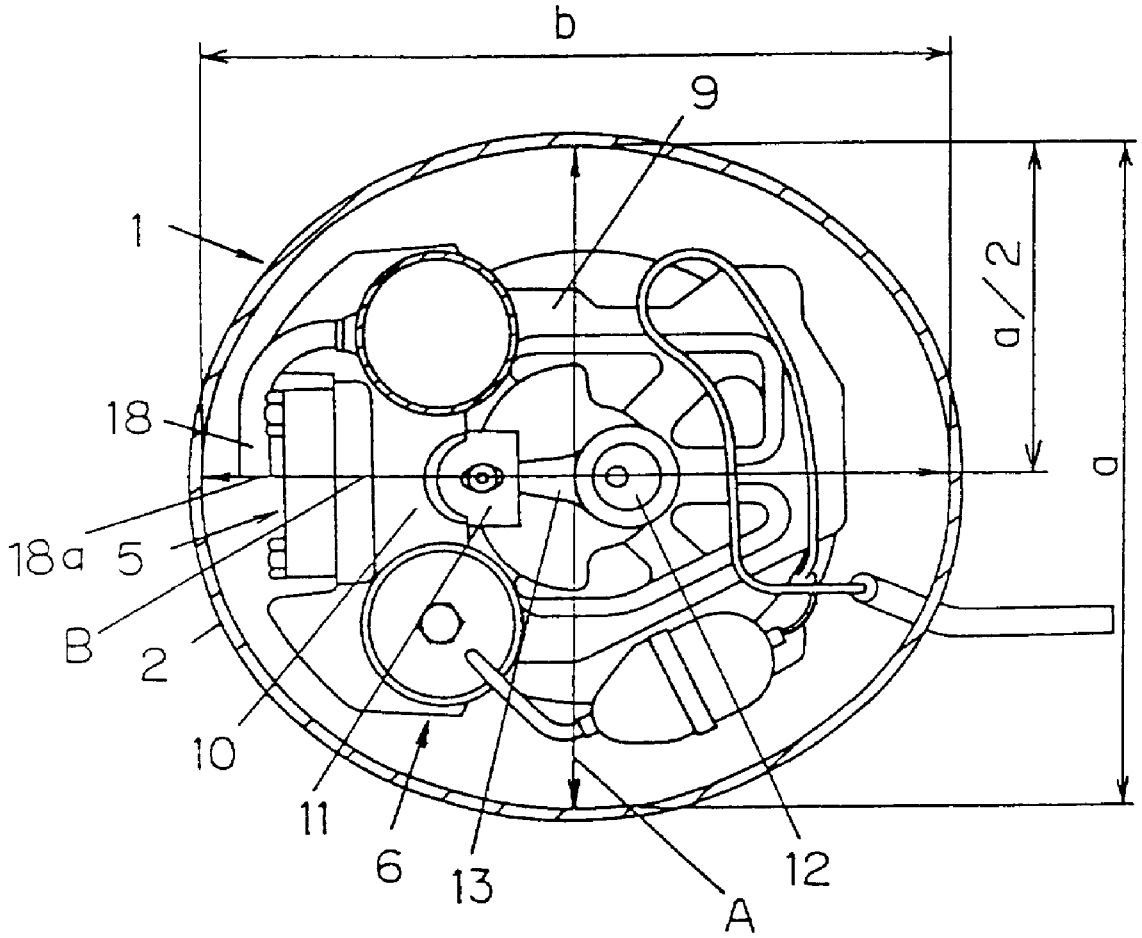
F I G. 68 PRIOR ART
FIG. 68 is the plan sectional view showing the conventional hermetic-type compressor intended for low noise.
Figure 69:
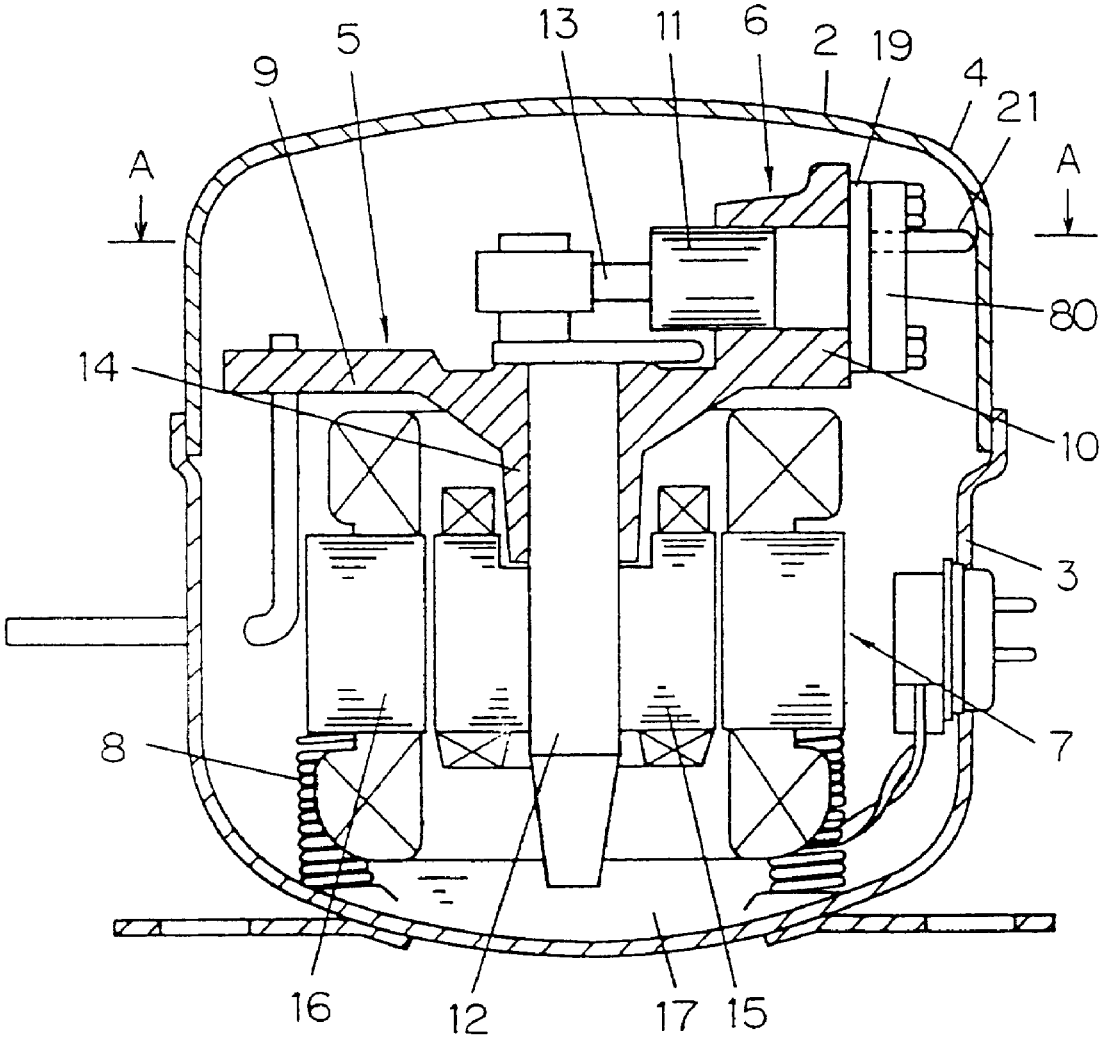
F I G. 69 PRIOR ART
FIG. 69 is the vertical sectional view showing the conventional hermetic-type compressor intended to improve refrigerant capability.
Figure 70:
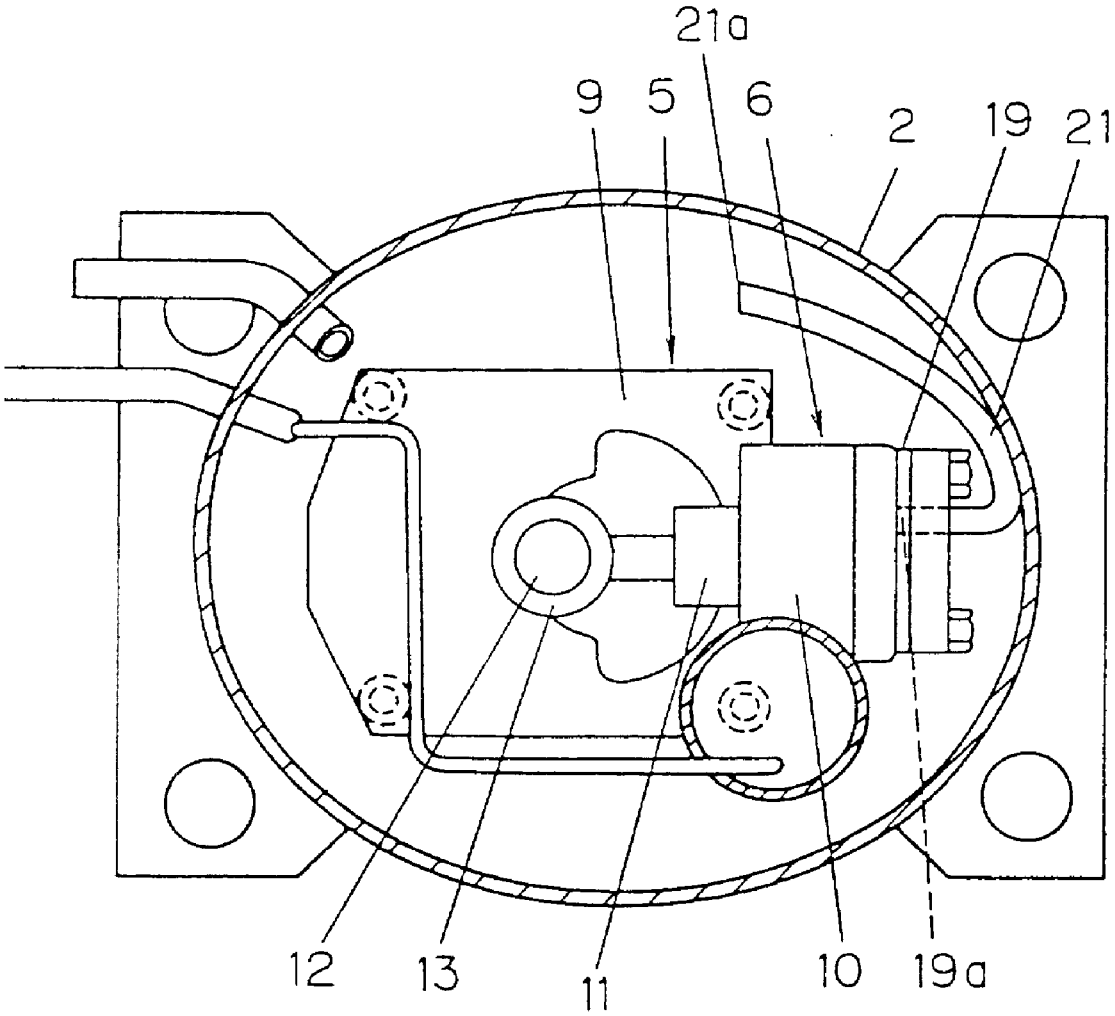
F I G. 70 PRIOR ART
FIG. 70 is the plan sectional view showing the hermetic-type compressor taken on line A—A of FIG. 69.

FIG. 65 is a sectional view showing an area near the cylinder of the hermetic-type compressor in accordance with embodiment 24 of the present invention during stoppage at low outside-air temperature. FIG. 66 is a sectional view showing the area near the cylinder of the hermetic-type compressor in accordance with embodiment 24 of the present invention during stoppage at high outside-air temperature.

In the hermetic-type compressor of embodiment 24, components having the same functions and configurations as those of the hermetic-type compressor of each of the above-mentioned embodiments are designated by the same marks, and their descriptions are omitted.

In FIGS. 65 and 66, a suction valve 325 is provided between the end surface of a cylinder 10 and a valve plate 195. This suction valve 325 is configured so as to open/close the suction hole 195*a* of the valve plate 195. A deflection control mechanism 345 for controlling the initial deflection amount of the suction valve 325 is installed in embodiment 24. The deflection control mechanism 345 is formed of a material to be deformed depending on temperature, such as a bimetal, a shape-memory alloy or the like, and disposed in the through hole 195*b* formed in the valve plate 195. The deflection control mechanism 345 is shrinkably installed in the through hole 195*b*.

Next, the operation of the hermetic-type compressor of embodiment 24 having the above-mentioned configuration is described below.

Generally, no refrigeration apparatus is required to have high refrigeration capability at low outside-air temperature. However, in such a situation, if a more than necessary circulation amount of refrigerant is supplied by a conventional hermetic-type compressor, suction pressure lowers, and discharge pressure rises. As a result, the efficiency of the entire refrigeration system including the conventional hermetic-type compressor is lowered, and as a result, the problem of increased overall electric power consumption occurs.

To solve this problem, the circulation amount of refrigerant at low outside-air temperature is decreased, whereby electric power consumption can be decreased.

In the hermetic-type compressor of embodiment 24, the temperatures of its various portions become lower at low outside-air temperature on the whole, and the temperature of the deflection control mechanism 345 also becomes lower. In that case, the deflection control mechanism 345 does not raise the suction valve 325, and the suction valve 325 during stoppage is in a condition for closing the suction hole 195*a* as shown in FIG. 65, in other words, the initial deflection of the suction valve 325 is zero. In this condition, the time from the opening to the closing of the suction hole 195*a* becomes shorter than that required when an initial deflection is present. Therefore, when the pressure wave generated during a suction stroke returns to the suction hole 195*a* as a reflected wave, the amount of refrigerant gas to be sucked into the cylinder 10 becomes slightly smaller, and the improvement effect of the circulation amount of refrigerant by supercharging is lowered. Therefore, in the hermetic-type compressor of embodiment 24, electric power consumption can be reduced at low outside-air temperature.

On the other hand, at high outside-air temperature, and the temperature of the deflection control mechanism 345 becomes high, the deflection control mechanism 345 extends and raises the suction valve 325. Therefore, the suction valve 325 during stoppage is in a condition for opening the suction hole 195*a* as shown in FIG. 66, in other words, in a condition wherein the suction valve 325 has an initial deflection. In this condition, the time from the opening to the closing of the suction hole 195*a* becomes longer than that required when the initial deflection is zero. Therefore, when the pressure wave generated during the suction stroke returns to the suction hole 195*a* as a reflected wave, the amount of the refrigerant gas to be sucked into the cylinder 10 increases, and the improvement effect of the circulation amount of refrigerant due to supercharging can be obtained sufficiently.

Therefore, in the hermetic-type compressor of embodiment 24, the improvement effect of refrigeration capability due to a supercharging effect can be obtained sufficiently at high outside-air temperature at which high refrigeration capability is required.

As described above, in the hermetic-type compressor of embodiment 24, the deflection control mechanism 345 for controlling the initial deflection amount of the suction valve 325 is formed of a material to be deformed depending on temperature, such as a bimetal, a shape-memory alloy or the like, and shrinkably provided in the valve plate 195. Therefore, in the hermetic-type compressor of embodiment 24, the improvement effect of refrigeration capability becomes small at low outside-air temperature at which high refrigeration capability is not required, whereby electric power consumption is reduced; and the improvement effect of sufficient refrigeration capability is obtained sufficiently at high outside-air temperature at which high refrigeration capability is required. Consequently, in the hermetic-type compressor of embodiment 24, electric power consumption can be reduced by controlling refrigeration capability.

INDUSTRIAL UTILIZATION

The hermetic-type compressor of the present invention is used for refrigeration apparatuses and the like; by raising pressure in the cylinder at the suction completion time of refrigerant gas higher than the low-pressure side pressure of a refrigeration cycle, the density of the refrigerant gas to be sucked into the cylinder is raised, whereby high refrigeration capability is delivered; in addition, the hermetic-type compressor is used to constitute a low-noise refrigeration apparatus or the like generating less noise by preventing resonance sound from generating during suction by compression.

What is claimed is:

1. A hermetic compressor comprising:

a motor portion used as a power source;

a mechanical portion including a crankshaft, a piston, and a cylinder driven by said motor portion;

an enclosed container for housing said motor portion and said mechanical portion and for storing lubricant;

a suction passage installed on said mechanical portion so as to communicate said cylinder with said enclosed container; and a position adjustment mechanism for adjusting an opening end in said suction passage into said enclosed container;

wherein said position adjustment mechanism disposes said opening end on at least one of three planes:

(1) a first plane which is substantially orthogonal to a first line segment at the center point of said first line segment passing through the center of gravity of a plane having a substantially maximum cross-sectional area on the horizontal cross-section of said enclosed container, said first line segment being at a position wherein the distance between the inner walls of said enclosed container is minimum, (2) a second plane which, on the horizontal plane including said first line segment, passes through the center point of a second line segment between the inner wall surfaces of said enclosed container, said second line segment being substantially orthogonal to said first line segment, and which is substantially orthogonal to said second line segment, or (3) a third plane which passes through the center point of a third line segment having the maximum distance between the upper inner wall surface of said enclosed container and said lubricant surface in the vertical direction, and which is substantially orthogonal to said third line segment.

2. A hermetic compressor as set forth in claim 1, further comprising a valve plate disposed at the end surface of said cylinder and having a suction hole and wherein said suction passage has first and second ends, said first end of which is substantially directly connected to said suction hole of said valve plate and said second end of which is disposed in the space inside said enclosed container as an opening end.

3. A hermetic compressor comprising:

a motor portion used as a power source;

a mechanical portion including a crankshaft, a piston, and a cylinder driven by said motor portion;

an enclosed container for housing said motor portion and said mechanical portion and for storing lubricant;

a valve plate disposed at the end surface of said cylinder and having a suction hole; and a first suction passage having first and second ends, one end of which is substantially directly connected to said suction hole of said valve plate, and the other end of which is disposed in the space inside said enclosed container as an opening end, wherein the resonance frequency of a refrigerant gas in said enclosed container is a frequency different from a value close to a frequency range corresponding to the integral multiples of the rotation number of said crankshaft.

4. The hermetic compress as set forth in claim 3, wherein said suction passage has a length adjustment mechanism.

5. The hermetic compressor as set forth in claim 3, wherein said suction passage has an inner cross-sectional area adjustment mechanism having first and second ends, said first end of which is substantially directly connected to said suction hole of said valve plate, and said second end of which is disposed in the space inside said enclosed container as an opening end.

6. The hermetic compressor as set forth in claim 3, wherein said enclosed container is filled with refrigerant gas and wherein on the assumptions that the crank angle at the opening start of said suction lead is θs (rad), that the length of said suction passage is L (m), that the rotation number of said crankshaft is f (Hz), and that the velocity of sound in the refrigerant gas in said suction passage is As (m/sec), the return crank angle θr (rad) of the pressure wave generated at said suction hole at the start of suction, represented by (equation 1) described below, is within the range of (equation 2) described below:

$$\theta r = \theta s + 4\pi \times L \times f / As \quad \text{(Equation 1)}$$

$$1.4\ (\text{rad}) \leqq \theta r \leqq 3.0\ (\text{rad}) \quad \text{(Equation 2).}$$

7. The hermetic compressor as set forth in claim 3, wherein said suction passage has first and second ends, said first end of which is substantially directly connected to said suction hole of said valve plate, and said second end of which is disposed in the space inside said enclosed container as an opening end; and a deformable reflection prevention plate provided oppositely facing said opening end of said suction passage in said space inside said enclosed container.

8. The hermetic compressor as set forth in claim 3, further comprising a suction muffler and wherein said second end of said suction passage is disposed in said muffler as an opening end.

9. The hermetic compressor as set forth in claim 3, wherein said suction passage has a part of which that is formed of a material having low heat conductivity.

10. The hermetic compressor as set forth in claim 3 further comprising a second suction passage having an opening end disposed near said opening end of said first suction passage.

11. The hermetic compressor as set forth in claim 3, wherein said second end of said suction passage is disposed inside said enclosed container as a plurality of opening ends, wherein the lengths from said suction hole to said plural opening ends have at least two kinds of values.

12. The hermetic compressor as set forth in claim 3, wherein said suction passage has a communication/shutoff mechanism.

13. The hermetic compressor as set forth in claim 3, wherein said first end of said first suction passage is connected to said suction hole of said valve plate, via a chamber and further comprising a second suction passage, having first and second ends, said first end of which is disposed near the opening end of said first suction passage, and said second end of said second suction passage of which is extended outside said enclosed container; and wherein said opening end of said first suction passage is disposed on at least one of three planes:

(1) a first plane which is substantially orthogonal to a first line segment at the center point of said first line segment passing through the center of gravity of a plane having a substantially maximum cross-sectional area on the horizontal cross-section of said enclosed container, said first line segment being at a position wherein the distance between the inner walls of said enclosed container is minimum, (2) a second plane which, on the horizontal plane including said first line segment, passes through the center point of a second line segment between the inner wall surfaces of said enclosed container, said second line segment being substantially orthogonal to said first line segment, and which is substantially orthogonal to said second line segment, or (3) a third plane which passes through the center point of a third line segment having the maximum distance between the upper inner wall surface of said enclosed container and said lubricant surface in the vertical direction, and which is substantially orthogonal to said third line segment.

14. The hermetic as set forth in claim 3, wherein said suction passage has bent portions having a substantially uniform curvature.

15. The hermetic compressor as set forth in claim 3, wherein said suction passage is bent a plurality of times and formed so that suction passage portions are close to each other.

16. The hermetic compressor as set forth in claim 3, further comprising a suction muffler for substantially covering said suction passage.

17. The hermetic compressor as set forth in claim 3, further comprising a suction valve for opening/closing said suction hole; and a resonance-type muffler provided in said suction passage.

18. The hermetic compressor as set forth in claim 3, further comprising a suction valve for opening/closing said suction hole and wherein at the direct connection portion between said suction hole and said suction passage, the axial direction of said suction passage has an angle smaller than 90° with respect to the connection surface of said valve plate.

19. The hermetic compressor as set forth in claim 3, further comprising a suction valve for opening/closing said suction hole; and a deflection control mechanism for controlling the initial deflection amount of said suction valve.

20. The hermetic compressor as set forth in claim 17, further comprising an inverter for driving said motor.

21. A hermetic compressor comprising:

an enclosed container;

an electric compression element which is housed in said enclosed container, and which comprises a cylinder constituting a compression element and an electric motor; a valve plate having a suction hole and disposed at the end surface of said cylinder;

a first suction passage, one end of which is open in said enclosed container, and the other end of which is substantially directly connected to said suction hole of said valve plate; and a passage changeover mechanism provided in said suction passage.

22. The hermetic compressor as set forth in claim 21, further comprising a second suction passage, one end of which is extended outside said enclosed container and the other end of which has an opening end disposed near said opening end of said first suction passage.

23. A method for canceling noise in a hermetic compressor, comprising:

providing an enclosure having at least a first and a second interior dimension, wherein said first and second interior dimensions are not equal;

providing a compressor within said enclosure;

providing a movable compressor inlet disposed within said enclosure;

directing said inlet so that it is parallel to an axis of said first interior dimension when a gas within said enclosure is within a first temperature range;

directing said inlet so that it is parallel with an axis of said second interior dimension when said gas within said enclosure is within a second temperature range, wherein a resonance of said enclosure cancels a resonance of said compressor.

24. A method for suppressing noise in a hermetic compressor, comprising varying a length of a compressor inlet from a first length when a gas within said compressor is within a first temperature range to a second length when said gas is within a second temperature range.

* * * * *

UNITED STATES PATENT AND TRADEMARK OFFICE

CERTIFICATE OF CORRECTION

PATENT NO. : 6,152,703
DATED : November 28, 2000
INVENTOR(S) : Yoshimura et al.

It is certified that error appears in the above-identified patent and that said Letters Patent is hereby corrected as shown below:

Title page,
Item [73], Assignee: should read -- Matsushita Refrigeration Company, Osaka, (JP) --

Signed and Sealed this

Eleventh Day of February, 2003

JAMES E. ROGAN
*Director of the United States Patent and Trademark Office*

US006152703C1

(12) REEXAMINATION CERTIFICATE (4651st)

United States Patent

Yoshimura et al.

(10) Number: US 6,152,703 C1

(45) Certificate Issued: Oct. 1, 2002

(54) HERMETIC-TYPE COMPRESSOR

(75) Inventors: Takao Yoshimura, Fujisawa (JP); Hironari Akashi, Chigasaki (JP); Akio Yagi, Kouza-gun (JP); Akira Hayashi, Fujisawa (JP)

(73) Assignee: Matsushita Refrigeration Company, Higashiosaka (JP)

Reexamination Request:
No. 90/006,009, May 15, 2001

Reexamination Certificate for:

| | |
|---|---|
| Patent No.: | **6,152,703** |
| Issued: | **Nov. 28, 2000** |
| Appl. No.: | **09/011,672** |
| Filed: | **May 21, 1998** |

(22) PCT Filed: Jun. 12, 1997

(86) PCT No.: PCT/JP97/02058

§ 371 (c)(1), (2), (4) Date: May 21, 1997

(87) PCT Pub. No.: WO97/47882

PCT Pub. Date: Dec. 18, 1997

(30) Foreign Application Priority Data

| | | |
|---|---|---|
| Jun. 14, 1996 | (JP) | 8-153973 |
| Oct. 29, 1996 | (JP) | 8-286376 |
| Nov. 8, 1996 | (JP) | 8-296123 |
| Feb. 7, 1997 | (JP) | 9-024925 |
| Feb. 10, 1997 | (JP) | 9-026488 |
| Apr. 19, 1997 | (JP) | 9-093483 |
| May 19, 1997 | (JP) | 9-128231 |

(51) Int. Cl.[7] ..... F04B 39/00

(52) U.S. Cl. ..... 417/312; 181/229; 181/403

(58) Field of Search ..... 417/312, 415; 181/403

(56) References Cited

U.S. PATENT DOCUMENTS

| | | | | |
|---|---|---|---|---|
| 4,353,682 A | * | 10/1982 | Linnert et al. | 417/295 |
| 5,281,105 A | | 1/1994 | Osaka et al. | 417/312 |
| 5,328,338 A | | 7/1994 | Hirano et al. | 417/312 |
| 5,542,824 A | | 8/1996 | Lee | 417/312 |

FOREIGN PATENT DOCUMENTS

| | | | |
|---|---|---|---|
| WO | WO 95/33135 | 12/1995 | F04B/39/00 |

* cited by examiner

*Primary Examiner*—Charles G Freay

(57) ABSTRACT

The present invention provides a hermetic-type compressor delivering high refrigeration capability at low noise. The hermetic-type compressor of the present invention is provided with a position adjustment mechanism, a communication/shutoff mechanism, a passage changeover mechanism or the like so as to dispose the opening end of a suction passage, which is provided in an enclosed container and used to communicate the cylinder of its compressor with the enclosed container, on a predetermined plane so that the opening end is aligned with the position of a node of a resonance mode generated in the enclosed container.

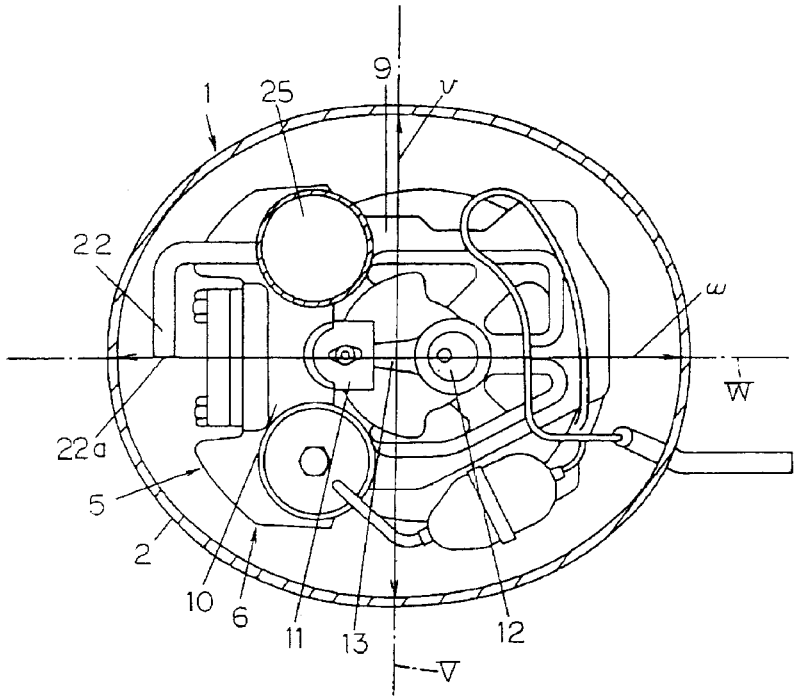

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–20, 23 and 24 is confirmed.

Claim 22 is cancelled.

Claim 21 is determined to be patentable as amended.

21. A hermetic compressor comprising:

an enclosed container;

an electric compression element which is housed in said enclosed container, and which comprises a cylinder constituting a compression element and en electric motor; a valve plate having a suction hole and disposed at the end surface of said cylinder;

a first suction passage, one end of which is open in said enclosed container, and the other end of which is substantially directly connected to said suction hole of said valve plate; [and]

a passage changeover mechanism provided in said *first* suction passage*; and*

*a second suction passage, one end of which is extended outside said enclosed container and the other end of which has an opening end disposed near said opening end of said first suction passage.*

* * * * *